US012185903B2

(12) United States Patent
Kim et al.

(10) Patent No.: US 12,185,903 B2
(45) Date of Patent: Jan. 7, 2025

(54) VACUUM CLEANER STATION, VACUUM CLEANER SYSTEM, AND METHOD FOR CONTROLLING VACUUM CLEANER STATION

(71) Applicant: LG Electronics Inc., Seoul (KR)

(72) Inventors: Sungjun Kim, Seoul (KR); Jinhyouk Shin, Seoul (KR); Ingyu Yang, Seoul (KR); Youngsoo Kim, Seoul (KR); Jungwan Ryu, Seoul (KR); Jeahyuk Wie, Seoul (KR); Dongjae Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 50 days.

(21) Appl. No.: 17/984,154

(22) Filed: Nov. 9, 2022

(65) Prior Publication Data

US 2023/0079937 A1 Mar. 16, 2023

Related U.S. Application Data

(63) Continuation of application No. 17/799,504, filed as application No. PCT/KR2021/002565 on Mar. 2, 2021.

(30) Foreign Application Priority Data

Mar. 3, 2020 (KR) ..... 10-2020-0026803
Jun. 22, 2020 (KR) ..... 10-2020-0075901
(Continued)

(51) Int. Cl.
*A47L 9/00* (2006.01)
*A47L 5/24* (2006.01)
(Continued)

(52) U.S. Cl.
CPC ..... *A47L 9/2873* (2013.01); *A47L 5/24* (2013.01); *A47L 7/0095* (2013.01);
(Continued)

(58) Field of Classification Search
CPC .... A47L 9/2873; A47L 9/0063; A47L 9/1683; A47L 9/22; A47L 9/2842; A47L 9/2884
See application file for complete search history.

(56) References Cited

U.S. PATENT DOCUMENTS 11,839,348 B2 * 12/2023 Kim ..... H01M 10/44
2007/0157415 A1 7/2007 Lee et al.
(Continued)

FOREIGN PATENT DOCUMENTS

CN 101254080 9/2008
CN 109068921 12/2018
(Continued)

OTHER PUBLICATIONS

Office Action in Korean Appln. No. 10-2022-0069933, mailed on Nov. 13, 2023, 12 pages (with English translation).
(Continued)

*Primary Examiner* — Marc Carlson
(74) *Attorney, Agent, or Firm* — Fish & Richardson P.C.

(57) ABSTRACT

The present disclosure relates to a cleaner system including: a cleaner; a cleaner station; and an imaginary plane including an imaginary suction flow path through line penetrating a suction flow path in a longitudinal direction and an imaginary suction motor axis defined by extending a rotation axis of a suction motor, in which when the cleaner is coupled to the cleaner station, the plane penetrates at least a part of the cleaner station, such that a center of gravity of the cleaner is disposed to pass through a space for maintaining balance of the station, and as a result, it is possible to stably
(Continued)

support the cleaner and the station while preventing the cleaner and the station from falling down.

18 Claims, 60 Drawing Sheets

(30) Foreign Application Priority Data

Jul. 9, 2020 (KR) ..... 10-2020-0084782
Nov. 4, 2020 (KR) ..... 10-2020-0145692

(51) Int. Cl.

| | |
|---|---|
| ***A47L 7/00*** | (2006.01) |
| ***A47L 9/10*** | (2006.01) |
| ***A47L 9/16*** | (2006.01) |
| ***A47L 9/22*** | (2006.01) |
| ***A47L 9/28*** | (2006.01) |
| ***A47L 9/32*** | (2006.01) |

(52) U.S. Cl.

CPC ..... *A47L 9/0063* (2013.01); *A47L 9/106* (2013.01); *A47L 9/1683* (2013.01); *A47L 9/22* (2013.01); *A47L 9/2815* (2013.01); *A47L 9/2842* (2013.01); *A47L 9/2884* (2013.01); *A47L 9/322* (2013.01); *A47L 2201/022* (2013.01); *A47L 2201/024* (2013.01)

(56) References Cited

U.S. PATENT DOCUMENTS

| | | | | |
|---|---|---|---|---|
| 2007/0226949 | A1 | 10/2007 | Hahm et al. | |
| 2008/0201895 | A1 | 8/2008 | Kim et al. | |
| 2009/0049640 | A1 | 2/2009 | Lee et al. | |
| 2011/0219571 | A1 | 9/2011 | Dyson et al. | |
| 2014/0137364 | A1* | 5/2014 | Stickney | A47L 5/24 15/347 |
| 2017/0196429 | A1 | 7/2017 | Brown et al. | |
| 2017/0196430 | A1* | 7/2017 | Machida | A47L 7/0047 |
| 2017/0280951 | A1* | 10/2017 | Nam | A47L 9/1641 |
| 2017/0319035 | A1* | 11/2017 | Kim | A47L 5/24 |
| 2018/0125314 | A1* | 5/2018 | Kim | A47L 5/28 |
| 2018/0177358 | A1* | 6/2018 | Conrad | B65F 1/105 |
| 2020/0215555 | A1 | 7/2020 | Pougher et al. | |
| 2020/0305671 | A1 | 10/2020 | Conrad | |
| 2020/0315419 | A1* | 10/2020 | Sato | A47L 5/36 |
| 2020/0345196 | A1* | 11/2020 | Innes | A47L 5/30 |
| 2021/0052121 | A1* | 2/2021 | Kim | A47L 9/1683 |
| 2021/0345848 | A1* | 11/2021 | Jeon | A47L 9/0063 |
| 2022/0079405 | A1 | 3/2022 | Yang et al. | |

FOREIGN PATENT DOCUMENTS

| | | | | |
|---|---|---|---|---|
| CN | 113317716 | | 8/2021 | |
| CN | 113317716 | A * | 8/2021 | |
| DE | 102019004417 | | 12/2020 | |
| DE | 102019004417 | A1 * | 12/2020 | A47L 5/30 |
| EP | 3424394 | | 1/2019 | |
| JP | 2001-212052 | | 8/2001 | |
| JP | 2004-283327 | | 10/2004 | |
| JP | 2008-079922 | | 4/2008 | |
| JP | 2011-172818 | | 9/2011 | |
| JP | 2012-245344 | | 12/2012 | |
| JP | 2016-116850 | | 6/2016 | |
| JP | 2016116850 | A * | 6/2016 | A47L 5/38 |
| JP | 2017-189453 | | 10/2017 | |
| JP | 2017189453 | A * | 10/2017 | |
| JP | 2018-511387 | | 4/2018 | |
| JP | 2018511387 | A * | 4/2018 | |
| JP | 2018530372 | A * | 10/2018 | |
| JP | 2019-508117 | | 3/2019 | |
| JP | 2019-514592 | | 6/2019 | |
| KR | 20010054396 | | 7/2001 | |
| KR | 10-2007- 0094288 | | 9/2007 | |
| KR | 20070094288 | A * | 9/2007 | |
| KR | 20070099763 | | 10/2007 | |
| KR | 10-2008-0079075 | | 8/2008 | |
| KR | 20080079075 | A * | 8/2008 | |
| KR | 20170126377 | | 11/2017 | |
| KR | 20170126379 | | 11/2017 | |
| KR | 20170126379 | A * | 11/2017 | |
| KR | 20180101145 | | 9/2018 | |
| KR | 10-2019-0119147 | | 10/2019 | |
| WO | WO 2017/101542 | | 6/2017 | |
| WO | WO-2017101542 | A1 * | 6/2017 | |
| WO | WO2020122631 | | 6/2020 | |
| WO | WO-2020122631 | A1 * | 6/2020 | A47L 5/18 |

OTHER PUBLICATIONS

Office Action in U.S. Appl. No. 17/984,168, mailed on Jan. 18, 2024, 28 pages.
Office Action in U.S. Appl. No. 17/984,181, mailed on Aug. 16, 2023, 25 pages.
Office Action in Japanese Appln. No. 2022-552887, mailed on Sep. 26, 2023, 20 pages (with English translation).
Office Action in Chinese Appln. No. 202180018767.5, mailed on May 12, 2023, 40 pages(with English translation).
Office Action in U.S. Appl. No. 17/984,181, dated Apr. 28, 2023, 28 pages.
International Search Report in International Appln. No. PCT/KR2021/002565, mailed on Jul. 1, 2021, 11 pages (with English translation).
Office Action in Korean Appln. No. 10-2022-7021106, mailed on Nov. 21, 2022, 10 pages (with English translation).
Office Action in Korean Appln. No. 10-2022-7025891, mailed on Sep. 20, 2022, 13 pages (with English translation).
Office Action in Korean Appln. No. 10-2022-7025892, mailed on Sep. 20, 2022, 15 pages (with English translation).
Office Action in Korean Appln. No. 10-2022-7025897, mailed on Sep. 20, 2022, 15 pages (with English translation).
Office Action in Taiwanese Appln. No. 110107586, mailed on Oct. 27, 2022, 66 pages (with English translation).
Office Action in U.S. Appl. No. 17/984,165, dated Mar. 23, 2023, 18 pages.
Office Action in U.S. Appl. No. 17/984,168, dated Mar. 21, 2023, 22 pages.

* cited by examiner

VACUUM CLEANER STATION, VACUUM CLEANER SYSTEM, AND METHOD FOR CONTROLLING VACUUM CLEANER STATION

CROSS-REFERENCE TO RELATED APPLICATIONS

This application is a continuation of U.S. application Ser. No. 17/799,504, filed on Aug. 12, 2022, which is a National Stage application under 35 U.S.C. § 371 of International Application No. PCT/KR2021/002565, filed on Mar. 2, 2021, which claims the benefit of Korean Application No. 10-2020-0145692, filed Nov. 4, 2020, Korean Application No. 10-2020-0084782, filed Jul. 9, 2020, Korean Application No. 10-2020-0075901, filed on Jun. 22, 2020, and Korean Application No. 10-2020-0026803, filed Mar. 3, 2020. The disclosures of the prior applications are incorporated by reference in their entirety.

TECHNICAL FIELD

The present disclosure relates to a cleaner station, a cleaner system, and a method of controlling the cleaner station, and more particularly, to a cleaner, a cleaner station configured to suck dust, stored in the cleaner, into the cleaner station, a cleaner system, and a method of controlling the cleaner station.

BACKGROUND

In general, a cleaner refers to an electrical appliance that draws in small garbage or dust by sucking air using electricity and fills a dust bin provided in a product with the garbage or dust. Such a cleaner is generally called a vacuum cleaner.

The cleaners may be classified into a manual cleaner which is moved directly by a user to perform a cleaning operation, and an automatic cleaner which performs a cleaning operation while autonomously traveling. Depending on the shape of the cleaner, the manual cleaners may be classified into a canister cleaner, an upright cleaner, a handy cleaner, a stick cleaner, and the like.

The canister cleaners were widely used in the past as household cleaners. However, recently, there is an increasing tendency to use the handy cleaner and the stick cleaner in which a dust bin and a cleaner main body are integrally provided to improve convenience of use.

In the case of the canister cleaner, a main body and a suction port are connected by a rubber hose or pipe, and in some instances, the canister cleaner may be used in a state in which a brush is fitted into the suction port.

The handy cleaner (hand vacuum cleaner) has maximized portability and is light in weight. However, because the handy cleaner has a short length, there may be a limitation to a cleaning region. Therefore, the handy cleaner is used to clean a local place such as a desk, a sofa, or an interior of a vehicle.

A user may use the stick cleaner while standing and thus may perform a cleaning operation without bending his/her waist. Therefore, the stick cleaner is advantageous for the user to clean a wide region while moving in the region. The handy cleaner may be used to clean a narrow space, whereas the stick cleaner may be used to clean a wide space and also used to a high place that the user's hand cannot reach.

Recently, modularized stick cleaners are provided, such that types of cleaners are actively changed and used to clean various places.

In addition, recently, a robot cleaner, which autonomously performs a cleaning operation without a user's manipulation, is used. The robot cleaner automatically cleans a zone to be cleaned by sucking foreign substances such as dust from the floor while autonomously traveling in the zone to be cleaned.

To this end, the robot cleaner includes a distance sensor configured to detect a distance from an obstacle such as furniture, office supplies, or walls installed in the zone to be cleaned, and left and right wheels for moving the robot cleaner.

In this case, the left wheel and the right wheel are configured to be rotated by a left wheel motor and a right wheel motor, respectively, and the robot cleaner cleans the room while autonomously changing its direction by operating the left wheel motor and the right wheel motor.

However, because the handy cleaner, the stick cleaner, or the robot cleaner in the related art has a dust bin with a small capacity for storing collected dust, which inconveniences the user because the user needs to empty the dust bin frequently.

In addition, because the dust scatters during the process of emptying the dust bin, there is a problem in that the scattering dust has a harmful effect on the user's health.

In addition, if residual dust is not removed from the dust bin, there is a problem in that a suction force of the cleaner deteriorates.

In addition, if the residual dust is not removed from the dust bin, there is a problem in that the residual dust causes an offensive odor.

Meanwhile, Patent Document KR2020-0074054A discloses a vacuum cleaner and a docking station.

In the case of a cleaner station, a structure, which is docked to a dust collecting container, is disposed to be directed upward. In this case, a method of separating a dust bin from the cleaner and then coupling only the dust bin may be used. However, there is inconvenience in that the user needs to directly separate the dust bin from the cleaner.

In addition, in the above-mentioned vacuum cleaner, an axis of an extension tube, an axis of a suction port, and an axis of the dust collecting container are disposed in parallel with one another. In this case, even though the cleaner mounted with the dust collecting container may be coupled to the station, a flow path through which dust and air may flow needs to be bent at least two times in order to introduce the air and the dust into the station. For this reason, there is a problem in that the structure of the flow path is complicated and efficiency in collecting the dust deteriorates.

Meanwhile, Patent Document JP2017-189453 discloses a station device for removing dust from a hand stick cleaner.

In a vacuum cleaner, an axis of an extension tube, an axis of a suction port, and an axis of a dust bin are disposed in parallel with one another. In the station device, a structure to be coupled to the dust bin of the vacuum cleaner is disposed to be directed upward. That is, the vacuum cleaner is mounted on an upper portion of the station.

However, the dust bin is exposed to the outside when the vacuum cleaner is mounted on the station, which may cause discomfort to the user.

In addition, if external impact is applied in a state in which a main body of the vacuum cleaner is coupled to the upper portion of the station, the main body of the vacuum cleaner is likely to fall down.

Patent Document US 2020-0129025 A1 discloses a dust bin to be combined with a stick vacuum cleaner.

In the combination the dust bin and the vacuum cleaner of the patent document, the vacuum cleaner is disposed to be coupled to the dust bin.

The dust bin of the patent document has an upper surface to which the vacuum cleaner is coupled.

However, a height of the upper surface of the dust bin to which the vacuum cleaner is coupled is low with respect to the ground surface, which causes discomfort to the user because the user needs to bend his/her waist to couple the vacuum cleaner to the dust bin.

Further, there is a problem in that the user needs to directly assemble the vacuum cleaner and the dust bin.

In addition, there is a problem in that it is impossible to compress dust in the vacuum cleaner to remove the dust remaining in the cleaner.

Meanwhile, Patent Document U.S. Ser. No. 10/595,692 B2 discloses a discharge station having a debris bin of a robot cleaner.

In the above-mentioned patent document, a station to which the robot cleaner is docked is provided, and the station has a flow path through which dust is sucked in a direction perpendicular to the ground surface. Further, a sensor is provided to sense docking between the robot cleaner and the station, and a motor operates to suck the dust from the robot cleaner during the docking process.

However, there is a problem in that the station of the above-mentioned patent document has no structure for coupling the stick cleaner. Further, the dust is sucked merely in a state in which the robot cleaner is coupled to a connector of the station, but there is no component for checking whether the cleaner is coupled, fixing the cleaner, and opening or closing the suction port.

Moreover, a height of the station according to the patent document is relatively low, whereas a dust collecting motor for sucking the dust from the robot cleaner is disposed at an upper side thereof.

Because of this configuration, even in a case in which the stick cleaner is mounted on the station, an overall center of gravity of the station on which the stick cleaner is mounted is concentrated on the upper side thereof. As a result, there is a problem in that the station may easily fall down and thus be broken down due to impact.

SUMMARY

The present disclosure has been made in an effort to solve the above-mentioned problems of the cleaner system in the related art, and an object of the present disclosure is to provide a cleaner station, a cleaner system, and a method of controlling the cleaner station, which are capable of eliminating inconvenience caused because a user needs to empty a dust bin all the time.

In addition, an object of the present disclosure is to provide a cleaner station, a cleaner system, and a method of controlling the cleaner station, which are capable of preventing dust from scattering when emptying a dust bin.

In addition, an object of the present disclosure is to provide a cleaner station, a cleaner system, and a method of controlling the cleaner station, in which when a cleaner is coupled to the cleaner station, the coupling of the cleaner may be detected, the cleaner may be automatically fixed, a suction port (door) of the cleaner station may be opened, and a cover of a dust bin of the cleaner may be opened.

In addition, an object of the present disclosure is to provide a cleaner station, a cleaner system, and a method of controlling the cleaner station, which are capable of removing dust in a dust bin without a user's separate manipulation.

In addition, an object of the present disclosure is to provide a cleaner station, a cleaner system, and a method of controlling the cleaner station, which are capable of removing an offensive odor caused by residual dust by preventing the residual dust from remaining in a dust bin.

In addition, an object of the present disclosure is to provide a cleaner station and a cleaner system, in which when a cleaner is coupled to the station, the cleaner and the station may be stably supported without falling down.

In addition, an object of the present disclosure is to provide a cleaner station and a cleaner system, in which a cleaner may be mounted in a state in which an extension tube and a cleaning module are mounted.

In addition, an object of the present disclosure is to provide a cleaner station and a cleaner system, which are capable of minimizing an occupied space on a horizontal plane even in a state in which a cleaner is mounted.

In addition, an object of the present disclosure is to provide a cleaner station and a cleaner system, which are capable of minimizing a loss of flow force for collecting dust.

In addition, an object of the present disclosure is to provide a cleaner station and a cleaner system, in which dust in a dust bin is invisible from the outside in a state in which a cleaner is mounted.

In addition, an object of the present disclosure is to provide a cleaner station and a cleaner system, which are capable of allowing a user to couple a cleaner to the station without bending his/her waist.

In addition, an object of the present disclosure is to provide a cleaner station and a cleaner system, which are capable of allowing a user to easily couple a cleaner to the cleaner station only by simply moving his/her wrist or forearm in a state in which the user grasps the cleaner.

In addition, an object of the present disclosure is to provide a cleaner station and a cleaner system, in which a stick cleaner and a robot cleaner may be coupled to the cleaner station at the same time, and as necessary, dust in a dust bin of the stick cleaner and dust in a dust bin of the robot cleaner may be selectively removed.

In order to achieve the above-mentioned objects, a cleaner system according to the present disclosure may include: a cleaner including: a suction part having a suction flow path through which air flows; a suction motor configured to generate a suction force for sucking the air along the suction part; a dust separating part having two or more cyclone parts configured to separate dust from the air introduced through the suction part; a dust bin configured to store the dust separated by the dust separating part; and a handle including a first extension portion extending toward the suction motor, a second extension portion extending toward the dust bin, and a grip portion connecting the first extension portion and the second extension portion; and a cleaner station including: a coupling part to which the dust bin is coupled; a dust collecting part into which the dust in the dust bin is collected; and a dust suction module having a dust collecting motor configured to generate a suction force for sucking the dust in the dust bin into the dust collecting part.

In this case, the cleaner system may include an imaginary plane including an imaginary suction flow path through line penetrating a suction flow path in a longitudinal direction and an imaginary suction motor axis defined by extending a rotation axis of a suction motor.

The plane may include an imaginary grip portion through line formed in a longitudinal direction of the grip portion and penetrating an inside of the grip portion.

The plane may include an imaginary dust collecting motor axis defined by extending a rotation axis of the dust collecting motor.

The plane may include an imaginary dust bin through line penetrating the dust bin in the longitudinal direction.

When the cleaner is coupled to the cleaner station, the plane may penetrate at least a part of the dust collecting motor.

The suction flow path through line may intersect the suction motor axis.

The suction flow path through line may intersect the imaginary grip portion through line formed in the longitudinal direction of the grip portion and penetrating the inside of the grip portion.

When the cleaner is coupled to the cleaner station, the suction motor axis may intersect an imaginary dust collecting motor axis defined by extending an axis of the dust collecting motor, and a height from a ground surface to an intersection point between the suction motor axis and the dust collecting motor axis may be equal to or less than a maximum height of the cleaner station.

The cleaner station may further include a flow path part having a flow path that allows an internal space of the dust bin and an internal space of the dust collecting part to communicate with each other when the cleaner is coupled to the cleaner station.

In this case, in the state in which the cleaner is coupled to the cleaner station, the imaginary dust bin through line penetrating the dust bin in the longitudinal direction and the imaginary dust collecting motor axis defined by extending the rotation axis of the dust collecting motor may intersect each other in the flow path part.

The flow path part may include: a first flow path configured to communicate with the internal space of the dust bin when the cleaner is coupled to the cleaner station; and a second flow path formed at a predetermined angle with respect to the first flow path and configured to allow the first flow path and the internal space of the dust collecting part to communicate with each other.

A length of the first flow path may be equal to or less than a length of the second flow path.

The cleaner station may further include a housing configured to define an external appearance of the cleaner station and accommodate the dust collecting part and the dust suction module.

The cleaner is coupled to the lateral surface of the housing. When the cleaner is coupled to the cleaner station, the imaginary grip portion through line penetrating the inside of the grip portion and extending in the longitudinal direction of the grip portion formed in a column shape may intersect the imaginary dust collecting motor axis defined by extending the axis of the dust collecting motor, and the intersection point between the grip portion through line and the dust collecting motor axis may be positioned in the housing.

The cleaner system according to the present disclosure may further include an imaginary plane including the grip portion through line and the dust collecting motor axis.

The plane may include the grip portion through line and the imaginary suction flow path through line penetrating the suction flow path in the longitudinal direction.

In the cleaner system according to the present disclosure, when the cleaner is coupled to the cleaner station, the grip portion through line intersects the suction flow path through line, and a height from the ground surface to the intersection point between the grip portion through line and the suction flow path through line may be equal to or less than a maximum height of the housing.

The plane may include the dust collecting motor axis, and the imaginary suction motor axis defined by extending the rotation axis of the suction motor.

When the cleaner is coupled to the cleaner station, the dust collecting motor axis may intersect the suction motor axis.

The plane may include the dust collecting motor axis and the dust bin through line.

When the cleaner is coupled to the cleaner station, the dust collecting motor axis may intersect the dust bin through line.

In the state in which the cleaner is coupled to the cleaner station, a shortest distance from the ground surface to the grip portion may be 60 cm or more.

An included angle between the suction motor axis and the perpendicular line to the ground surface may be 40 degrees or more and 95 degrees or less.

The included angle between the suction motor axis and the perpendicular line to the ground surface may be 43 degrees or more and 90 degrees or less.

The plane may include the suction flow path through line and the grip portion through line.

When the cleaner is coupled to the cleaner station, the plane may penetrate at least a part of the dust collecting motor, and an orthogonal projection of the suction motor axis to the plane may intersect the suction flow path through line.

The coupling part may be disposed vertically above the dust collecting motor, the dust collecting motor is heavier than the suction motor, a distance from the dust collecting motor to the coupling part may be longer than a distance from the suction motor to the coupling part.

The suction motor axis and the dust collecting motor axis may intersect each other.

When the cleaner is coupled to the cleaner station, the coupling part may be disposed between the imaginary suction flow path through line penetrating the suction flow path in the longitudinal direction and the imaginary dust collecting motor axis defined by extending the rotation axis of the dust collecting motor.

The cleaner station may further include a fixing member configured to move from the outside of the dust bin toward the dust bin in order to fix the dust bin.

When the cleaner is coupled to the cleaner station, the fixing member may be disposed between the suction flow path through line and the dust collecting motor axis.

The cleaner station may further include a cover opening unit configured to open a discharge cover of the dust bin.

When the cleaner is coupled to the cleaner station, the cover opening unit may be disposed between the suction flow path through line and the dust collecting motor axis.

When the cleaner is coupled to the cleaner station, the handle may be positioned to be farther from the ground surface than is the imaginary suction motor axis defined by extending the axis of the suction motor.

The cleaner may further include a battery configured to supply power to the suction motor.

When the cleaner is coupled to the cleaner station, the battery may be positioned to be farther from the ground surface than is the imaginary suction motor axis defined by extending the axis of the suction motor.

When the cleaner is coupled to the cleaner station, the included angle between the imaginary suction motor axis defined by extending the axis of the suction motor and the imaginary dust collecting motor axis defined by extending the axis of the dust collecting motor may be 40 degrees or more and 95 degrees or less.

The included angle between the suction motor axis and the dust collecting motor axis may be 43 degrees or more and 90 degrees or less.

When the main body of the cleaner is coupled to the cleaner station, the longitudinal axis of the dust bin and the longitudinal axis of the cleaner station may intersect each other.

When the main body of the cleaner is coupled to the cleaner station, the flow axis of the dust separating part and the longitudinal axis of the cleaner station may intersect each other.

The dust bin may be separable from the main body of the cleaner, when the dust bin is coupled to the cleaner station, the longitudinal axis of the dust bin and the longitudinal axis of the cleaner station may intersect each other.

When the main body of the cleaner is coupled to the cleaner station, the rotation axis of the suction motor and the longitudinal axis of the cleaner station may intersect each other.

The rotation axis of the suction motor may be disposed in parallel with the longitudinal axis of the dust bin.

The rotation axis of the suction motor may be disposed in parallel with the flow axis of the dust separating part.

The main body of the cleaner may be moved in the direction intersecting the longitudinal direction of the suction part and coupled to the coupling part.

The direction intersecting the longitudinal direction of the suction part may be a direction perpendicular to the longitudinal direction of the suction part.

The direction intersecting the longitudinal direction of the suction part may be a direction parallel to the ground surface.

The main body of the cleaner may be moved in the direction intersecting the longitudinal direction of the suction part, moved in the longitudinal direction of the suction part, and then coupled to the coupling part.

The main body of the cleaner may be moved along the longitudinal axis of the cleaner station and coupled to the coupling part.

The main body of the cleaner may be moved along the longitudinal axis of the cleaner station, moved in the direction perpendicular to the longitudinal direction of the suction part, and then coupled to the coupling part.

The main body of the cleaner may be moved vertically downward and coupled to the coupling part.

In order to achieve the above-mentioned objects, a cleaner station according to the present disclosure may include: a housing; a coupling part disposed in the housing and including a coupling surface to which a first cleaner is coupled; a dust collecting part accommodated in the housing, disposed below the coupling part, and configured to capture dust in a dust bin of the first cleaner; a dust collecting motor accommodated in the housing, disposed below the dust collecting part, and configured to generate a suction force for sucking the dust in the dust bin; a fixing unit disposed on the coupling part and configured to fix the first cleaner; and a control unit configured to control the coupling part, the fixing unit, the door unit, the cover opening unit, the lever pulling unit, and the dust collecting motor.

In this case, the coupling part may further include a guide protrusion protruding from the coupling surface; and a coupling sensor disposed on the guide protrusion and configured to detect whether the first cleaner is coupled at an exact position.

When the first cleaner is coupled at the exact position, the coupling sensor may transmit a signal indicating that the first cleaner is coupled.

The fixing unit may include: a fixing member configured to move from the outside of the dust bin toward the dust bin in order to fix the dust bin when the first cleaner is coupled to the coupling part; and a fixing drive part configured to provide power for moving the fixing member.

The control unit may receive the signal, which indicates that the first cleaner is coupled, from the coupling sensor.

When the control unit receives the signal, which indicates that the cleaner is coupled, from the coupling sensor, the control unit may operate the fixing drive part so that the fixing member fixes the dust bin.

The fixing unit may further include a fixing detecting part capable of detecting a movement of the fixing member.

When the fixing detecting part detects that the fixing member is moved to the position at which the fixing member fixes the dust bin, the fixing detecting part may transmit a signal indicating that the dust bin is fixed.

The control unit may receive the signal, which indicates that the dust bin is fixed, from the fixing detecting part and stop the operation of the fixing drive part.

When at least a part of the cleaner is coupled at the exact position on the coupling part, the fixing drive part may operate to move the fixing member.

The cleaner station according to the present disclosure may further include a door unit including a door coupled to the coupling surface and configured to open or close a dust passage hole formed in the coupling surface so that outside air may be introduced into the housing.

The door unit may include: the door hingedly coupled to the coupling surface and configured to open or close the dust passage hole; and a door motor configured to provide power for rotating the door.

In this case, when the dust bin is fixed, the control unit may operate the door motor to open the dust passage hole.

When the dust bin is fixed, the door motor may operate to rotate the door and open the dust passage hole.

The door unit may further include a door opening/closing detecting part configured to detect whether the door is opened or closed.

When the door opening/closing detecting part detects that the door is opened, the door opening/closing detecting part may transmit a signal indicating that the door is opened.

On the basis of whether power is supplied to the battery of the first cleaner, the control unit may check whether the first cleaner is coupled.

The control unit may receive the signal, which indicates that the door is opened, and stop the operation of the door motor.

The cleaner station according to the present disclosure may further include a cover opening unit disposed on the coupling part and configured to open a discharge cover of the dust bin.

The cover opening unit may include: a push protrusion configured to move when the first cleaner is coupled; and a cover opening drive part configured to provide power for moving the push protrusion.

In this case, when the door is opened, the control unit may operate the cover opening drive part to open the discharge cover.

The cover opening unit may further include a cover opening detecting part configured to detect whether the discharge cover is opened.

When the cover opening detecting part detects that the discharge cover is opened, the cover opening detecting part may transmit a signal indicating that the discharge cover is opened. The control unit may receive the signal, which indicates that the discharge cover is opened, and stop the operation of the cover opening drive part.

The cleaner station according to the present disclosure may further include a lever pulling unit accommodated in the housing and configured to stroke-move and rotate to pull a dust bin compression lever of the first cleaner.

The lever pulling unit may include a stroke drive motor disposed in the housing and configured to provide power for stroke-moving the lever pulling arm.

In this case, the control unit may operate the stroke drive motor to move the lever pulling arm to a height equal to or higher than a height of the dust bin compression lever.

The lever pulling unit may further include an arm movement detecting part configured to detect a movement of the lever pulling arm.

When the arm movement detecting part detects that the lever pulling arm is moved to the height equal to or higher than the height of the dust bin compression lever, the arm movement detecting part may transmit a signal indicating that the lever pulling arm is stroke-moved to a target position.

The control unit may receive the signal, which indicates that the lever pulling arm is stroke-moved to the target position, and stop the operation of the stroke drive motor.

Meanwhile, the lever pulling unit may further include a rotation drive motor configured to provide power for rotating the lever pulling arm.

In this case, when the lever pulling arm is moved to the height equal to or higher than the height of the dust bin compression lever, the control unit may operate the rotation drive motor to rotate the lever pulling arm to a position at which an end of the lever pulling arm may push the dust bin compression lever.

When the lever pulling arm is moved to the height equal to or higher than the height of the dust bin compression lever, the rotation drive motor may operate.

When the arm movement detecting part detects that the lever pulling arm is rotated to the position at which the lever pulling arm may push the dust bin compression lever, the arm movement detecting part may transmit a signal indicating that the lever pulling arm is rotated to a target position.

The control unit may receive the signal, which indicates that the lever pulling arm is rotated to the target position, and stop the operation of the rotation drive motor.

Meanwhile, when the lever pulling arm is moved to the position at which the end of the lever pulling arm may push the dust bin compression lever, the control unit may operate the stroke drive motor in a direction in which the lever pulling arm pulls the dust bin compression lever.

When the lever pulling arm is moved to the position at which the end of the lever pulling arm may push the dust bin compression lever, the stroke drive motor may operate.

When the arm movement detecting part detects that the lever pulling arm is moved to the target position when the compression lever is pulled, the arm movement detecting part may transmit a signal indicating that the lever pulling arm is pulled.

The control unit may receive the signal, which indicates that the lever pulling arm is pulled, and stop the operation of the stroke drive motor.

The control unit may operate the dust collecting motor and operate the stroke drive motor during the operation of the dust collecting motor so that the lever pulling arm pulls the dust bin compression lever at least once.

The stroke drive motor may be operated at least once during the operation of the dust collecting motor.

After the operation of the dust collecting motor is ended, the control unit may operate the door motor in a direction in which the door is closed.

The door motor may be operated after the operation of the dust collecting motor is ended.

After the operation of the dust collecting motor is ended, the control unit may operate the rotation drive motor to rotate and return the end of the lever pulling arm to the original position, and the control unit may operate the stroke drive motor to return the height of the lever pulling arm to the original position.

When the door is closed, the control unit may operate the fixing drive part so that the fixing member may release the dust bin.

The fixing drive part may operate when the door closes the dust passage hole.

In order to achieve the above-mentioned objects, a cleaner system according to the present disclosure may include: a cleaner comprising: a suction part; a suction motor configured to generate a suction force for sucking air along the suction part; a dust separating part configured to separate dust from the air introduced through the suction part; a dust bin configured to store the dust separated by the dust separating part; a discharge cover configured to selectively open or close a lower side of the dust bin; and a compression member configured to move in an internal space of the dust bin to compress the dust in the dust bin downward; and a cleaner station comprising: a coupling part to which the dust bin is coupled; a cover opening unit configured to separate the discharge cover from the dust bin; and a dust collecting part disposed below the coupling part.

In this case, when the discharge cover is separated from the dust bin, the dust in the dust bin may be captured into the dust collecting part by gravity.

In addition, when the discharge cover is separated from the dust bin, the compression member may move from the upper side to the lower side of the dust bin, thereby capturing the dust in the dust bin into the dust collecting part.

In addition, the cleaner may include a compression lever disposed outside the dust bin or the dust separating part and connected to the compression member.

In this case, when the compression lever is moved downward by an external force, the compression member may be moved from the upper side to the lower side of the dust bin to capture the dust in the dust bin into the dust collecting part.

In addition, the coupling part may include: a coupling surface formed at a predetermined angle with respect to the ground surface and configured such that a lower surface of the dust bin is coupled to the coupling surface; and a dust bin guide surface connected to the coupling surface and formed in a shape corresponding to an outer surface of the dust bin. In addition, the cleaner station may include a first drive part configured to rotate the coupling surface.

In this case, when the dust bin is coupled to the coupling surface, the first drive part may rotate the coupling surface in parallel with the ground surface.

In addition, the cleaner may include: a hinge part configured to rotate the discharge cover with respect to the dust bin; and a coupling lever configured to couple the discharge cover to the dust bin.

In this case, the cover opening unit may selectively open or close the lower side of the dust bin by separating the coupling lever from the dust bin. In addition, the dust in the dust bin may be captured into the dust collecting part by impact that occurs when the discharge cover is separated from the dust bin.

In addition, the cleaner station may include: a coupling sensor configured to detect whether the dust bin is coupled to the coupling part; and a cover opening drive part configured to operate the cover opening unit when the dust bin is coupled to the coupling part.

In addition, the cleaner station may include: a door configured to couple the discharge cover, separated from the dust bin, to the dust bin; and a door motor configured to rotate the door to one side.

In addition, the cleaner station may include a first flow part configured to allow air to flow to the suction part.

In this case, the air flowing to the suction part may capture the dust in the dust bin into the dust collecting part.

In addition, the cleaner station may include: a sealing member configured to seal the suction part; and a second flow part configured to allow air to flow to the dust bin.

In this case, the air flowing to the dust bin may capture the dust in the dust bin into the dust collecting part.

In addition, the second flow part may include: a discharge part configured to discharge air, and a drive part configured to rotate the discharge part about a first shaft.

In addition, the cleaner station may include: the sealing member configured to seal the suction part; and a suction device configured to suck the dust in the dust bin to capture the dust into the dust collecting part.

In addition, the cleaner station may include a removing part configured to remove residual dust in the dust bin by moving in the dust bin.

In addition, the dust collecting part may include: a roll vinyl film configured to be spread by a load of the captured dust; and a joint part configured to cut and join the roll vinyl film.

In this case, the joint part may retract the roll vinyl film to a central region and join an upper portion of the roll vinyl film using a heating wire.

In order to achieve the above-mentioned objects, a cleaner station according to the present disclosure includes: a coupling part to which a dust bin is coupled; a cover opening unit configured to separate a discharge cover from the dust bin; and a dust collecting part disposed below the coupling part.

In this case, when the discharge cover is separated from the dust bin, the dust in the dust bin is captured into the dust collecting part by gravity.

In this case, the cleaner station may capture the dust from a cleaner including: a suction part; a suction motor configured to generate a suction force for sucking air along the suction part; a dust separating part configured to separate dust from the air introduced through the suction part; a dust bin configured to store the dust separated by the dust separating part; a discharge cover configured to selectively open or close a lower side of the dust bin; and a compression member configured to move in an internal space of the dust bin to compress the dust in the dust bin downward.

In addition, when the discharge cover is separated from the dust bin, the compression member may move from the upper side to the lower side of the dust bin, thereby capturing the dust in the dust bin into the dust collecting part.

In order to achieve the above-mentioned objects, a cleaner system according to the present disclosure may include: a first cleaner including: a suction part; a suction motor configured to generate a suction force for sucking air along the suction part; a dust separating part configured to separate dust from the air introduced through the suction part; a dust bin configured to store the dust separated by the dust separating part; and a discharge cover configured to selectively open or close a lower side of the dust bin; a second cleaner configured to travel in a movement space; and a cleaner station including: a coupling part to which the dust bin of the first cleaner is coupled; a cover opening unit configured to separate the discharge cover of the first cleaner from the dust bin; a dust collecting part disposed below the coupling part; a dust suction module connected to the dust collecting part; a first cleaner flow path part configured to connect the dust bin of the first cleaner to the dust collecting part; a second cleaner flow path part configured to connect the second cleaner to the dust collecting part; and a flow path switching valve configured to selectively open or close the first cleaner flow path part and the second cleaner flow path part.

In addition, the first cleaner may include a compression member configured to move in an internal space of the dust bin to compress the dust in the dust bin downward.

In addition, when the discharge cover is separated from the dust bin, the compression member may move from the upper side to the lower side of the dust bin, thereby capturing the dust in the dust bin into the dust collecting part.

In addition, when the discharge cover is separated from the dust bin, the dust in the dust bin may pass through the first cleaner flow path part and then be captured into the dust collecting part by gravity.

In order to achieve the above-mentioned objects, a method of controlling a cleaner station according to the present disclosure may include: a dust bin fixing step of holding and fixing, by a fixing member of the cleaner station, a dust bin of a first cleaner when the first cleaner is coupled to the cleaner station; a door opening step of opening a door of the cleaner station when the dust bin is fixed; a cover opening step of opening a discharge cover configured to open or close the dust bin when the door is opened; and a dust collecting step of collecting dust in the dust bin by operating a dust collecting motor of the cleaner station when the discharge cover is opened.

The method of controlling the cleaner station according to the present disclosure may further include a dust bin compressing step of compressing an inside of the dust bin when the discharge cover is opened.

The dust bin compressing step may include: a first compression preparing step of stroke-moving a lever pulling arm of the cleaner station to a height at which the lever pulling arm may push a dust bin compression lever of the first cleaner; a second compression preparing step of rotating the lever pulling arm to a position at which the lever pulling arm may push the dust bin compression lever; and a lever pulling step of pulling, by the lever pulling arm, the dust bin compression lever at least once after the second compression preparing step.

The method of controlling the cleaner station according to the present disclosure may further include a compression ending step of returning the lever pulling arm to an original position after the dust bin compressing step.

The compression ending step may include: a first returning step of rotating the lever pulling arm to the original position; and a second returning step of stroke-moving the lever pulling arm to the original position.

The method of controlling the cleaner station according to the present disclosure may further include a coupling checking step of checking whether the first cleaner is coupled to a coupling part of the cleaner station.

The dust bin compressing step may be performed during the operation of the dust collecting motor.

The dust collecting step may be performed after the dust bin compressing step.

The method of controlling the cleaner station according to the present disclosure may further include a door closing step of closing the door after the dust collecting step.

The method of controlling the cleaner station according to the present disclosure may further include a release step of releasing the dust bin after the door closing step.

According to the cleaner station, the cleaner system, and the method of controlling the cleaner station according to the present disclosure, it is possible to eliminate the inconvenience caused because the user needs to empty the dust bin all the time.

In addition, since the dust in the dust bin is sucked into the station when emptying the dust bin, it is possible to prevent the dust from scattering.

In addition, it is possible to open the dust passing hole by detecting coupling of the cleaner without the user's separate manipulation and remove the dust in the dust bin in accordance with the operation of the dust collecting motor, and as a result, it is possible to provide convenience for the user.

In addition, a stick cleaner and a robot cleaner may be coupled to the cleaner station at the same time, and as necessary, the dust in the dust bin of the stick cleaner and the dust in the dust bin of the robot cleaner may be selectively removed.

In addition, when the cleaner is coupled to the cleaner station, the coupling of the cleaner may be detected, the cleaner may be automatically fixed, a suction port (door) of the cleaner station may be opened, and the cover of the dust bin of the cleaner may be opened.

In addition, when the cleaner station detects the coupling of the dust bin, the lever is pulled to compress the dust bin, such that the residual dust does not remain in the dust bin, and as a result, it is possible to increase the suction force of the cleaner.

Further, it is possible to remove an offensive odor caused by the residual dust by preventing the residual dust from remaining in the dust bin.

In addition, the cleaner is coupled to the lateral surface of the station, the dust collecting part is disposed below the coupling part, and the dust suction module is disposed below the dust collecting part, such that a horizontal space occupied by the cleaner station in the room may be minimized, and as a result, it is possible to improve space efficiency.

In addition, the cleaner is coupled to the station such that a center of gravity of the cleaner is disposed to pass through the space for maintaining the balance of the station, and as a result, it is possible to stably support the cleaner and the station while preventing the cleaner and the station from falling down.

In addition, the cleaner may be mounted on the cleaner station in the state in which the extension tube and the cleaning module are mounted.

In addition, it is possible to minimize an occupied space on a horizontal plane even in the state in which the cleaner is mounted on the cleaner station.

In addition, because the flow path, which communicates with the dust bin, is bent downward only once, it is possible to minimize a loss of flow force for collecting the dust.

In addition, the dust in the dust bin is invisible from the outside in the state in which the cleaner is mounted on the cleaner station.

In addition, the user may easily couple the cleaner to the station without bending his/her waist.

In addition, the user may couple the cleaner to the cleaner station only by simply moving his/her wrist or forearm.

DETAILED DESCRIPTION

Figure 1:
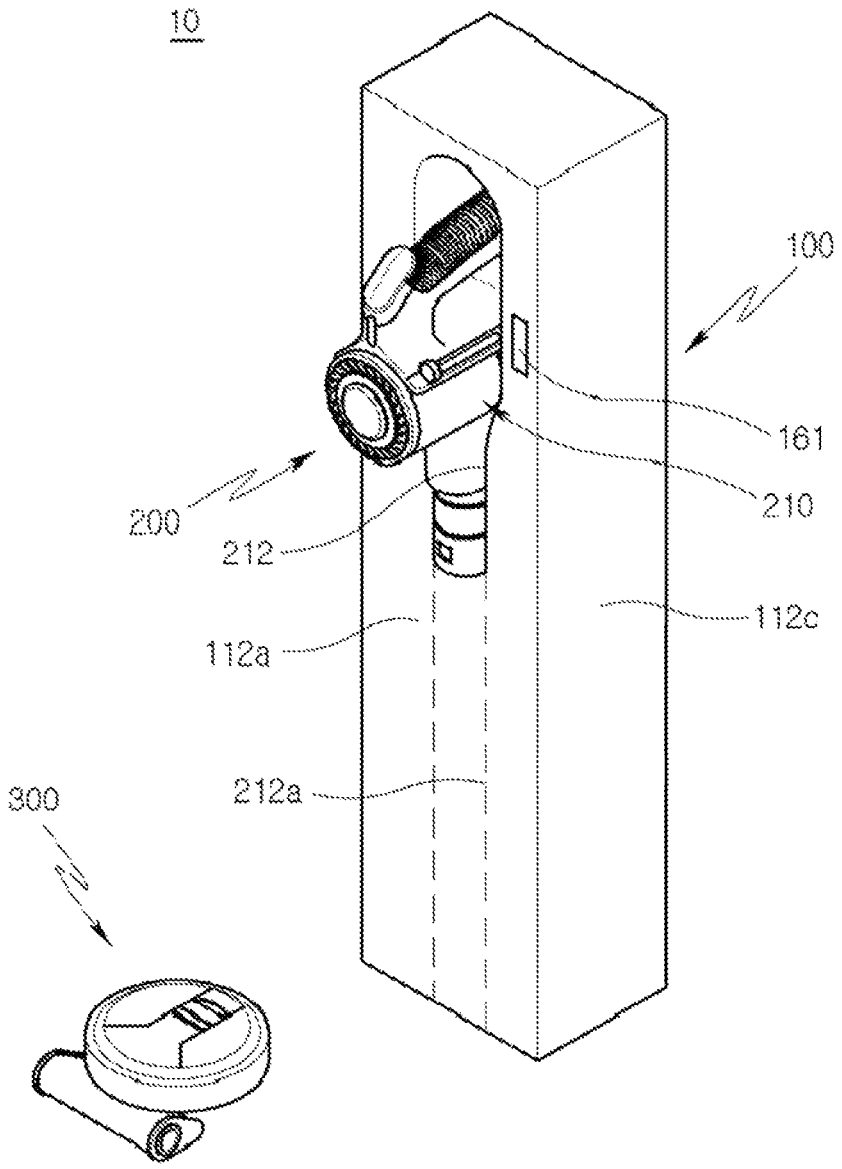
FIG. 1 is a perspective view illustrating a cleaner system including a station, a first cleaner, and a second cleaner according to an embodiment of the present disclosure.

Hereinafter, exemplary embodiments of the present disclosure will be described in detail with reference to the accompanying drawings.

The present disclosure may be variously modified and may have various embodiments, and particular embodiments illustrated in the drawings will be specifically described below. The description of the embodiments is not intended to limit the present disclosure to the particular embodiments, but it should be interpreted that the present disclosure is to cover all modifications, equivalents and alternatives falling within the spirit and technical scope of the present disclosure.

The terminology used herein is used for the purpose of describing particular embodiments only and is not intended to limit the present disclosure. Singular expressions may include plural expressions unless clearly described as different meanings in the context.

Unless otherwise defined, all terms used herein, including technical or scientific terms, may have the same meaning as commonly understood by those skilled in the art to which the present disclosure pertains. The terms such as those defined in a commonly used dictionary may be interpreted as having meanings consistent with meanings in the context of related technologies and may not be interpreted as ideal or excessively formal meanings unless explicitly defined in the present application.

Figure 2:
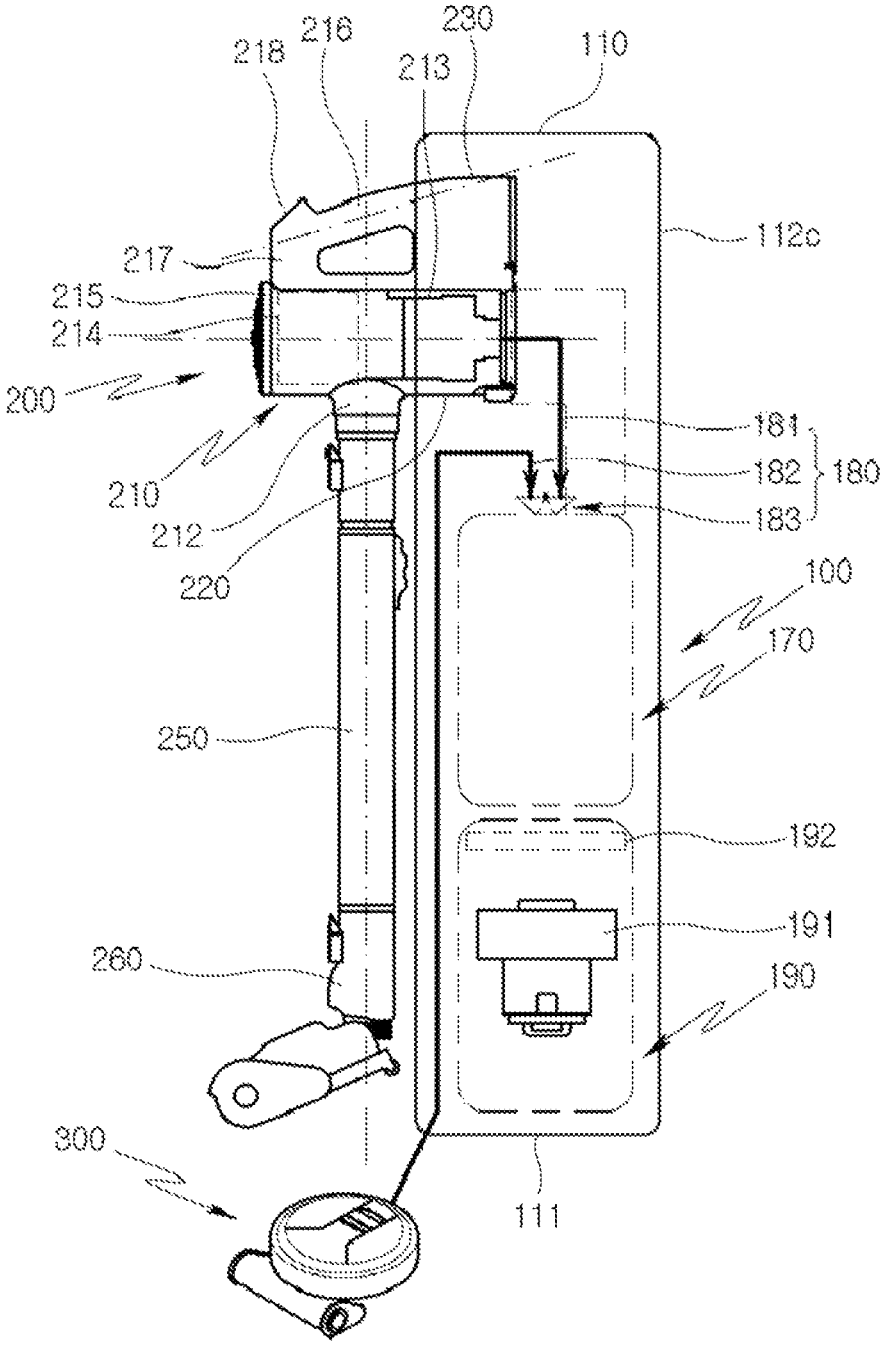
FIG. 2 is a schematic view illustrating a configuration of the cleaner system according to the embodiment of the present disclosure.

FIG. 1 is a perspective view illustrating a cleaner system including a cleaner station, a first cleaner, and a second cleaner according to an embodiment of the present disclosure, and FIG. 2 is a schematic view illustrating a configuration of the cleaner system according to the embodiment of the present disclosure.

Referring to FIGS. 1 and 2, a cleaner system 10 according to an embodiment of the present specification may include a cleaner station 100 and cleaners 200 and 300. In this case, the cleaners 200 and 300 may include a first cleaner 200 and a second cleaner 300. Meanwhile, the present embodiment may be carried out without some of the above-mentioned components and does not exclude additional components.

The cleaner system 10 may include the cleaner station 100. The first cleaner 200 and the second cleaner 300 may be coupled to the cleaner station 100. The first cleaner 200 may be coupled to a lateral surface of the cleaner station 100. Specifically, a main body of the first cleaner 200 may be coupled to the lateral surface of the cleaner station 100. The second cleaner 200 may be coupled to a lower portion of the cleaner station 100. The cleaner station 100 may remove dust from a dust bin 220 of the first cleaner 200. The cleaner station 100 may remove dust from a dust bin (not illustrated) of the second cleaner 300.

Figure 3:
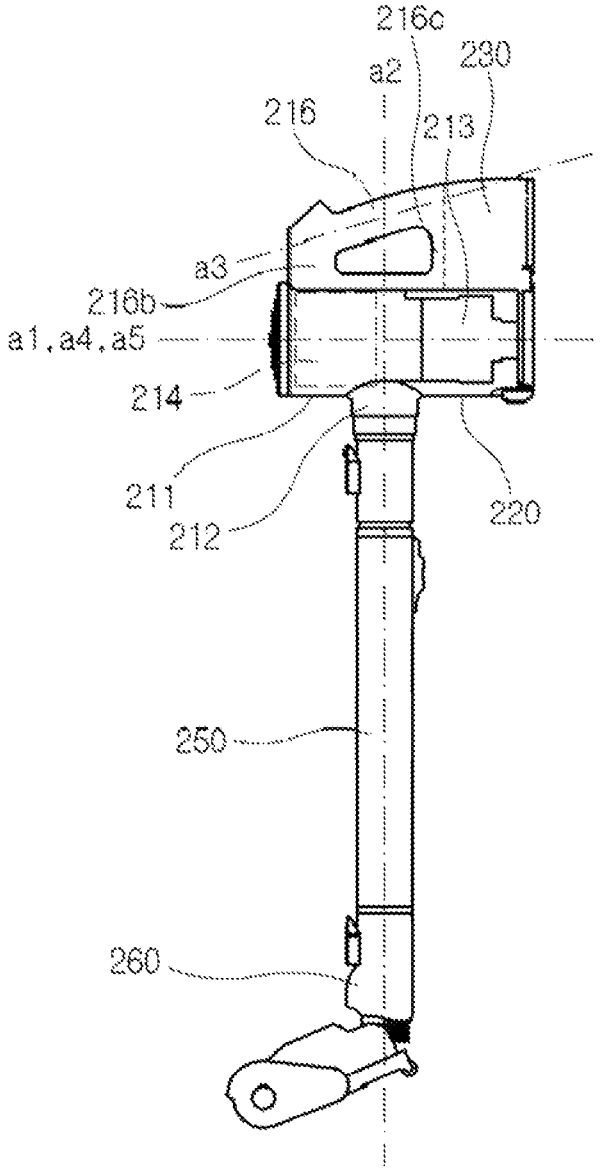
FIG. 3 is a view for explaining illustrating the first cleaner of the cleaner system according to the embodiment of the present disclosure.
Figure 14:
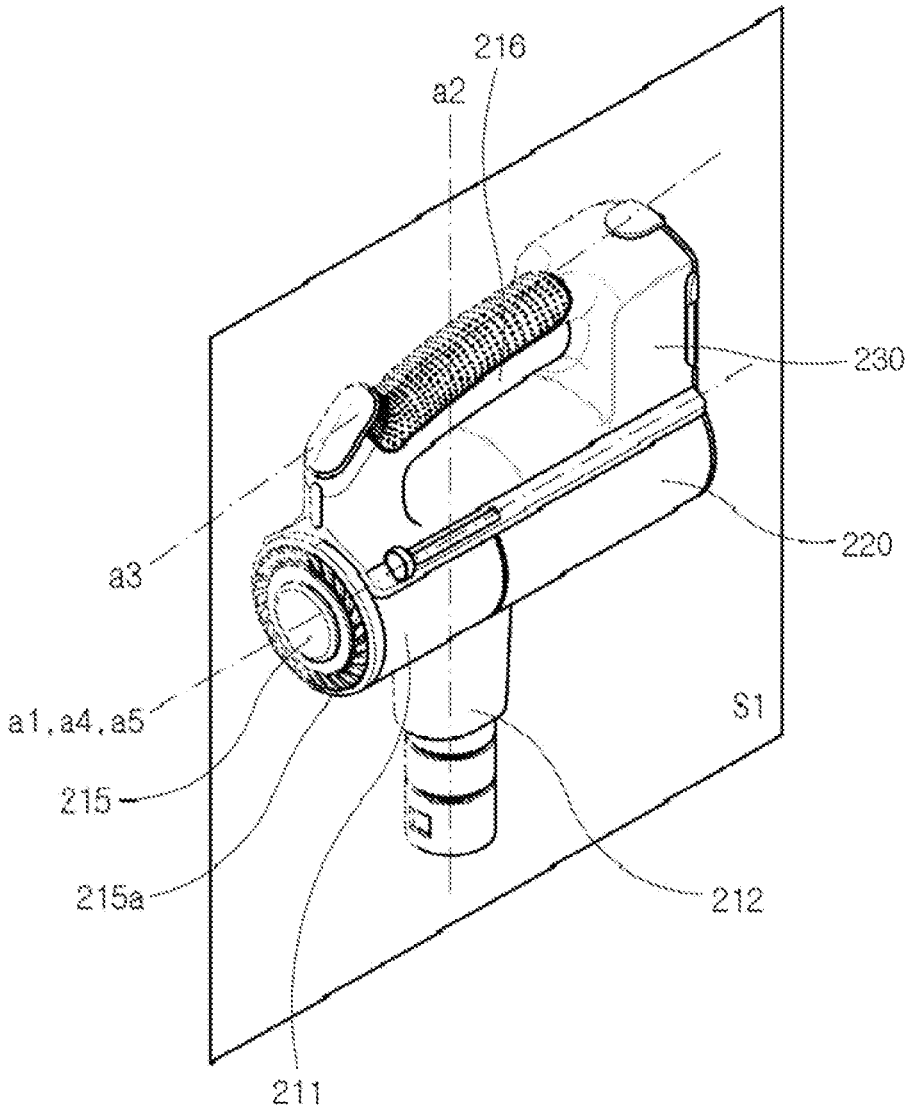
FIG. 14 is a view for explaining a weight distribution using an imaginary plane penetrating the first cleaner in the cleaner system according to the embodiment of the present disclosure.

Meanwhile, FIG. 3 is a view for explaining the first cleaner in a dust removing system according to the embodiment of the present disclosure, and FIG. 14 is a view for explaining a weight distribution of the first cleaner according to the embodiment of the present disclosure using an imaginary line and an imaginary plane.

First, a structure of the first cleaner 200 will be described below with reference to FIGS. 1 to 3.

The first cleaner 200 may mean a cleaner configured to be manually operated by a user. For example, the first cleaner 200 may mean a handy cleaner or a stick cleaner.

The first cleaner 200 may be mounted on the cleaner station 100. The first cleaner 200 may be supported by the cleaner station 100. The first cleaner 200 may be coupled to the cleaner station 100.

Meanwhile, in the embodiment of the present disclosure, directions may be defined on the basis of a state in which a bottom surface (lower surface) of the dust bin 220 and a bottom surface (lower surface) of a battery housing 230 are placed on a ground surface.

In this case, a forward direction may mean a direction in which a suction part 212 is disposed based on a suction motor 214, and a rear direction may mean a direction in which a handle 216 is disposed. Further, on the basis of a state in which the suction part 212 is viewed from the suction motor 214, a right direction may refer to a direction in which a component is disposed at the right, and a left direction may refer to a direction in which a component is disposed at the left. In addition, in the embodiment of the present disclosure, upper and lower sides may be defined in a direction perpendicular to the ground surface on the basis of the state in which the bottom surface (lower surface) of the dust bin 220 and the bottom surface (lower surface) of the battery housing 230 are placed on the ground surface.

The first cleaner 200 may include a main body 210. The main body 210 may include a main body housing 211, the suction part 212, a dust separating part 213, the suction motor 214, an air discharge cover 215, the handle 216, and an operating part 218.

The main body housing 211 may define an external appearance of the first cleaner 200. The main body housing 211 may provide a space that may accommodate therein the suction motor 214 and a filter (not illustrated). The main body housing 211 may be formed in a shape similar to a cylindrical shape.

The suction part 212 may protrude outward from the main body housing 211. For example, the suction part 212 may be formed in a cylindrical shape with an opened inside. The suction part 212 may be coupled to an extension tube 250. The suction part 212 may be referred to as a flow path (hereinafter, referred to as a 'suction flow path') through which air containing dust may flow.

Meanwhile, in the present embodiment, an imaginary line may be defined to penetrate the inside of the suction part 212 having a cylindrical shape. That is, an imaginary suction flow path through line a2 may be formed to penetrate the suction flow path in a longitudinal direction.

In this case, the suction flow path through line a2 may be an imaginary line formed to be perpendicular to a plane and including a point on the plane made by cutting the suction part 212 in a radial direction and in the longitudinal direction (axial direction). For example, the suction flow path through line a2 may be an imaginary line made by connecting origins of circles made by cutting the cylindrical suction part 212 in the radial direction and in the longitudinal direction (axial direction).

The dust separating part 213 may communicate with the suction part 212. The dust separating part 213 may separate dust introduced into the dust separating part 213 through the suction part 212. A space in the dust separating part 213 may communicate with a space in the dust bin 220.

For example, the dust separating part 213 may have two or more cyclone parts capable of separating dust using a cyclone flow. Further, the space in the dust separating part 213 may communicate with the suction flow path. Therefore, the air and the dust, which are introduced through the suction part 212, spirally flow along an inner circumferential surface of the dust separating part 213. Therefore, the cyclone flow may be generated in the internal space of the dust separating part 213.

Meanwhile, in the present embodiment, an imaginary cyclone line a4 may be formed to extend in the upward/downward direction of the dust separating part 213 in which the cyclone flow is generated.

In this case, the cyclone line a4 may be an imaginary line formed to be perpendicular to a plane and including a point on the plane made by cutting the dust separating part 213 in the radial direction.

The suction motor 214 may generate a suction force for sucking air. The suction motor 214 may be accommodated in the main body housing 211. The suction motor 214 may generate the suction force by means of a rotation. For example, the suction motor 214 may be formed in a shape similar to a cylindrical shape.

Meanwhile, in the present embodiment, an imaginary suction motor axis a1 may be formed by extending a rotation axis of the suction motor 214.

The air discharge cover 215 may be disposed at one side in an axial direction of the main body housing 211. A filter for filtering air may be accommodated in the air discharge cover 215. For example, an HEPA filter may be accommodated in the air discharge cover 215.

The air discharge cover 215 may have an air discharge port 215*a* for discharging the air introduced by the suction force of the suction motor 214.

A flow guide may be disposed on the air discharge cover 215. The flow guide may guide a flow of the air to be discharged through the air discharge port 215*a*.

The handle 216 may be grasped by the user. The handle 216 may be disposed at a rear side of the suction motor 214. For example, the handle 216 may be formed in a shape similar to a cylindrical shape. Alternatively, the handle 216 may be formed in a curved cylindrical shape. The handle 216 may be disposed at a predetermined angle with respect to the main body housing 211, the suction motor 214, or the dust separating part 213.

The handle 216 may include a grip portion 216*a* formed in a column shape so that the user may grasp the grip portion 216*a*, a first extension portion 216*b* connected to one end in the longitudinal direction (axial direction) of the grip portion 216*a* and extending toward the suction motor 214, and a second extension portion 216*c* connected to the other end in the longitudinal direction (axial direction) of the grip portion 216*a* and extending toward the dust bin 220.

Meanwhile, in the present embodiment, an imaginary grip portion through line a3 may be formed to extend in the longitudinal direction of the grip portion 216*a* (the axial direction of the column) and penetrate the grip portion 216*a*.

For example, the grip portion through line a3 may be an imaginary line formed in the handle 216 having a cylindrical shape, that is, an imaginary line formed in parallel with at least a part of an outer surface (outer circumferential surface) of the grip portion 216*a*.

An upper surface of the handle 216 may define an external appearance of a part of an upper surface of the first cleaner 200. Therefore, it is possible to prevent a component of the first cleaner 200 from coming into contact with the user's arm when the user grasps the handle 216.

The first extension portion 216*b* may extend from the grip portion 216*a* toward the main body housing 211 or the suction motor 214. At least a part of the first extension portion 216*b* may extend in a horizontal direction.

The second extension portion 216*c* may extend from the grip portion 216*a* toward the dust bin 220. At least a part of the second extension portion 216*c* may extend in the horizontal direction.

The operating part 218 may be disposed on the handle 216. The operating part 218 may be disposed on an inclined surface formed in an upper region of the handle 216. The user may input an instruction to operate or stop the first cleaner 200 through the operating part 218.

The first cleaner 200 may include the dust bin 220. The dust bin 220 may communicate with the dust separating part 213. The dust bin 220 may store the dust separated by the dust separating part 213.

The dust bin 220 may include a dust bin main body 221, a discharge cover 222, a dust bin compression lever 223, and a compression member (not illustrated).

The dust bin main body 221 may provide a space capable of storing the dust separated from the dust separating part 213. For example, the dust bin main body 221 may be formed in a shape similar to a cylindrical shape.

Meanwhile, in the present embodiment, an imaginary dust bin through line a5 may be formed to penetrate the inside (internal space) of the dust bin main body 221 and extend in the longitudinal direction of the dust bin main body 221 (that means the axial direction of the cylindrical dust bin main body 221).

In this case, the dust bin through line a5 may be an imaginary line formed to be perpendicular to a plane and including a point on the plane made by cutting the dust bin 220 in the radial direction and in the longitudinal direction (the axial direction of the cylindrical dust bin main body 221).

For example, the dust bin through line a5 may be an imaginary line formed to be perpendicular to circles and passing through origins of the circles made by cutting the dust bin 220 in the radial direction and in the longitudinal direction.

A part of a lower side (bottom side) of the dust bin main body 221 may be opened. In addition, a lower extension portion 221*a* may be formed at the lower side (bottom side) of the dust bin main body 221. The lower extension portion 221*a* may be formed to block a part of the lower side of the dust bin main body 221.

The dust bin 220 may include a discharge cover 222. The discharge cover 222 may be disposed at a lower side of the dust bin 220. The discharge cover 222 may selectively open or close the lower side of the dust bin 220 which is opened downward.

The discharge cover 222 may include a cover main body 222*a* and a hinge part 222*b*. The cover main body 222*a* may be formed to block a part of the lower side of the dust bin main body 221. The cover main body 222*a* may be rotated downward about the hinge part 222*b*. The hinge part 222*b* may be disposed adjacent to the battery housing 230. The discharge cover 222 may be coupled to the dust bin 220 by a hook engagement.

Meanwhile, the dust bin may further include a coupling lever 222*c*. The discharge cover 222 may be separated from the dust bin 220 by means of the coupling lever 222*c*. The coupling lever 222*c* may be disposed at a front side of the dust bin. Specifically, the coupling lever 222*c* may be disposed on an outer surface at the front side of the dust bin 220. When external force is applied to the coupling lever 222*c*, the coupling lever 222*c* may elastically deform a hook extending from the cover main body 222*a* in order to release the hook engagement between the cover main body 222*a* and the dust bin main body 221.

When the discharge cover 222 is closed, the lower side of the dust bin 220 may be blocked (sealed) by the discharge cover 222 and the lower extension portion 221*a*.

The dust bin 220 may further include the dust bin compression lever 223 and the compression member 224.

Meanwhile, the first cleaner 100 according to the present embodiment has the dust bin compression lever 223 and the compression member 224, but the dust bin compression lever 223 and the compression member 224 are not essential. The first cleaner 100 may be configured without having the dust bin compression lever 223 and the compression member 224 in accordance with embodiments.

The dust bin compression lever 223 may be disposed outside the dust bin 220 or the dust separating part 211. The dust bin compression lever 223 may be disposed outside the dust bin 220 or the dust separating part 211 so as to be movable upward and downward. The dust bin compression lever 223 may be connected to the compression member (not illustrated). When the dust bin compression lever 223 is moved downward by external force, the compression member 224 may also be moved downward. Therefore, it is possible to provide convenience for the user. The compression member (not illustrated) and the dust bin compression lever 223 may return back to original positions by an elastic member (not illustrated). Specifically, when the external force applied to the dust bin compression lever 223 is eliminated, the elastic member may move the dust bin compression lever 223 and the compression member 224 upward.

The compression member 224 may be disposed in the dust bin main body 221. The compression member may move in the internal space of the dust bin main body 221. Specifically, the compression member may move upward and downward in the dust bin main body 221. Therefore, the compression member may compress the dust in the dust bin main body 221. In addition, when the discharge cover 222 is separated from the dust bin main body 221 and thus the lower side of the dust bin 220 is opened, the compression member may move from an upper side of the dust bin 220 to the lower side of the of the dust bin 220, thereby removing foreign substances such as residual dust in the dust bin 220. Therefore, it is possible to improve the suction force of the cleaner by preventing the residual dust from remaining in the dust bin 220. Further, it is possible to remove an offensive odor caused by the residual dust by preventing the residual dust from remaining in the dust bin 220 (see FIGS. 38 and 39).

The first cleaner 200 may include the battery housing 230. A battery 240 may be accommodated in the battery housing 230. The battery housing 230 may be disposed at a lower side of the handle 216. For example, the battery housing 230 may have a hexahedral shape opened at a lower side thereof. A rear surface of the battery housing 230 may be connected to the handle 216.

The battery housing 230 may include an accommodation portion opened at a lower side thereof. The battery 230 may be attached or detached through the accommodation portion of the battery housing 220.

The first cleaner 200 may include the battery 240.

For example, the battery 240 may be separably coupled to the first cleaner 200. The battery 240 may be separably coupled to the battery housing 230. For example, the battery 240 may be inserted into the battery housing 230 from the lower side of the battery housing 230. The above-mentioned configuration may improve portability of the first cleaner 200.

Otherwise, the battery 240 may be integrally provided in the battery housing 230. In this case, a lower surface of the battery 240 is not exposed to the outside.

The battery 240 may supply power to the suction motor 214 of the first cleaner 200. The battery 240 may be disposed on a lower portion of the handle 216. The battery 240 may be disposed at a rear side of the dust bin 220. That is, the suction motor 214 and the battery 240 may be disposed so as not to overlap each other in the upward/downward direction and disposed at different disposition heights. On the basis of the handle 216, the suction motor 214, which is heavy in weight, is disposed at a front side of the handle 216, and the battery 240, which is heavy in weight, is disposed at the lower side of the handle 216, such that an overall weight of the first cleaner 200 may be uniformly distributed. Therefore, it is possible to prevent stress from being applied to the user's wrist when the user grasps the handle 216 and performs a cleaning operation.

In a case in which the battery 240 is coupled to the battery housing 230 in accordance with the embodiment, the lower surface of the battery 240 may be exposed to the outside. Because the battery 240 may be placed on the floor when the first cleaner 200 is placed on the floor, the battery 240 may be immediately separated from the battery housing 230. In addition, because the lower surface of the battery 240 is exposed to the outside and thus in direct contact with air outside the battery 240, performance of cooling the battery 240 may be improved.

Meanwhile, in a case in which the battery 240 is fixed integrally to the battery housing 230, the number of structures for attaching or detaching the battery 240 and the battery housing 230 may be reduced, and as a result, it is possible to reduce an overall size of the first cleaner 200 and a weight of the first cleaner 200.

The first cleaner 200 may include the extension tube 250. The extension tube 250 may communicate with a cleaning module 260. The extension tube 250 may communicate with the main body 210. The extension tube 250 may communicate with the suction part 214 of the main body 210. The extension tube 250 may be formed in a long cylindrical shape.

The main body 210 may be connected to the extension tube 250. The main body 210 may be connected to the cleaning module 260 through the extension tube 250. The main body 210 may generate the suction force by means of the suction motor 214 and provide the suction force to the cleaning module 260 through the extension tube 250. The outside dust may be introduced into the main body 210 through the cleaning module 260 and the extension tube 250.

The first cleaner 200 may include the cleaning module 260. The cleaning module 260 may communicate with the extension tube 260. Therefore, the outside air may be introduced into the main body 210 of the first cleaner 200 via the cleaning module 260 and the extension tube 250 by the suction force in the main body 210 of the first cleaner 200.

The dust in the dust bin 220 of the first cleaner 200 may be captured by a dust collecting part 170 of the cleaner station 100 by gravity and a suction force of a dust collecting motor 191. Therefore, it is possible to remove the dust in the dust bin without the user's separate manipulation, thereby providing convenience for the user. In addition, it is possible to eliminate the inconvenience caused because the user needs to empty the dust bin all the time. In addition, it is possible to prevent the dust from scattering when emptying the dust bin.

The first cleaner 200 may be coupled to a lateral surface of a housing 110. Specifically, the main body 210 of the first cleaner 200 may be mounted on a coupling part 120. More specifically, the dust bin 220 and the battery housing 230 of the first cleaner 200 may be coupled to a coupling surface 121, an outer circumferential surface of the dust bin main body 221 may be coupled to a dust bin guide surface 122, and the suction part 212 may be coupled to a suction part guide surface 126 of the coupling part 120. In this case, a central axis of the dust bin 220 may be disposed in a direction parallel to the ground surface, and the extension tube 250 may be disposed in a direction perpendicular to the ground surface (see FIG. 2).

The cleaner system 10 may include the second cleaner 300. The second cleaner 300 may mean a robot cleaner. The second cleaner 300 may automatically clean a zone to be cleaned by sucking foreign substances such as dust from the floor while autonomously traveling in the zone to be cleaned. The second cleaner 300, that is, the robot cleaner may include a distance sensor configured to detect a distance from an obstacle such as furniture, office supplies, or walls installed in the zone to be cleaned, and left and right wheels for moving the robot cleaner. The second cleaner 300 may be coupled to the cleaner station 100. The dust in the second cleaner 300 may be captured into the dust collecting part 170 through a second cleaner flow path part 182.

Figure 19:
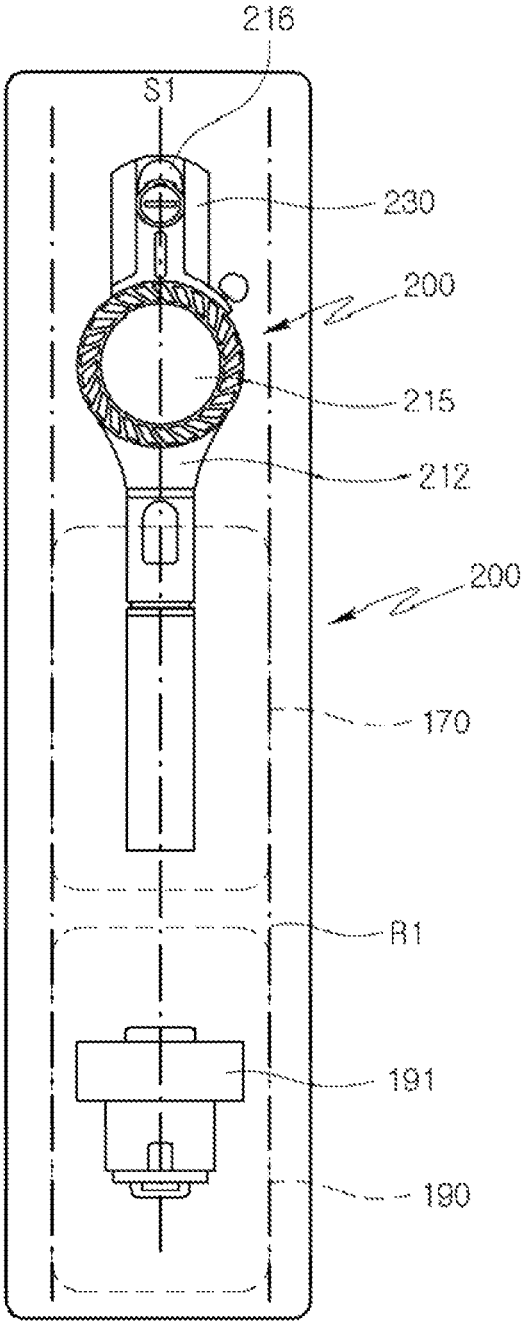
FIG. 19 is a view for explaining an arrangement for maintaining balance in a state in which the first cleaner and the cleaner station are coupled in the cleaner system according to the embodiment of the present disclosure.
Figure 20:
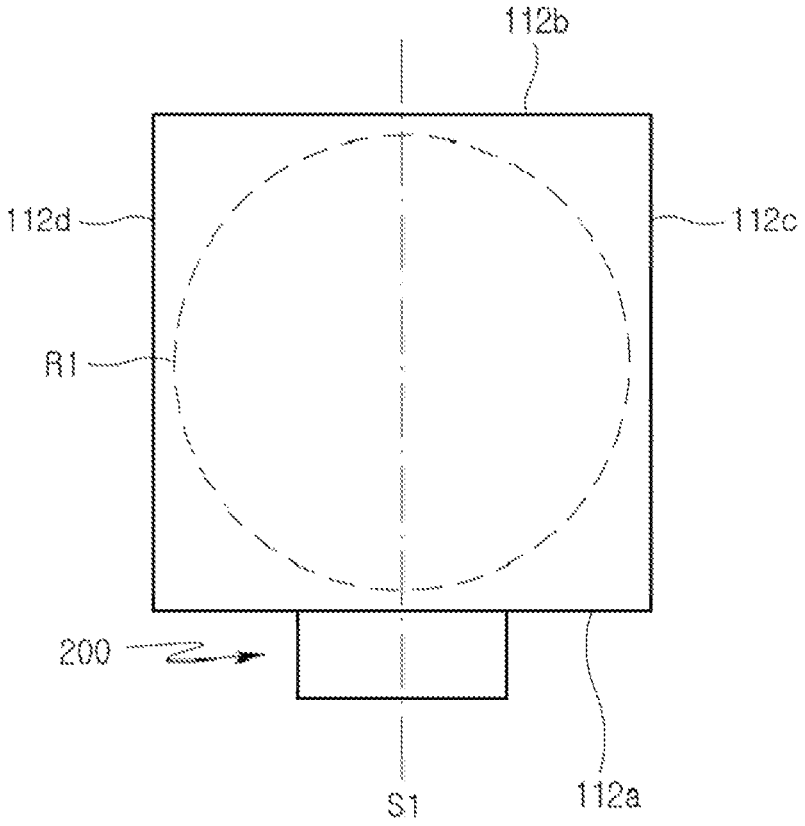
FIG. 20 is a schematic view when viewing FIG. 19 in another direction.

Meanwhile, FIGS. 19 and 20 are views for explaining a state in which the first cleaner and the cleaner station are coupled in the cleaner system according to the embodiment of the present disclosure and for expanding balance maintenance according to the coupling between the first cleaner and the cleaner station.

The cleaner station 100 according to the present disclosure will be described below with reference to FIGS. 1, 2, 19, and 20.

The first cleaner 200 and the second cleaner 300 may be disposed on the cleaner station 100. The first cleaner 200 may be coupled to the lateral surface of the cleaner station 100. Specifically, the dust bin 220 of the first cleaner 200 may be coupled to the lateral surface of the cleaner station 100. The second cleaner 200 may be coupled to the lower portion of the cleaner station 100. The cleaner station 100 may remove the dust from the dust bin 220 of the first cleaner 200. The cleaner station 100 may remove the dust from the dust bin (not illustrated) of the second cleaner 300.

The cleaner station 100 may include the housing 110. The housing 110 may define an external appearance of the cleaner station 100. Specifically, the housing 110 may be formed in the form of a column including one or more outer wall surfaces. For example, the housing 110 may be formed in a shape similar to a quadrangular column.

The housing 110 may have a space capable of accommodating the dust collecting part 170 configured to store dust therein, and a dust suction module 190 configured to generate a flow force for collecting the dust from the dust collecting part 170.

The housing 110 may include a bottom surface 111 and an outer wall surface 112.

The bottom surface 111 may support a lower side in a gravitational direction of the dust suction module 190. That is, the bottom surface 111 may support a lower side of the dust collecting motor 191 of the dust suction module 190.

In this case, the bottom surface 111 may be disposed toward the ground surface. The bottom surface 111 may also be disposed in parallel with the ground surface or disposed to be inclined at a predetermined angle with respect to the ground surface. The above-mentioned configuration may be advantageous in stably supporting the dust collecting motor 191 and maintaining the balance of an overall weight even in a case in which the first cleaner 200 is coupled.

Meanwhile, according to the embodiment, the bottom surface 111 may further include ground surface support portions (not illustrated) in order to prevent the cleaner station 100 from falling down and increase an area being in contact with the ground surface to maintain the balance. For example, the ground surface support portion may have a plate shape extending from the bottom surface 111, and one or more frames may protrude and extend from the bottom surface 111 in a direction of the ground surface. In this case, the ground surface support portions may be disposed to be linearly symmetrical in order to maintain the left and right balance and the front and rear balance on the basis of a front surface on which the first cleaner 200 is mounted.

The outer wall surface 112 may mean a surface formed in the gravitational direction or a surface connected to the bottom surface 111. For example, the outer wall surface 112 may mean a surface connected to the bottom surface 111 so as to be perpendicular to the bottom surface 111. As another embodiment, the outer wall surface 112 may be disposed to be inclined at a predetermined angle with respect to the bottom surface 111.

The outer wall surface 112 may include at least one surface. For example, the outer wall surface 112 may include a first outer wall surface 112*a*, a second outer wall surface 112*b*, a third outer wall surface 112*c*, and a fourth outer wall surface 112*d*.

In this case, in the present embodiment, the first outer wall surface 112*a* may be disposed on the front surface of the cleaner station 100. In this case, the front surface may mean a surface on which the first cleaner 200 or the second cleaner 300 is coupled. Therefore, the first outer wall surface 112*a* may define an external appearance of the front surface of the cleaner station 100.

Meanwhile, the directions are defined as follows to understand the present embodiment. In the present embodiment, the directions may be defined in the state in which the first cleaner 200 is mounted on the cleaner station 100.

In this case, a surface including an extension line 212*a* of the suction part 212 may be referred to as the front surface (see FIG. 1). That is, in the state in which the first cleaner 200 is mounted on the cleaner station 100, a portion of the suction part 212 may be in contact with and coupled to the suction part guide surface 126, and the remaining portion of the suction part 212, which is not coupled to the suction part guide surface 126, may be disposed to be exposed to the outside from the first outer wall surface 112*a*. Therefore, the imaginary extension line 212*a* of the suction part 212 may be disposed on the first outer wall surface 112*a*, and the surface including the extension line 212*a* of the suction part 212 may be referred to as the front surface.

In another point of view, in a state in which a lever pulling arm 161 is coupled to the housing 110, a surface including a side through which the lever pulling arm 161 is exposed to the outside may be referred to as the front surface.

In still another point of view, in the state in which the first cleaner 200 is mounted on the cleaner station 100, an outer surface of the cleaner station 100, which is penetrated by the main body 210 of the first cleaner, may be referred to as the front surface.

Further, in the state in which the first cleaner 200 is mounted on the cleaner station 100, a direction in which the first cleaner 200 is exposed to the outside of the cleaner station 100 may be referred to as a forward direction.

In addition, in another point of view, in the state in which the first cleaner 200 is mounted on the cleaner station 100, a direction in which the suction motor 214 of the first cleaner 200 is disposed may be referred to as the forward direction. Further, a direction opposite to the direction in which the suction motor 214 is disposed on the cleaner station 100 may be referred to as a rearward direction.

In still another point of view, a direction in which an intersection point at which the grip portion through line a3 and the suction motor axis a1 intersect is disposed may be referred to as the forward direction on the basis of the cleaner station 100. Alternatively, a direction in which an intersection point P2 at which the grip portion through line a3 and the suction flow path through line a2 intersect is disposed may be referred to as the forward direction. Alternatively, a direction in which an intersection point P1 at which the suction motor axis a1 and the suction flow path through line a2 intersect is disposed may be referred to as the forward direction. Further, a direction opposite to the direction in which the intersection point is disposed may be referred to as the rearward direction on the basis of the cleaner station 100.

Further, on the basis of the internal space of the housing 110, a surface facing the front surface may be referred to as a rear surface of the cleaner station 100. Therefore, the rear surface may mean a direction in which the second outer wall surface 112*b* is formed.

Further, on the basis of the internal space of the housing 110, a left surface when viewing the front surface may be referred to as a left surface, and a right surface when viewing the front surface may be referred to as a right surface. Therefore, the left surface may mean a direction in which the third outer wall surface 112*c* is formed, and the right surface may mean a direction in which the fourth outer wall surface 112*d* is formed.

The first outer wall surface 112*a* may be formed in the form of a flat surface, or the first outer wall surface 112*a* may be formed in the form of a curved surface as a whole or formed to partially include a curved surface.

The first outer wall surface 112*a* may have an external appearance corresponding to the shape of the first cleaner 200. In detail, the coupling part 120 may be disposed in the first outer wall surface 112*a*. With this configuration, the first cleaner 200 may be coupled to the cleaner station 100 and supported by the cleaner station 100. The specific configuration of the coupling part 120 will be described below.

According to the embodiment, a lever pulling unit 160 may be disposed on the first outer wall surface 112*a*.

Specifically, the lever pulling arm 161 of the lever pulling unit 160 may be mounted on the first outer wall surface 112*a*. For example, the first outer wall surface 112*a* may have an arm accommodating groove in which the lever pulling arm 161 may be accommodated. In this case, the arm accommodating groove may be formed to correspond to a shape of the lever pulling arm 161. Therefore, when the lever pulling arm 161 is mounted in the arm accommodating groove, the first outer wall surface 112*a* and an outer surface of the lever pulling arm 161 may define a continuous external shape, and the lever pulling arm 161 may be stroke-moved to protrude from the first outer wall surface 112*a* by the operation of the lever pulling unit 160.

Meanwhile, a structure for mounting various types of cleaning modules 290 used for the first cleaner 200 may be additionally provided on the first outer wall surface 112*a*.

In addition, a structure to which the second cleaner 300 may be coupled may be additionally provided on the first outer wall surface 112*a*. Therefore, the structure corresponding to the shape of the second cleaner 300 may be additionally provided on the first outer wall surface 112*a*.

Further, a cleaner bottom plate (not illustrated) to which the lower surface of the second cleaner 300 may be coupled may be additionally coupled to the first outer wall surface 112*a*. Meanwhile, as another embodiment, the cleaner bottom plate (not illustrated) may be shaped to be connected to the bottom surface 111.

In the present embodiment, the second outer wall surface 112*b* may be a surface facing the first outer wall surface 112*a*. That is, the second outer wall surface 112*b* may be disposed on the rear surface of the cleaner station 100. In this case, the rear surface may be a surface facing the surface to which the first cleaner 200 or the second cleaner 300 is coupled. Therefore, the second outer wall surface 112*b* may define an external appearance of the rear surface of the cleaner station 100.

For example, the second outer wall surface 112*b* may be formed in the form of a flat surface. With this configuration, the cleaner station 100 may be in close contact with a wall in a room, and the cleaner station 100 may be stably supported.

As another example, the structure for mounting various types of cleaning modules 260 used for the first cleaner 200 may be additionally provided on the second outer wall surface 112*b*.

In addition, the structure to which the second cleaner 300 may be coupled may be additionally provided on the second outer wall surface 112*b*. Therefore, the structure corresponding to the shape of the second cleaner 300 may be additionally provided on the second outer wall surface 112*b*.

Further, a cleaner bottom plate (not illustrated) to which the lower surface of the second cleaner 300 may be coupled may be additionally coupled to the second outer wall surface 112*b*. Meanwhile, as another embodiment, the cleaner bottom plate (not illustrated) may be shaped to be connected to the bottom surface 111. With this configuration, when the second cleaner 300 is coupled to the cleaner bottom plate (not illustrated), an overall center of gravity of the cleaner station 100 may be lowered, such that the cleaner station 100 may be stably supported.

In the present embodiment, the third outer wall surface 112*c* and the fourth outer wall surface 112*d* may mean surfaces that connect the first outer wall surface 112*a* and the second outer wall surface 112*b*. In this case, the third outer wall surface 112*c* may be disposed on the left surface of the station 100, and the fourth outer wall surface 112*d* may be disposed on the right surface of the cleaner station 100. Otherwise, the third outer wall surface 112*c* may be disposed on the right surface of the cleaner station 100, and the fourth outer wall surface 112*d* may be disposed on the left surface of the cleaner station 100.

The third outer wall surface 112*c* or the fourth outer wall surface 112*d* may be formed in the form of a flat surface, or the third outer wall surface 112*c* or the fourth outer wall surface 112*d* may be formed in the form of a curved surface as a whole or formed to partially include a curved surface.

Meanwhile, the structure for mounting various types of cleaning modules 260 used for the first cleaner 200 may be additionally provided on the third outer wall surface 112*c* or the fourth outer wall surface 112*d*.

In addition, the structure to which the second cleaner 300 may be coupled may be additionally provided on the third outer wall surface 112*c* or the fourth outer wall surface 112*d*. Therefore, the structure corresponding to the shape of the second cleaner 300 may be additionally provided on the third outer wall surface 112*c* or the fourth outer wall surface 112*d*.

Further, a cleaner bottom plate (not illustrated) to which the lower surface of the second cleaner 300 may be coupled may be additionally provided on the third outer wall surface 112*c* or the fourth outer wall surface 112*d*. Meanwhile, as another embodiment, the cleaner bottom plate (not illustrated) may be shaped to be connected to the bottom surface 111.

Figure 4:
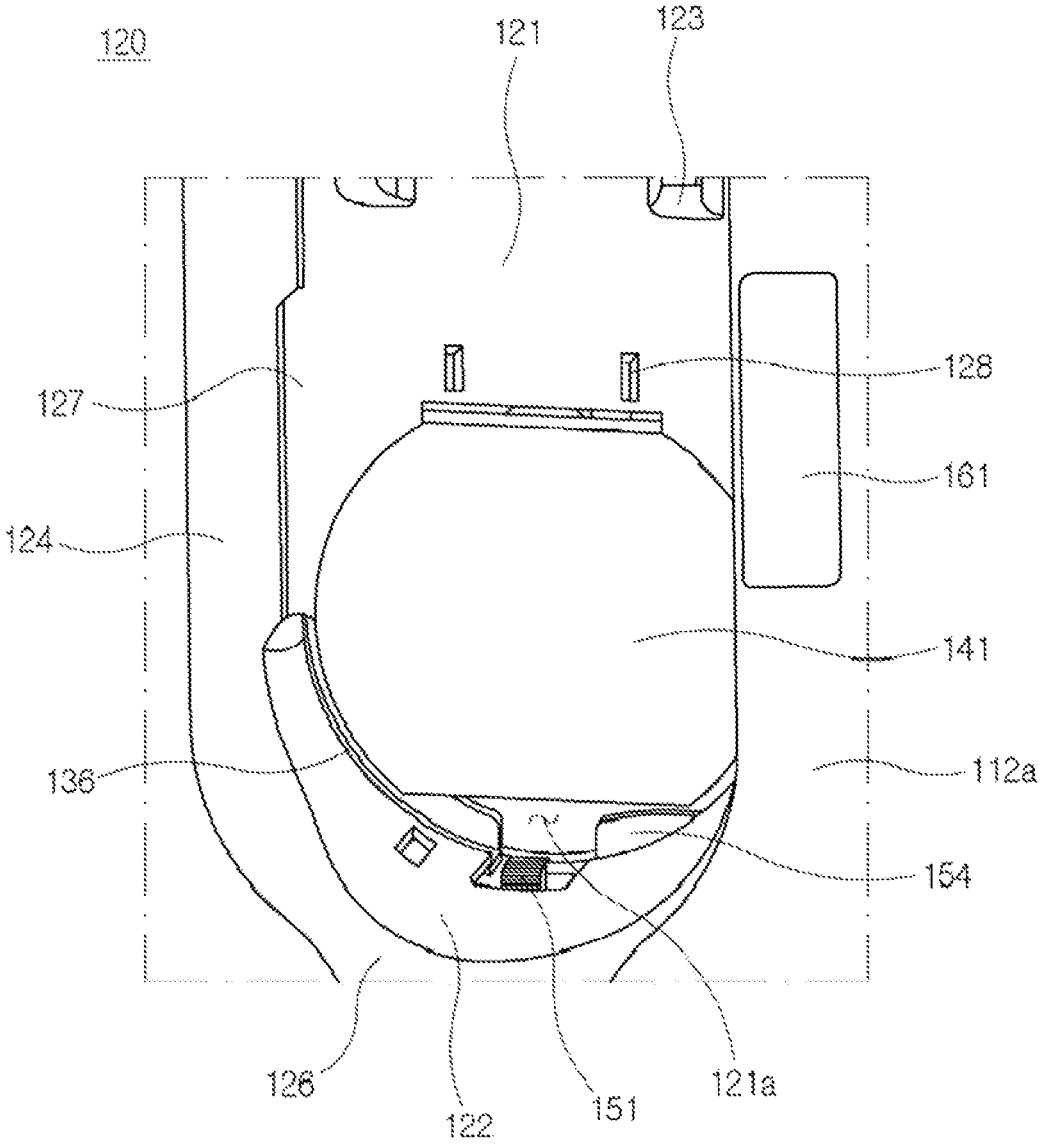
FIG. 4 is a view for explaining a coupling part of the cleaner station according to the embodiment of the present disclosure.
Figure 5:
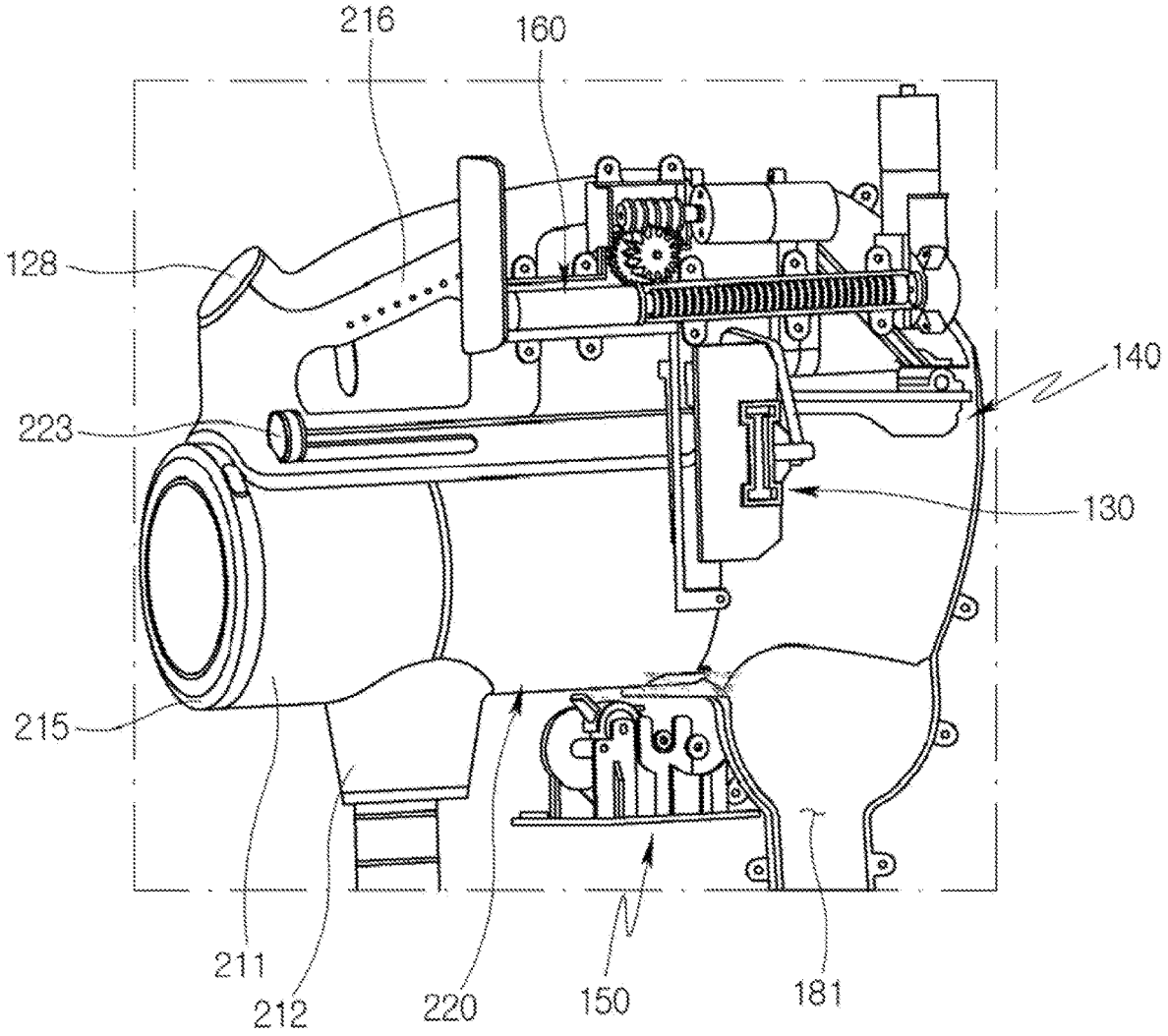
FIG. 5 is a view for explaining an arrangement of a fixing unit, a door unit, a cover opening unit, and a lever pulling unit in the cleaner station according to the embodiment of the present disclosure.
Figure 6:
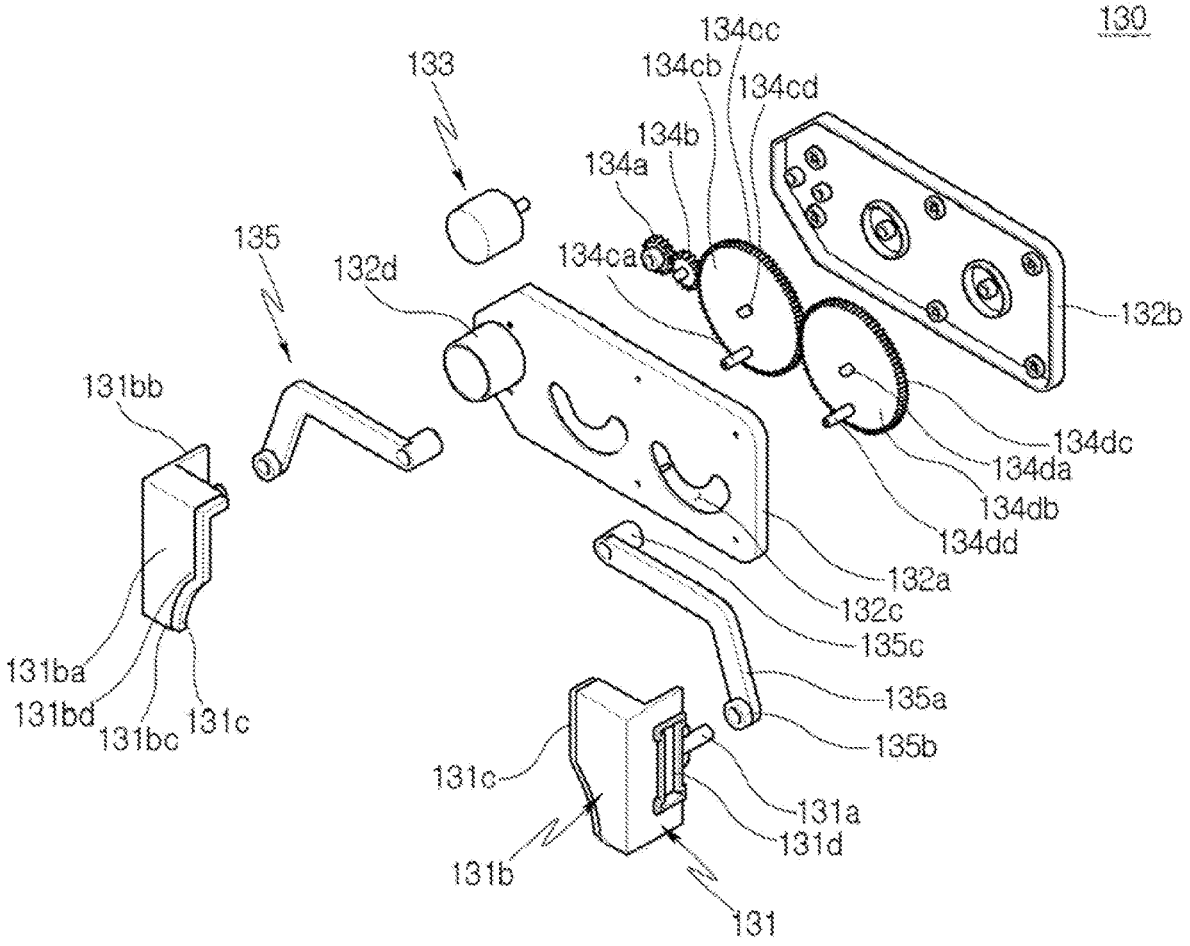
FIG. 6 is an exploded perspective view for explaining the fixing unit of the cleaner station according to the embodiment of the present disclosure.
Figure 7:
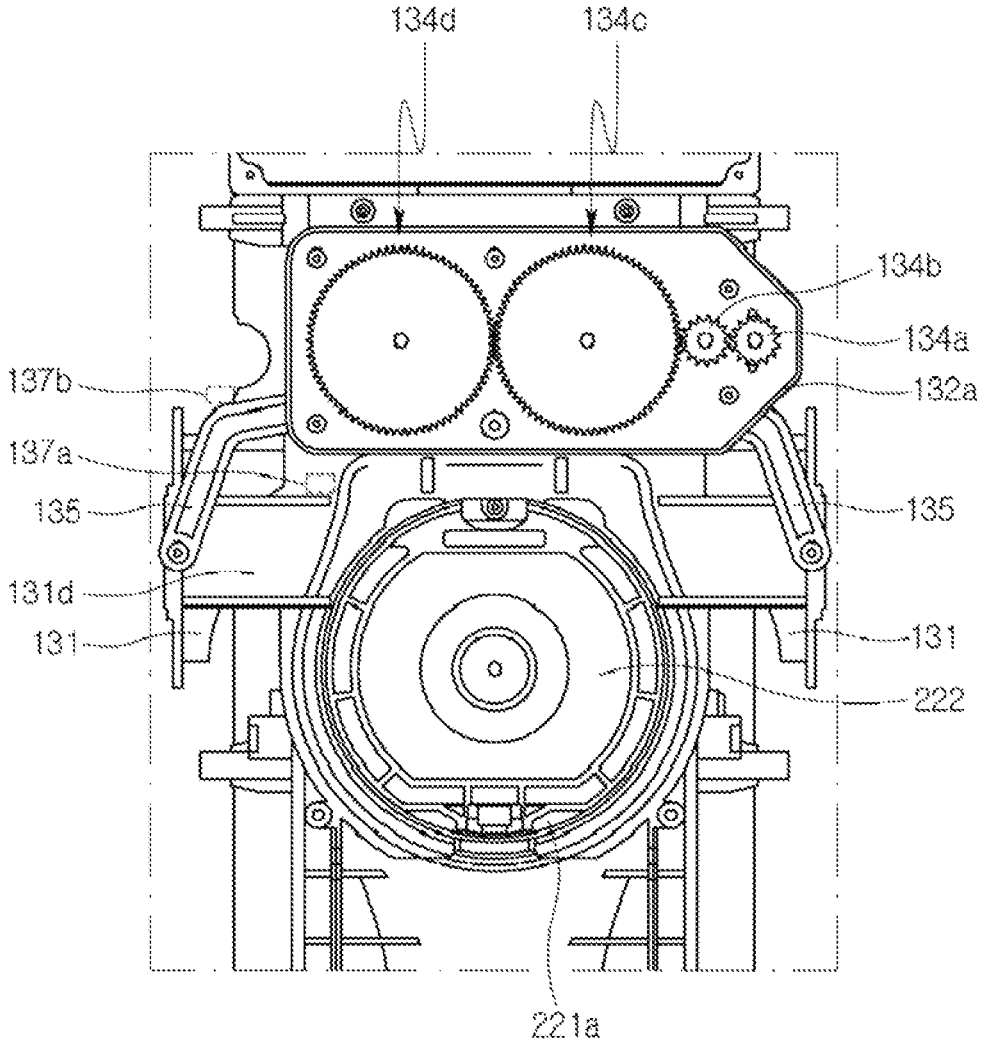
FIG. 7 is a view for explaining an arrangement of the first cleaner and the fixing unit in the cleaner station according to the embodiment of the present disclosure.

FIG. 4 is a view for explaining the coupling part of the cleaner station according to the embodiment of the present disclosure, and FIG. 5 is a view for explaining the arrangement of a fixing unit, a door unit, a cover opening unit, and the lever pulling unit in the cleaner station according to the embodiment of the present disclosure.

The coupling part 120 of the cleaner station 100 according to the present disclosure will be described below with reference to FIGS. 4 and 5.

The cleaner station 100 may include the coupling part 120 to which the first cleaner 200 is coupled. Specifically, the coupling part 120 may be disposed in the first outer wall surface 112*a*, and the main body 210, the dust bin 220, and the battery housing 230 of the first cleaner 200 may be coupled to the coupling part 120.

The coupling part 120 may include the coupling surface 121. The coupling surface 121 may be disposed on the lateral surface of the housing 110. For example, the coupling surface 121 may mean a surface formed in the form of a groove which is concave toward the inside of the cleaner station 100 from the first outer wall surface 112*a*. That is, the coupling surface 121 may mean a surface formed to have a stepped portion with respect to the first outer wall surface 112*a*.

The first cleaner 200 may be coupled to the coupling surface 121. For example, the coupling surface 121 may be in contact with the lower surface of the dust bin 220 and the lower surface of the battery housing 230 of the first cleaner 200. In this case, the lower surface may mean a surface directed toward the ground surface when the user uses the first cleaner 200 or places the first cleaner 200 on the ground surface.

In this case, the coupling between the coupling surface 121 and the dust bin 220 of the first cleaner 200 may mean physical coupling by which the first cleaner 200 and the cleaner station 100 are coupled and fixed to each other. This may be a premise of coupling of a flow path through which the dust bin 220 and a flow path part 180 communicate with each other and a fluid may flow.

Further, the coupling between the coupling surface 121 and the battery housing 230 of the first cleaner 200 may mean physical coupling by which the first cleaner 200 and the cleaner station 100 are coupled and fixed to each other. This may be a premise of electrical coupling by which the battery 240 and a charging part 128 are electrically connected to each other.

For example, an angle of the coupling surface 121 with respect to the ground surface may be a right angle. Therefore, it is possible to minimize a space of the cleaner station 100 when the first cleaner 200 is coupled to the coupling surface 121.

As another example, the coupling surface 121 may be disposed to be inclined at a predetermined angle with respect to the ground surface. Therefore, the cleaner station 100 may be stably supported when the first cleaner 200 is coupled to the coupling surface 121. In this case, the coupling surface 121 may be provided at an angle of 40 degrees or more and 95 degrees or less with respect to the ground surface. Particularly, the coupling surface 121 may be provided at an angle of 43 degrees or more and 90 degrees or less with respect to the ground surface. If the coupling surface 121 is provided at an angle of less than 40 degrees with respect to the ground surface, the user needs to bend his/her waist to couple the first cleaner 200 to the cleaner station 100, which may cause discomfort to the user. If the coupling surface 121 is provided at an angle of more than 95 degrees with respect to the ground surface, the first cleaner 200 may be separated from the cleaner station 100 by its own weight.

The coupling surface 121 may have a dust passage hole 121*a* through which air outside the housing 110 may be introduced into the housing 110. The dust passage hole 121*a* may be formed in the form of a hole corresponding to the shape of the dust bin 220 so that the dust in the dust bin 220 may be introduced into the dust collecting part 170. The dust passage hole 121*a* may be formed to correspond to the shape of the discharge cover 222 of the dust bin 220. The dust passage hole 121*a* may be formed to communicate with a first cleaner flow path part 181 to be described below.

The coupling part 120 may include the dust bin guide surface 122. The dust bin guide surface 122 may be disposed on the first outer wall surface 112*a*. The dust bin guide surface 122 may be connected to the first outer wall surface 112*a*. In addition, the dust bin guide surface 122 may be connected to the coupling surface 121.

The dust bin guide surface 122 may be formed in a shape corresponding to the outer surface of the dust bin 220. A front outer surface of the dust bin 220 may be coupled to the dust bin guide surface 122. Therefore, it is possible to provide convenience when coupling the first cleaner 200 to the coupling surface 121.

The coupling part 120 may include guide protrusions 123. The guide protrusions 123 may be disposed on the coupling surface 121. The guide protrusions 123 may protrude upward from the coupling surface 121. Two guide protrusions 123 may be disposed to be spaced apart from each other. A distance between the two guide protrusions 123, which are spaced apart from each other, may correspond to a width of the battery housing 230 of the first cleaner 200. Therefore, it is possible to provide convenience when coupling the first cleaner 200 to the coupling surface 121.

The coupling part 120 may include sidewalls 124. The sidewalls 124 may mean wall surfaces disposed on two lateral surfaces of the coupling surface 121 and may be perpendicularly connected to the coupling surface 121. The sidewalls 124 may be connected to the first outer wall surface 112*a*. In addition, the sidewalls 124 may be connected to the dust bin guide surface 122. That is, the sidewalls 124 may define surfaces connected to the dust bin guide surface 122. Therefore, the first cleaner 200 may be stably accommodated.

The coupling part 120 may include a coupling sensor 125. The coupling sensor 125 may detect whether the first cleaner 200 is physically coupled to the coupling part 120.

The coupling sensor 125 may include a contact sensor. For example, the coupling sensor 125 may include a microswitch. In this case, the coupling sensor 125 may be disposed on the guide protrusion 123. Therefore, when the battery housing 230 or the battery 240 of the first cleaner 200 is coupled between the pair of guide protrusions 123, the battery housing 230 or the battery 240 comes into contact with the coupling sensor 125, such that the coupling sensor 125 may detect that the first cleaner 200 is physically coupled to the cleaner station 100.

Meanwhile, the coupling sensor 125 may include a non-contact sensor. For example, the coupling sensor 125 may include an infrared (IR) sensor. In this case, the coupling sensor 125 may be disposed on the sidewall 124. Therefore, when the dust bin 220 or the main body 210 of the first cleaner 200 passes the sidewall 124 and then reaches the coupling surface 121, the coupling sensor 125 may detect the presence of the dust bin 220 or the main body 210 and detect that the first cleaner 200 is physically coupled to the cleaner station 100.

The coupling sensor 125 may face the dust bin 220 or the battery housing 230 of the first cleaner 200.

The coupling sensor 125 may be a mean for determining whether the first cleaner 200 is coupled and power is applied to the battery 240 of the first cleaner 200.

The coupling part 120 may include the suction part guide surface 126. The suction part guide surface 126 may be disposed on the first outer wall surface 112*a*. The suction part guide surface 126 may be connected to the dust bin guide surface 122. The suction part 212 may be coupled to the suction part guide surface 126. A shape of the suction part guide surface 126 may correspond to the shape of the suction part 212. Therefore, it is possible to provide convenience when coupling the main body 210 of the first cleaner 200 to the coupling surface 121.

The coupling part 120 may include fixing member entrance holes 127. The fixing member entrance hole 127 may be formed in the form of a long hole along the sidewall 124 so that a fixing member 131 may enter and exit the fixing member entrance hole 127. For example, the fixing member entrance hole 127 may be a rectangular hole formed along the sidewall 124. The fixing member 131 will be described below in detail.

With this configuration, when the user couples the first cleaner 200 to the coupling part 120 of the cleaner station 100, the main body 210 of the first cleaner 200 may be stably disposed on the coupling part 120 by the dust bin guide surface 122, the guide protrusions 123, and the suction part guide surface 126. Therefore, it is possible to provide convenience when coupling the dust bin 220 and the battery housing 230 of the first cleaner 200 to the coupling surface 121.

Meanwhile, FIGS. 6 to 8B are views for explaining a fixing unit of the cleaner station according to the embodiment of the present disclosure.

A fixing unit 130 according to the present disclosure will be described below with reference to FIGS. 4 to 8B.

The cleaner station 100 according to the present disclosure may include the fixing unit 130. The fixing unit 130 may be disposed on the sidewall 124. In addition, the fixing unit 130 may be disposed on a back surface to the coupling surface 121. The fixing unit 130 may fix the first cleaner 200 coupled to the coupling surface 121. Specifically, the fixing unit 130 may fix the dust bin 220 and the battery housing 230 of the first cleaner 200 coupled to the coupling surface 121.

The fixing unit 130 may include the fixing members 131 configured to fix the dust bin 220 and the battery housing 230 of the first cleaner 200, and a fixing drive part 133 configured to operate the fixing members 131. In addition, the fixing unit 130 may further include fixing part gears 134 configured to transmit power from the fixing drive part 133 to the fixing members 131, and fixing part links 135 configured to convert rotational motions of the fixing part gears 134 into reciprocating motions of the fixing members 131. Further, the fixing unit 13 may further include a fixing part housing 132 configured to accommodate the fixing drive part 133 and the fixing part gears 134.

The fixing members 131 may be disposed on the sidewall 124 of the coupling part 120 and provided on the sidewall 124 so as to reciprocate in order to fix the dust bin 220. Specifically, the fixing members 131 may be accommodated in the fixing member entrance holes 127.

The fixing members 131 may be disposed at both sides of the coupling part 120, respectively. For example, a pair of two fixing members 131 may be symmetrically disposed with respect to the coupling surface 121.

Specifically, the fixing member 131 may include a link coupling portion 131*a*, a movable panel 131*b*, and a movable sealer 131*c*. In this case, the link coupling portion 131*a* may be disposed at one side of the movable panel 131*b*, and the movable sealer 131*c* may be disposed at the other side of the movable panel 131*b*.

The link coupling portion 131*a* is disposed at one side of the movable panel 131*b* and coupled to the fixing part link 135. For example, the link coupling portion 131*a* may protrude in a cylindrical shape or a circular pin shape from a connection projection 131*bb* formed by bending and extending one end of the movable panel 131*b*. Therefore, the link coupling portion 131*a* may be rotatably inserted and coupled into one end of the fixing part link 135.

The movable panel 131*b* may be connected to the link coupling portion 131*a* and provided to be reciprocally movable from the sidewall 124 toward the dust bin 220 by the operation of the fixing drive part 133. For example, the movable panel 131*b* may be provided to be rectilinearly and reciprocally movable along a guide frame 131*d*.

Specifically, one side of the movable panel 131*b* may be disposed to be accommodated in a space in the first outer wall surface 112*a*, and the other side of the movable panel 131*b* may be disposed to be exposed from the sidewall 124.

The movable panel 131*b* may include a panel main body 131*ba*, the connection projection 131*bb*, a first pressing portion 131*bc*, and a second pressing portion 131*bd*. For example, the panel main body 131*ba* may be formed in the form of a flat plate. In addition, the connection projection 131*bb* may be disposed at one end of the panel main body 131*ba*. Further, the first pressing portion 131*bc* may be formed at the other end of the panel main body 131*ba*.

The connection projection 131*bb* may be formed by bending and extending one end of the panel main body 131*ba* toward the fixing drive part 131. The link coupling portion 131*a* may protrude and extend from the tip of the connection projection 131*bb*.

The connection projection 131*bb* may have a frame through hole that may be penetrated by the guide frame 131*d*. For example, the frame through hole may be formed in a shape similar to an 'I' shape.

The first pressing portion 131*bc* is formed at the other end of the panel main body 131*ba* and formed in a shape corresponding to the shape of the dust bin 220 in order to seal the dust bin 220. For example, the first pressing portion 131*bc* may be formed in a shape capable of surrounding a cylindrical shape. That is, the first pressing portion 131*bc* may mean an end portion having a concave arc shape and formed at the other side of the panel main body 131*ba*.

The second pressing portion 131*bd* may be connected to the first pressing portion 131*bc* and formed in a shape corresponding to the shape of the battery housing 230 in order to seal the battery housing 230. For example, the second pressing portion 131*bd* may be formed in a shape capable of pressing the battery housing 230. That is, the second pressing portion 131*bd* may mean an end portion having a straight shape and formed at the other side of the panel main body 131*ba*.

The movable sealer 131*c* may be disposed on a tip in the reciprocation direction of the movable panel 131*b* and may seal the dust bin 220. Specifically, the movable sealer 131*c* may be coupled to the first pressing portion 131*bc* and may seal a space between the dust bin 220 and the first pressing portion 131*bc* when the first pressing portion 131*bc* surrounds and presses the dust bin 220. In addition, the movable sealer 131*c* may be coupled to the second pressing portion 131*bd* and may seal a space between the battery housing 230 and the second pressing portion 131*bd* when the second pressing portion 131*bd* surrounds and presses the battery housing 230.

The fixing unit 130 may further include the guide frames 131*d* coupled to the housing 110 and configured to penetrate the movable panels 131*b* and guide the movements of the fixing members 131. For example, the guide frame 131*d* may be a frame having an 'I' shape that penetrates the connection projection 131*bb*. With this configuration, the movable panel 131*b* may rectilinearly reciprocate along the guide frame 131*d*.

The fixing part housing 132 may be disposed in the housing 110. For example, the fixing part housing 132 may be disposed on the back surface to the coupling surface 121.

The fixing part housing 132 may have therein a space capable of accommodating the fixing part gears 134. Further, the fixing part housing 132 may accommodate the fixing drive part 133.

The fixing part housing 132 may include a first fixing part housing 132*a*, a second fixing part housing 132*b*, link guide holes 132*c*, and a motor accommodation portion 132*d*.

The first fixing part housing 132*a* and the second fixing part housing 132*b* are coupled to each other to define the space capable of accommodating the fixing part gears 134 therein.

For example, the first fixing part housing 132*a* may be disposed in a direction toward the outside of the cleaner station 100, and the second fixing part housing 132*b* may be disposed in a direction toward the inside of the cleaner station 100. That is, the first fixing part housing 132*a* may be disposed in a direction toward the coupling surface 121, and the second fixing part housing 132*b* may be disposed in a direction toward the second outer wall surface 112*b*.

The link guide holes 132*c* may be formed in the first fixing part housing 132*a*. The link guide holes 132*c* may mean holes formed to guide movement routes of the fixing part link 135. For example, the link guide hole 132*c* may mean an arc-shaped hole formed in a circumferential direction about a rotary shaft of the fixing part gear 134.

Two link guide holes 132*c* may be formed to guide the pair of fixing part links 135 for moving the pair of fixing members 132. In addition, the two link guide holes 132*c* may be symmetrically formed.

The motor accommodation portion 132*d* may be provided to accommodate the fixing drive part 133. For example, the motor accommodation portion 132*d* may protrude in a cylindrical shape from the first fixing part housing 132*a* in order to accommodate the fixing drive part 133 therein.

The fixing drive part 133 may provide power for moving the fixing members 131. In the embodiment of the present disclosure, an example in which the fixing drive part 133 is an electric motor is described, but the present disclosure is not limited thereto.

Specifically, the fixing drive part 133 may rotate the fixing part gears 134 in a forward direction or a reverse direction. In this case, the forward direction may mean a direction in which the fixing member 131 is moved from the sidewall 124 to press the dust bin 220. In addition, the reverse direction may mean a direction in which the fixing member 131 is moved to the inside of the sidewall 124 from a position at which the fixing member 131 presses the dust bin 220. The forward direction may be opposite to the reverse direction.

The fixing part gears 134 may be coupled to the fixing drive part 133 and may move the fixing members 131 using power from the fixing drive part 133.

The fixing part gears 134 may include a driving gear 134*a*, a connection gear 134*b*, a first link rotating gear 134*c*, and a second link rotating gear 134*d*.

A shaft of the fixing drive part 133 may be inserted and coupled into the driving gear 134*a*. For example, the shaft of the fixing drive part 133 may be inserted and fixedly coupled into the driving gear 134*a*. As another example, the driving gear 134*a* may be formed integrally with the shaft of the fixing drive part 133.

The connection gear 134*b* may engage with the driving gear 134*a* and the first link rotating gear 134*c*.

The other end of the fixing part link 135 is rotatably coupled to the first link rotating gear 134*c*, and the first link rotating gear 134*c* may transmit rotational force transmitted from the driving gear 134*a* to the fixing part link 135.

The first link rotating gear 134*c* may include a rotary shaft 134*ca*, a rotation surface 134*cb*, gear teeth 134*cc*, and a link fastening portion 134*cd*.

The rotary shaft 134*ca* may be coupled to and supported by the first fixing part housing 132*a* and the second fixing part housing 132*b*. The rotation surface 134*cb* may be formed in a circular plate shape having a predetermined thickness about the rotary shaft 134*ca*. The gear teeth 134*cc* may be formed on an outer circumferential surface of the rotation surface 134*cb* and may engage with the connection gear 134*b*. Further, the gear teeth 134*cc* may engage with the second link rotating gear 134*d*. With this configuration, the first link rotating gear 134*c* may receive power from the fixing drive part 133 through the driving gear 134*a* and the connection gear 134*b* and transmit the power to the second link rotating gear 134*d*.

The link fastening portion 134*cd* may protrude and extend in a cylindrical shape or a circular pin shape in an axial direction from the rotation surface 134*cb*. The link fastening portion 134*cd* may be rotatably coupled to the other end of the fixing part link 135. For example, the link fastening portion 134*cd* may penetrate the link guide hole 132*c* and may be coupled to the other end of the fixing part link 135. With this configuration, the first link rotating gear 134*c* may be rotated by power from the fixing drive part 133, the fixing part link 135 may be rotated and rectilinearly moved by the rotation of the first link rotating gear 134*c*, and consequently, the fixing member 131 may be moved to fix or release the dust bin 220.

The second link rotating gear 134*d* may engage with the first link rotating gear 134*c* and rotate in a direction opposite to the rotation direction of the first link rotating gear 134*c*.

The other end of the fixing part link 135 is rotatably coupled to the second link rotating gear 134*d*, and the second link rotating gear 134*d* may transmit the rotational force transmitted from the driving gear 134*a* to the fixing part link 135.

The second link rotating gear 134*d* may include a rotary shaft 134*da*, a rotation surface 134*db*, gear teeth 134*dc*, and a link fastening portion 134*dd*.

The rotary shaft 134*da* may be coupled to and supported by the first fixing part housing 132*a* and the second fixing part housing 132*b*. The rotation surface 134*db* may be formed in a circular plate shape having a predetermined thickness about the rotary shaft 134*da*. The gear teeth 134*dc* may be formed on an outer circumferential surface of the rotation surface 134*db* and may engage with the first link rotating gear 134*c*. With this configuration, the second link rotating gear 134*d* may receive the power from the fixing drive part 133 through the driving gear 134*a*, the connection gear 134*b*, and the first link rotating gear 134*c*.

The link fastening portion 134*dd* may protrude and extend in a cylindrical shape or a circular pin shape in an axial direction from the rotation surface 134*db*. The link fastening portion 134*dd* may be rotatably coupled to the other end of the fixing part link 135. For example, the link fastening portion 134*dd* may penetrate the link guide hole 132*c* and may be coupled to the other end of the fixing part link 135. With this configuration, the second link rotating gear 134*d* may be rotated by power from the fixing drive part 133, the fixing part link 135 may be rotated and rectilinearly moved by the rotation of the second link rotating gear 134*d*, and consequently, the fixing member 131 may be moved to fix or release the dust bin 220.

The fixing part links 135 may link the fixing part gears 134 and the fixing members 131 and convert the rotations of the fixing part gears 134 into the reciprocation movements of the fixing members 131.

One end of the fixing part link 135 may be coupled to the link coupling portion 131*a* of the fixing member 131, and the other end of the fixing part link 135 may be coupled to the link fastening portion 134*cd* or 134*dd* of the fixing part gear 134.

The fixing part link 135 may include a link main body 135*a*, a first link connecting portion 135*b*, and a second link connecting portion 135*c*.

For example, the link main body 135*a* may be formed in the form of a frame with a bent central portion. This is to improve efficiency in transmitting power by changing an angle at which a force is transmitted.

The first link connecting portion 135*b* may be disposed at one end of the link main body 135*a*, and the second link connecting portion 135*c* may be disposed at the other end of the link main body 135*a*. The first link connecting portion 135*b* may be protrude in a cylindrical shape from one end of the link main body 135*a*. The first link connecting portion 135*b* may have a hole into which the link coupling portion 131*a* may be inserted and coupled. The second link connecting portion 135*c* may protrude in a cylindrical shape from the other end of the link main body 135*a*. In this case, a height by which the second link connecting portion 135*c* protrudes may be greater than a height by which the first link connecting portion 135*b* protrudes. This is to enable the link fastening portions 134*cd* and 134*dd* of the fixing part gears 134 to be accommodated in the link guide holes 132*c* and move along the link guide holes 132*c*, and to support the link fastening portions 134*cd* and 134*dd* when the link fastening portions 134*cd* and 134*dd* rotate. The second link connecting portion 135*c* may have a hole into which the link fastening portion 134*cd* or 134*dd* may be inserted and coupled.

A stationary sealer 136 may be disposed on the dust bin guide surface 122 so as to seal the dust bin 220 when the cleaner 200 is coupled. With this configuration, when the dust bin 220 of the cleaner 200 is coupled, the cleaner 200 may press the stationary sealer 136 by its own weight, such that the dust bin 220 and the dust bin guide surface 122 may be sealed.

The stationary sealer 136 may be disposed in an imaginary extension line of the movable sealer 131*c*. With this configuration, when the fixing drive part 133 operates and the fixing members 131 press the dust bin 220, a circumference of the dust bin 220 at the same height may be sealed. That is, the stationary sealer 136 and the movable sealers 131*c* may seal outer circumferential surfaces of the dust bin 220 disposed on concentric circles.

According to the embodiment, the stationary sealer 136 may be disposed on the dust bin guide surface 122 and formed in the form of a bent line corresponding to an arrangement of a cover opening unit 150 to be described below.

Therefore, when the main body 210 of the first cleaner 200 is disposed on the coupling part 120, the fixing unit 130 may fix the main body 210 of the first cleaner 200. Specifically, when the coupling sensor 125 detects that the main body 210 of the first cleaner 200 is coupled to the coupling part 120 of the cleaner station 100, the fixing drive part 133 may move the fixing members 131 to fix the main body 210 of the first cleaner 200.

The fixing unit 130 may further include fixing detecting parts 137 capable of detecting the movements of the fixing members 131.

The fixing detecting parts 137 may be provided in the housing 100 and may detect whether the dust bin 220 is fixed.

For example, the fixing detecting parts 137 may be disposed at both ends in a rotational region of the fixing part links 135, respectively. That is, in the rotational region of the fixing part links 135, a first fixing detecting part 137*a* may be disposed at an end portion in a direction in which the fixing members 131 are pushed toward the dust bin 220. In addition, in the rotational region of the fixing part links 135, a second fixing detecting part 137*b* may be disposed at an end portion in a direction in which the fixing members 131 are moved away from the dust bin 220. Otherwise, as another example, the fixing detecting parts 137 may be disposed at both ends of a rectilinear movement region of the fixing members 131, respectively.

Therefore, when the fixing part link 135 is moved to a predetermined position (hereinafter, also referred to as a 'dust bin fixing position FP1') at which the first fixing detecting part 137*a* is disposed or when the fixing member 131 is rectilinearly moved to a predetermined position, the fixing detecting part 137 may detect the movement and transmit a signal indicating that the dust bin 220 is fixed. In addition, when the fixing part link 135 is moved to a predetermined position (hereinafter, also referred to as a 'dust bin releasing position FP2') at which the second fixing detecting part 137*b* is disposed or when the fixing member 131 is rectilinearly moved to a predetermined position, the fixing detecting part 137 may detect the movement and transmit a signal indicating that the dust bin 220 is released.

The fixing detecting part 137 may include a contact sensor. For example, the fixing detecting part 137 may include a micro-switch.

Meanwhile, the fixing detecting part 137 may include a non-contact sensor. For example, the fixing detecting part 137 may include an infrared (IR) sensor.

A method of controlling the fixing unit 130 will be described below together with a description of a control unit 400 of the cleaner station 100 according to the present disclosure.

Figure 8A:
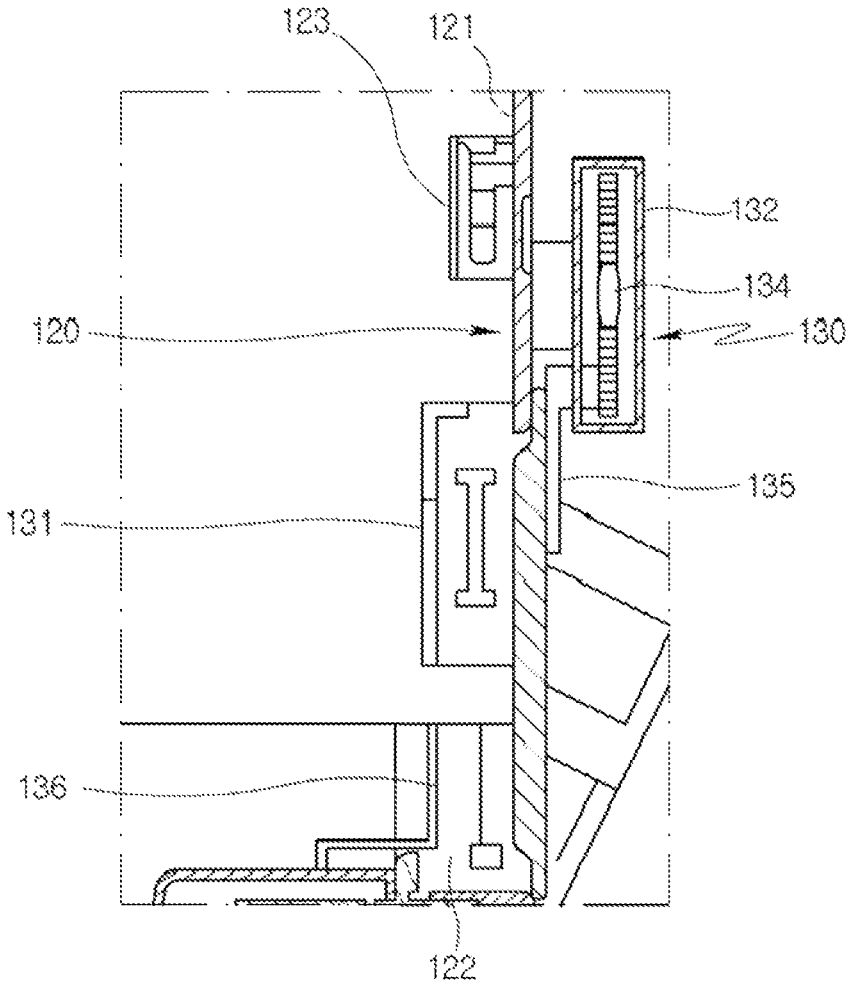
FIG. 8A is a cross-sectional view for explaining the fixing unit of the cleaner station according to the embodiment of the present disclosure.
Figure 8B:
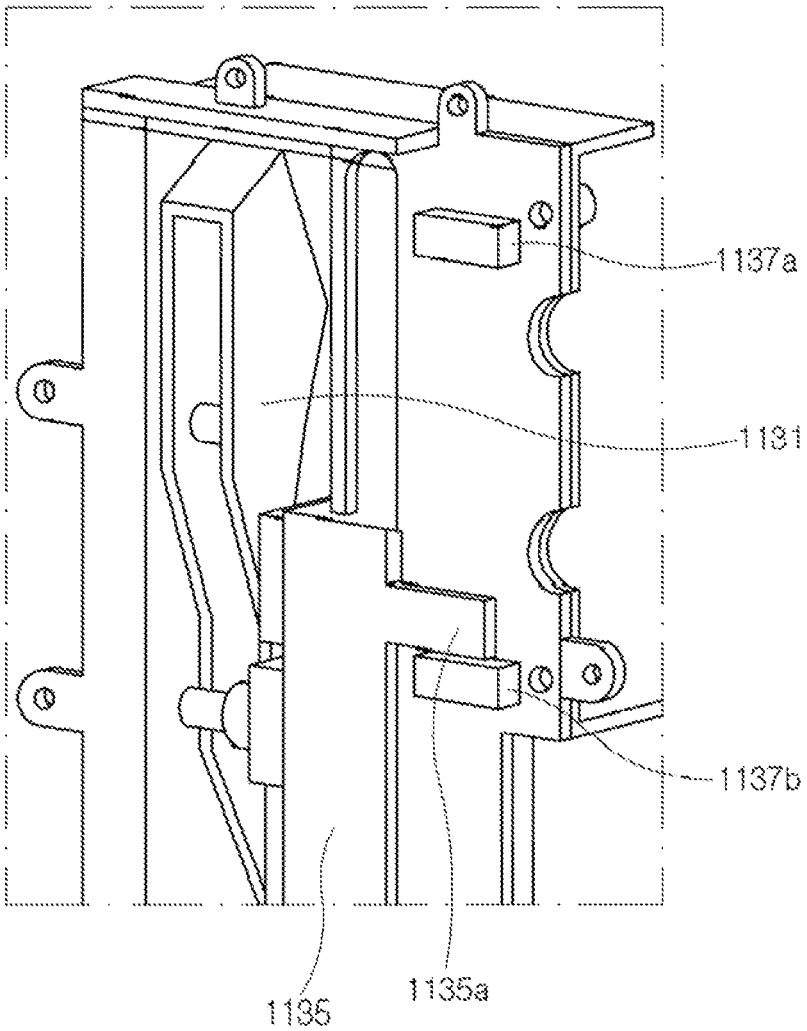
FIG. 8B is a view for explaining a fixing unit according to another embodiment of the present disclosure.

Meanwhile, FIG. 8A illustrates another embodiment of a fixing unit 1130 of the cleaner station according to the present disclosure.

In order to avoid a repeated description, the contents related to the fixing unit 130 according to the embodiment of the present disclosure may be used to describe other components except for the components particularly mentioned in the present embodiment.

In the present embodiment, a fixing member 1131 may fix the dust bin 220 and the battery housing 230 by an upward/downward rectilinear movement of a fixing part frame 1135.

That is, when the fixing part frame 1135 is rectilinearly moved upward by an operation of a fixing drive part 1133, the fixing member 1131 is moved in the sidewall 124 toward the dust bin 220 by being guided by the fixing part frame 1135.

In this case, fixing detecting parts 1137 may be disposed at both ends in a movement region of the fixing part frame 1135, respectively. That is, a first fixing detecting part 1137*a* may be disposed at an upper end in the movement region of the fixing part frame 1135. In addition, a second fixing detecting part 1137*b* may be disposed at a lower end in the movement region of the fixing part frame 1135.

Therefore, when the fixing part frame 1135 is moved to a predetermined position (hereinafter, also referred to as the 'dust bin fixing position FP1') at which the first fixing detecting part 1137*a* is disposed, a sensor touch bar 1135*a* protruding from the fixing part frame 1135 pushes the first fixing detecting part 1137*a*, and the first fixing detecting part 1137*a* may transmit a signal indicating that the dust bin 220 is fixed. In addition, when the fixing part frame 1135 is moved to a predetermined position (hereinafter, also referred to as the 'dust bin releasing position FP2') at which the second fixing detecting part 1137*b* is disposed, the sensor touch bar 1135*a* pushes the second fixing detecting part 1137*b*, and the second fixing detecting part 1137*b* may transmit a signal indicating that the dust bin 220 is released.

Therefore, the amount of vibration and impact, which occur when the discharge cover 222 of the main body 210 of the fixed first cleaner 200 is separated from the dust bin 220, is increased, and as a result, it is possible to improve efficiency in moving the dust stored in the dust bin 220 to the dust collecting part 170 of the cleaner station 100. That is, it is possible to improve the suction force of the cleaner by preventing the residual dust from remaining in the dust bin. Further, it is possible to remove an offensive odor caused by the residual dust by preventing the residual dust from remaining in the dust bin.

Figure 9:
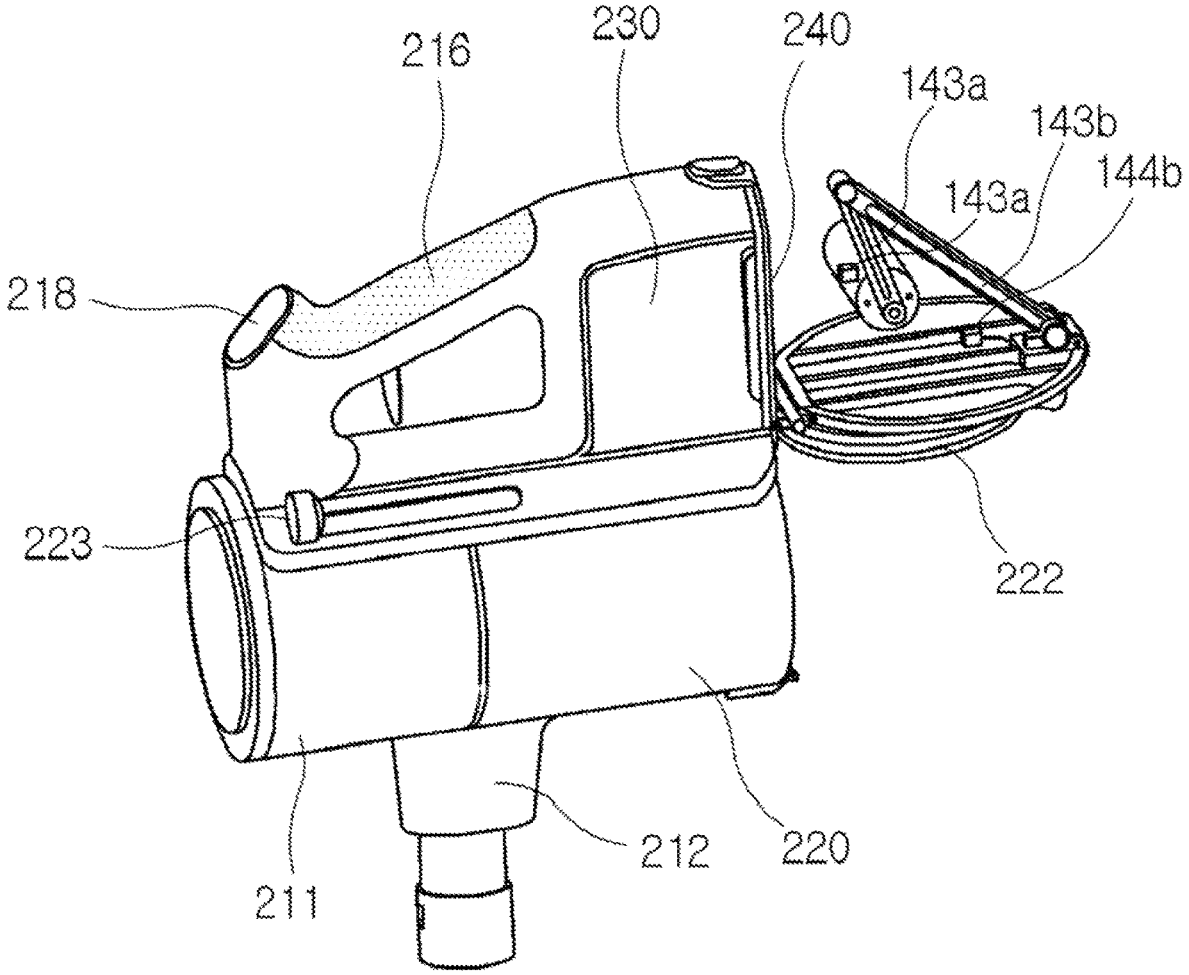
FIG. 9 is a view for explaining a relationship between the first cleaner and the door unit in the cleaner station according to the embodiment of the present disclosure.

Meanwhile, FIG. 9 is a view for explaining a relationship between the first cleaner and the door unit in the cleaner station according to the embodiment of the present disclosure.

A door unit 140 according to the present disclosure will be described below with reference to FIGS. 4, 5, and 9.

The cleaner station 100 according to the present disclosure may include the door unit 140. The door unit 140 may be configured to open or close the dust passage hole 121*a*.

The door unit 140 may include a door 141, a door motor 142, and a door arm 143.

The door 141 may be hingedly coupled to the coupling surface 121 and may open or close the dust passage hole 121*a*. The door 141 may include a door main body 141*a*, a hinge part 141*b*, and an arm coupling part 141*c*.

The door main body 141*a* may be formed in a shape capable of blocking the dust passage hole 121*a*. For example, the door main body 141*a* may be formed in a shape similar to a circular plate shape. On the basis of a state in which the door main body 141*a* blocks the dust passage hole 121*a*, the hinge part 141*b* may be disposed at an upper side of the door main body 141*a*, and the arm coupling part 141*c* may be disposed at a lower side of the door main body 141*a*.

The door main body 141*a* may be formed in a shape capable of sealing the dust passage hole 121*a*. For example, an outer surface of the door main body 141*a*, which is exposed to the outside of the cleaner station 100, is formed to have a diameter corresponding to a diameter of the dust passage hole 121*a*, and an inner surface of the door main body 141*a*, which is disposed in the cleaner station 100, is formed to have a diameter greater than the diameter of the dust passage hole 121*a*. In addition, a level difference may be defined between the outer surface and the inner surface. Meanwhile, one or more reinforcing ribs may protrude from the inner surface in order to connect the hinge part 141*b* and the arm coupling part 141*c* and reinforce a supporting force of the door main body 141*a*.

The hinge part 141*b* may be a means by which the door 141 is hingedly coupled to the coupling surface 121. The hinge part 141*b* may be disposed at an upper end of the door main body 141*a* and coupled to the coupling surface 121.

The arm coupling part 141*c* may be a means to which the door arm 143 is rotatably coupled. The arm coupling part 141*c* may be disposed at a lower side of the inner surface, and the door arm 143 may be rotatably coupled to the arm coupling part 141*c*.

With this configuration, when the door arm 143 pulls the door main body 141*a* in the state in which the door 141 closes the dust passage hole 121*a*, the door main body 141*a* is rotated about the hinge part 141*b* toward the inside of the cleaner station 100, such that the dust passage hole 121*a* may be opened. Meanwhile, when the door arm 143 pushes the door main body 141*a* in the state in which the dust passage hole 121*a* is opened, the door main body 141*a* is rotated about the hinge part 141*b* toward the outside of the cleaner station 100, such that the dust passage hole 121*a* may be closed.

The door motor 142 may provide power for rotating the door 141. Specifically, the door motor 142 may rotate the door arm 143 in a forward direction or a reverse direction. In this case, the forward direction may mean a direction in which the door arm 143 pulls the door 141. Therefore, when the door arm 143 is rotated in the forward direction, the dust passage hole 121*a* may be opened. In addition, the reverse direction may mean a direction in which the door arm 143 pushes the door 141. Therefore, when the door arm 143 is rotated in the reverse direction, at least a part of the dust passage hole 121*a* may be closed. The forward direction may be opposite to the reverse direction.

The door arm 143 may connect the door 141 and the door motor 142 and open or close the door 141 using the power generated from the door motor 142.

For example, the door arm 143 may include a first door arm 143*a* and a second door arm 143*b*. One end of the first door arm 143*a* may be coupled to the door motor 142. The first door arm 143*a* may be rotated by the power of the door motor 142. The other end of the first door arm 143*a* may be rotatably coupled to the second door arm 143*b*. The first door arm 143*a* may transmit a force transmitted from the door motor 142 to the second door arm 143*b*. One end of the second door arm 143*b* may be coupled to the first door arm 143*a*. The other end of the second door arm 143*b* may be coupled to the door 141. The second door arm 143*b* may open or close the dust passage hole 121*a* by pushing or pulling the door 141.

The door unit 140 may further include door opening/closing detecting parts 144. The door opening/closing detecting parts 144 may be provided in the housing 100 and may detect whether the door 141 is in an opened state.

For example, the door opening/closing detecting parts 144 may be disposed at both ends in a rotation region of the door arm 143, respectively. As another example, the door opening/closing detecting parts 144 may be disposed at both ends in a movement region of the door 141, respectively.

Therefore, when the door arm 143 is moved to a predetermined opened position DP1 or when the door 141 is opened to a predetermined position, the door opening/closing detecting parts 144 may detect that the door is opened. In addition, when the door arm 143 is moved to a predetermined closed position DP2 or when the door 141 is moved to a predetermined position, the door opening/closing detecting parts 144 may detect that the door is closed.

The door opening/closing detecting parts 144 may transmit a signal indicating that the door is opened and transmit a signal indicating that the door is closed.

The door opening/closing detecting part 144 may include a contact sensor. For example, the door opening/closing detecting part 144 may include a micro-switch.

Meanwhile, the door opening/closing detecting part 144 may also include a non-contact sensor. For example, the door opening/closing detecting part 144 may include an infrared (IR) sensor.

With this configuration, the door unit 140 may selectively open or close at least a part of the coupling surface 121, thereby allowing the outside of the first outer wall surface 112*a* to communicate with the first cleaner flow path part 181 and/or the dust collecting part 170.

The door unit 140 may be opened when the discharge cover 222 of the first cleaner 200 is opened. In addition, when the door unit 140 is closed, the discharge cover 222 of the first cleaner 200 may also be closed.

When the dust in the dust bin 220 of the first cleaner 200 is removed, the door motor 142 may rotate the door 141, thereby coupling the discharge cover 222 to the dust bin main body 221. Specifically, the door motor 142 may rotate the door 141 to rotate the door 142 about the hinge part 141*b*, and the door 142 rotated about the hinge part 141*b* may push the discharge cover 222 toward the dust bin main body 221.

Figure 10:
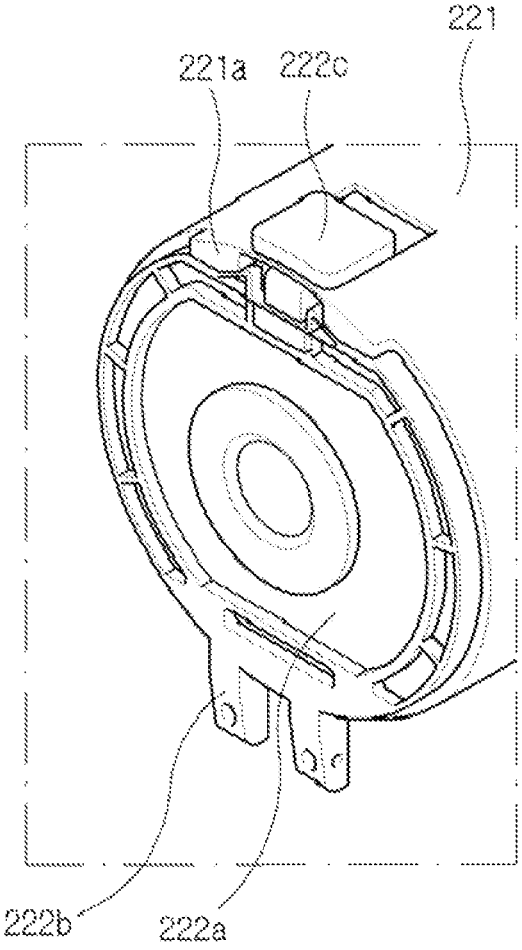
FIG. 10 is a view for explaining a lower side of a dust bin of the first cleaner according to the embodiment of the present disclosure.
Figure 11:
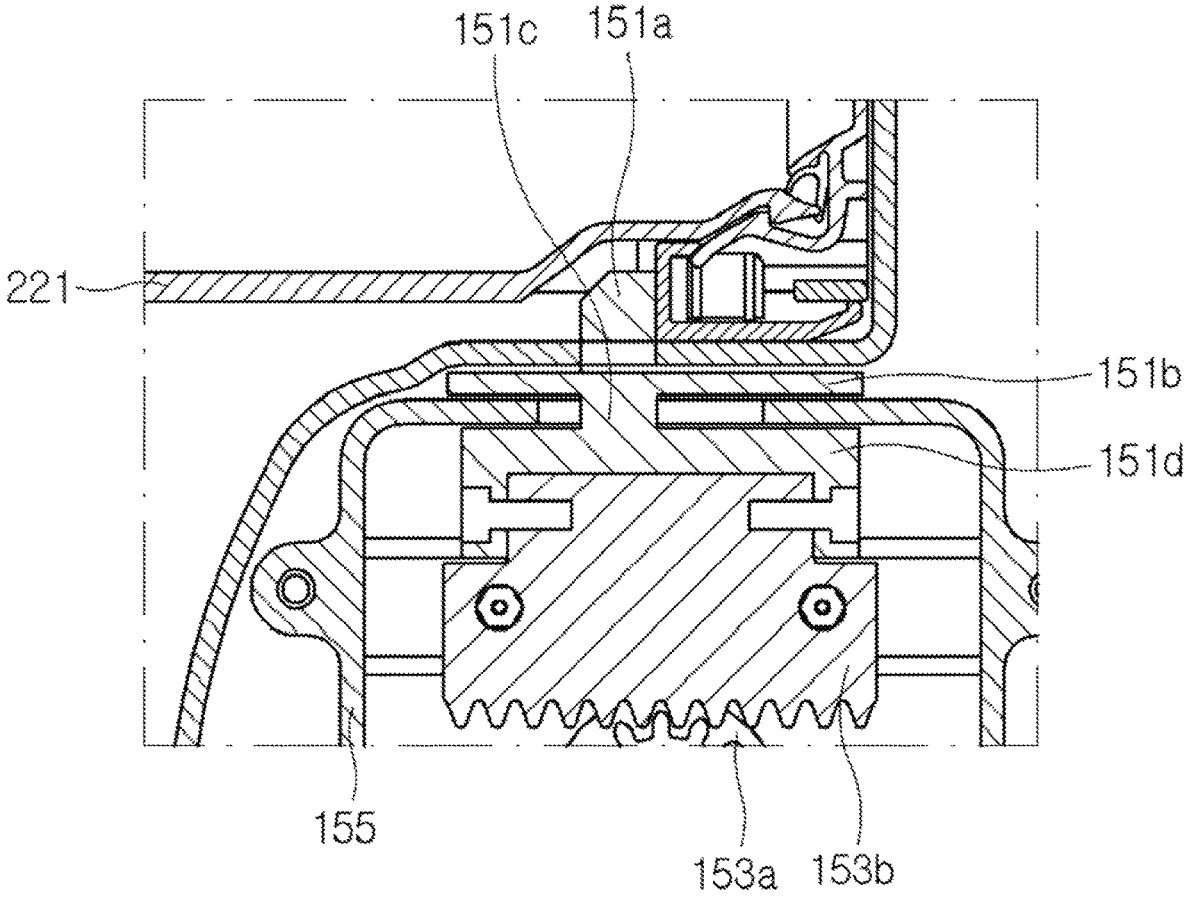
FIG. 11 is a view for explaining a relationship between the first cleaner and the cover opening unit in the cleaner station according to the embodiment of the present disclosure.
Figure 12:
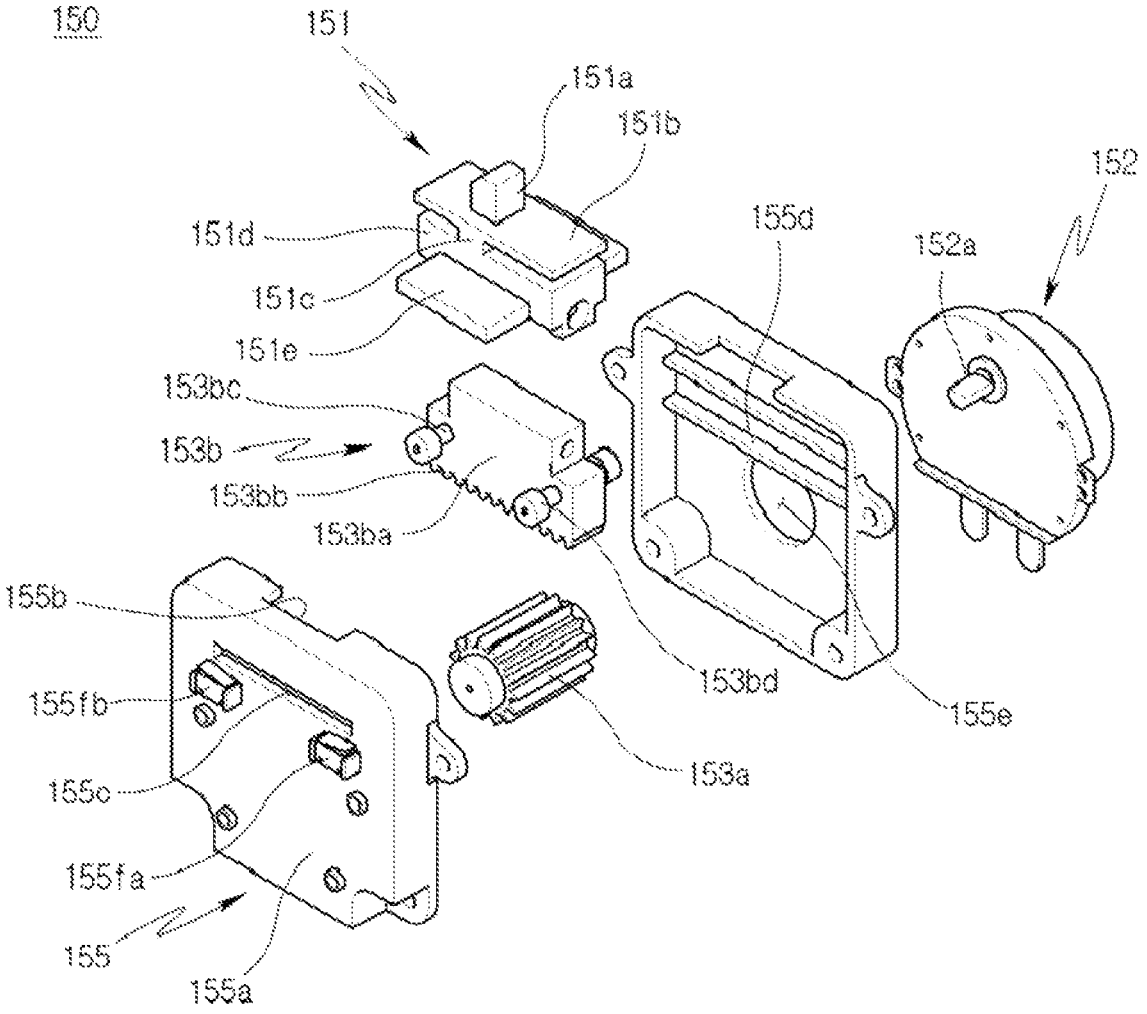
FIG. 12 is a perspective view for explaining the cover opening unit of the cleaner station according to the embodiment of the present disclosure.

FIG. 10 is a view for explaining the lower surface (bottom surface) of the dust bin of the first cleaner according to the embodiment of the present disclosure, FIG. 11 is a view for explaining a relationship between the first cleaner and the cover opening unit in the cleaner station according to the embodiment of the present disclosure, and FIG. 12 is a perspective view for explaining the cover opening unit of the cleaner station according to the embodiment of the present disclosure.

The cover opening unit 150 according to the present disclosure will be described below with reference to FIGS. 4, 5, and 10 to 12.

The cleaner station 100 according to the present disclosure may include the cover opening unit 150. The cover opening unit 150 may be disposed on the coupling part 120 and may open the discharge cover 222 of the first cleaner 200.

The cover opening unit 150 may include a push protrusion 151, a cover opening drive part 152, cover opening gears 153, a support plate 154, and a gear box 155.

The push protrusion 151 may move to press the coupling lever 222*c* when the first cleaner 200 is coupled.

The push protrusion 151 may be disposed on the dust bin guide surface 122. Specifically, a protrusion moving hole may be formed in the dust bin guide surface 122, and the push protrusion 151 may be exposed to the outside by passing through the protrusion moving hole.

When the first cleaner 100 is coupled, the push protrusion 151 may be disposed at a position at which the push protrusion 151 may push the coupling lever 222*c*. That is, the coupling lever 222*c* may be disposed on the protrusion moving hole. In addition, the coupling lever 222*c* may be disposed in a movement region of the push protrusion 151.

The push protrusion 151 may rectilinearly reciprocate to press the coupling lever 222*c*. Specifically, the push protrusion 151 may be coupled to the gear box 155, such that the rectilinear movement of the push protrusion 151 may be guided. The push protrusion 151 may be coupled to the cover opening gears 153 and moved together with the cover opening gears 153 by the movements of the cover opening gears 153.

For example, the push protrusion 151 may include a protrusion portion 151*a*, a protrusion support plate 151*b*, a connection portion 151*c*, a gear coupling block 151*d*, and guide frames 151*e*.

The protrusion portion 151*a* may be provided to push the coupling lever 222*c*. The protrusion portion 151*a* may be formed in a protrusion shape similar to a hook shape, a right-angled triangular shape, or a trapezoidal shape. The protrusion support plate 151*b* may be connected to the protrusion portion 151*a* and formed in the form of a flat plate for supporting the protrusion portion 151*a*.

The protrusion support plate 151*b* may be provided to be movable along an upper surface of the gear box 155. The connection portion 151*c* may connect the protrusion support plate 151*b* and the gear coupling block 151*d*. The connection portion 151*c* may be formed to have a narrower width than the protrusion support plate 151*b* and the gear coupling block 151*d*.

The connection portion 151*c* may be disposed to penetrate a protrusion through hole 155*b* formed in the gear box 155. The gear coupling block 151*d* may be coupled to the cover opening gears 153. The gear coupling block 151*d* may be fixedly coupled to the cover opening gears 153 using a member such as a screw or a piece.

The gear coupling block 151*d* may be accommodated in the gear box 155 and may be rectilinearly reciprocated in the gear box 155 by the movement of the cover opening gears 153. The guide frames 151*e* may protrude and extend from two lateral surfaces of the gear coupling block 151*d*, respectively. The guide frames 151*e* may be protrude and extend in a quadrangular column shape from the gear coupling block 151*d*.

The guide frame 151*e* may be disposed to penetrate a guide hole 155*c* formed in the gear box 155. Therefore, when the gear coupling block 151*d* rectilinearly moves, the guide frame 151*e* may rectilinearly reciprocate along the guide hole 155*c*.

The cover opening drive part 152 may provide power for moving the push protrusion 151. In the embodiment of the present disclosure, an example in which the cover opening drive part 152 is an electric motor is described, but the present disclosure is not limited thereto. Specifically, the cover opening drive part 152 may rotate a motor shaft 152*a* in a forward direction or a reverse direction. In this case, the forward direction may mean a direction in which the push protrusion 151 pushes the coupling lever 222*c*. In addition, the reverse direction may mean a direction in which the push protrusion 151, which has pushed the coupling lever 222*c*, returns back to an original position. The forward direction may be opposite to the reverse direction.

The cover opening drive part 152 may be disposed outside the gear box 155. The motor shaft 152*a* of the cover opening drive part 152 may penetrate a motor through hole 155*e* of the gear box 155 and may be coupled to the cover opening gears 153. For example, the motor shaft 152*a* may be coupled to an opening driving gear 153*a* and rotated together with the opening driving gear 153*a*.

The cover opening gears 153 may be coupled to the cover opening drive part 152 and may move the push protrusion 151 using the power from the cover opening drive part 152. Specifically, the cover opening gears 153 may be accommodated in the gear box 155. The cover opening gears 153 may be coupled to the cover opening drive part 152 and supplied with the power. The cover opening gears 153 may be coupled to the push protrusion 151 to move the push protrusion 151.

The cover opening gears 153 may include the opening driving gear 153*a* and an opening driven gear 153*b*. Specifically, the shaft 152*a* of the cover opening drive part 152 is inserted and coupled into the opening driving gear 153*a*, such that the opening driving gear 153*a* may receive rotational power from the cover opening drive part 152.

The opening driven gear 153*b* may engage with the opening driving gear 153*a* and may be coupled to the gear coupling block 151*d* of the push protrusion 151, thereby moving the push protrusion 151. For example, the opening driven gear 153*b* may be formed in the form of a rack gear so as to engage with the opening driving gear 153*a* formed in the form of a pinion gear. The opening driven gear 153*b* may include a body portion 153*ba* coupled to the gear coupling block 151*d*. In addition, the opening driven gear 153*b* may include a gear portion 153*bb* formed at a lower side of the body portion 153*ba* and configured to engage with the opening driving gear 153*a*. Further, the opening driven gear 153*b* may include guide shafts 153*bc* protruding from the two lateral surfaces of the body portion 153*ba*. In addition, the opening driven gear 153*b* may include gear wheels 153*bd* into which the guide shafts 153*bc* are inserted and coupled, and the gear wheels 153*bd* may rollably move along guide rails 155*d* formed in an inner surface of the gear box 155.

The support plate 154 may be provided to support one surface of the dust bin 220. Specifically, the support plate 154 may extend from the coupling surface 121. The support plate 154 may protrude and extend toward a center of the dust passage hole 121*a* from the coupling surface 121.

The support plate 154 may protrude and extend symmetrically from the coupling surface 121, but the present disclosure is not limited thereto, and the support plate 154 may have various shapes capable of supporting the lower extension portion 221*a* of the first cleaner 200 or the lower surface of the dust bin 220.

When the first cleaner 200 is coupled to the cleaner station 100, the lower surface of the dust bin 220 may be disposed in the dust passage hole 121*a*, and the support plate 154 may support the lower surface of the dust bin 220. The discharge cover 222 may be openably and closably provided at the lower side of the dust bin 220, and the dust bin 220 may include the cylindrical dust bin main body 221 and the extending lower extension portion 221*a*. In this case, the support plate 154 may be in contact with the lower extension portion 221*a* and may support the lower extension portion 221*a*.

With this configuration, the push protrusion 151 may push the coupling lever 222*c* of the discharge cover 222 in the state in which the support plate 154 supports the lower extension portion 221*a*. Therefore, the discharge cover 222 may be opened, and the dust passage hole 121*a* and the inside of the dust bin 220 may communicate with each other. That is, as the discharge cover 222 is opened, the flow path part 180 and the inside of the dust bin 220 may communicate with each other, and the cleaner station 100 and the first cleaner 200 may be coupled to each other to enable a flow of a fluid (coupling of the flow path).

The gear box 155 may be coupled to the inner surface of the housing 110 and disposed at the lower side of the coupling part 120 in the gravitational direction, and the cover opening gears 153 may be accommodated in the gear box 155. Specifically, the box main body 155*a* has a space capable of accommodating the cover opening gears 153, and the protrusion through hole 155*b*, which is penetrated by the connection portion 151*c* of the push protrusion 151, is formed in an upper surface of the box main body 155*a*. In addition, the guide hole 155*c* is formed in the form of a long hole in the lateral surface in a leftward/rightward direction of the box main body 155*a*, such that the guide frame 151*e* of the push protrusion 151 penetrates the guide hole 155*c*.

Meanwhile, the guide rails 155*d* may be formed on the inner surfaces at the lateral sides in the leftward/rightward direction of the box main body 155*a*. The guide rails 155*d* may support the opening driven gear 153*b* and guide the movement of the opening driven gear 153*b*. The motor through hole 155*e* may be formed in one surface of the gear box 155, and the shaft 152*a* of the cover opening drive part 152 may penetrate the motor through hole 155*e*. In addition, cover opening detecting parts 155*f* may be disposed on the lateral surface of the gear box 155.

The cover opening detecting part 155*f* may include a contact sensor. For example, the cover opening detecting part 155*f* may include a micro-switch. Meanwhile, the cover opening detecting part 155*f* may also include a non-contact sensor. For example, the cover opening detecting part 155*f* may include an infrared (IR) sensor. Therefore, the cover opening detecting part 155*f* may detect a position of the guide frame 151*e*, thereby detecting a position of the push protrusion 151.

The cover opening detecting parts 155*f* may be disposed at both ends of the guide hole 155*c* formed in the form of a long hole, respectively. Therefore, when the push protrusion 151 is moved to a position at which the push protrusion 151 may push the coupling lever 222*c* to open the discharge cover 222, the guide frame 151*e* may be positioned at a predetermined cover opened point CP1, and the cover opening detecting part 155*f* may detect that the discharge cover 222 is opened. In addition, when the push protrusion 151 returns back to an original position, the guide frame 151*e* may be positioned at a predetermined cover non-opened point CP2, and the cover opening detecting part 155*f* may detect that the push protrusion 151 has returned back to the original position.

With this configuration, the cover opening unit 150 may selectively open or close the lower portion of the dust bin 220 by separating the coupling lever 222*c* from the dust bin 220. In this case, the dust in the dust bin 220 may be captured into the dust collecting part 170 by the impact that occurs when the discharge cover 222 is separated from the dust bin 220.

Therefore, in the case in which the main body 210 of the first cleaner 200 is fixed to the coupling part 120, the cover opening drive part 152 may move the push protrusion 151 to separate the discharge cover 222 from the dust bin 220. When the discharge cover 222 is separated from the dust bin 220, the dust in the dust bin 220 may be captured into the dust collecting part 170.

Accordingly, according to the present disclosure, the cover opening unit 150 may open the dust bin 220 even though the user separately opens the discharge cover 222 of the first cleaner, and as a result, it is possible to improve convenience.

In addition, since the discharge cover 222 is opened in the state in which the first cleaner 200 is coupled to the cleaner station 100, it is possible to prevent the dust from scattering.

Figure 13A:
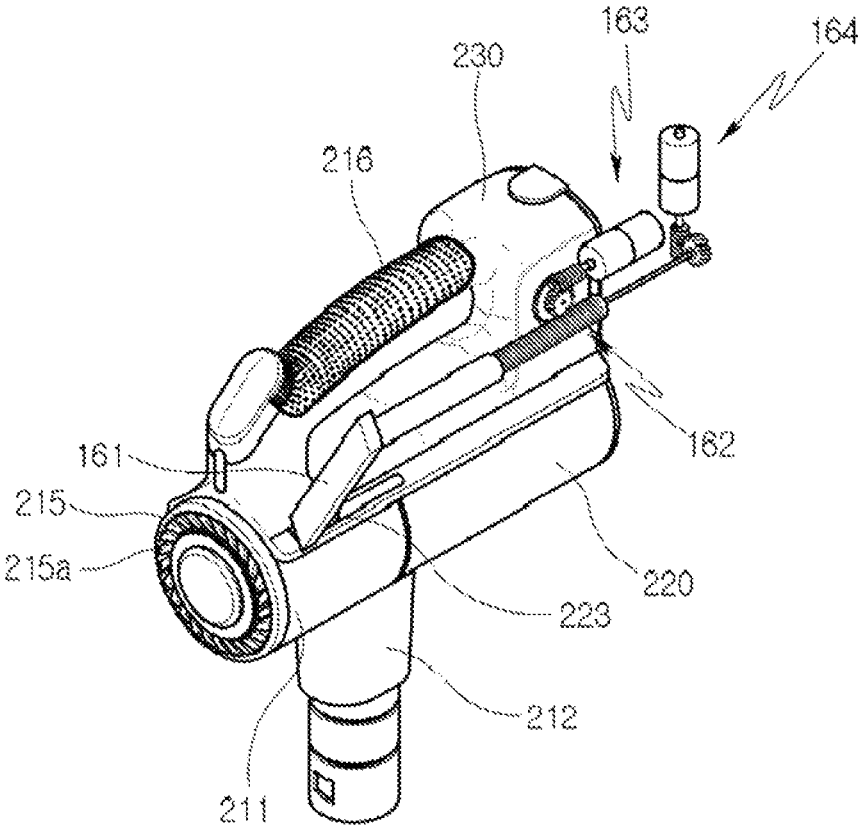
FIG. 13A is a view for explaining a relationship between the first cleaner and the lever pulling unit in the cleaner station according to the embodiment of the present disclosure.

Meanwhile, FIG. 13A is a view for explaining a relationship between the first cleaner and the lever pulling unit in the cleaner station according to the embodiment of the present disclosure.

The lever pulling unit 160 according to the present disclosure will be described below with reference to FIGS. 4, 5, 13A and 13B.

The cleaner station 100 according to the present disclosure may further include the lever pulling unit 160. The lever pulling unit 160 may be disposed on the first outer wall surface 112*a* of the housing 110. The lever pulling unit 160 may push the dust bin compression lever 223 of the first cleaner 200 to compress the dust in the dust bin 220.

Meanwhile, in the present embodiment, the cleaner station 100 is described as having the lever pulling unit 160, but the lever pulling unit 160 is not essential. The cleaner station 100 may be configured without having the lever pulling unit 160.

The lever pulling unit 160 may include a lever pulling arm 161, an arm gear 162, a stroke drive motor 163, a rotation drive motor 164, and arm movement detecting parts 165.

The lever pulling arm 161 is accommodated in the housing 110 and may be provided to be stroke-movable and rotatable. For example, the lever pulling arm 161 may be accommodated in an arm accommodating groove formed in the first outer wall surface 112*a*. In this case, when an imaginary cylindrical shape is defined with respect to a lower end of the arm accommodating groove, the dust bin compression lever 223 may be disposed in the imaginary cylindrical shape.

The lever pulling arm 161 may be provided to push the dust bin compression lever 223. The lever pulling arm 161 may be formed to correspond to a shape of the arm accommodating groove. For example, the lever pulling arm 161 may be formed in a shape similar to an elongated bar.

One surface of the lever pulling arm 161 may be formed to define a continuous surface together with the first outer wall surface 112*a* in the state in which the lever pulling arm 161 is accommodated in the arm accommodating groove. The arm gear 162 may be coupled to one side of the other surface of the lever pulling arm 161.

The arm gear 162 may be coupled to the lever pulling arm 161, the stroke drive motor 163, and the rotation drive motor 164. For example, the arm gear 162 may be formed to be similar to a kind of shaft. One end of the shaft of the arm gear 162 may be fixedly coupled to the lever pulling arm 161. The other end of the shaft of the arm gear 162 may be provided in the form of a worm wheel. Therefore, the other end of the shaft of the arm gear 162 is formed in the form of a worm gear and may engage with the rotation drive motor 164. The shaft of the arm gear 162 may be formed in the form of a cylindrical worm. The shaft of the arm gear 162 may be formed in the form of a worm gear and may engage with the stroke drive motor 163.

The stroke drive motor 163 may provide power for stroke-moving the lever pulling arm 161. The stroke drive motor 163 may rotate in a forward direction or a reverse direction. In this case, the forward direction may mean a direction in which the lever pulling arm 161 is moved away from the housing 110 of the cleaner station 100. In addition, the reverse direction may mean a direction in which the lever pulling arm 161 is pulled toward the cleaner station 100. The forward direction may be opposite to the reverse direction.

The rotation drive motor 164 may provide power for rotating the lever pulling arm 161. The rotation drive motor 164 may rotate in a forward direction or a reverse direction. In this case, the forward direction may mean a direction in which the lever pulling arm 161 rotates to a position at which the lever pulling arm 161 may push the dust bin compression lever 223. In addition, the reverse direction may be a direction opposite to the forward direction.

The arm movement detecting parts 165 may be disposed in the housing 110. The arm movement detecting parts 165 may be disposed on a movement route of the shaft of the arm gear 162. The arm movement detecting parts 165 may be disposed at an initial position LP1 of the shaft of the arm gear 162, a maximum stroke movement position LP2, and a position LP3 when the compression lever 223 is pulled, respectively.

The arm movement detecting part 165 may include a contact sensor. For example, the arm movement detecting part 165 may include a micro-switch. Meanwhile, the arm movement detecting part 165 may also include a non-contact sensor. For example, the arm movement detecting part 165 may include an infrared (IR) sensor. With this configuration, the arm movement detecting parts 165 may detect a stroke position of the arm gear 162.

In addition, the arm movement detecting parts 165 may be disposed at the other end of the shaft of the arm gear 162. The arm movement detecting parts 165 may be disposed at the other end of the arm gear 162 provided in the form of a worm wheel and may detect a rotation position. The arm movement detecting part 165 may include a contact sensor. For example, the arm movement detecting part 165 may include a micro-switch. Meanwhile, the arm movement detecting part 165 may also include a non-contact sensor. For example, the arm movement detecting part 165 may include an infrared (IR) sensor or a Hall sensor.

Therefore, the arm movement detecting part 165 may detect that the lever pulling arm 161 is positioned at the initial position. In addition, the arm movement detecting part 165 may detect that the lever pulling arm 161 has been moved maximally away from the housing 110. In addition, the arm movement detecting part 165 may detect that the lever pulling arm 161 rotates to pull the compression lever 223. In addition, the arm movement detecting part 165 may detect that the lever pulling arm 161 has pulled the compression lever 223. In addition, the arm movement detecting part 165 may detect that the lever pulling arm 161 rotates to the original position after pulling the compression lever 223.

Therefore, when the first cleaner 200 is coupled to the coupling part 120, the compression member 224 may move downward as the lever pulling arm 161 stroke-moves, thereby compressing the dust in the dust bin 220. In one embodiment of the present specification, the dust in the dust bin 220 may be captured primarily into the dust separating part 130 by gravity as the discharge cover 222 is separated from the dust bin 220, and then the residual dust in the dust bin 220 may be captured secondarily into the dust separating part 130 by the compression member 224. Otherwise, the compression member 224 may compress the dust in the dust bin 220 downward in the state in which the discharge cover 222 is coupled to the dust bin 220, and then the discharge cover 222 may be separated from the dust bin 220, such that the dust in the dust bin 220 may be captured into the dust separating part 130.

Figure 13B:
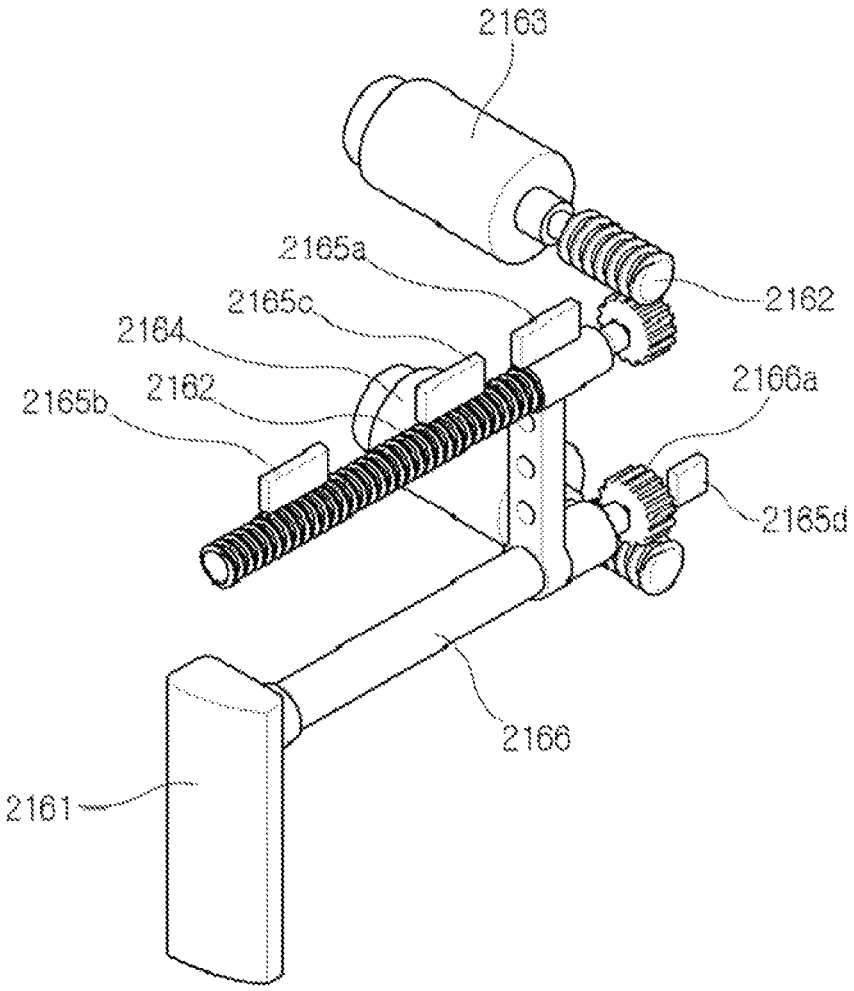
FIG. 13B is a view for explaining a lever pulling unit according to another embodiment of the present disclosure.

Meanwhile, FIG. 13B illustrates another embodiment of the lever pulling unit according to the present disclosure.

In order to avoid a repeated description, the contents related to the lever pulling unit 160 according to the embodiment of the present disclosure may be used to describe other components except for the components particularly mentioned in the present embodiment.

In the present embodiment, an arm gear 2162 and a shaft 2166 may be separately provided, and the arm gear 2162 and the shaft 2166 may be provided in parallel with each other. In addition, the shaft 2166 may be coupled to be stroke movable relative to the arm gear 2162. That is, in order to connect the shaft 2166 to the arm gear 2162, an internal screw thread may be formed on an inner surface of a connection portion of the shaft 2166.

Therefore, when the arm gear 2162 is rotated by an operation of a stroke drive motor 2163, the shaft 2166 may stroke-move along a screw thread of the arm gear 2162.

Meanwhile, a lever pulling arm 2161 may be provided at one end of the shaft 2166, a worm wheel 2166*a* may be provided at the other end of the shaft 2166, and a rotation drive motor 2164 may engage with the worm wheel 2166*a*.

Therefore, when the rotation drive motor 2164 operates, the shaft 2166 may be rotated, and the lever pulling arm 2161 may be rotated.

Arm movement detecting parts 2165 may be disposed adjacent to the arm gear 2162 and arranged on a movement route of the shaft 2166. The arm movement detecting parts 2165 may be disposed at an initial position LP1 of the shaft 2166, a maximum stroke movement position LP2, and a position LP3 when the compression lever 223 is pulled, respectively.

That is, a first arm movement detecting part 2165*a* may be disposed at the initial position LP1 of the shaft. In addition, a second arm movement detecting part 2165*b* may be disposed at the maximum stroke movement position LP2. In addition, a third arm movement detecting part 2165*c* may be disposed at the position LP3 when the compression lever 223 is pulled.

The arm movement detecting part 2165 may include a contact sensor. For example, the arm movement detecting part 2165 may include a micro-switch. Meanwhile, the arm movement detecting part 2165 may also include a non-contact sensor. For example, the arm movement detecting part 2165 may include an infrared (IR) sensor. With this configuration, the arm movement detecting parts 2165 may detect a stroke position of the shaft 2166.

In addition, the arm movement detecting parts 2165 may include a fourth arm movement detecting part 2165*d* disposed at the other end 2166*a* of the shaft. The fourth arm movement detecting part 2165*d* may detect a rotation position of the shaft 2166. The fourth arm movement detecting part 2165*d* may include a contact sensor. For example, the fourth arm movement detecting part 2165*d* may include a micro-switch. Meanwhile, the fourth arm movement detecting part 2165*d* may also include a non-contact sensor. For example, the fourth arm movement detecting part 2165*d* may include an infrared (IR) sensor or a Hall sensor.

Therefore, the first arm movement detecting part 2165*a* may detect that the lever pulling arm 2161 is positioned at the initial position LP1. In addition, the second arm movement detecting part 2165*b* may detect that the lever pulling arm 2161 has been moved maximally away from the housing 2110 (LP2). In addition, the fourth arm movement detecting part 2165*d* may detect that the lever pulling arm 2161 rotates to pull the compression lever 223. In addition, the third arm movement detecting part 2165*d* may detect that the lever pulling arm 2161 has pulled the compression lever 223. In addition, the fourth arm movement detecting part 2165*d* may detect that the lever pulling arm 2161 rotates to the original position after pulling the compression lever 223.

Meanwhile, the dust collecting part 170 will be described below with reference to FIGS. 2 and 53.

The cleaner station 100 may include the dust collecting part 170. The dust collecting part 170 may be disposed in the housing 110. The dust collecting part 170 may be disposed at a lower side in the gravitational direction of the coupling part 120.

The dust collecting part 170 may include a roll vinyl film (not illustrated). The roll vinyl film may be fixed to the housing 110 and spread downward by a load of the dust falling from the dust bin 220.

The cleaner station 100 may include a joint part (not illustrated). The joint part may be disposed in the housing 110. The joint part may be disposed in an upper region of the dust collecting part 170. The joint part may cut and join an upper region of the roll vinyl film in which the dust is captured. Specifically, the joint part may retract the roll vinyl film to a central region and join the upper region of the roll vinyl film using a heating wire. The joint part may include a first joint member (not illustrated) and a second joint member (not illustrated). The first joint member (not illustrated) may be moved in a first direction by a first joint drive part 174, and the second joint member (not illustrated) may be moved in a second direction perpendicular to the first direction by a second joint drive part 175.

With this configuration, the dust captured from the first cleaner 200 or the second cleaner 200 may be collected in the roll vinyl film, and the roll vinyl film may be automatically joined. Therefore, it is not necessary for the user to separately bind a bag in which the dust is captured, and as a result, it is possible to improve convenience for the user.

Meanwhile, the flow path part 180 will be described below with reference to FIGS. 2 and 16.

The cleaner station 100 may include the flow path part 180. The flow path part 180 may connect the first cleaner 200 or the second cleaner 300 to the dust collecting part 170.

The flow path part 180 may include the first cleaner flow path part 181, the second cleaner flow path part 182, and a flow path switching valve 183.

The first cleaner flow path part 181 may connect the dust bin 220 of the first cleaner 200 to the dust collecting part 170. The first cleaner flow path part 181 may be disposed at a rear side of the coupling surface 121. The first cleaner flow path part 181 may mean a space between the dust bin 220 of the first cleaner 200 and the dust collecting part 170. The first cleaner flow path part 181 may be a space formed at a rear side of the dust passage hole 121*a*. The first cleaner flow path part 181 may be a flow path bent downward from the dust passage hole 121*a*, and the dust and the air may flow through the first cleaner flow path part 181.

Specifically, the first cleaner flow path part 181 may include a first flow path 181*a* and a second flow path 181*b*. When the first cleaner 200 is coupled to the cleaner station 200 and the dust passage hole 121*a* is opened, the first flow path 181*a* communicates with the internal space of the dust bin 220, and the second flow path 181*b* allows the first flow path 181*a* to communicate with the internal space of the dust collecting part 170.

For example, the first flow path 181*a* may be disposed substantially in parallel with the suction motor axis a1 or the dust bin through line a5. In this case, the suction motor axis a1 or the dust bin through line a5 may penetrate the first flow path 181.

In addition, the second flow path 181*b* may be disposed in a direction parallel to a dust collecting motor axis C. With this configuration, it is possible to minimize a decrease in suction force of the dust collecting motor 181 in the first flow path 181*a* and the second flow path 181*b*.

In this case, the first flow path 181*a* may be provided at a predetermined angle with respect to the second flow path 181*b*. For example, an angle between the first flow path 181*a* and the second flow path 181*b* may be a right angle. With this configuration, it is possible to minimize an overall volume of the cleaner station 100.

As another example, an angle between the first flow path 181*a* and the second flow path 181*b* may be an acute angle. This may mean that the first flow path 181*a* is directed upward in the gravitational direction, and the second flow path 181*b* is directed downward in the gravitational direction. That is, the air, which flows through the first flow path 181*a* and the second flow path 181*b* by the operation of the dust collecting motor 191, may flow upward in the gravitational direction in the dust bin 220, change in direction thereof, and then flow downward in the gravitational direction. This configuration has an effect of preventing the air containing the dust from flowing reversely when the dust collecting motor 191 does not operate.

As still another example, an angle between the first flow path 181*a* and the second flow path 181*b* may be an obtuse angle. In this case, there is an effect of reducing a loss in the flow path.

Meanwhile, a length of the first flow path 181*a* may be equal to or shorter than a length of the second flow path. With this configuration, the suction force of the dust collecting motor 191 may be transmitted to the space in the dust bin 220 even though the entire flow path for removing the dust is bent once.

The dust in the dust bin 220 of the first cleaner 200 may move to the dust collecting part 170 through the first cleaner flow path part 181.

The second cleaner flow path part 182 may connect the second cleaner 300 to the dust collecting part 170. The dust in the second cleaner 300 may move to the dust collecting part 170 through the second cleaner flow path part 182.

The flow path switching valve 183 may be disposed between the dust collecting part 170, the first cleaner flow path part 181, and the second cleaner flow path part 182. The flow path switching valve 183 may selectively open or close the first cleaner flow path part 181 and the second cleaner flow path part 182 connected to the dust collecting part 170.

Therefore, it is possible to prevent a decrease in suction force caused when the plurality of flow paths 181 and 182 is opened.

For example, in a case in which only the first cleaner 200 is coupled to the cleaner station 100, the flow path switching valve 183 may connect the first cleaner flow path part 181 to the dust collecting part 170 and disconnect the second cleaner flow path part 182 from the dust collecting part 170.

As another example, in a case in which only the second cleaner 300 is coupled to the cleaner station 100, the flow path switching valve 183 may disconnect the first cleaner flow path part 181 from the dust collecting part 170 and connect the second cleaner flow path part 182 to the dust collecting part 170.

As still another example, in a case in which both the first cleaner 200 and the second cleaner 300 are coupled to the cleaner station 100, the flow path switching valve 183 may connect the first cleaner flow path part 181 to the dust collecting part 170 and disconnect the second cleaner flow path part 182 from the dust collecting part 170 to remove the dust in the dust bin 220 of the first cleaner 200 first. Thereafter, the flow path switching valve 183 may disconnect the first cleaner flow path part 181 from the dust collecting part 170 and connect the second cleaner flow path part 182 to the dust collecting part 170 to remove the dust from the second cleaner 300. Therefore, it is possible to improve convenience in respect to the use of the first cleaner 200 manually manipulated by the user.

Meanwhile, the dust suction module 190 will be described below with reference to FIGS. 2, 16 to 20, and 53.

The cleaner station 100 may include the dust suction module 190. The dust suction module 190 may include the dust collecting motor 191, a first filter 192, and a second filter (not illustrated).

The dust collecting motor 191 may be disposed below the dust collecting part 170. The dust collecting motor 191 may generate the suction force in the first cleaner flow path part 181 and the second cleaner flow path part 182. Therefore, the dust collecting motor 191 may provide the suction force capable of sucking the dust in the dust bin 220 of the first cleaner 200 and the dust in the second cleaner 300.

The dust collecting motor 191 may generate the suction force by means of the rotation. For example, the dust collecting motor 191 may be formed in a shape similar to a cylindrical shape.

Meanwhile, in the present embodiment, an imaginary dust collecting motor axis C may be defined by extending the rotation axis of the dust collecting motor 191.

The first filter 192 may be disposed between the dust collecting part 170 and the dust collecting motor 191. The first filter 192 may be a prefilter.

The second filter (not illustrated) may be disposed between the dust collecting motor 191 and the outer wall surface 112. The second filter (not illustrated) may be an HEPA filter.

The cleaner station 100 may include the charging part 128. The charging part 128 may be disposed on the coupling part 120. Specifically, the charging part 128 may be disposed on the coupling surface 121. In this case, the charging part 128 may be positioned at a position facing a charging terminal provided on the battery 240 of the first cleaner 200. The charging part 128 may be electrically connected to the first cleaner 200 coupled to the coupling part 120. The charging part 128 may supply power to the battery of the first cleaner 200 coupled to the coupling part 120. That is, when the first cleaner 200 is physically coupled to the coupling surface 121, the charging part 128 may be electrically coupled to the first cleaner 200.

In addition, the charging part 128 may include a lower charging part (not illustrated) disposed in a lower region of the housing 110. The lower charging part may be electrically connected to the second cleaner 300 coupled to the lower region of the housing 110. A second charger may supply power to the battery of the second cleaner 300 coupled to the lower region of the housing 110.

The cleaner station 100 may include a lateral door (not illustrated). The lateral door may be disposed in the housing 110. The lateral door may selectively expose the dust collecting part 170 to the outside. Therefore, the user may easily remove the dust collecting part 170 from the cleaner station 100.

Figure 24:
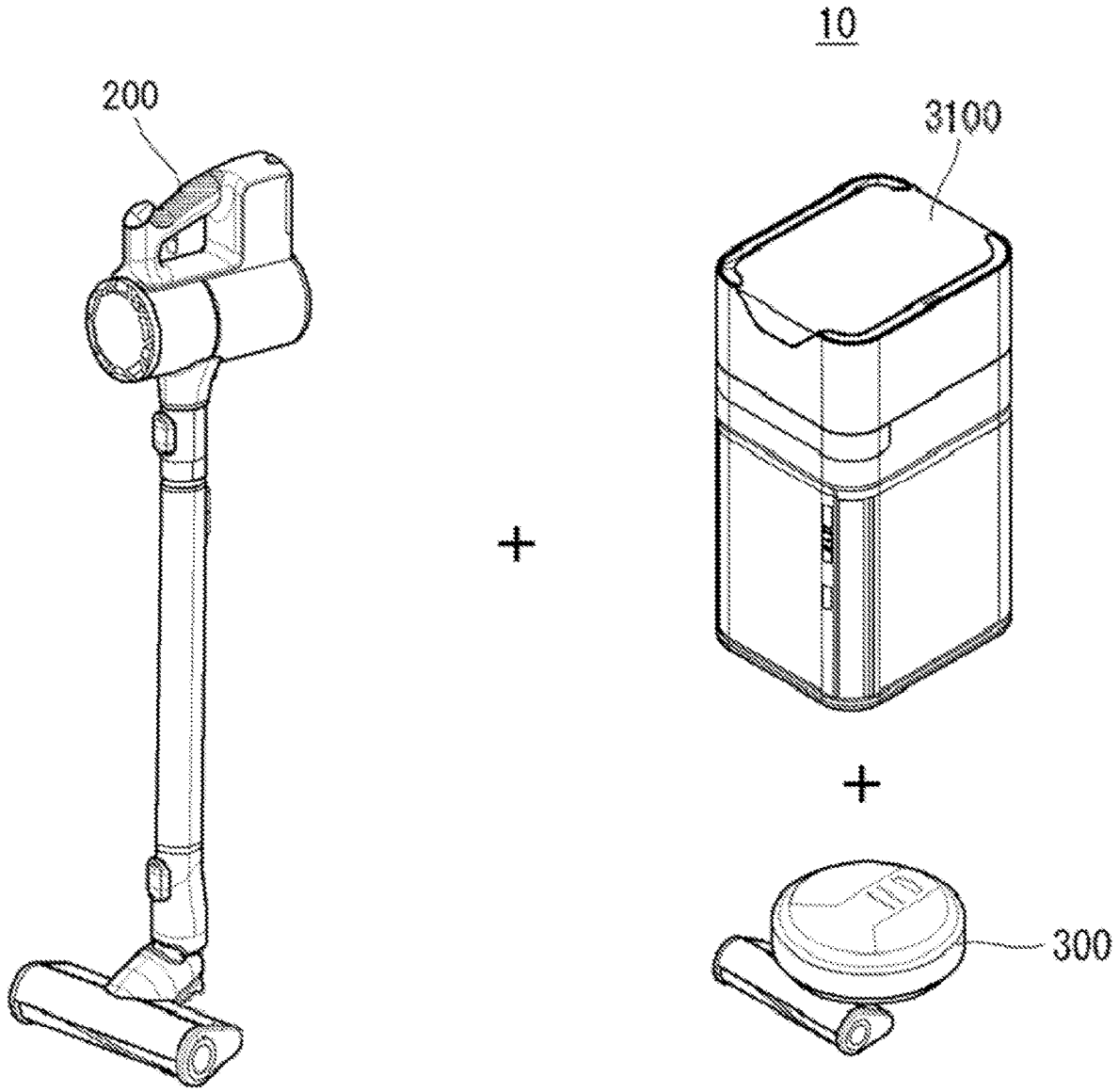
FIG. 24 is a perspective view illustrating the cleaner system including a cleaner station according to a second embodiment of the present disclosure.
Figure 25:
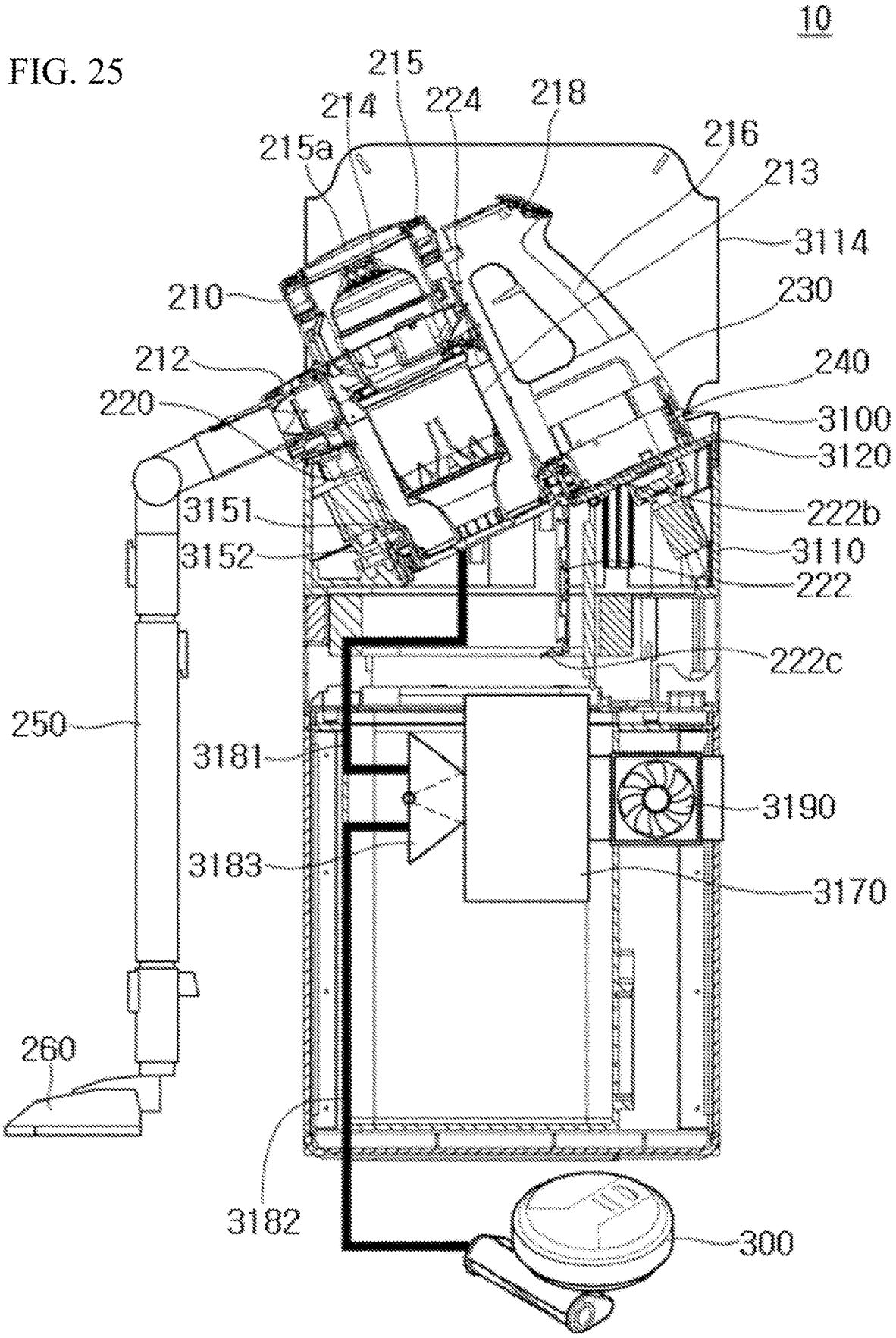
FIG. 25 is a cross-sectional view illustrating the cleaner system including the cleaner station according to the second embodiment of the present disclosure.
Figure 26:
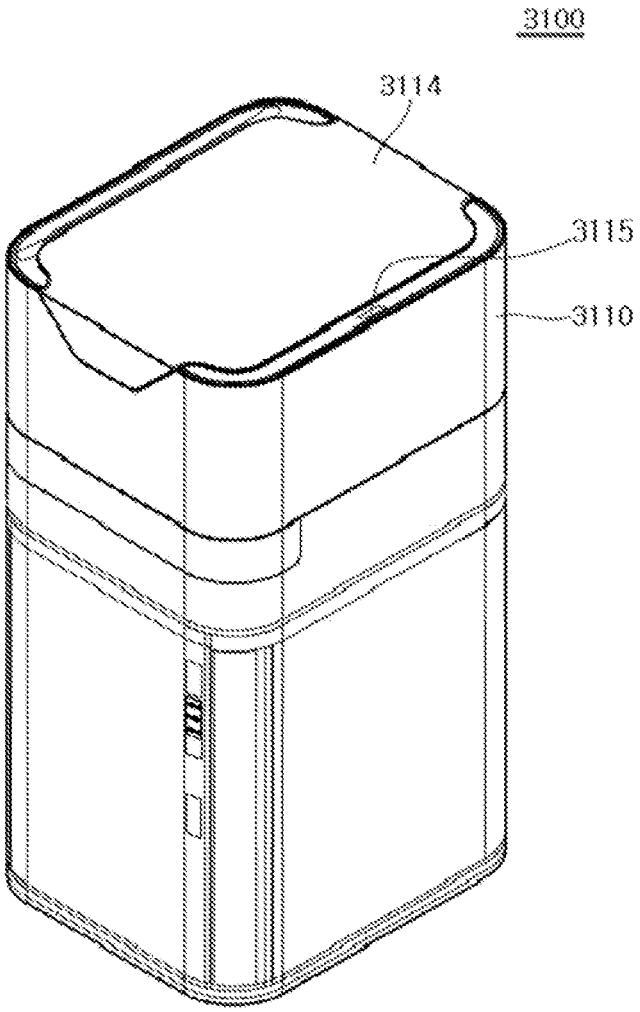
FIG. 26 is a perspective view illustrating the cleaner station according to the second embodiment of the present disclosure.
Figure 27:
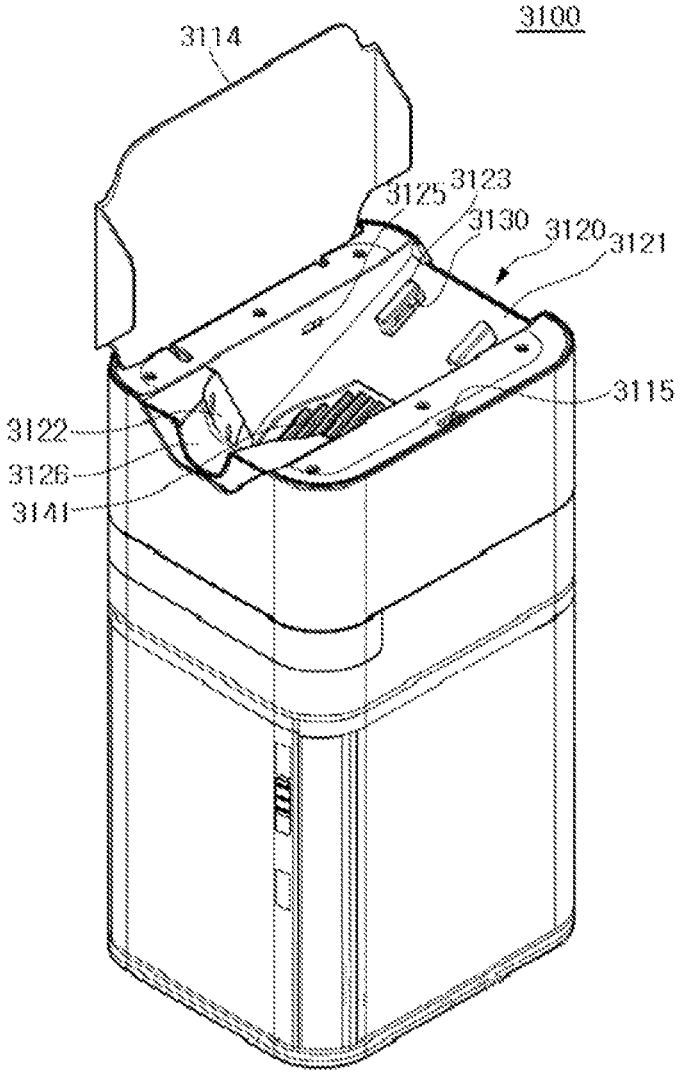
FIG. 27 is a perspective view illustrating a state in which a first door member illustrated in FIG. 26.
Figure 28:
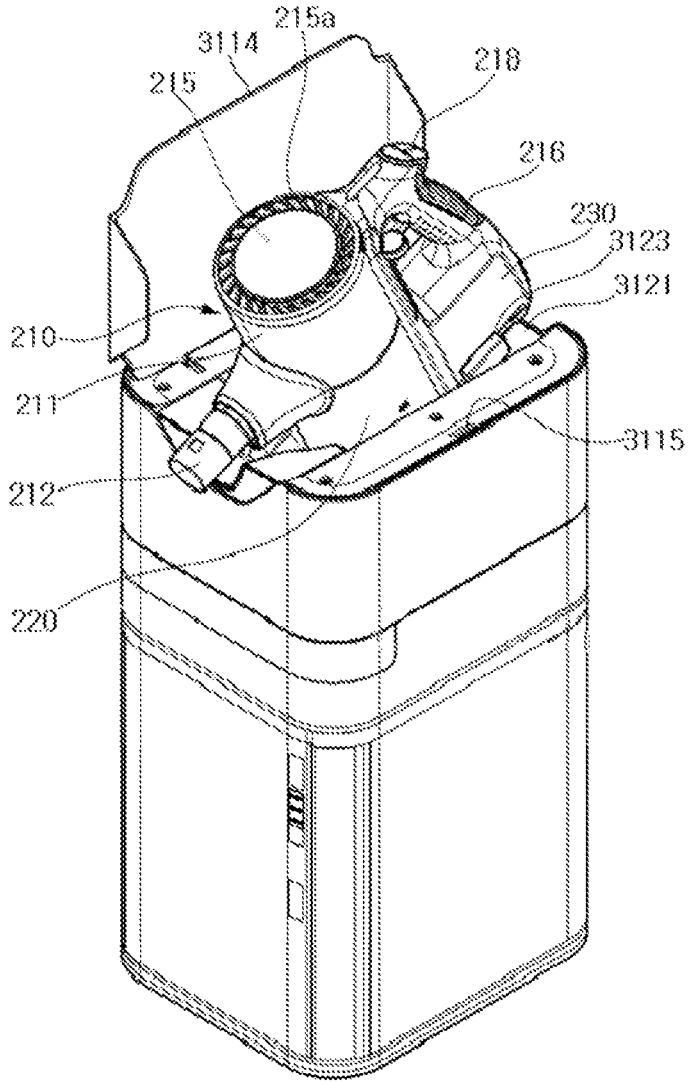
FIGS. 28 and 29 are operational views illustrating a state in which a main body of the first cleaner is coupled to the cleaner station according to the second embodiment of the present disclosure.
Figure 29:
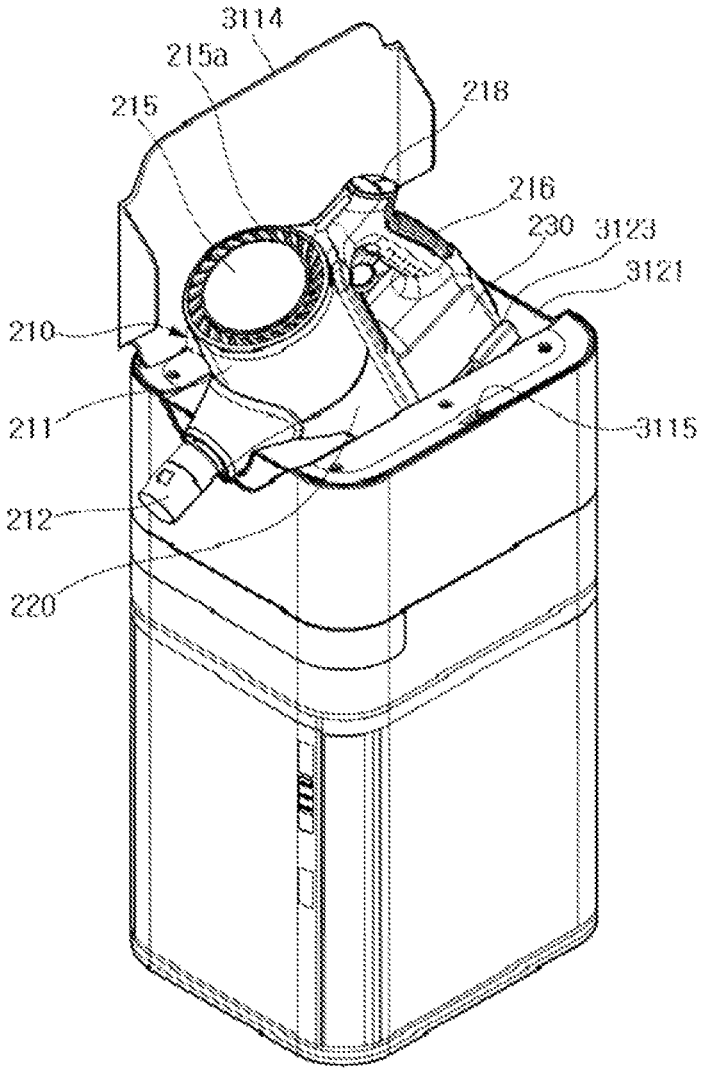
Figure 30:
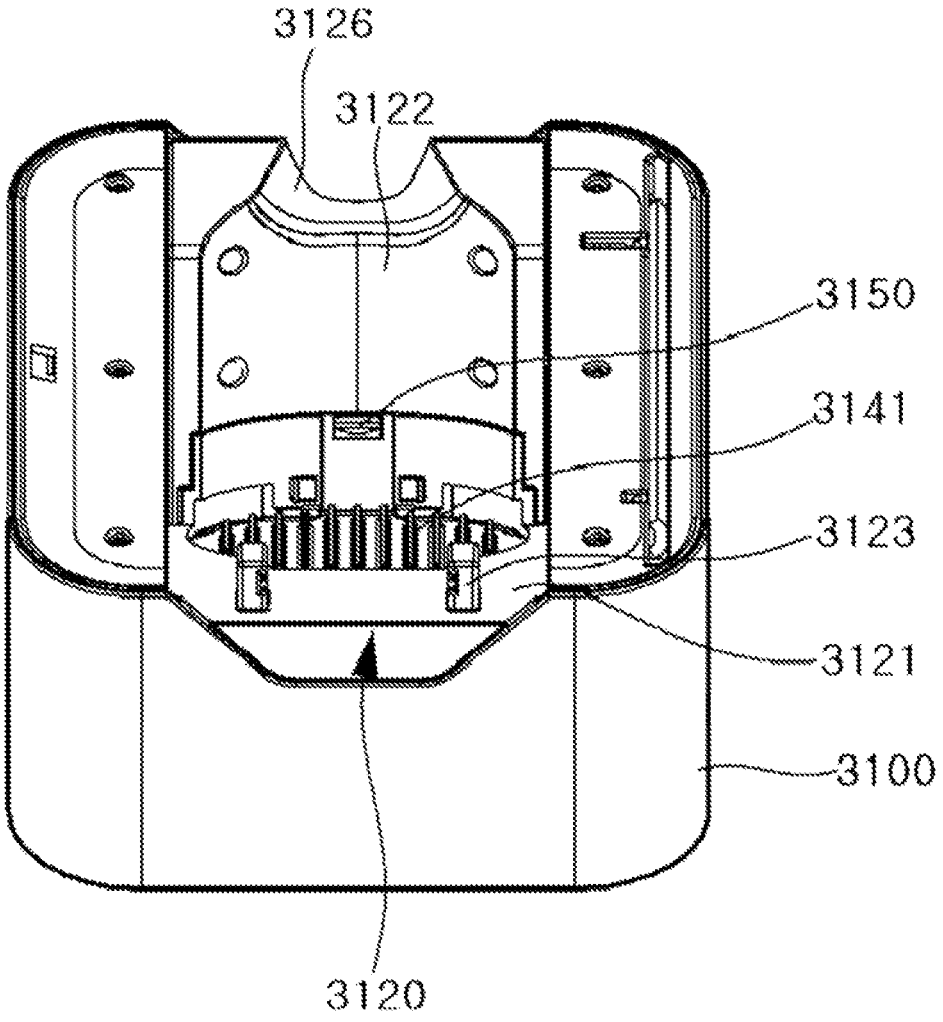
FIG. 30 is a perspective view illustrating a coupling part of the cleaner station according to the second embodiment of the present disclosure.
Figure 31:
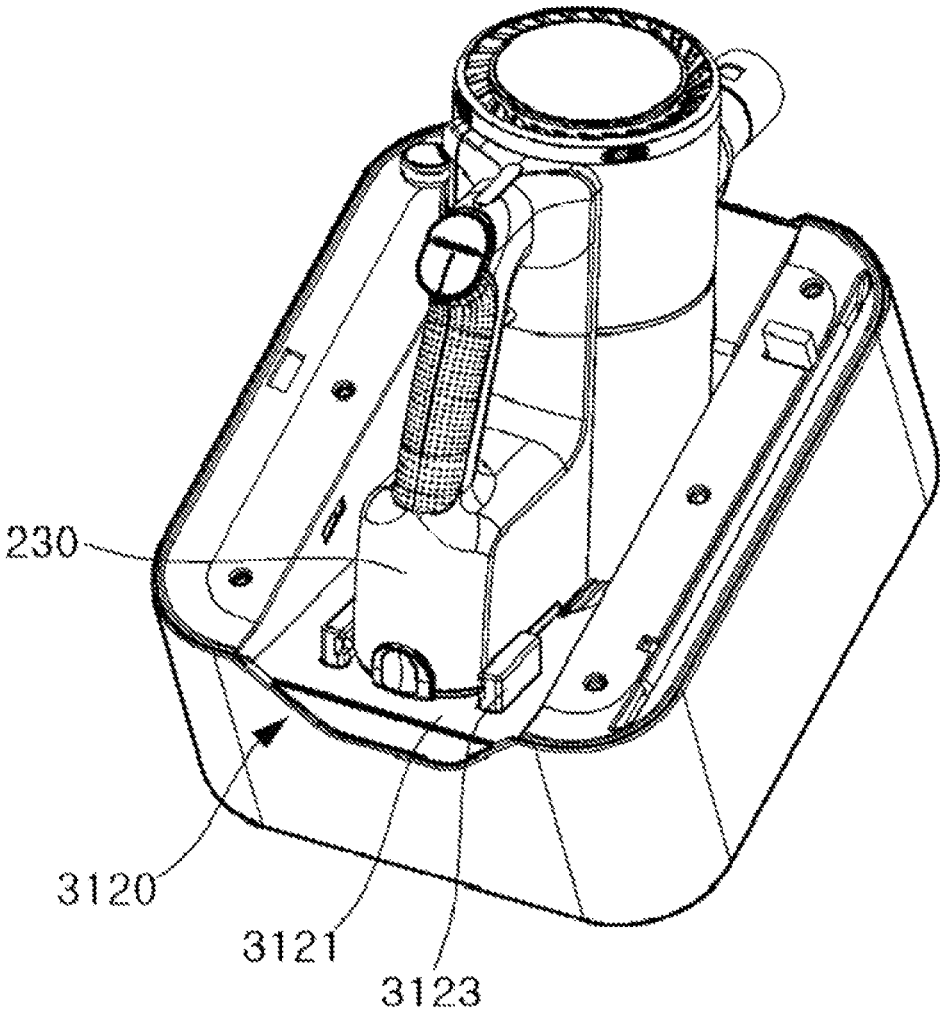
FIG. 31 is a perspective view illustrating a state in which the main body of the first cleaner is coupled to the coupling part of the cleaner station according to the second embodiment of the present disclosure.

FIG. 24 is a perspective view illustrating a cleaner system including a cleaner station according to a second embodiment of the present disclosure, FIG. 25 is a cross-sectional view illustrating the cleaner system including the cleaner station according to the second embodiment of the present disclosure, FIG. 26 is a perspective view illustrating the cleaner station according to the second embodiment of the present disclosure, FIG. 27 is a perspective view illustrating a state in which a first door member illustrated in FIG. 26 is opened, FIGS. 28 and 29 are operational views illustrating states in which the main body of the first cleaner is coupled to the cleaner station according to the second embodiment of the present disclosure, FIG. 30 is a perspective view illustrating a coupling part of the cleaner station according to the second embodiment of the present disclosure, and FIG. 31 is a perspective view illustrating a state in which the main body of the first cleaner is coupled to the coupling part of the cleaner station according to the second embodiment of the present specification.

The cleaner system according to the second embodiment of the present disclosure will be described below with reference to FIGS. 24 to 31.

The cleaner system according to the second embodiment of the present specification may include a cleaner station 3100 and the cleaners 200 and 300. In this case, the cleaners 200 and 300 may include a first cleaner 200 and a second cleaner 300.

Meanwhile, because the cleaners 200 and 300 according to the present embodiment are identical to the cleaners 200 and 300 according to the above-mentioned embodiment of the present disclosure, the same description may be applied.

Further, in order to avoid a repeated description, the contents related to the cleaner system 10 according to the embodiment of the present disclosure may be used to describe other components except for the components particularly mentioned in the present embodiment.

In the present embodiment, the first cleaner 200 may be coupled to an upper portion of the cleaner station 3100. Specifically, the main body 210 of the first cleaner 200 may be coupled to the upper portion of the cleaner station 3100.

The cleaner station 3100 may include a housing 3110. In the present embodiment, the coupling part 3120, to which the first cleaner 200 is coupled, may be disposed on an upper portion of the housing 3110. The second cleaner 300 may be coupled to a lower portion of the housing 3110. In the present embodiment, an example in which the housing 3110 is formed in a hexahedral shape is described, but the present disclosure is not limited thereto, and the shape of the housing 3110 may be variously changed.

In the present embodiment, the housing 3110 may include a first door member 3114. The first door member 3114 may be disposed at an upper side of the housing 3110. The first door member 3114 may selectively expose the coupling part 3120, which is disposed on the upper portion of the housing 3100, to the outside. The first door member 3114 may be opened when the user approaches the cleaner station 3100, and the first door member 3114 may be closed when the first cleaner 200 coupled to the cleaner station 3100 is separated from the cleaner station 3100. Therefore, it is possible to prevent foreign substances such as dust from being introduced into the cleaner station 3100.

In the present embodiment, the housing 3110 may include a first sensor part 3115. The first sensor part 3115 may be disposed on the housing 3110. The first sensor part 3115 may detect whether the user approaches the cleaner station 3100. The first sensor part 3115 may include a non-contact sensor. For example, the first sensor part 3115 may be an infrared (IR) sensor. The first sensor part 3115 may include a contact sensor. For example, the first sensor part 3115 may include a micro-switch. In one embodiment of the present specification, an example in which the first sensor part 3115 is disposed on an upper surface of the housing 3110 is described, but the position of the first sensor part 3115 may be variously changed as long as the first sensor part 3115 may detect whether the user approaches the cleaner station 3100.

In the present embodiment, the cleaner station 3100 may include the coupling part 3120. The coupling part 3120 may be disposed on the upper portion of the cleaner station 3100. The coupling part 3120 may be disposed on the upper portion of the housing 3110. The coupling part 3120 may be selectively opened or closed by the first door member 3114. The main body 210, the dust bin 220, and the battery housing 230 of the first cleaner 200 may be coupled to the coupling part 3120.

The coupling part 3120 may include a coupling surface 3121, a dust bin guide surface 3122, a guide protrusion 3123, a coupling sensor 3125, and a suction part guide surface 3126.

Meanwhile, unless described otherwise, the descriptions of the coupling surface 121, the dust bin guide surface 122, the guide protrusion 123, the coupling sensor 125, and the suction part guide surface 126 according to the above-mentioned embodiment of the present disclosure may be applied to the specific descriptions of the coupling surface 3121, the dust bin guide surface 3122, the guide protrusion 3123, the coupling sensor 3125, and the suction part guide surface 3126 in order to avoid the repeated description.

The coupling part 3120 may include the coupling surface 3121. The coupling surface 3121 may be disposed on the upper surface of the housing 110. The first cleaner 200 may be coupled to the coupling surface 3121. Specifically, the main body 210, the dust bin 220, and the battery housing 230 of the first cleaner 200 may be coupled to the coupling surface 3121.

The coupling surface 3121 may have a predetermined angle with respect to the ground surface. For example, an angle between the coupling surface 3121 and the ground surface may be an acute angle. Therefore, it is possible to provide convenience when coupling the main body 210 of the first cleaner 200 to the coupling surface 3121. In this case, the coupling between the coupling surface 3121 and the main body 210 of the first cleaner 200 may mean physical coupling by which the first cleaner 200 and the cleaner station 3100 are coupled and fixed to each other.

The coupling part 3120 may include a first drive part (not illustrated). The first drive part may be disposed in the housing 3110. The first drive part may rotate the coupling surface 3121. When the dust bin 220 is coupled to the coupling surface 3121, the first drive part may rotate the coupling surface 3121 in parallel with the ground surface. Therefore, it is possible to improve efficiency in capturing the dust into the dust bin 220 into the dust collecting part 3170 by means of a weight of the dust.

The coupling part 3120 may include the dust bin guide surface 3122. The dust bin guide surface 3122 may be disposed on the upper portion of the housing 110. The dust bin guide surface 3122 may be connected to the upper surface of the housing 3110. The dust bin guide surface 3122 may be connected to the coupling surface 3121. The dust bin guide surface 3122 may have a predetermined angle with respect to the ground surface. For example, an angle between the dust bin guide surface 3122 and the ground surface may be an obtuse angle.

The coupling part 3120 may include the coupling sensor 3125. The coupling sensor 3125 may be disposed in the housing 3110. The coupling sensor 3125 may detect whether the first cleaner 200 is physically coupled to the coupling part 3120. The coupling sensor 3125 may face the main body 210 of the first cleaner 200.

The coupling part 3120 may include the suction part guide surface 3126. The suction part guide surface 3126 may be disposed on the upper portion of the housing 3110. The suction part guide surface 3126 may be connected to the dust bin guide surface 3122. The suction part 212 may be coupled to the suction part guide surface 3126. The suction part guide surface 3126 may be formed in a shape corresponding to the shape of the suction part 212. Therefore, it is possible to provide convenience when coupling the main body 210 of the first cleaner 200 to the coupling surface 3121.

Figure 32:
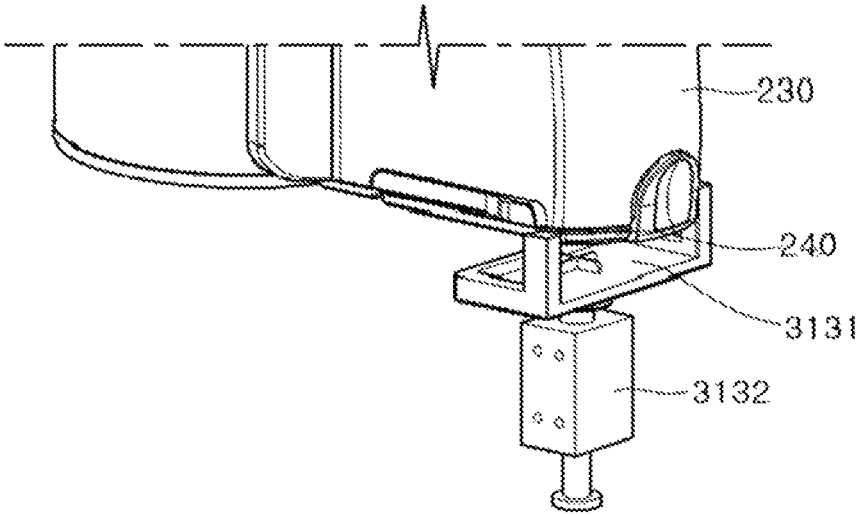
FIGS. 32 and 33 are operational views illustrating states in which the main body of the first cleaner is fixed to the coupling part of the cleaner station according to the second embodiment of the present disclosure.
Figure 33:
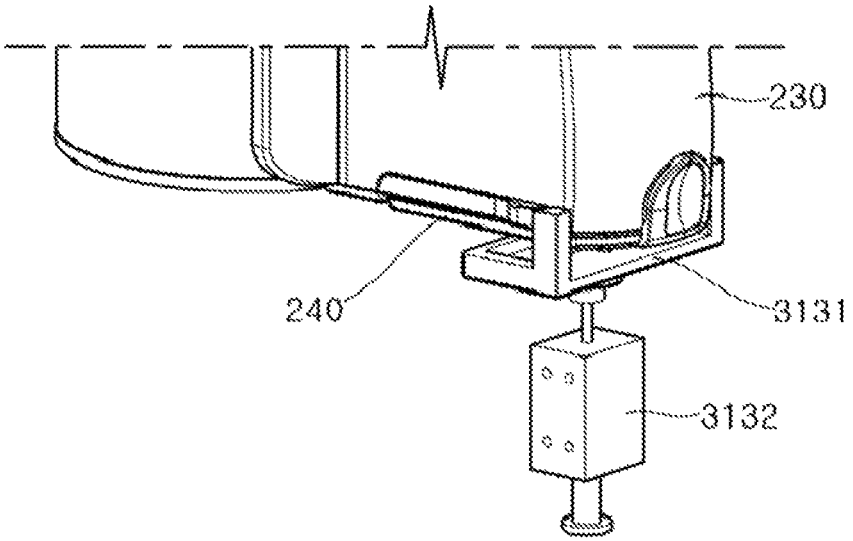

Meanwhile, FIGS. 32 and 33 are operational views illustrating states in which the main body of the first cleaner according to the embodiment of the present specification is fixed to the coupling part of the cleaner station.

Referring to FIGS. 32 and 33, the cleaner station 3100 according to the present embodiment may include a fixing part 3130. The fixing part 3130 may be disposed on the coupling surface 3121. The fixing part 3130 may be disposed on the guide protrusion 3123. The fixing part 3130 may fix the first cleaner 200 coupled to the coupling surface 3121. Specifically, the fixing part 3130 may fix the main body 210 of the first cleaner 200 coupled to the coupling surface 3121. The fixing part 3130 may include a fixing member 3131 configured to fix the main body 210 of the first cleaner 200, and a fixing drive part 3132 configured to operate the fixing member 3131. In the embodiment of the present disclosure, an example in which the fixing drive part 3132 moves the fixing member 3131 upward or downward is described. However, the shape of the fixing member 3131 and the type of the fixing drive part 3132 may be variously changed as long as the fixing member 3131 and the fixing drive part 3132 may fix the main body 210 of the first cleaner 200 to the coupling part 3120.

The cleaner station 3100 of the present embodiment may include a door 3141. The door 3141 may be disposed in the housing 3110. The door 3141 may be disposed on the coupling surface 3121. The door 3141 may selectively open or close at least a part of the coupling surface 3121, thereby allowing the upper portion of the coupling part 3120 to communicate with a first cleaner flow path part 3181 and/or a dust collecting part 3170. The door 3141 may be opened together with the discharge cover 222 of the first cleaner 200 when the discharge cover 222 of the first cleaner 200 is opened. The door 3141 may rotate downward about a hinge part 3141*b*. The door 3141 may be closed by a door arm 3143 or a door motor 3142. For example, the door 3141 may be rotated to one side by the door motor 3142. The discharge cover 222 of the first cleaner 200 may be closed together with the door 3141 when the door 3141 is closed. Therefore, the dust bin 220 of the first cleaner 200 and the first cleaner flow path part 3181 may be coupled to implement a flow path through which a fluid may flow.

Figure 34:
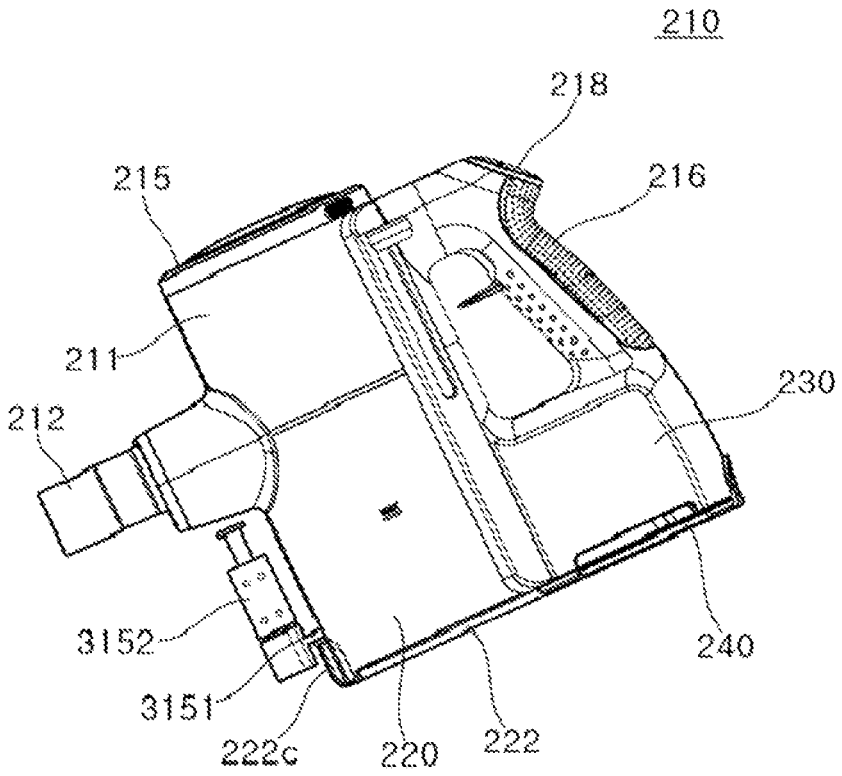
FIG. 34 is a view illustrating a state in which a discharge cover of the first cleaner according to the present disclosure is opened or closed.

Meanwhile, FIG. 34 is a view illustrating a state in which the discharge cover of the first cleaner according to the second embodiment of the present specification is opened or closed.

Referring to FIG. 34, the cleaner station 3100 may include a cover opening unit 3150. The cover opening unit 3150 may be disposed on the upper portion of the coupling surface 3121. The cover opening unit 3150 may be disposed adjacent to the dust bin guide surface 3122. In the case in which the main body 210 of the first cleaner 200 is coupled to the coupling part 3120, the cover opening unit 3150 may separate the discharge cover 222 from the dust bin 220.

The cover opening unit 3150 may include a separation member 3151, and a cover opening drive part 3152 configured to operate the separation member 3151. In the case in which the dust bin 220 is coupled to the coupling part 3120, the cover opening drive part 3152 may operate the separation member 3151. Specifically, when the cover opening drive part 3152 moves the separation member 3151 downward, the separation member 3151 may separate the coupling lever 222*c* from the dust bin 220, thereby selectively opening or closing the lower side of the dust bin 220. In this case, the dust in the dust bin 220 may be moved downward and captured into the dust collecting part 3170 by the impact that occurs when the discharge cover 222 is separated from the dust bin 220.

The cleaner station 3100 may include the dust collecting part 3170.

In order to avoid a repeated description, the contents related to the dust collecting part 170 according to the embodiment of the present disclosure may be used to describe the dust collecting part 3170 according to the present embodiment except for the components particularly mentioned.

The dust collecting part 3170 may be disposed in the housing 3110. The dust collecting part 3170 may be below the coupling part 3120. Therefore, when the discharge cover 222 is separated from the dust bin 220, the dust in the dust bin 220 may be captured into the dust collecting part 3170 by gravity.

In the present embodiment, the cleaner station 3100 may include a flow path part, and the flow path part may include the first cleaner flow path part 3181, a second cleaner flow path part 3182, and a flow path switching valve 3183.

In order to avoid a repeated description, the contents related to the flow path part 180 according to the embodiment of the present disclosure may be used to describe the flow path part according to the present embodiment except for the components particularly mentioned.

The first cleaner flow path part 3181 may mean a straight region extending upward and downward. The dust in the dust bin 220 of the first cleaner 200 may move to the dust collecting part 3170 through the first cleaner flow path part 3181.

Meanwhile, because the second cleaner flow path part 3182 and the flow path switching valve 3183 are identical in configuration and operation to the second cleaner flow path part 182 and the flow path switching valve 183 according to the embodiment of the present disclosure, the same description may be applied.

In the present embodiment, the cleaner station 3100 may include a dust suction module 3190.

In order to avoid a repeated description, the contents related to the dust suction module 190 according to the embodiment of the present disclosure may be used to describe the dust suction module 3190 according to the present embodiment except for the components particularly mentioned.

The dust suction module 3190 may be disposed in the dust collecting part 3170. Otherwise, the dust suction module 3190 may be disposed outside the dust collecting part 3170 and connected to the dust collecting part 3170. The dust suction module 3190 may generate the suction force in the first cleaner flow path part 3181 and the second cleaner flow path part 3182. Therefore, the dust suction module 3190 may provide the suction force capable of sucking the dust in the dust bin 220 of the first cleaner 200 and the dust in the second cleaner 300.

Although not illustrated, in the present embodiment, the cleaner station 3100 may include a charging part. The charging part may include a first charger disposed on the coupling part 3120, and a second charger disposed in a lower region of the housing 3110. Therefore, the first cleaner 200 or the second cleaner 300 may be electrically coupled to the cleaner station 3100 through the charging part.

In the present embodiment, the cleaner station 3100 may include a lateral door (not illustrated). The lateral door may be disposed in the housing 3110. Therefore, in the present embodiment, the user may also use the dust collecting part 3170 as a trash can, and as a result, it is possible to improve convenience for the user.

Referring to FIGS. 26 and 27, when the user approaches the cleaner station 3100, the first door member 114 may be moved upward, and the coupling part 3120 may be exposed upward. In this case, the first sensor part 3115 may detect whether the user approaches the cleaner station 3100. Therefore, because the user need not separately open or close the first door member 3114, it is possible to provide convenience for the user.

Referring to FIGS. 28 and 29, when the user couples the first cleaner 200 to the coupling part 3120 of the cleaner station 3100, the main body 210 and the dust bin 220 of the first cleaner 200 may be stably disposed on the coupling part 3120. Therefore, it is possible to provide convenience when coupling the main body 210 and the dust bin 220 of the first cleaner 200 to the coupling surface 3121.

Referring to FIGS. 31 and 33, when the main body 210 of the first cleaner 200 is disposed on the coupling part 3120, the fixing part 3130 may move the main body 210 of the first cleaner 200. Specifically, when the coupling sensor 3125 detects that the main body 210 of the first cleaner 200 is coupled to the coupling part 3120 of the cleaner station 3100, the fixing drive part 3132 may move the fixing member 3131 upward to fix the main body 210 of the first cleaner 200.

Therefore, the amount of vibration and impact, which occur when the discharge cover 222 of the main body 210 of the fixed first cleaner 200 is separated from the dust bin 220, is increased, and as a result, it is possible to improve efficiency in moving the dust stored in the dust bin 220 to the dust collecting part 3170 of the cleaner station 3100. That is, it is possible to improve the suction force of the cleaner by preventing the residual dust from remaining in the dust bin. Further, it is possible to remove an offensive odor caused by the residual dust by preventing the residual dust from remaining in the dust bin.

In the embodiment of the present disclosure, an example in which the fixing drive part 3132 is a solenoid actuator is described, but the present disclosure is not limited thereto, and the fixing drive part 3132 may be variously changed to an electromagnetic actuator or the like.

Referring to FIG. 34, in the case in which the main body 210 of the first cleaner 200 is fixed to the coupling part 3120, the cover opening drive part 3152 may move the separation member 3151 downward to separate the discharge cover 222 from the dust bin 220. When the discharge cover 222 is separated from the dust bin 220, the dust in the dust bin 220 may be captured into the dust collecting part 3170 by gravity and the load of the dust. In this case, the door 3141 is rotated downward by the weight of the discharge cover 222 separated from the dust bin 220, such that the lower side of the dust bin 220 may communicate with the dust collecting part 3170. Otherwise, one embodiment of the present specification may be carried out without the door 3141.

Therefore, it is possible to remove the dust in the dust bin without the user's separate manipulation, thereby providing convenience for the user. In addition, it is possible to eliminate the inconvenience caused because the user needs to empty the dust bin all the time. In addition, it is possible to prevent the dust from scattering when emptying the dust bin.

In the embodiment of the present specification, an example in which the cover opening drive part 3152 is a solenoid actuator is described, but the present disclosure is not limited thereto, and the cover opening drive part 3152 may be variously changed to an electromagnetic actuator and the like.

Figure 35:
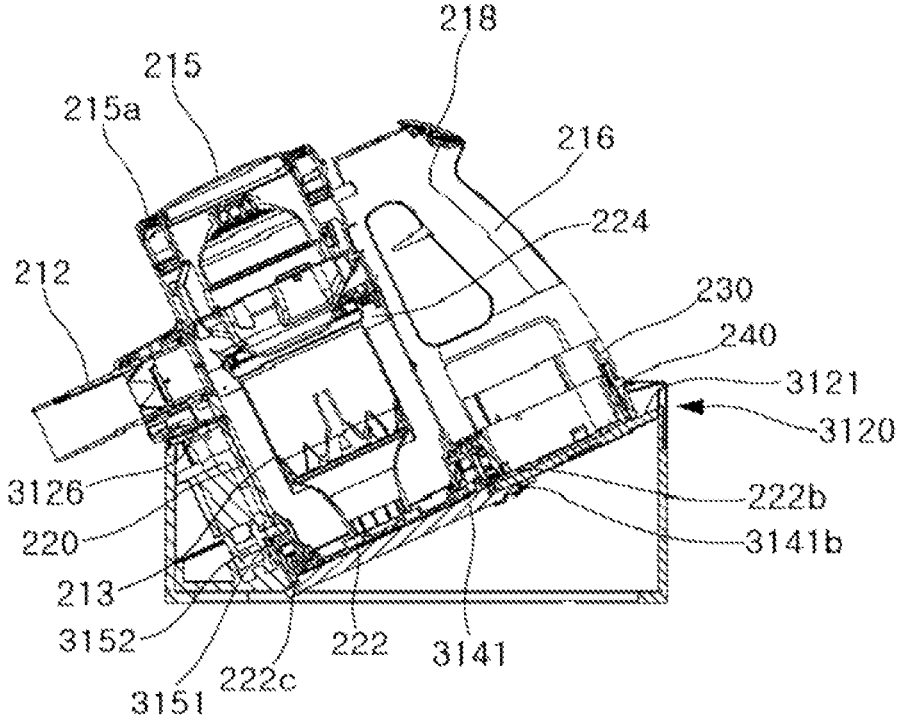
FIGS. 35 and 36 are operational views illustrating states in which the main body of the first cleaner coupled to the coupling part of the cleaner station according to the second embodiment of the present disclosure is rotated.
Figure 36:
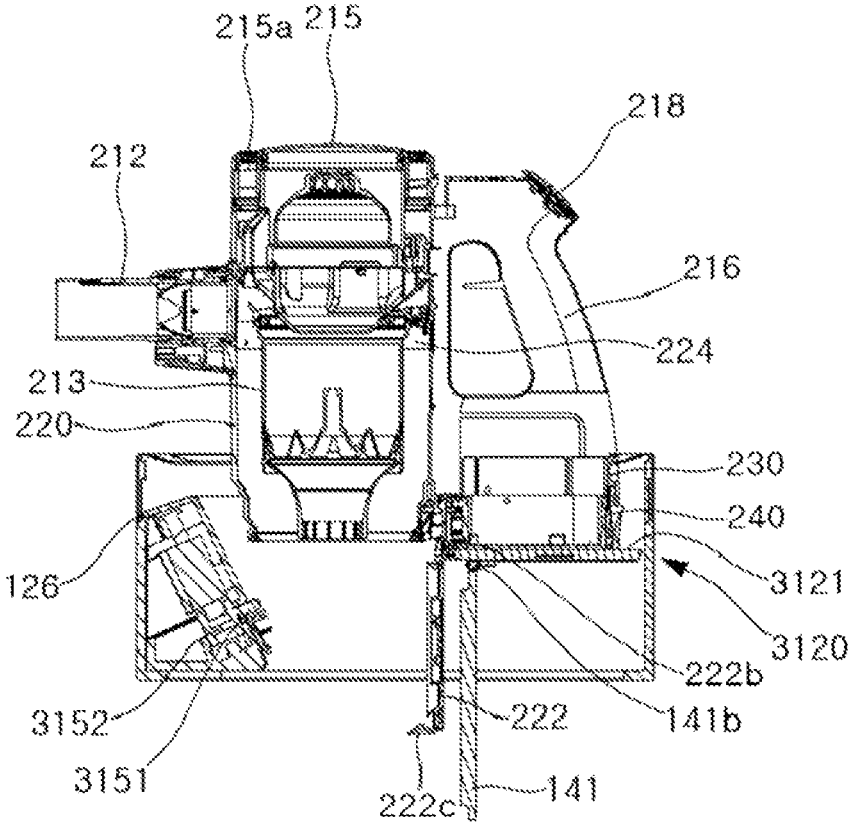

Meanwhile, FIGS. 35 and 36 are operational views illustrating states in which the main body of the first cleaner coupled to the coupling part of the cleaner station according to the embodiment of the present specification rotates.

Referring to FIGS. 35 and 36, when the main body 210 of the first cleaner 200 is fixed to the coupling part 3120, the first drive part (not illustrated) may rotate the coupling surface 3121. In this case, since the coupling surface 3121 is positioned in parallel with the ground surface, it is possible to improve efficiency in capturing the dust into the dust bin 220 into the dust collecting part 3170 by means of the weight of the dust.

Even in the case in which the coupling surface 3121 rotates, the cover opening drive part 3152 may separate the discharge cover 222 from the dust bin 220, as illustrated in FIG. 11. Otherwise, a separate protrusion may be formed on the inner surface of the coupling part. When the coupling surface 3121 is positioned in parallel with the ground surface, the protrusion formed on the inner surface of the coupling part may come into contact with the coupling lever 222*c* to separate the discharge cover 222 from the dust bin 220.

Figure 37:
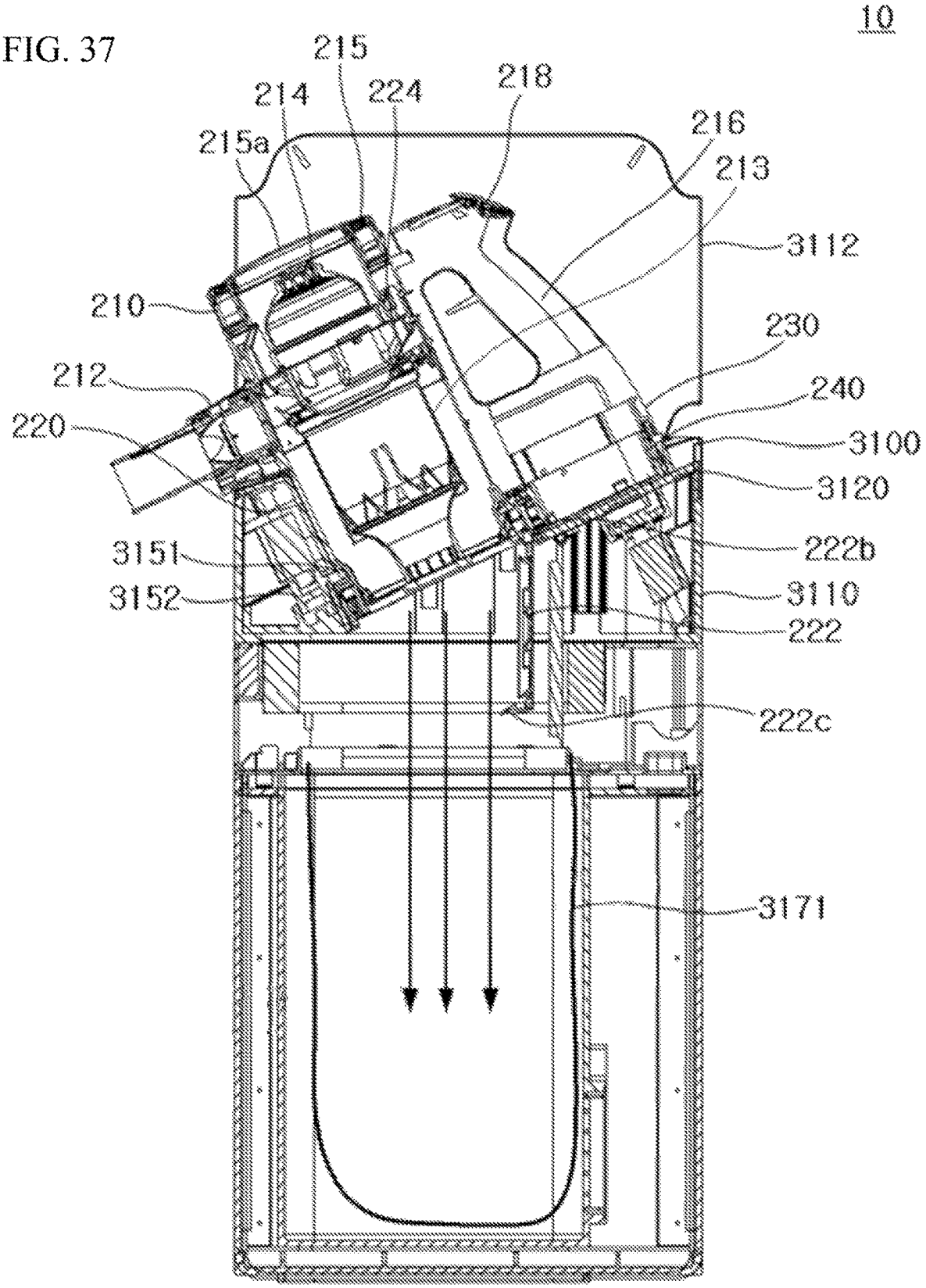
FIG. 37 is a cross-sectional view illustrating the cleaner system according to the second embodiment of the present disclosure.

FIG. 37 is a cross-sectional view illustrating the cleaner system according to the embodiment of the present specification.

Referring to FIG. 37, the dust collecting part 3170 may include a roll vinyl film 3171. The roll vinyl film 3171 may be fixed to the housing 110 and spread downward by the load of the dust falling from the dust bin 220.

Figure 47:
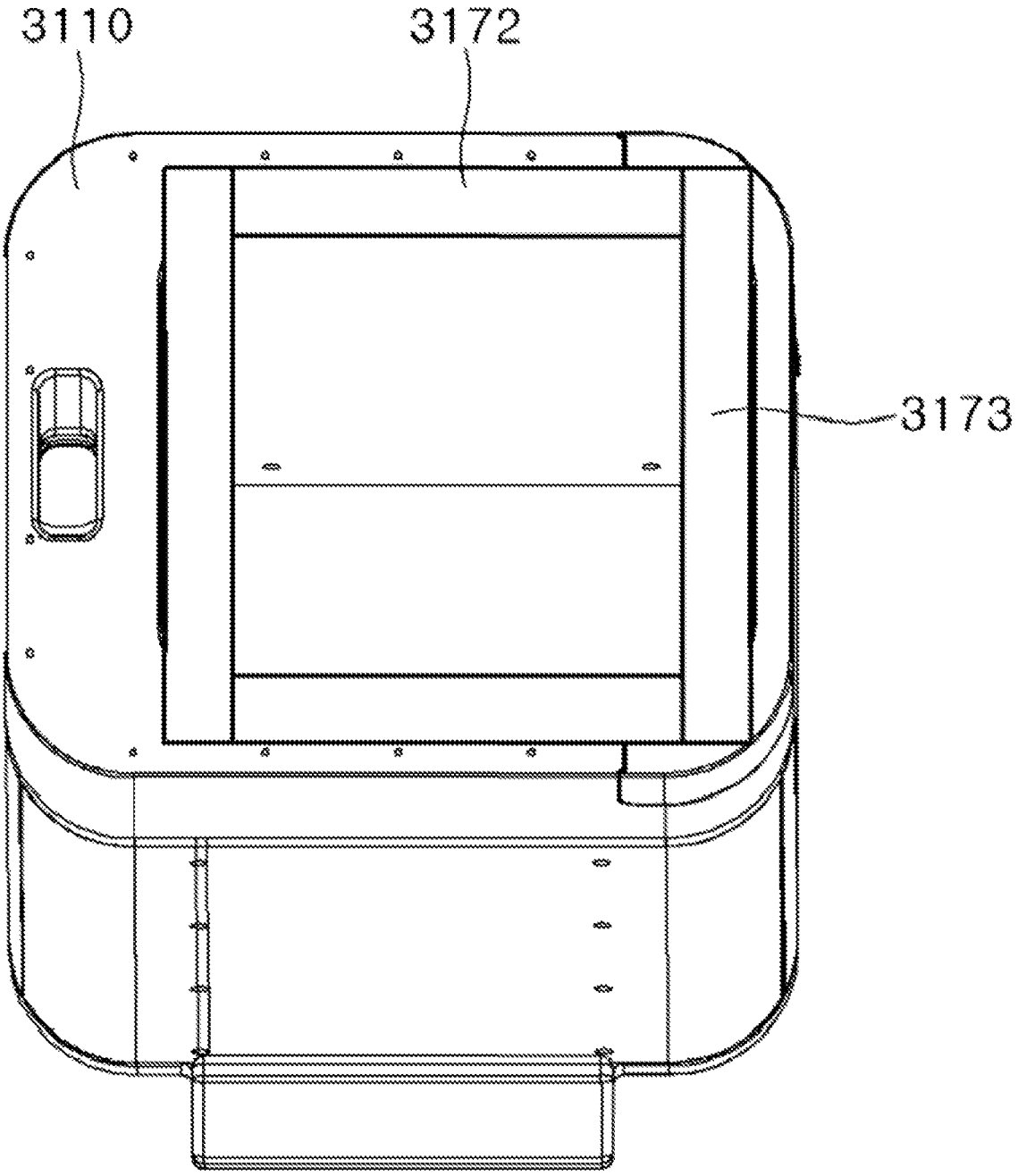
FIGS. 47 and 48 are operational views a state in which a roll vinyl film is bonded in the cleaner station according to the second embodiment of the present disclosure.
Figure 48:
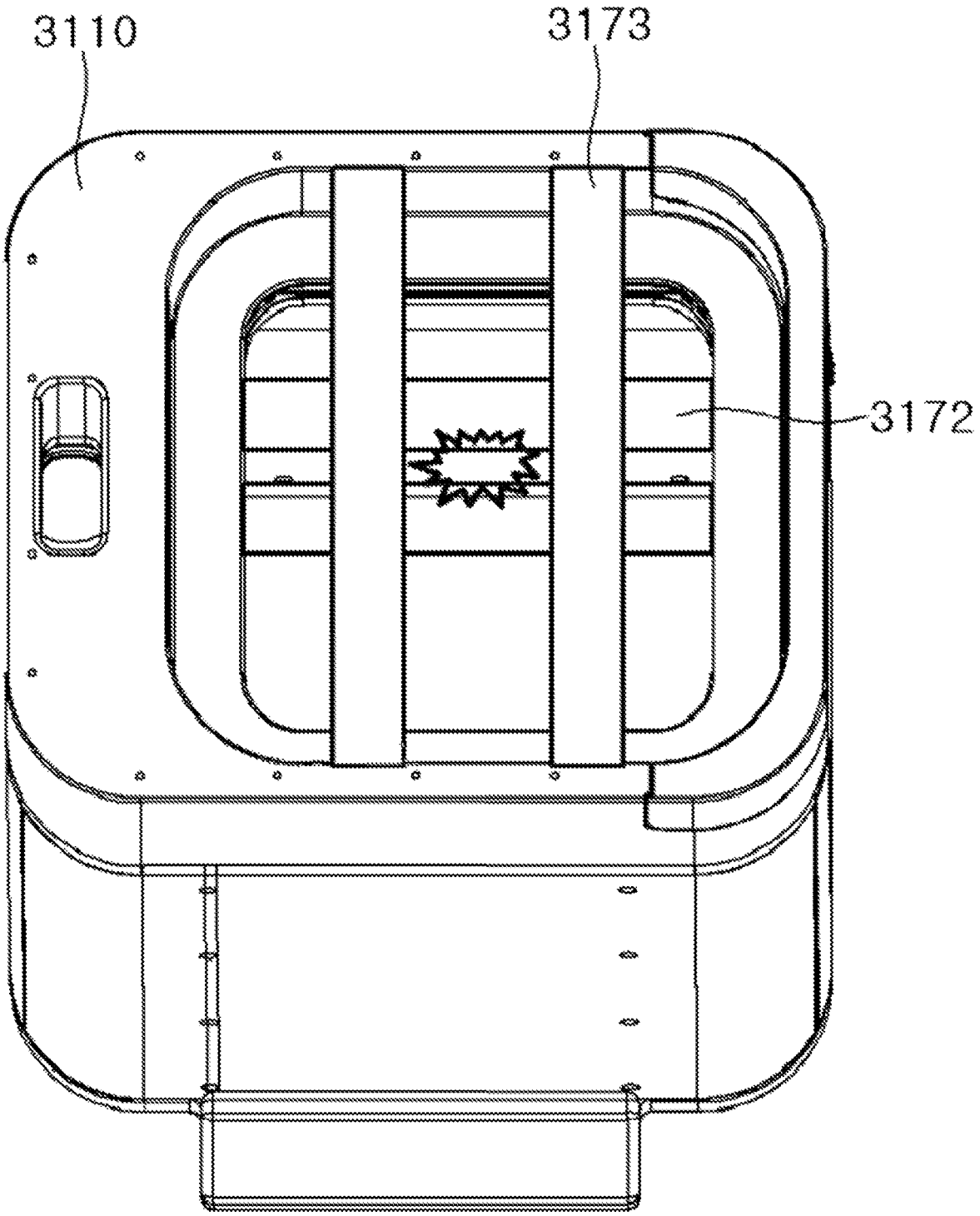

Meanwhile, FIGS. 47 and 48 are operational views illustrating states in which the roll vinyl film is joined in the cleaner station according to the second embodiment of the present specification.

Referring to FIGS. 47 and 48, the cleaner station 3100 may include a joint part. The joint part may be disposed in the housing 3110. The joint part may be disposed in an upper region of the dust collecting part 3170. The joint part may cut and join the upper region of the roll vinyl film 3171 in which the dust is captured. Specifically, the joint part may retract the roll vinyl film 3171 to a central region and join the upper region of the roll vinyl film 3171 using a heating wire. The joint part may include a first joint member 3172 and a second joint member 3173. The first joint member 3172 may be moved in a first direction by a first joint drive part 3174, and the second joint member 3173 may be moved in a second direction perpendicular to the first direction by a second joint drive part 3175.

Figure 38:
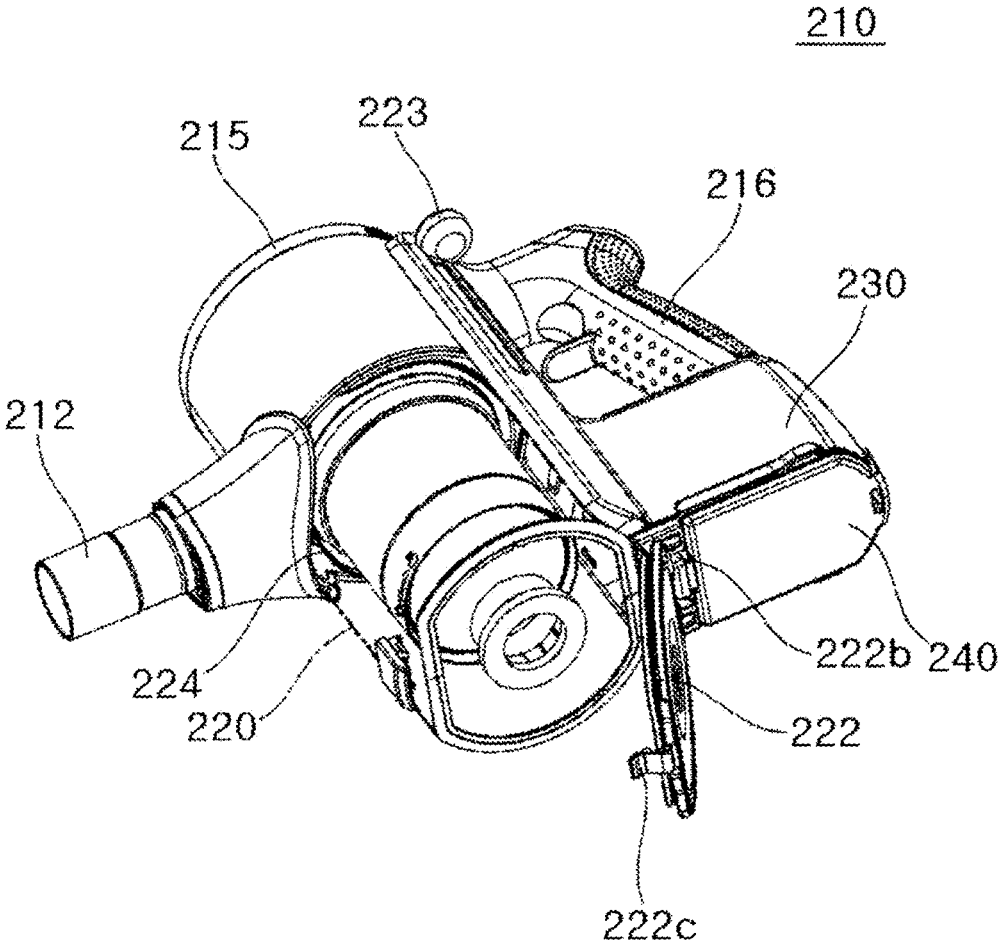
FIGS. 38 and 39 are operational views illustrating a compression member of the first cleaner according to the present disclosure.
Figure 39:
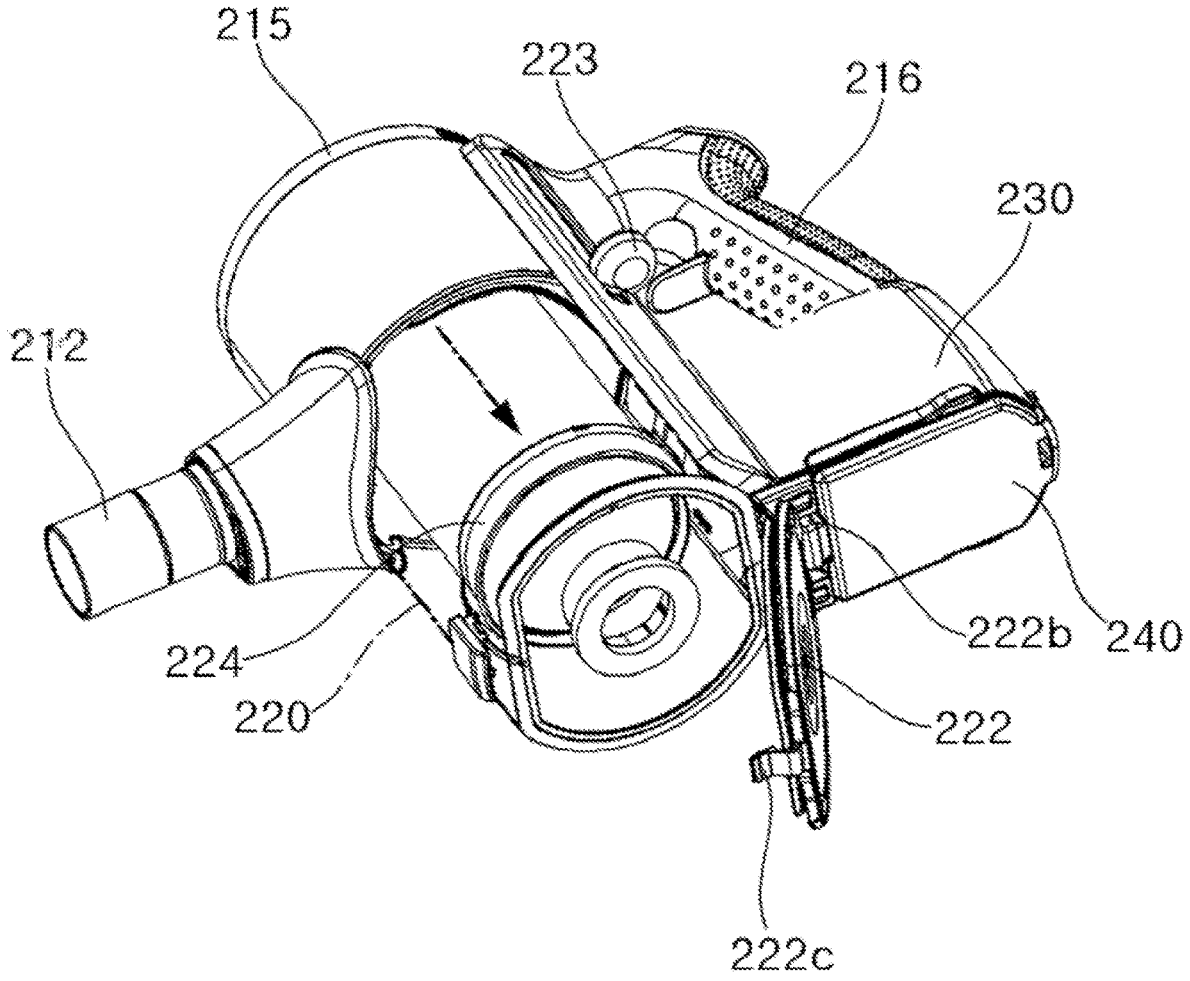

Meanwhile, FIGS. 38 and 39 are operational views illustrating the compression part of the first cleaner according to the embodiment of the present specification.

Referring to FIGS. 38 and 39, when the compression lever 223 moves downward, the compression member 224 moves downward to move the dust in the dust bin 220 downward. In the embodiment of the present specification, the dust in the dust bin 220 may be captured primarily into the dust collecting part 3170 by gravity as the discharge cover 222 is separated from the dust bin 220, and then the residual dust in the dust bin 220 may be captured secondarily into the dust collecting part 3170 by the compression member 224. Otherwise, the compression member 224 may compress the dust in the dust bin 220 downward in the state in which the discharge cover 222 is coupled to the dust bin 220, and then the discharge cover 222 may be separated from the dust bin 220, such that the dust in the dust bin 220 may be captured into the dust collecting part 3170.

FIGS. 40 to 44 are views for explaining another embodiment of the cleaner system according to the second embodiment of the present disclosure.

Figure 40:
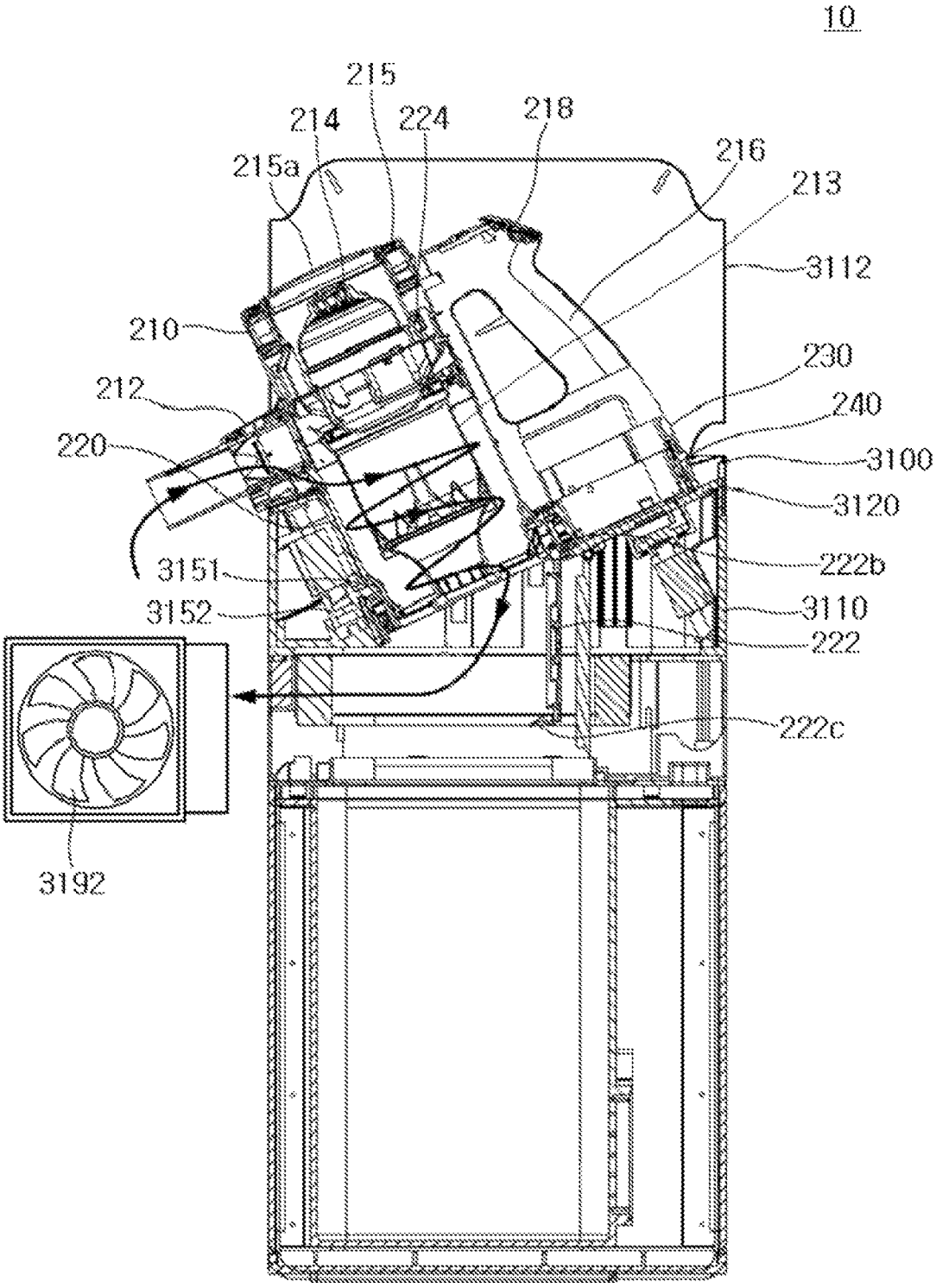
FIGS. 40 to 44 are cross-sectional views illustrating cleaner systems according to other embodiments of the present disclosure.

Referring to FIG. 40, the cleaner station 3100 according to another embodiment of the present specification may include a first flow part 3192. The first flow part 3192 may allow air to flow to the suction part 212 of the first cleaner 200. The air flowing to the suction part 212 of the first cleaner 200 may move the residual dust in the dust bin 220 downward to capture the residual dust into the dust collecting part 3170. Therefore, it is possible to improve the suction force of the first cleaner 200 by preventing the residual dust from remaining in the dust bin 220. Further, it is possible to remove an offensive odor caused by the residual dust by preventing the residual dust from remaining in the dust bin 220.

Figure 41:
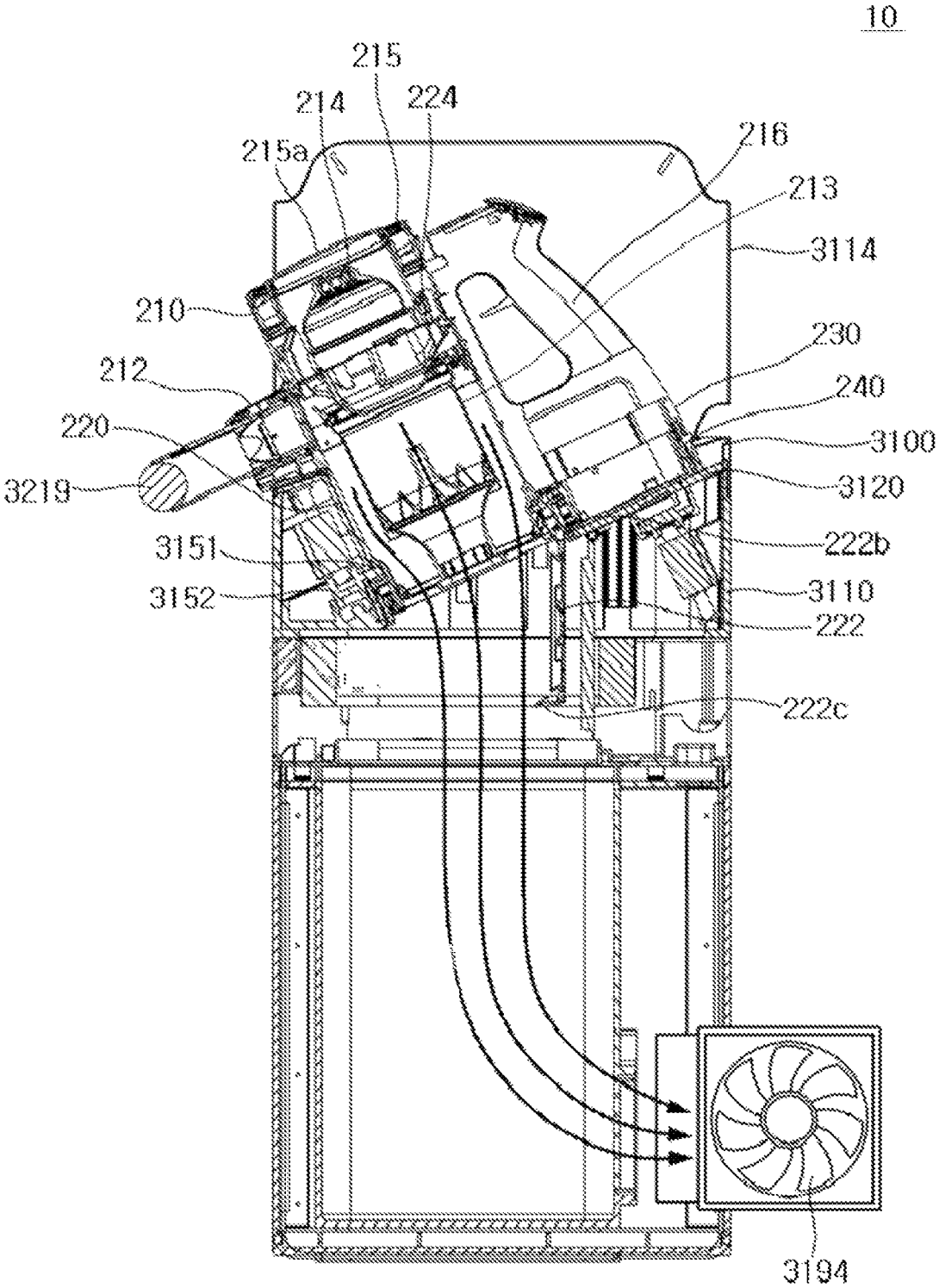

Referring to FIG. 41, the cleaner station 3100 according to another embodiment of the present specification may include a sealing member 3219 configured to seal the suction part 212 of the main body 210 of the first cleaner 200 coupled to the coupling part 3120, and a suction device 3194 configured to suck the dust in the dust bin 220 to capture the dust into the dust collecting part 3170. Therefore, it is possible to improve the suction force of the first cleaner 200 by preventing the residual dust from remaining in the dust bin 220. Further, it is possible to remove an offensive odor caused by the residual dust by preventing the residual dust from remaining in the dust bin 220.

Figure 42:
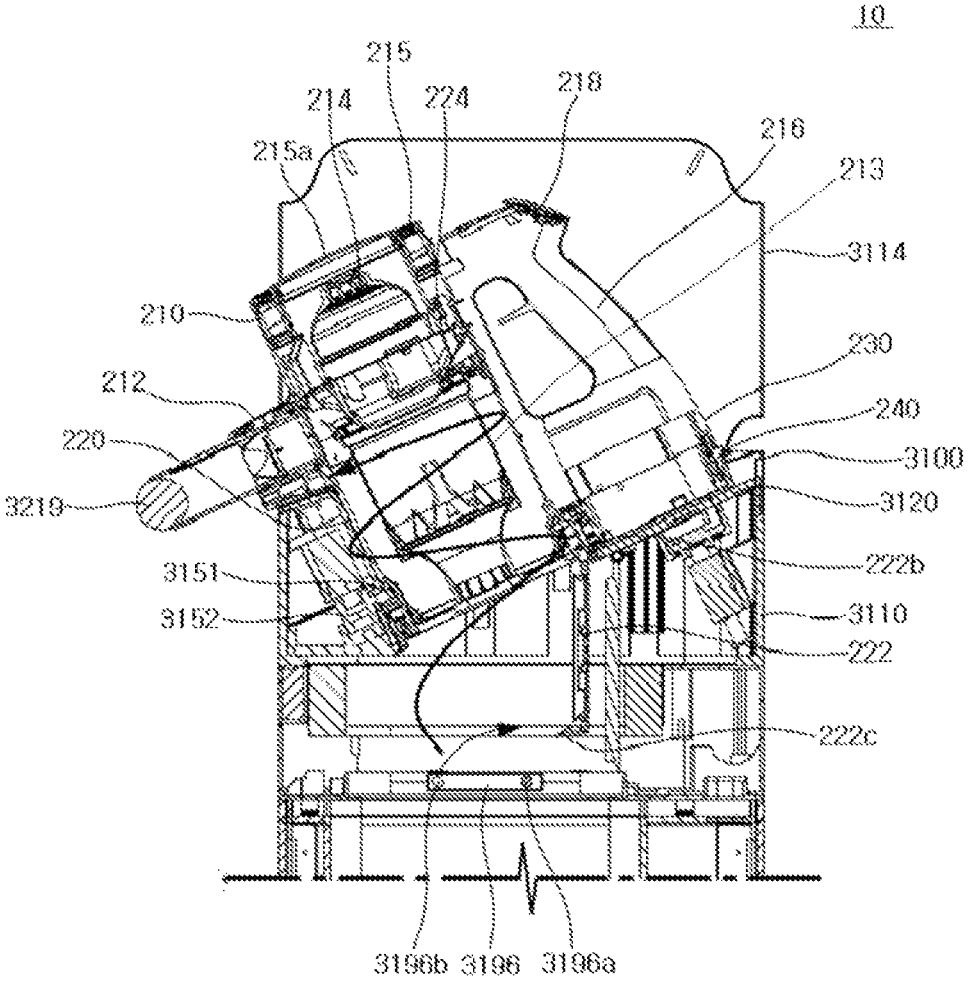

Referring to FIG. 42, the cleaner station 3100 according to another embodiment of the present specification may include the sealing member 3219 configured to seal the suction part 212 of the main body 210 of the first cleaner 200 coupled to the coupling part 3120, and a second flow part 3196 configured to allow air to flow to the dust bin 220. It can be understood that the second flow part 3196 is identical to the first flow part 3192. The second flow part 3196 may allow the air to flow into the dust bin 220 instead of the suction part 212. The air introduced into the dust bin 220 of the first cleaner 200 may move the residual dust in the dust bin 220 downward to capture the residual dust into the dust collecting part 3170. Therefore, it is possible to improve the suction force of the first cleaner 200 by preventing the residual dust from remaining in the dust bin 220. Further, it is possible to remove an offensive odor caused by the residual dust by preventing the residual dust from remaining in the dust bin 220.

The second flow part 3196 may include a discharge part 3196*b* configured to discharge air, and a drive part (not illustrated) configured to rotate the discharge part 3196*b* about the first shaft 3196*a*. The discharge part 3196*b* may rotate about the first shaft 3196*a* to allow the air to flow to various regions in the dust bin 220, thereby efficiently removing the residual dust in the dust bin 220.

Figure 43:
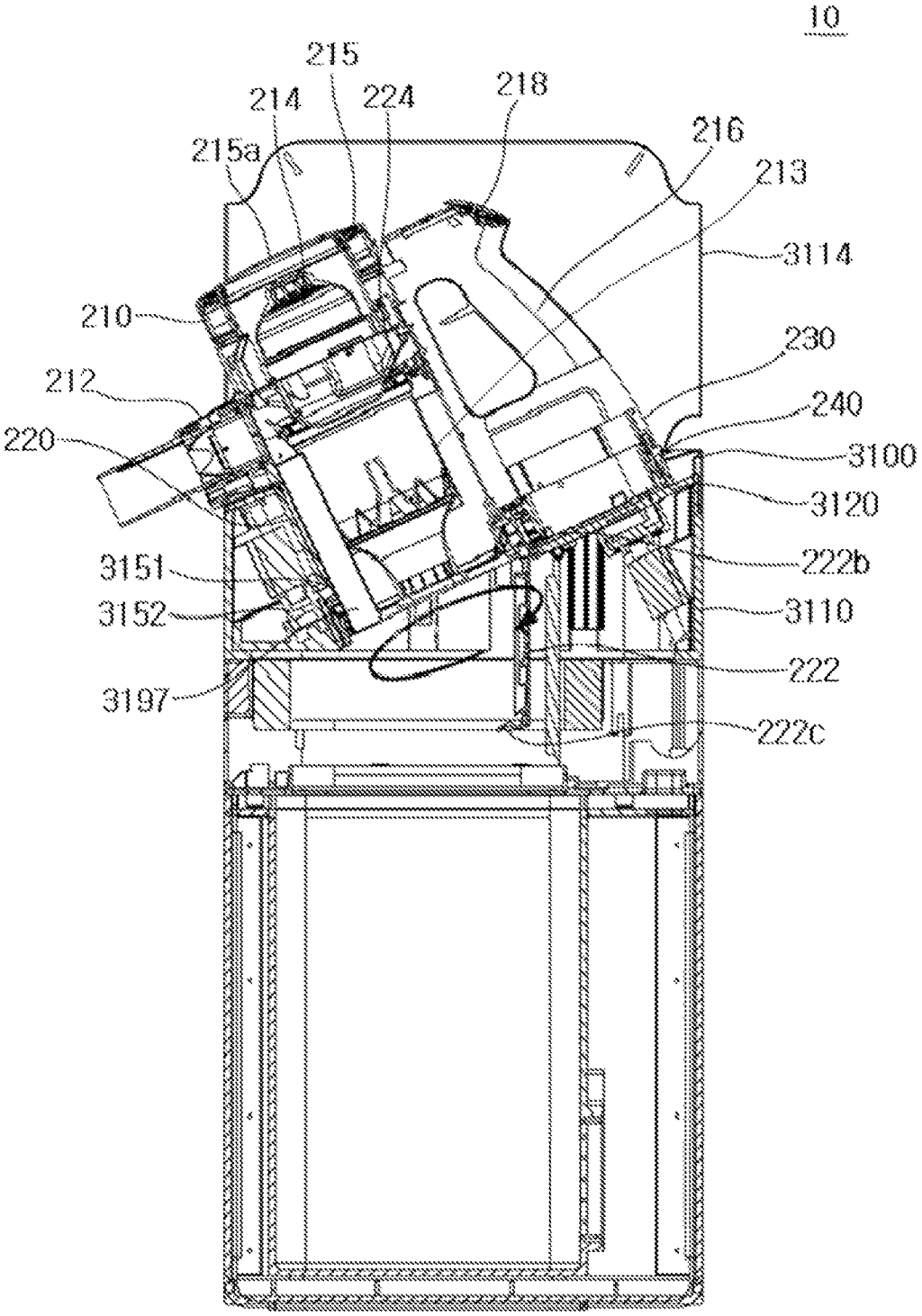
Figure 44:
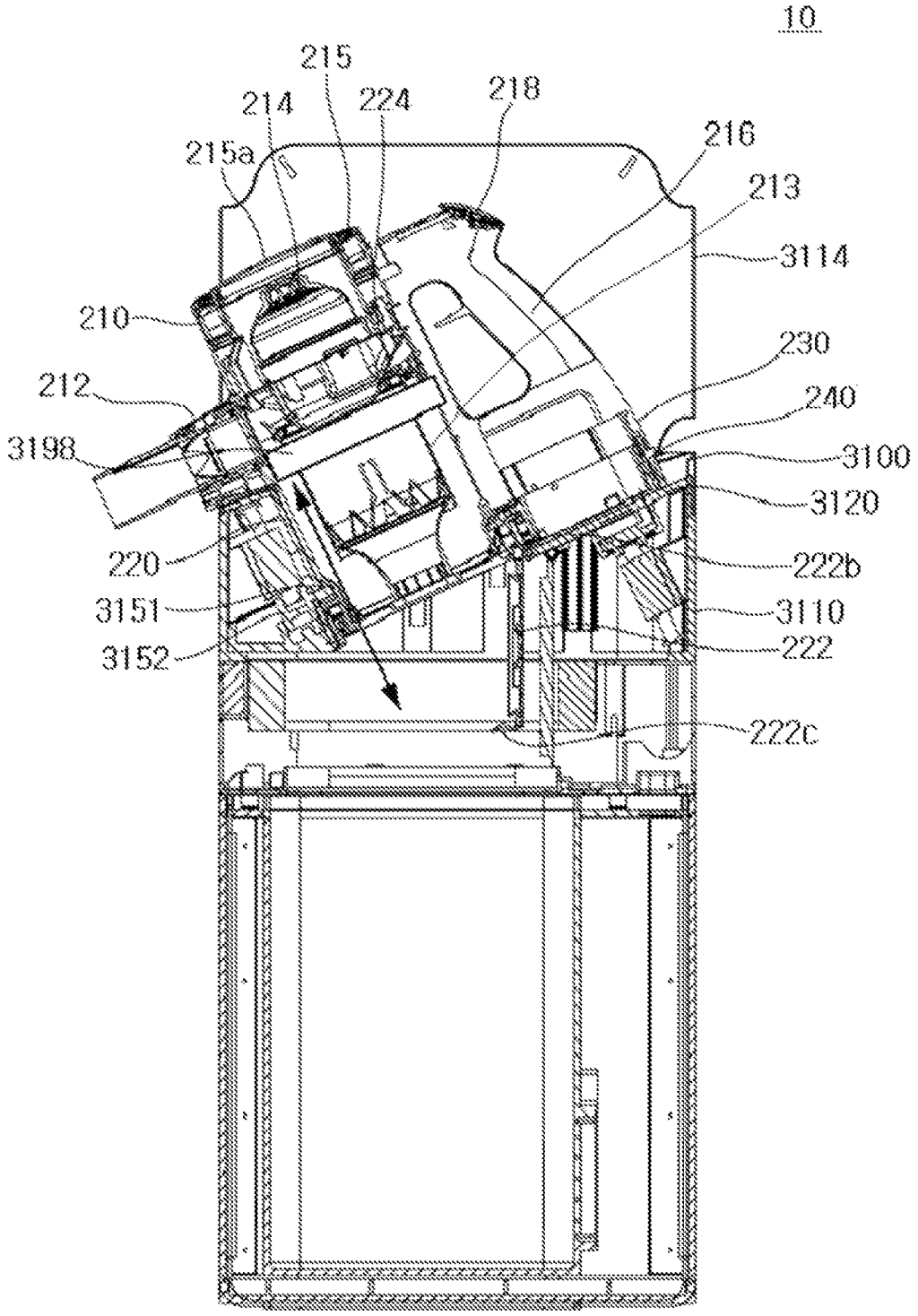

Referring to FIGS. 43 and 44, the cleaner station 3100 according to another embodiment of the present specification may include a removing part configured to remove the residual dust in the dust bin 220 by moving in the dust bin 220.

The removing part may include a first removing member 3197. The first removing member 3197 may rotate about the central region of the dust bin 220 to scrape down the residual dust in the dust bin 220.

The removing part may include a second removing member 3198. The second removing member 3198 may scrape down the residual dust in the dust bin 220 while moving from the upper side to the lower side of the dust bin 220.

Therefore, it is possible to improve the suction force of the first cleaner 200 by preventing the residual dust from remaining in the dust bin 220. Further, it is possible to remove an offensive odor caused by the residual dust by preventing the residual dust from remaining in the dust bin 220.

Figure 45:
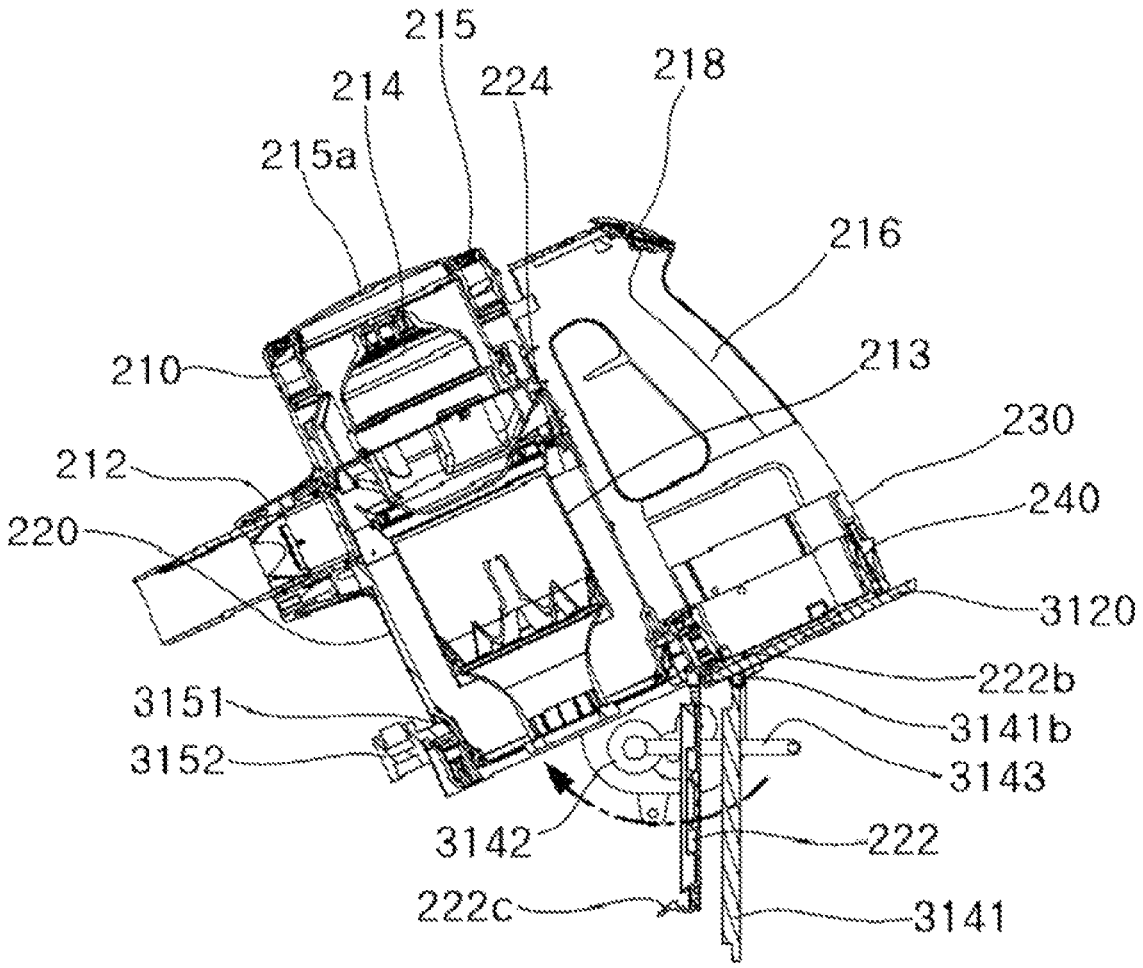
FIGS. 45 and 46 are views illustrating states in which the discharge cover of the first cleaner according to the second embodiment of the present disclosure is opened or closed.
Figure 46:
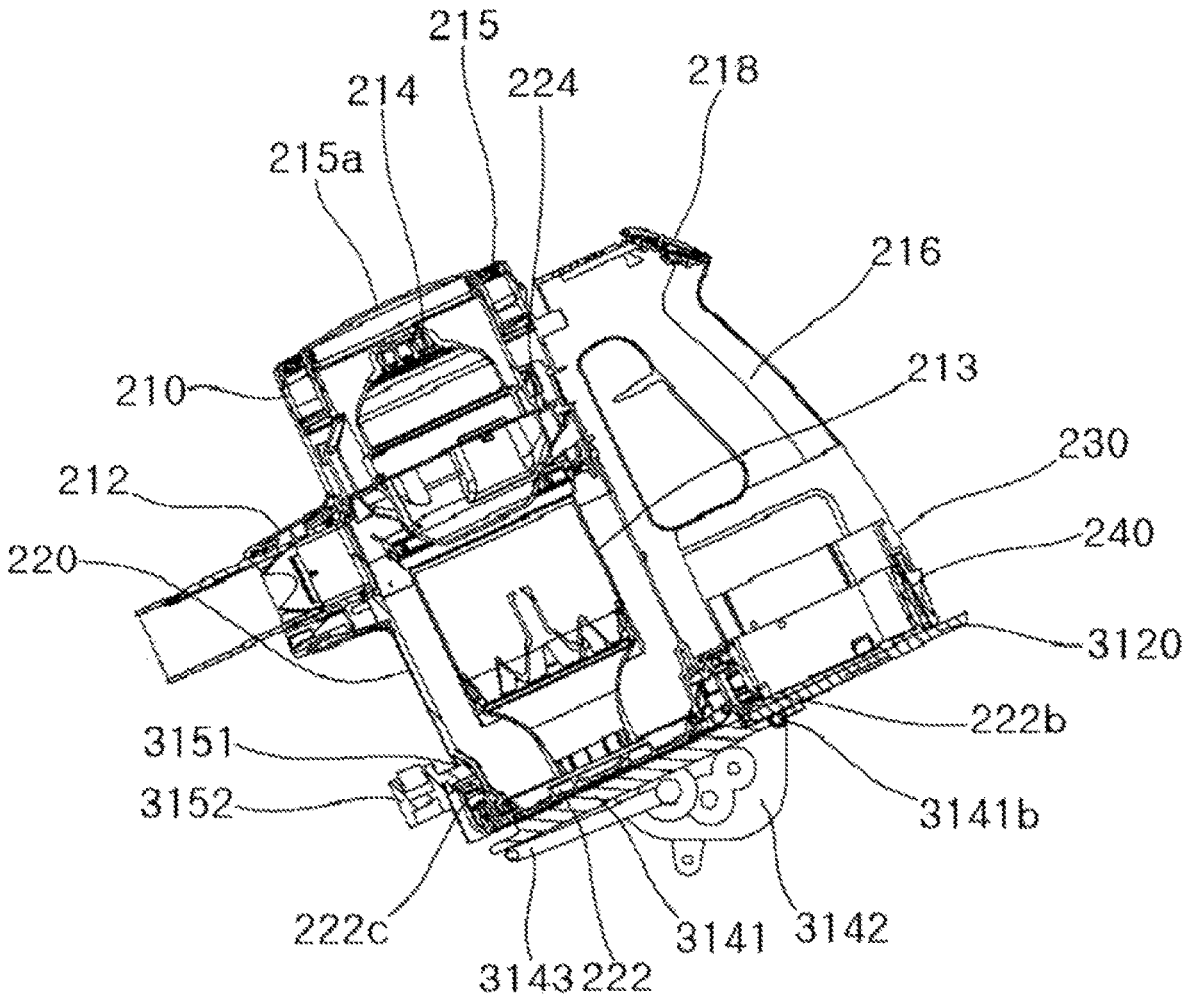

Meanwhile, FIGS. 45 and 46 are views illustrating states in which the discharge cover of the first cleaner according to the second embodiment of the present specification is opened and closed.

Referring to FIGS. 45 and 46, when the dust is removed from the dust bin 220 of the first cleaner 200, the door motor 3142 may rotate the door 3141 to couple the discharge cover 222 to the dust bin 220. Specifically, the door motor 3142 may rotate the door 3141 about the hinge part 3142*b* by rotating the door arm 3143, and the door 3141 rotating about the hinge part 3142*b* may push the discharge cover 222 upward. In this case, the discharge cover 222 may be rotated about the hinge part 222*b*, and the coupling lever 222*c* may be coupled to the dust bin 220.

Figure 49:
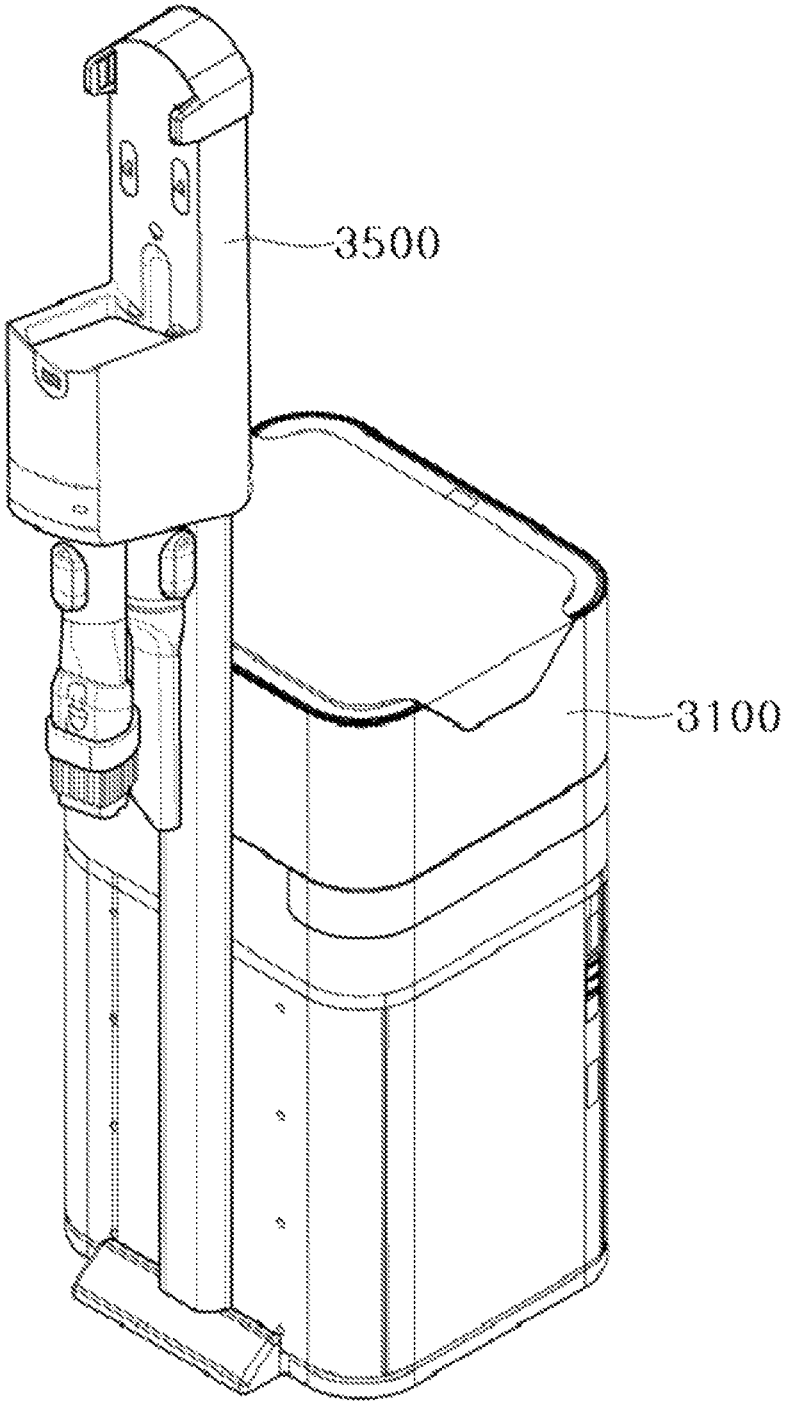
FIG. 49 is a perspective view illustrating the cleaner station according to the second embodiment of the present disclosure.
Figure 50:
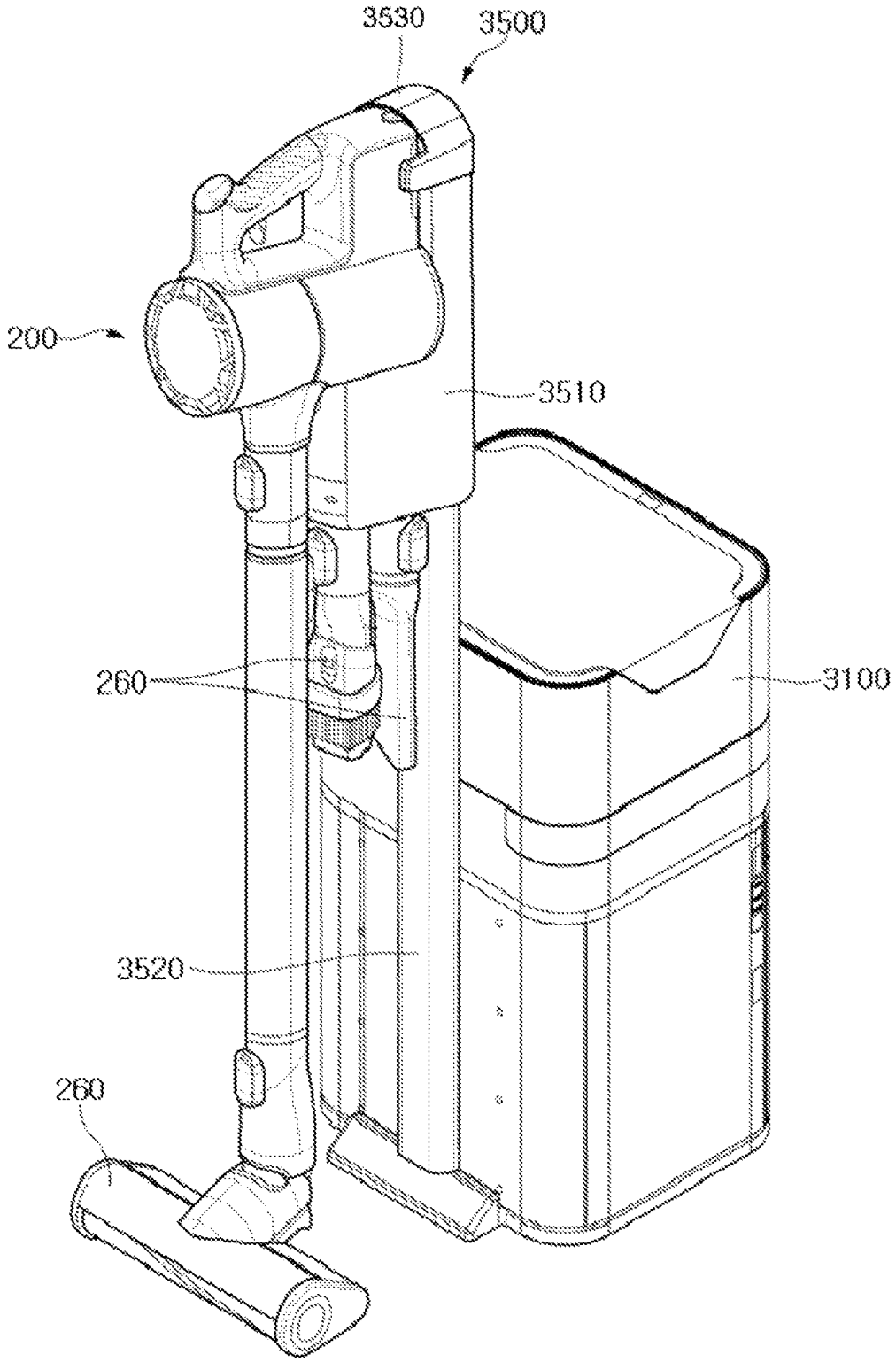
FIG. 50 is a perspective view illustrating the cleaner system according to the second embodiment of the present disclosure.

Meanwhile, FIGS. 49 and 50 are perspective views for explaining an embodiment in which a mount is additionally provided on the cleaner station according to the second embodiment of the present specification.

Referring to FIGS. 49 and 50, the cleaner station 3100 according to the embodiment of the present specification may include a mount 3500. The mount 3500 may extend in the upward/downward direction. The mount 3500 may be separably coupled to the housing 3110. Otherwise, the mount 3500 may be formed integrally with the housing 3110. The first cleaner 200 may be mounted on the mount 3500. The mount 3500 may support the first cleaner 200.

The mount 3500 may include a main body part 3510. The main body part 3510 may be disposed on a support part 3520. The main body part 3510 may disposed on an upper portion of the support part 3520. The main body part 3510 may be supported by the support part 3520. The main body part 3510 may be separably coupled to the support part 3520. The first cleaner 200 may be coupled to the main body part 3510. The main body part 3510 may charge the battery 240 of the first cleaner 200.

The mount 3500 may include the support part 3520. The support part 3520 may be separably coupled to the housing 3110. Otherwise, the support part 3520 may be formed integrally with the housing 3110. The support part 3520 may support the main body part 3510. In the embodiment of the present specification, an example in which the support part 3520 is provided on the lateral surface of the housing 3110 is described, but the present disclosure is not limited thereto, and the support part 3520 may be disposed on the upper surface of the housing 3110. In addition, in the embodiment of the present specification, an example in which the support part 3520 is formed in a hexahedral shape extending in the upward/downward direction is described. However, the shape of the support part 3520 may be variously changed as long as the support part 3520 may support the main body part 3510.

The mount 3500 may include a locking part 3530. The locking part 3530 may be disposed on an upper portion of the main body part 3510. The locking part 3530 may be coupled to the first cleaner 200 to stably fix the first cleaner 200. The locking part 3530 may include a plurality of locking members provided to be spaced apart from one another in the horizontal direction. The main body 210 of the first cleaner 200 may be fitted into a space between the plurality of locking members from above. In this case, the outer surface of the main body 210 of the first cleaner 200 may be slidably coupled to an inner surface of the locking part 3530. A sliding groove may be formed in the inner surface of the locking part 3530, and a sliding protrusion, which is slidably coupled to the sliding groove of the locking part 3530, may be formed on the outer surface of the main body 210 of the first cleaner 200. On the contrary, a sliding protrusion may be formed on the inner surface of the locking part 3530, and a sliding groove may be formed in the outer surface of the main body 210 of the first cleaner 200.

Additional cleaning modules may be disposed on the mount 3500. The additional cleaning modules may be detachably coupled to the mount 3500. In general, the first cleaner 200 may have a variety of replaceable cleaning modules suitable for each application. Therefore, the additional cleaning module, which is not used, is stored by being coupled to the mount 3500, and as a result, it is possible to reduce a risk of loss of the additional cleaning module. The additional cleaning module may be referred to as an 'accessory'.

Figure 51:
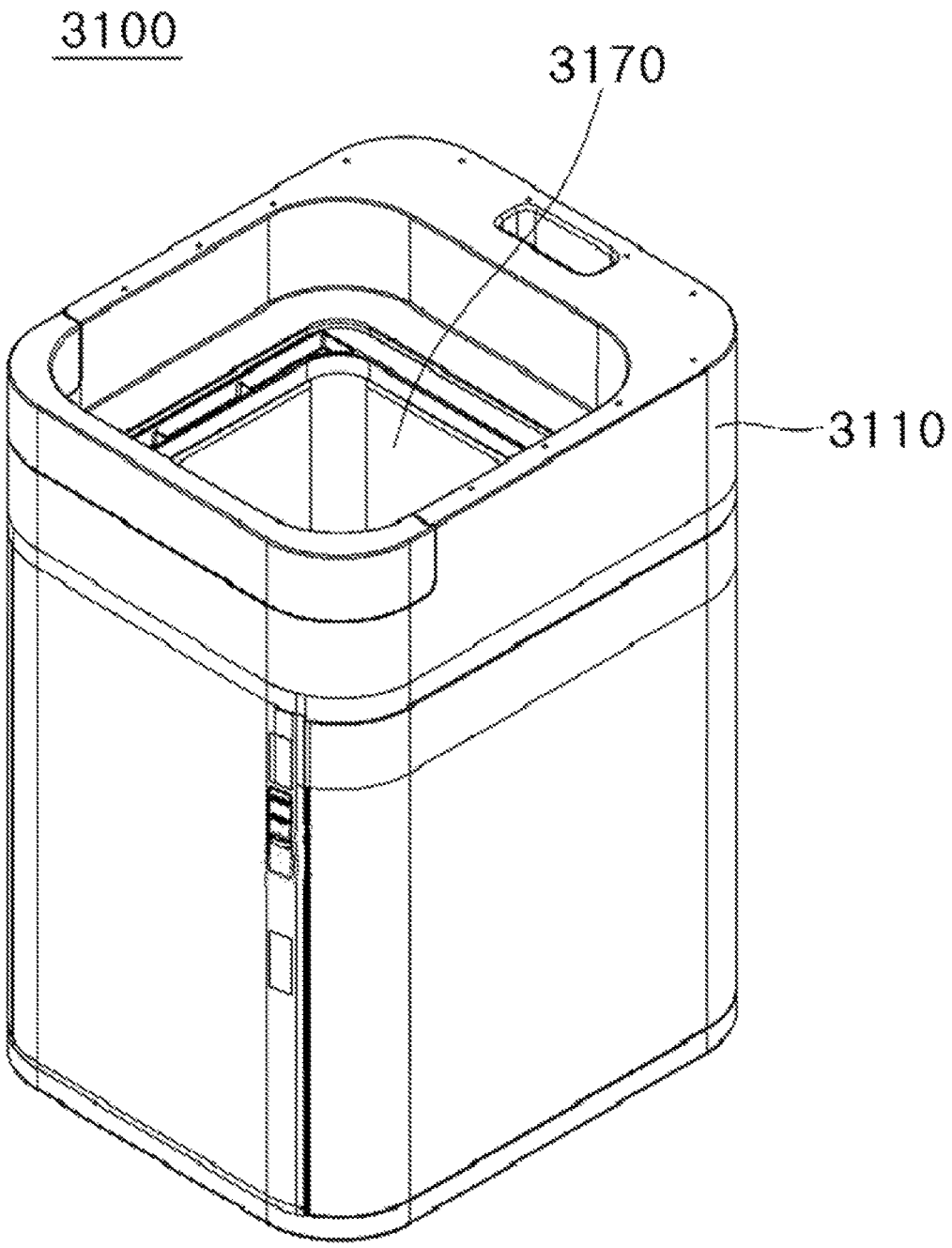
FIG. 51 is a perspective view illustrating some components of the cleaner station according to the second embodiment of the present disclosure.

Meanwhile, FIG. 51 is a perspective view for explaining some components of the cleaner station according to the second embodiment of the present specification.

Referring to FIG. 51, the coupling part 3120 of the cleaner station 3100 according to the second embodiment of the present disclosure may be separated. Specifically, the coupling part 3120 and the first door member 3114 of the cleaner station 3100 may be separably coupled to the housing 3110. When the coupling part 3120 is removed, the dust collecting part 3170 disposed in the housing 3110 may be exposed upward, and the user may use the cleaner station 3100 as a general trash can. In addition, when the dust collecting part 3170 is filled with the dust, the user may easily remove and/or replace the dust collecting part 3170, and as a result, it is possible to provide convenience for the user.

Figure 52:
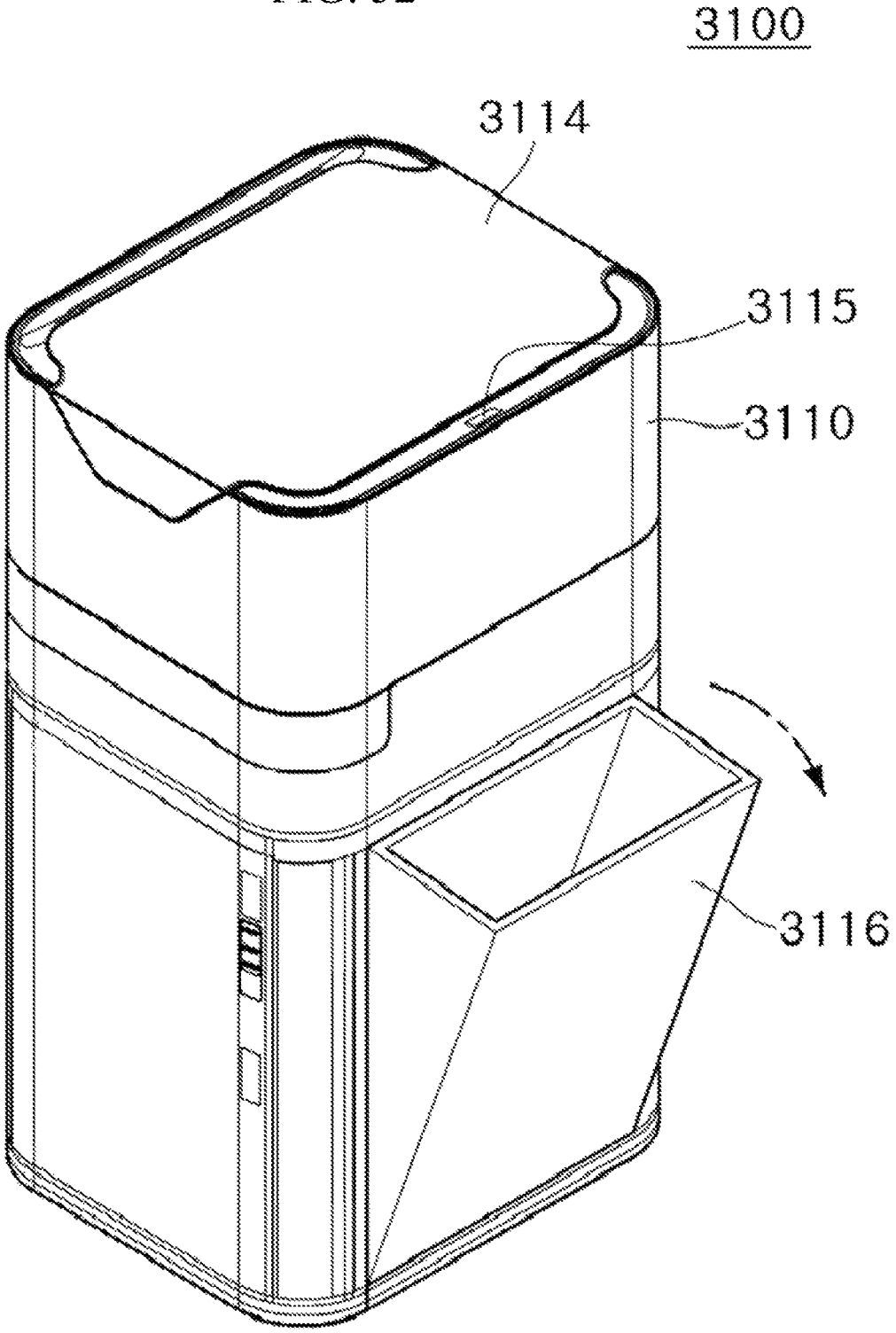
FIG. 52 is a perspective view illustrating the cleaner station according to the second embodiment of the present disclosure.

Meanwhile, FIG. 52 is a perspective view for explaining an embodiment in which the cleaner station according to the second embodiment of the present specification has a second door member.

Referring to FIG. 52, the cleaner station 3100 according to the embodiment of the present specification may include a second door member 3116. The second door member 3116 may be disposed at the lateral side of the cleaner station 3100. The second door member 3116 may communicate with the dust collecting part 3170. Specifically, when the second door member 3116 is opened, the dust collecting part 3170 may be exposed to the outside, and the user may use the cleaner station 3100 as a general trash can. In addition, when the dust collecting part 3170 is filled with the dust, the user may easily remove and/or replace the dust collecting part 3170, and as a result, it is possible to provide convenience for the user.

Figure 53:
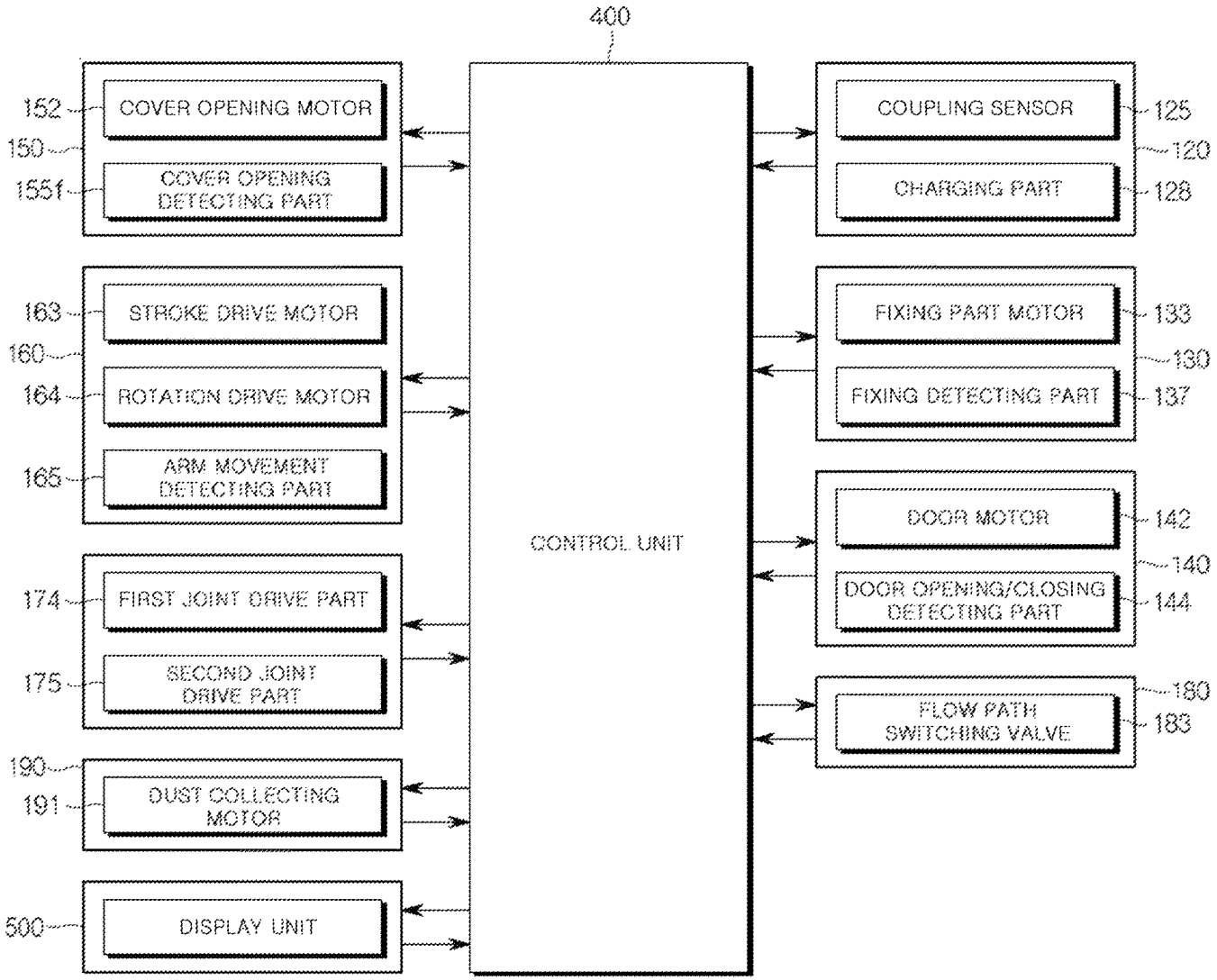
FIG. 53 is a block diagram for explaining a control configuration of the cleaner station according to the embodiment of the present disclosure.

Meanwhile, FIG. 53 is a block diagram for explaining a control configuration of the cleaner station according to the embodiment of the present disclosure.

The control configuration according to the present disclosure will be described below with reference to FIG. 53.

The cleaner station 100 according to the embodiment of the present disclosure may further include a control unit 400 configured to control the coupling part 120, the fixing unit 130, the door unit 140, the cover opening unit 150, the lever pulling unit 160, the dust collecting part 170, the flow path part 180, and the dust suction module 190.

The control unit 400 may be disposed at the upper side in the housing 110. For example, the control unit 400 may be disposed on the coupling part 120. With this arrangement, the control unit 400, the fixing unit 130, the door unit 140, the cover opening unit 150, and the lever pulling unit 160 are disposed adjacent to one another, and as a result, response performance may be improved.

Otherwise, the control unit 400 may be disposed at the lower side in the housing 110. For example, the control unit 400 may be disposed in the dust suction module 190. With this arrangement, the control unit 400 may be disposed adjacent to the relatively heavy dust collecting motor 191 and disposed adjacent to the ground surface, such that the control unit 400 may be stably supported. As a result, it is possible to prevent damage to the control unit 400 even though external impact is applied to the control unit 400.

The control unit 400 may include a printed circuit board, and elements mounted on the printed circuit board.

When the coupling sensor 125 detects the coupling of the first cleaner 200, the coupling sensor 125 may transmit a signal indicating that the first cleaner 200 is coupled to the coupling part 120. In this case, the control unit 400 may receive the signal from the coupling sensor 125 and determine that the first cleaner 200 is physically coupled to the coupling part 120.

In addition, when the charging part 128 supplies power to the battery 240 of the first cleaner 200, the control unit 400 may determine that the first cleaner 200 is electrically coupled to the coupling part 120.

Therefore, when the control unit 400 determines that the first cleaner 200 is physically and electrically coupled to the coupling part 120, the control unit 400 may determine that the first cleaner 200 is coupled to the cleaner station 120.

When the control unit 400 determines that the first cleaner 200 is coupled to the coupling part 120, the control unit 400 may operate the fixing drive part 133 to fix the first cleaner 200.

When the fixing members 131 or the fixing part links 135 are moved to the predetermined fixing point FP1, the fixing detecting part 137 may transmit a signal indicating that the first cleaner 200 is fixed. The control unit 400 may receive the signal, which indicates that the first cleaner 200 is fixed, from the fixing detecting part 137 and determine that the first cleaner 200 is fixed. When the control unit 400 determines that the first cleaner 200 is fixed, the control unit 400 may stop the operation of the fixing drive part 133.

Meanwhile, when the operation of emptying the dust bin 200 is ended, the control unit 400 may rotate the fixing drive part 133 in the reverse direction to release the first cleaner 200.

When the control unit 400 determines that the first cleaner 200 is fixed to the coupling part 120, the control unit 400 may operate the door motor 142 to open the door 141 of the cleaner station 100.

When the door 141 or the door arm 143 reaches the predetermined opened position DP1, the door opening/closing detecting part 144 may transmit a signal indicating that the door 141 is opened. The control unit 400 may receive the signal, which indicates that the door 141 is opened, from the door opening/closing detecting part 137 and determine that the door 141 is opened. When the control unit 400 determines that the door 141 is opened, the control unit 400 may stop the operation of the door motor 142.

Meanwhile, when the operation of emptying the dust bin 200 is ended, the control unit 400 may rotate the door motor 142 in the reverse direction to close the door 141.

When the control unit 400 determines that the door 141 is opened, the control unit 400 may operate the cover opening drive part 152 to open the discharge cover 222 of the first cleaner 200. As a result, the dust passage hole 121*a* may communicate with the inside of the dust bin 220. Therefore, the cleaner station 100 and the first cleaner 200 may be coupled to each other to enable a flow of a fluid (coupling of the flow path).

When the guide frame 151*e* reaches the predetermined opened position CP1, the cover opening detecting part 155*f* may transmit a signal indicating that the discharge cover 222 is opened. The control unit 400 may receive the signal, which indicates that the discharge cover 222 is opened, from the cover opening detecting part 155*f* and determine that the discharge cover 222 is opened. When the control unit 400 determines that the discharge cover 222 is opened, the control unit 400 may stop the operation of the cover opening drive part 152.

The control unit 400 may operate the stroke drive motor 163 and the rotation drive motor 164 to control the lever pulling arm 161 so that the lever pulling arm 161 may pull the dust bin compression lever 223.

When the arm movement detecting part 165 detects that the arm gear 162 reaches the maximum stroke movement position LP2, the arm movement detecting part 165 may transmit a signal, and the control unit 400 may receive the signal from the arm movement detecting part 165 and stop the operation of the stroke drive motor 163.

When the arm movement detecting part 165 detects that the arm gear 162 is rotated to the position at which the arm gear 162 may pull the compression lever 223, the arm movement detecting part 165 may transmit a signal, and the control unit 400 may receive the signal from the arm movement detecting part 165 and stop the operation of the rotation drive motor 164.

In addition, the control unit 400 may operate the stroke drive motor 163 in the reverse direction to pull the lever pulling arm 161.

In this case, when the arm movement detecting part 165 detects that the arm gear 162 reaches the position LP3 when the compression lever 223 is pulled, the arm movement detecting part 165 may transmit a signal, and the control unit 400 may receive the signal from the arm movement detecting part 165 and stop the operation of the stroke drive motor 163.

Meanwhile, when the operation of emptying the dust bin 200 is ended, the control unit 400 may rotate the stroke drive motor 163 and the rotation drive motor 164 in the reverse direction to return the lever pulling arm 161 to the original position.

The control unit 400 may operate the first joint drive part 174 and the second joint drive part 175 to join the roll vinyl film (not illustrated).

The control unit 400 may control the flow path switching valve 183 of the flow path part 180. For example, the control unit 400 may selectively open or close the first cleaner flow path part 181 and the second cleaner flow path part 182.

The control unit 400 may operate the dust collecting motor 191 to suck the dust in the dust bin 220.

The control unit 400 may operate a display unit 500 to display a dust bin emptied situation and a charged situation of the first cleaner 200 or the second cleaner 300.

A specific control process of the control unit 400 over time will be described below.

Meanwhile, the cleaner station 100 according to the present disclosure may include the display unit 500.

The display unit 500 may be disposed on the housing 110, disposed on a separate display device, or disposed on a terminal such as a mobile phone.

The display unit 500 may be configured to include at least any one of a display panel capable of outputting letters and/or figures and a speaker capable of outputting voice signals and sound. The user may easily ascertain a situation of a currently performed process, a residual time, and the like on the basis of information outputted through the display unit 500.

Figure 15:
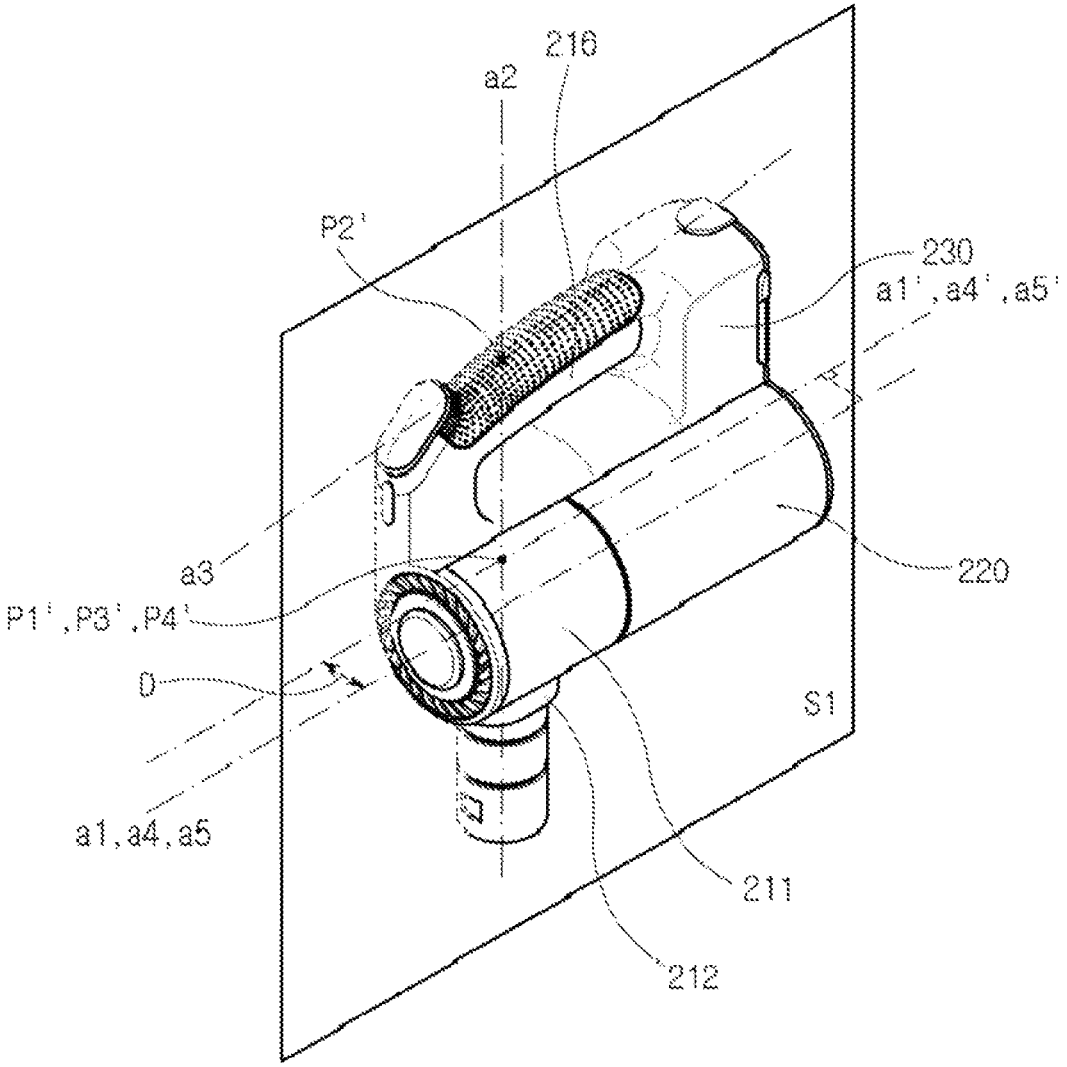
FIG. 15 is a view for explaining an imaginary plane and an orthogonal projection on the imaginary plane for expressing a weight distribution according to another embodiment of FIG. 14.
Figure 16:
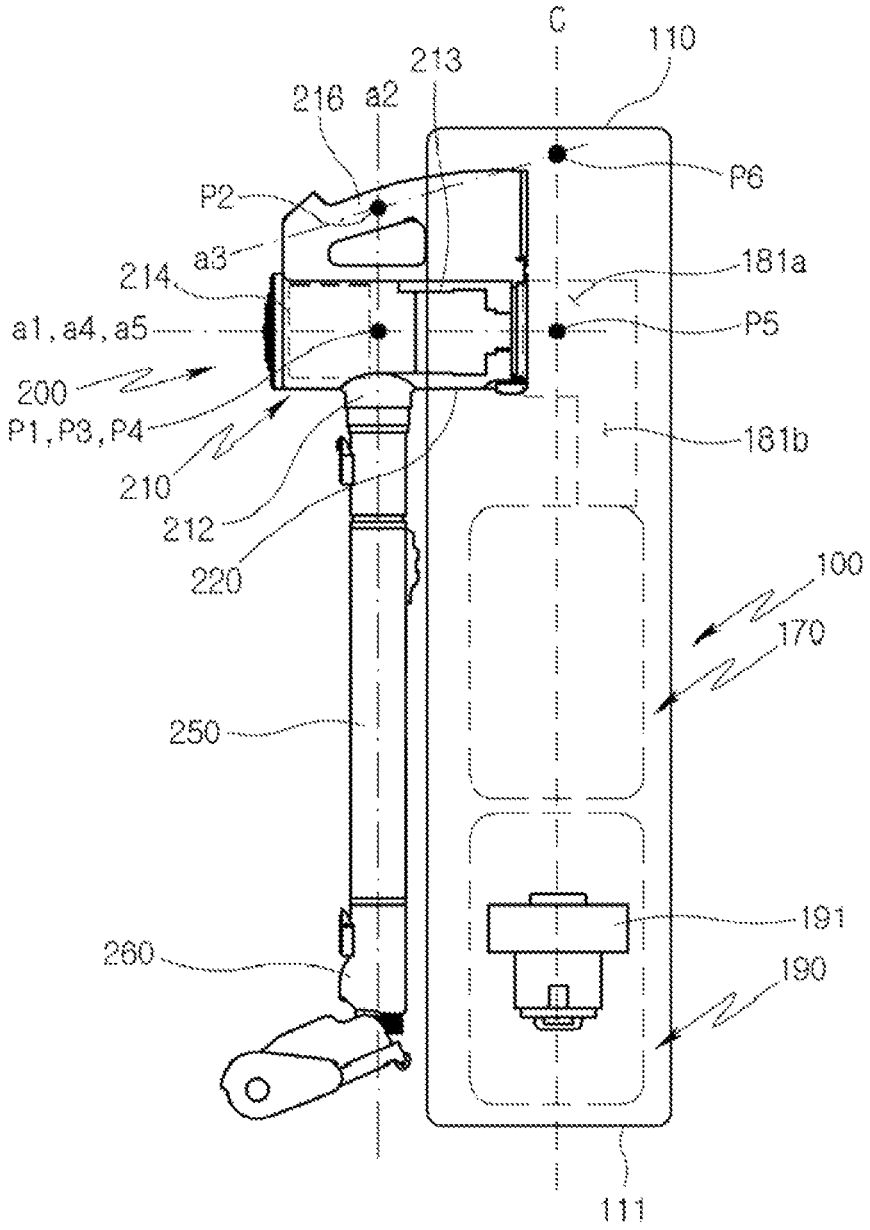
FIG. 16 is a view for explaining a weight distribution, in a state in which the first cleaner and the cleaner station are coupled, using an imaginary line in the cleaner system according to the embodiment of the present disclosure.
Figure 17A:
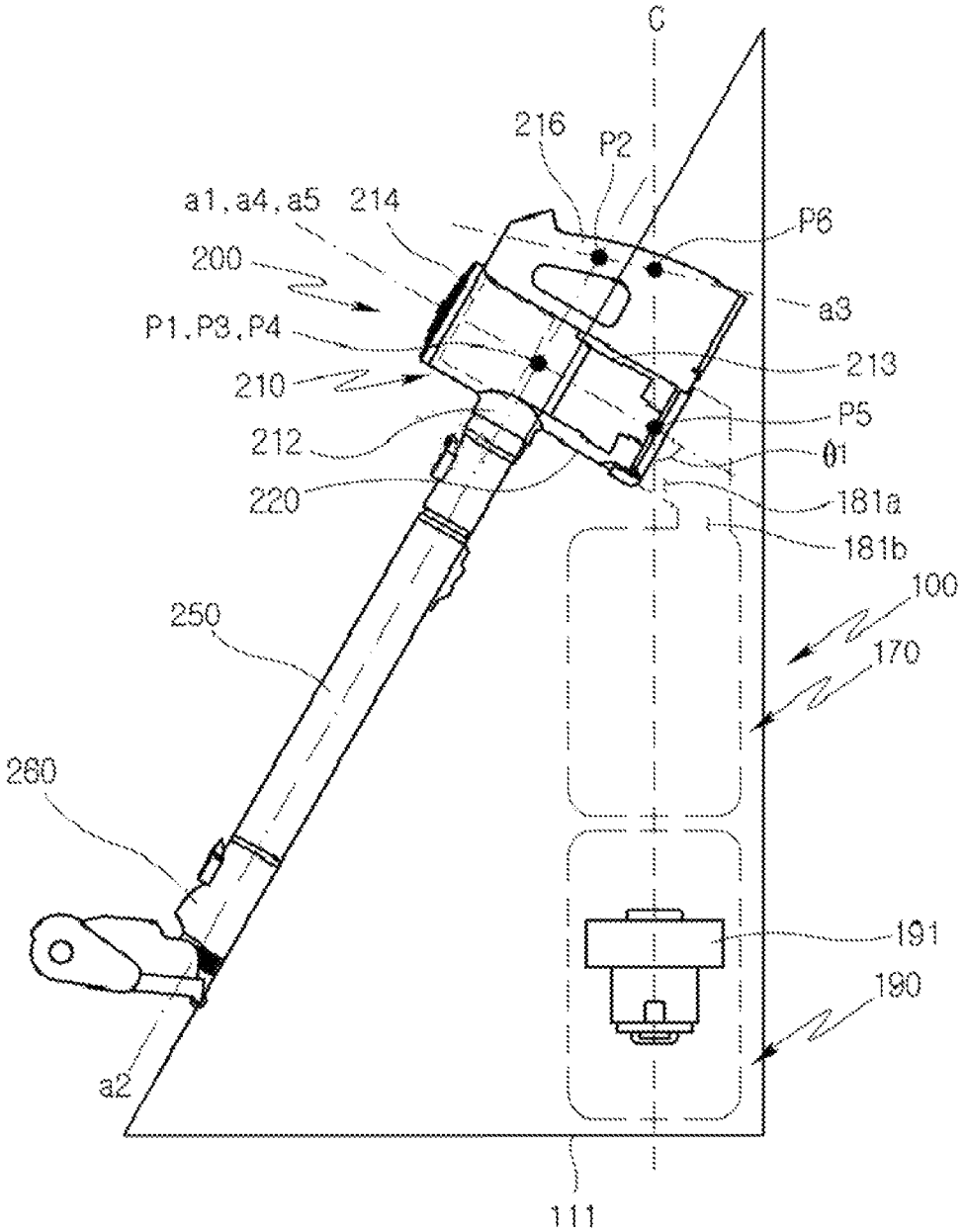
FIGS. 17A and 17B are views for explaining a weight distribution in a state in which the first cleaner is coupled to the cleaner station at a predetermined angle.
Figure 17B:
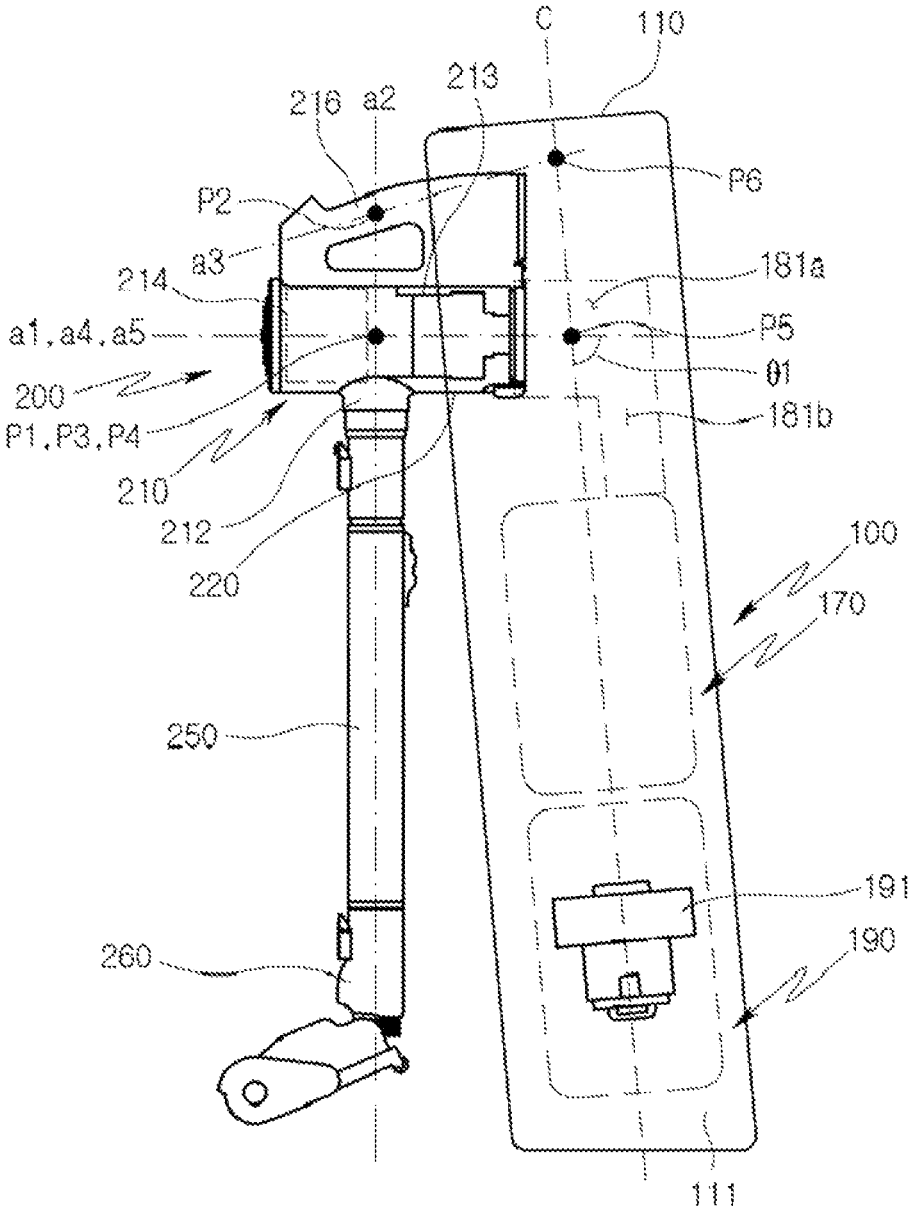
Figure 18:
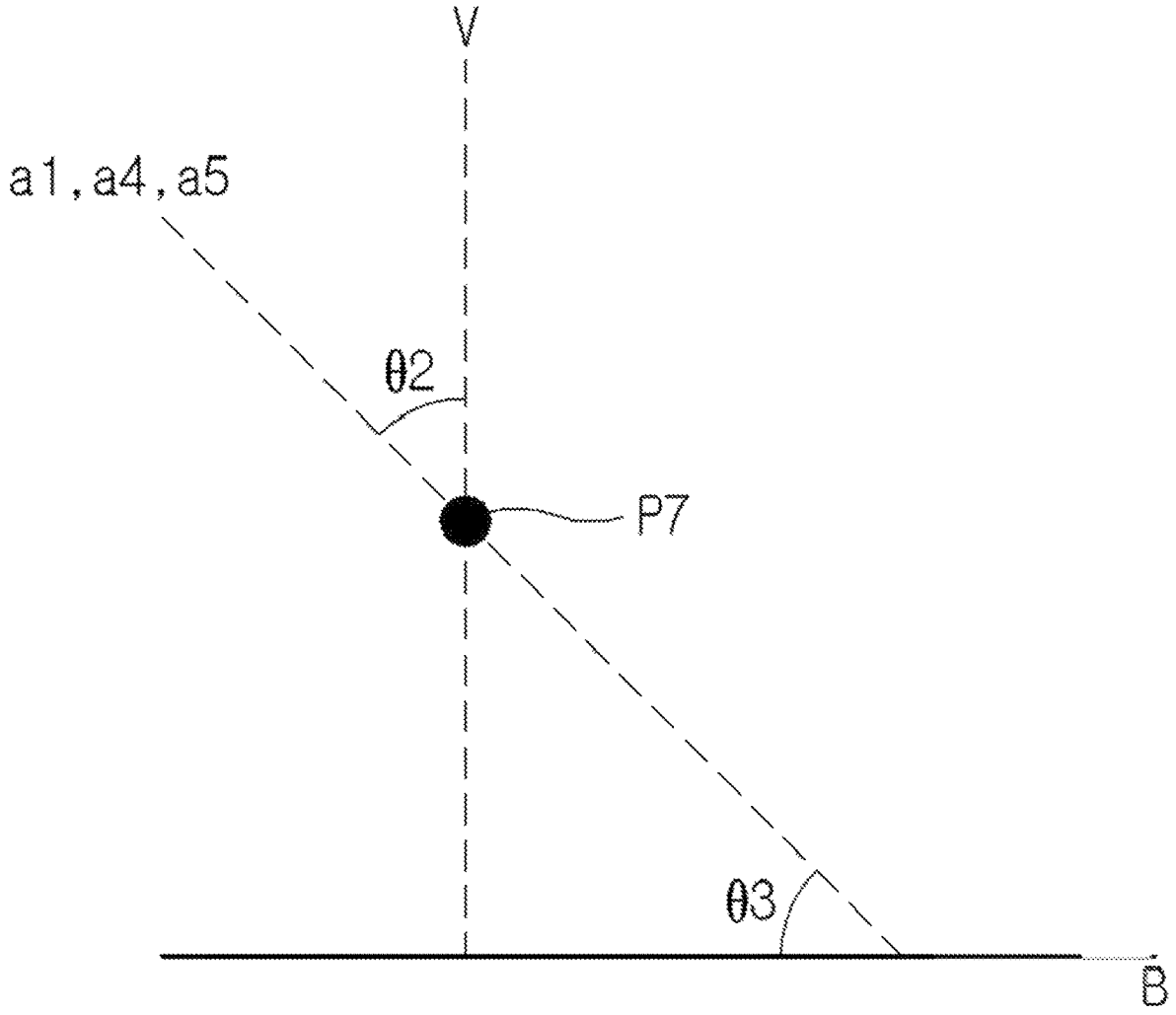
FIG. 18 is a view for explaining an angle defined between an imaginary line and a ground surface and an angle defined between the imaginary line and a perpendicular line to the ground surface in a state in which the first cleaner is coupled to the cleaner station at a predetermined angle.
Figure 21:
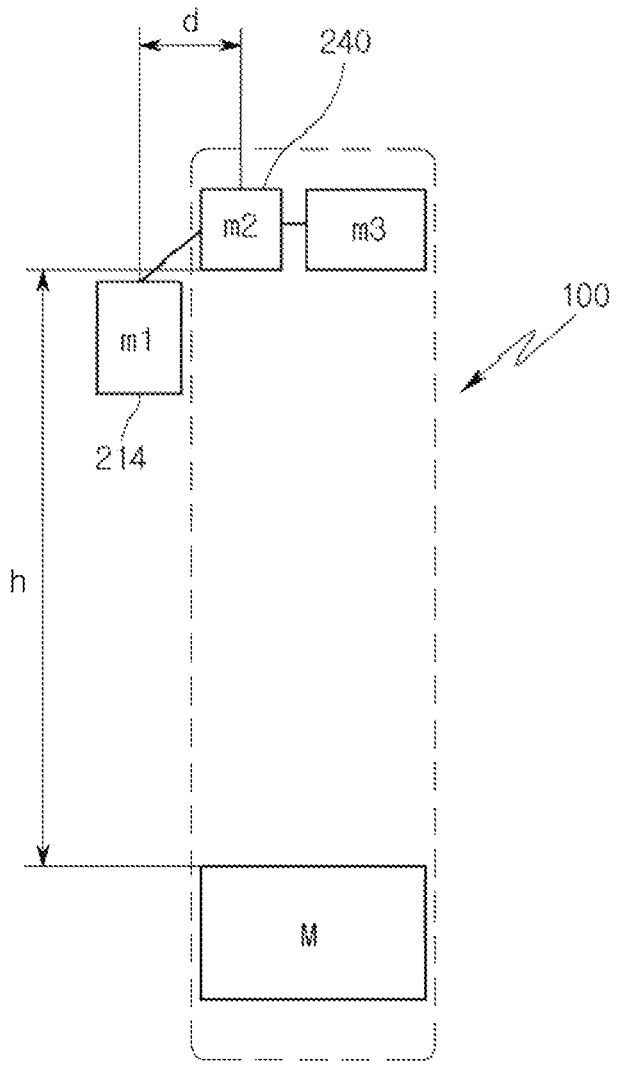
FIG. 21 is a view for explaining an arrangement relationship between relatively heavy components in a state in which the first cleaner and the cleaner station according to the embodiment of the present disclosure are coupled.

Meanwhile, FIG. 14 is a view for explaining a weight distribution using an imaginary plane penetrating the first cleaner in the cleaner system according to the embodiment of the present disclosure, FIG. 15 is a view for explaining an imaginary plane and an orthogonal projection on the imaginary plane for expressing a weight distribution according to another embodiment, FIG. 16 is a view for explaining a weight distribution, in a state in which the first cleaner and the cleaner station are coupled, using an imaginary line, FIGS. 17A to 18 are views for explaining an angle defined between an imaginary line and a ground surface and an angle defined between the imaginary line and a perpendicular line to the ground surface in a state in which the first cleaner is coupled to the cleaner station at a predetermined angle, FIG. 19 is a view for explaining an arrangement for maintaining the balance in a state in which the first cleaner and the cleaner station are coupled, FIG. 20 is a schematic view when viewing FIG. 19 in another direction, and FIG. 21 is a view for explaining an arrangement relationship between relatively heavy components in a state in which the first cleaner and the cleaner station are coupled.

The overall weight distribution and the maintenance of balance in the state in which the first cleaner 200 is mounted on the cleaner station 100 will be described below with reference to FIGS. 14 to 21.

In the present disclosure, the first cleaner 200 may be mounted on the outer wall surface 112 of the cleaner station 100. For example, the dust bin 220 and the battery housing 230 of the first cleaner 200 may be coupled to the coupling surface 121 of the cleaner station 100. That is, the first cleaner 200 may be mounted on the first outer wall surface 112*a*.

In this case, the suction motor axis a1 may be defined to be perpendicular to the first outer wall surface 112*a*. That is, the suction motor axis a1 may be defined in parallel with the ground surface. The suction motor axis a1 may be defined on a plane perpendicular to the ground surface. In addition, the suction motor axis a1 may be defined on a plane that perpendicularly intersects the first outer wall surface 112*a*.

Meanwhile, as another embodiment, the suction motor axis a1 may be defined in parallel with the first outer wall surface 112*a*. The suction motor axis a1 may be defined in the gravitational direction. That is, the suction motor axis a1 may be defined to be perpendicular to the ground surface. In addition, the suction motor axis a1 may be defined on the plane that perpendicularly intersects the first outer wall surface 112*a*.

The suction flow path through line a2 may be defined in parallel with the first outer wall surface 112*a*. The suction flow path through line a2 may be defined in the gravitational direction. That is, the suction flow path through line a2 may be defined to be perpendicular to the ground surface. In addition, the suction flow path through line a2 may be defined on the plane that perpendicularly intersects the first outer wall surface 112*a*.

The grip portion through line a3 may be defined to be inclined at a predetermined angle with respect to the first outer wall surface 112*a*. In addition, the grip portion through line a3 may be defined to be inclined at a predetermined angle with respect to the ground surface. The grip portion through line a3 may be defined on the plane that perpendicularly intersects the first outer wall surface 112*a*.

The cyclone line a4 may be defined to be perpendicular to the first outer wall surface 112*a*. That is, the cyclone line a4 may be defined in parallel with the ground surface. The cyclone line a4 may be defined on the plane perpendicular to the ground surface. In addition, the cyclone line a4 may be defined on the plane that perpendicularly intersects the first outer wall surface 112*a*.

Meanwhile, as another embodiment, the cyclone line a4 may be defined in parallel with the first outer wall surface 112*a*. The cyclone line a4 may be defined in the gravitational direction. That is, the cyclone line a4 may be defined to be perpendicular to the ground surface. In addition, the cyclone line a4 may be defined on the plane that perpendicularly intersects the first outer wall surface 112*a*.

The dust bin through line a5 may be defined to be perpendicular to the first outer wall surface 112*a*. That is, the dust bin through line a5 may be defined in parallel with the ground surface. The dust bin through line a5 may be defined on the plane perpendicular to the ground surface. In addition, the dust bin through line a5 may be defined on the plane that perpendicularly intersects the first outer wall surface 112*a*.

Meanwhile, as another embodiment, the dust bin through line a5 may be defined in parallel with the first outer wall surface 112*a*. The dust bin through line a5 may be defined in the gravitational direction. That is, the dust bin through line a5 may be defined to be perpendicular to the ground surface. In addition, the dust bin through line a5 may be defined on the plane that perpendicularly intersects the first outer wall surface 112*a*.

The dust collecting motor axis C may be defined to be perpendicular to the ground surface. The dust collecting motor axis C may be defined in parallel with at least any one of the first outer wall surface 112*a*, the second outer wall surface 112*b*, the third outer wall surface 112*c*, and the fourth outer wall surface 112*d*.

The relationships between the suction motor axis a1, the suction flow path through line a2, the grip portion through line a3, the cyclone line a4, the dust bin through line a5, and the dust collecting motor axis C in the cleaner system according to the embodiment of the present disclosure will be described below.

In the embodiment of the present disclosure, the suction motor axis a1 may be disposed between the suction part 212 and the handle 216. In addition, the cyclone line a4 may be disposed between the suction part 212 and the handle 216. The dust bin through line a5 may be disposed between the suction part 212 and the handle 216.

The suction motor axis a1 may be disposed at a predetermined angle with respect to the suction flow path through line a2 or the grip portion through line a3. Therefore, the suction motor axis a1 may intersect the suction flow path through line a2 or the grip portion through line a3.

In this case, the intersection point P1 may be present between the suction motor axis a1 and the suction flow path through line a2. For example, the suction motor axis a1 may perpendicularly intersect the suction flow path through line a2.

In addition, the intersection point may be present between the suction motor axis a1 and the grip portion through line a3. For example, the intersection point between the suction motor axis a1 and the grip portion through line a3 may be disposed to be farther from the cleaner station 100 than is the intersection point P1 between the suction motor axis a1 and the suction flow path through line a2.

The suction motor axis a1 may be defined coaxially with the cyclone line a4 or the dust bin through line a5. With this configuration, there is an effect of reducing a loss of flow path.

Although not illustrated, the suction motor axis a1 may be defined to be parallel to the cyclone line a4 or the dust bin through line a5 and spaced apart from the cyclone line a4 or the dust bin through line a5 at a predetermined interval. That is, the rotation axis of the suction motor 214 may be disposed in parallel with a longitudinal axis of the dust bin 220 or a flow axis of the dust separating part 213. As still another example, the suction motor axis a1 may be defined to be perpendicular to the cyclone line a4 or the dust bin through line a5.

When the first cleaner 200 is coupled to the cleaner station 100, the suction motor axis a1 may intersect a longitudinal axis of the cleaner station 100. That is, the rotation axis of the suction motor 214 may intersect the longitudinal axis of the cleaner station 100. In this case, the intersection point between the rotation axis of the suction motor 214 and the longitudinal axis of the cleaner station 100 may be positioned in the housing 110, and more particularly, positioned in the flow path part 180.

When the first cleaner 200 is coupled to the cleaner station 100, the suction motor axis a1 may intersect the dust collecting motor axis C. In this case, an intersection point P5 may be present between the suction motor axis a1 and the dust collecting motor axis C. The intersection point P5 between the suction motor axis a1 and the dust collecting motor axis C may be positioned in the housing 110, and more particularly, positioned in the flow path part 180.

In this case, a height of the intersection point P5 between the suction motor axis a1 and the dust collecting motor axis C from the ground surface may be equal to or less than a maximum height of the cleaner station 100.

In addition, the height of the intersection point P5 between the suction motor axis a1 and the dust collecting motor axis C from the ground surface may be equal to a height of an intersection point P4 between the suction flow path through line a2 and the dust bin through line a5.

Further, the height of the intersection point P5 between the suction motor axis a1 and the dust collecting motor axis C from the ground surface may be equal to a height of the intersection point P1 between the suction flow path through line a2 and the suction motor axis a1.

With this configuration, the first cleaner 200 may be stably supported on the cleaner station 100 in the state in which the first cleaner 200 is coupled to the cleaner station 100, and a loss of flow path may be reduced during the operation of emptying the dust bin 220.

In the state in which the first cleaner 200 and the cleaner station 100 are coupled, the suction motor axis a1 may intersect the dust collecting motor axis C at a predetermined angle. For example, an included angle θ1 between the suction motor axis a1 and the dust collecting motor axis C may be 40 degrees or more and 95 degrees or less, and particularly, 43 degrees or more and 90 degrees or less. If the included angle is less than 40 degrees, the user needs to bend his/her waist to couple the first cleaner 200 to the cleaner station 100, which may cause discomfort to the user. If the included angle is more than 95 degrees, the first cleaner 200 may be separated from the cleaner station 100 by the weight of the first cleaner 200.

In this case, the included angle may mean an angle defined as the suction motor axis a1 and the dust collecting motor axis C intersect each other, that is, an included angle defined between the suction motor axis a1 and the dust collecting motor axis C. For example, the included angle may mean an angle between the dust collecting motor axis C and the suction motor axis a1, in which when the intersection point P5 between the suction motor axis a1 and the dust collecting motor axis C is defined as a vertex, the dust collecting motor axis C is farther from the ground surface than is the intersection point P5, and the suction motor axis a1 is defined in the direction of the suction motor 214 based on the intersection point P5 (see FIGS. 16 to 17B).

In addition, in the state in which the first cleaner 200 and the cleaner station 100 are coupled, the suction motor axis a1 may intersect the perpendicular line V to the ground surface at a predetermined angle. For example, an included angle θ2 between the suction motor axis a1 and the perpendicular line V to the ground surface may be 40 degrees or more and 95 degrees or less, and particularly, 43 degrees or more and 90 degrees or less. If the included angle is less than 40 degrees, the user needs to bend his/her waist to couple the first cleaner 200 to the cleaner station 100, which may cause discomfort to the user. If the included angle is more than 95 degrees, the first cleaner 200 may be separated from the cleaner station 100 by the weight of the first cleaner 200.

In this case, the included angle may mean an angle defined as the suction motor axis a1 and the perpendicular line V to the ground surface intersect each other, that is, an included angle between the suction motor axis a1 and the perpendicular line V to the ground surface. For example, the included angle may mean an angle between the perpendicular line V to the ground surface and the suction motor axis a1, in which when an intersection point P7 between the suction motor axis a1 and the perpendicular line to the ground surface is defined as a vertex, the perpendicular line V is farther from the ground surface than is the intersection point P7, and the suction motor axis a1 is defined in the direction of the suction motor 214 based on the intersection point P7 (see FIG. 18).

In addition, in the state in which the first cleaner 200 and the cleaner station 100 are coupled, the suction motor axis a1 may intersect the ground surface B at a predetermined angle.

For example, an included angle θ3 between the suction motor axis a1 and the ground surface B may be −5 degrees or more and 50 degrees or less, and particularly, 0 degree or more and 47 degrees or less. In this case, the included angle may be an acute angle. In this case, the negative angle may mean the included angle between the suction motor axis a1 and the ground surface when the intersection point P1 between the suction motor axis a1 and the suction flow path through line a2 is positioned to be close to the ground surface based on the intersection point P5 between the suction motor axis a1 and the dust collecting motor axis C (see FIG. 18).

Meanwhile, when the first cleaner 200 is coupled to the cleaner station 100, the handle 216 may be disposed to be farther from the ground surface than is the suction motor axis a1. With this configuration, when the user grasps the handle 216, the relatively heavy suction motor 214 is positioned at the lower side in the gravitational direction, and the user may couple or separate the first cleaner 200 to/from the cleaner station 100 only by simply moving the first cleaner 200 in the direction parallel to the ground surface. As a result, it is possible to provide convenience for the user.

In addition, when the first cleaner 200 is coupled to the cleaner station 100, the battery 240 may be disposed to be farther from the ground surface than is the suction motor axis a1. With this configuration, the first cleaner 200 may be stably supported on the cleaner station 100.

The suction flow path through line a2 may intersect the suction flow path axis a1, the grip portion through line a3, the cyclone line a4, or the dust bin through line a5.

For example, the suction flow path through line a2 may perpendicularly intersect the suction flow path axis a1. In this case, the intersection point P1 may be defined between the suction motor axis a1 and the suction flow path through line a2.

In addition, the suction flow path through line a2 and the grip portion through line a3 may intersect each other at a predetermined angle. Further, the intersection point P2 may be defined between the suction flow path through line a2 and the grip portion through line a3.

In addition, the suction flow path through line a2 may perpendicularly intersect the cyclone line a4. In this case, an intersection point P3 may be present between the suction flow path through line a2 and the cyclone line a4.

In addition, the suction flow path through line a2 may perpendicularly intersect the dust bin through line a5. In this case, the intersection point P4 may be present between the suction flow path through line a2 and the dust bin through line a5.

When the first cleaner 200 is coupled to the cleaner station 100, the suction flow path through line a2 may be defined in parallel with the dust collecting motor axis C. With this configuration, it is possible to minimize an occupied space on a horizontal plane in the state in which the first cleaner 200 is coupled to the cleaner station 100.

In this case, the coupling part 120 may be disposed between the suction flow path through line a2 and the dust collecting motor axis C. The fixing member 131 may be disposed between the suction flow path through line a2 and the dust collecting motor axis C. The cover opening unit 150 may be between the suction flow path through line a2 and the dust collecting motor axis C. With this configuration, the user may couple or separate the first cleaner 200 to/from the cleaner station 100, fix the dust bin 220, and open the dust bin 220 only by simply moving the first cleaner 200 in the direction parallel to the ground surface. As a result, it is possible to provide convenience for the user.

Meanwhile, as another example, the suction flow path through line a2 may be disposed at a predetermined angle with respect to the dust collecting motor axis C. In this case, an included angle between the suction flow path through line a2 and the dust collecting motor axis C may be 50 degrees or less. If the included angle between the suction flow path through line a2 and the dust collecting motor axis C is more than 50 degrees, the user needs to bend his/her waist to couple the first cleaner 200 to the cleaner station 100, which may cause discomfort to the user.

The grip portion through line a3 may intersect the suction flow path axis a1, the suction flow path through line a2, the cyclone line a4, or the dust bin through line a5.

When the first cleaner 200 is coupled to the cleaner station 100, a height of the intersection point P2 between the grip portion through line a3 and the suction flow path through line a2 from the ground surface may be equal to or less than a maximum height of the housing 110. With this configuration, it is possible to minimize an overall volume in the state in which the first cleaner 200 is coupled to the cleaner station 100.

The grip portion through line a3 may intersect the dust collecting motor axis C at a predetermined angle. In this case, an intersection point P6 between the grip portion through line a3 and the dust collecting motor axis C may be positioned in the housing 110. This configuration is advantageous in that the user may couple the first cleaner 200 to the cleaner station 100 only by simply pushing his/her arm toward the lateral side of the cleaner station 100 in the state in which the user grasps the first cleaner 200. In addition, since the dust collecting motor 191, which is relatively heavy in weight, is accommodated in the housing 110, it is possible to prevent the cleaner station 100 from swaying even though the user strongly pushes the first cleaner 200 into the cleaner station 100.

The cyclone line a4 may be defined coaxially with the suction motor axis a1 or the dust bin through line a5. With this configuration, there is an effect of reducing a loss of flow path during a cleaning process.

Although not illustrated, as another example, the cyclone line a4 may be defined to be parallel to the suction motor axis a1 or the dust bin through line a5 or spaced apart from the suction motor axis a1 or the dust bin through line a5 at a predetermined interval. As still another example, the cyclone line a4 may be defined to be perpendicular to the suction motor axis a1 or the dust bin through line a5.

When the first cleaner 200 is coupled to the cleaner station 100, the cyclone line a4 may intersect the longitudinal axis of the cleaner station 100. That is, the flow axis of the dust separating part 213 may intersect the longitudinal axis of the cleaner station 100. In this case, the intersection point between the flow axis of the dust separating part 213 and the longitudinal axis of the cleaner station 100 may be positioned in the housing 110, and more particularly, positioned in the flow path part 180.

When the first cleaner 200 is coupled to the cleaner station 100, the cyclone line a4 may intersect the dust collecting motor axis C. In this case, the intersection point P5 may be present between the cyclone line a4 and the dust collecting motor axis C. The intersection point P5 between the cyclone line a4 and the dust collecting motor axis C may be positioned in the housing 110, and more particularly, positioned in the flow path part 180. With this configuration, the first cleaner 200 may be stably supported on the cleaner station 100 in the state in which the first cleaner 200 is coupled to the cleaner station 100, and a loss of flow path may be reduced during the operation of emptying the dust bin 220.

The cyclone line a4 may intersect the dust collecting motor axis C at a predetermined angle. For example, an included angle between the cyclone line a4 and the dust collecting motor axis C may be 40 degrees or more and 95 degrees or less, and particularly, 43 degrees or more and 90 degrees or less. If the included angle is less than 40 degrees, the user needs to bend his/her waist to couple the first cleaner 200 to the cleaner station 100, which may cause discomfort to the user. If the included angle is more than 95 degrees, the first cleaner 200 may be separated from the cleaner station 100 by the weight of the first cleaner 200.

The dust bin through line a5 may be defined coaxially with the suction motor axis a1 or the cyclone line a4. With this configuration, there is an effect of reducing a loss of flow path during a cleaning process.

Although not illustrated, as another example, the dust bin through line a5 may be defined to be parallel to the suction motor axis a1 or the cyclone line a4 and spaced apart from the suction motor axis a1 or the cyclone line a4 at a predetermined interval. As still another example, the dust bin through line a5 may be defined to be perpendicular to the suction motor axis a1 or the cyclone line a4.

When the first cleaner 200 is coupled to the cleaner station 100, the dust bin through line a5 may intersect the longitudinal axis of the cleaner station 100. That is, the longitudinal axis of the dust bin 220 may intersect the longitudinal axis of the cleaner station 100. In this case, an intersection point between the longitudinal axis of the dust bin 220 and the longitudinal axis of the cleaner station 100 may be positioned in the housing 110, and more particularly, positioned in the flow path part 180.

The dust bin through line a5 may intersect the dust collecting motor axis C at a predetermined angle. For example, an included angle between the dust bin through line a5 and the dust collecting motor axis C may be 40 degrees or more and 95 degrees or less, and particularly, 43 degrees or more and 90 degrees or less. If the included angle is less than 40 degrees, the user needs to bend his/her waist to couple the first cleaner 200 to the cleaner station 100, which may cause discomfort to the user. If the included angle is more than 95 degrees, the first cleaner 200 may be separated from the cleaner station 100 by the weight of the first cleaner 200.

Meanwhile, when the first cleaner 200 is coupled to the cleaner station 100, the handle 216 may be disposed to be farther from the ground surface than is the dust bin through line a5. With this configuration, when the user grasps the handle 216, the user may couple or separate the first cleaner 200 to/from the cleaner station 100 only by simply moving the first cleaner 200 in the direction parallel to the ground surface. As a result, it is possible to provide convenience for the user.

In addition, when the first cleaner 200 is coupled to the cleaner station 100, the battery 240 may be disposed to be farther from the ground surface than is the dust bin through line a5. In this configuration, because the battery 240 pushes the main body 210 of the first cleaner 200 by means of the weight of the battery 240, the first cleaner 200 may be stably supported on the cleaner station 100.

Meanwhile, in the present embodiment, an imaginary plane S1 may be defined in a direction of a long axis connecting the front side and the rear side of the first cleaner 100, and an overall weight of the first cleaner 100 may be concentrated on the plane S1.

Specifically, the imaginary plane S1 may include at least two of the suction motor axis a1, the suction flow path through line a2, the grip portion through line a3, the cyclone line a4, the dust bin through line a5, and the dust collecting motor axis C. That is, the plane S1 may be an imaginary plane defined by connecting two imaginary straight lines and may include an imaginary plane defined by expanding and extending the two imaginary straight lines.

For example, the plane S1 may include the suction motor axis a1 and the suction flow path through line a2. Alternatively, the plane S1 may include the suction motor axis a1 and the grip portion through line a3. Alternatively, the plane S1 may include the cyclone line a4 and the suction flow path through line a2. Alternatively, the plane S1 may include the cyclone line a4 and the grip portion through line a3. Alternatively, the plane S1 may include the dust bin through line a5 and the suction flow path through line a2. Alternatively, the plane S1 may include the dust bin through line a5 and the grip portion through line a3. Alternatively, the plane S1 may include the suction flow path through line a2 and the grip portion through line a3. In addition, the plane S1 may include the dust collecting motor axis C and the suction motor axis a1. In addition, the plane S1 may include the dust collecting motor axis C and the suction flow path through line a2. In addition, the plane S1 may include the dust collecting motor axis C and the grip portion through line a3. In addition, the plane S1 may include the dust collecting motor axis C and the cyclone line a4. In addition, the plane S1 may include the dust collecting motor axis C and the dust bin through line a5.

Meanwhile, FIG. 15 illustrates an embodiment in which some of the suction motor axis a1, the suction flow path through line a2, the grip portion through line a3, the cyclone line a4, the dust bin through line a5, and the dust collecting motor axis C are parallel to the plane S1.

In this case, the plane S1 may include at least two of the suction motor axis a1, the suction flow path through line a2, the grip portion through line a3, the cyclone line a4, the dust bin through line a5, and the dust collecting motor axis C, and an imaginary line, which is not included in the plane S1, may be parallel to the plane S1. Further, the imaginary line, which is not included in the plane S1, may have an orthogonal projection to the plane S1, and the orthogonal projection may intersect the imaginary line included in the plane S1.

For example, as illustrated in FIG. 15, the plane S1 may include the suction flow path through line a2 and the grip portion through line a3, and the suction motor axis a1, the cyclone line a4, or the dust bin through line a5 may be parallel to the plane S1. Further, an orthogonal projection a1' of the suction motor axis, an orthogonal projection a4' of the cyclone line, or an orthogonal projection a5' of the dust bin through line may intersect the suction flow path through line a2. That is, an intersection point P1' may be present between the orthogonal projection a1' of the suction motor axis and the suction flow path through line a2. In addition, an intersection point P3' may be present between the orthogonal projection a4' of the cyclone line and the suction flow path through line a2. In addition, an intersection point P4' may be present between the orthogonal projection a5' of the dust bin through line and the suction flow path through line a2.

Although not illustrated, as another example, the plane S1 may include the suction motor axis a1 and the dust collecting motor axis C, and the suction flow path through line a2 may be parallel to the plane S1. Further, the orthogonal projection of the suction flow path through line a2 may intersect the suction motor axis a1. That is, an intersection point may be present between the orthogonal projection of the suction flow path through line a2 and the suction motor axis a1.

An imaginary extension surface of the plane S1 may penetrate the first cleaner 200.

For example, the imaginary extension surface of the plane S1 may penetrate the suction part 212. Alternatively, the imaginary extension surface of the plane S1 may penetrate the dust separating part 213. Alternatively, the imaginary extension surface of the plane S1 may penetrate the suction motor 214. Alternatively, the imaginary extension surface of the plane S1 may penetrate the handle 216. Alternatively, the imaginary extension surface of the plane S1 may penetrate the dust bin 220.

In addition, when the first cleaner 200 is mounted on the cleaner station 200, the imaginary extension surface of the plane S1 may penetrate at least a part of the cleaner station 100.

Therefore, when the first cleaner 200 is mounted on the cleaner station 200, the plane S1 may penetrate (pass through) the housing 110.

Specifically, when the first cleaner 200 is mounted on the cleaner station 200, the plane S1 may penetrate the bottom surface 111.

For example, the plane S1 may pass through the bottom surface 111 to bisect the bottom surface 111. That is, the bottom surface 111, which is formed to be similar to a quadrangle, may be a surface that is symmetric with respect to a centerline. The imaginary line formed by the bottom surface 111 and the plane S1 intersecting each other may be coincident with the centerline of the bottom surface 111. With this configuration, the overall weight of the first cleaner 200 may be concentrated on the center of the bottom surface 111, and the cleaner station 100 may maintain the balance in the state in which the first cleaner 200 is mounted on the cleaner station 100.

The plane S1 may perpendicularly intersect the first outer wall surface 112*a*. That is, the plane S1 may pass through the first outer wall surface 112*a* and the second outer wall surface 112*b*. For example, the plane S1 may be an imaginary plane that bisects the first outer wall surface 112*a* and the second outer wall surface 112*b* of the cleaner station 100. Therefore, the housing 110 may be symmetrically divided by the plane S1. In addition, the plane S1 may pass through the coupling surface 121 to bisect the coupling surface 121.

The imaginary extension surface of the plane S1 may penetrate the dust collecting motor 191. In this case, the overall load of the first cleaner 100 is concentrated on the region in which the dust collecting motor 191 is disposed. In this case, the dust collecting motor 191 is heavier in weight than the first cleaner 100, and the dust collecting motor 191 is disposed to be closer to the ground surface than is the main body 110 of the first cleaner 100. As a result, an overall center of gravity of an assembly of the first cleaner 100 and the cleaner station 200 may be lowered, thereby maintaining the balance.

The imaginary extension surface of the plane S1 may penetrate the flow path part 180. In this case, it is possible to minimize a loss of the air flow path connected from the dust bin 220 to dust collecting part 170.

Meanwhile, the imaginary extension surface of the plane S1 may pass through the bottom surface 111 in an asymmetric manner or may not penetrate the dust collecting motor 191. However, even in this case, the first cleaner 200 according to the present disclosure is supported by the coupling part 120 and the housing 110, such that the overall load of the first cleaner 220 is concentrated in the region of the bottom surface 111. In this case, since the dust collecting motor 191 is also provided in the housing 110, the load of the dust collecting motor 191 is also concentrated in the region of the bottom surface 111. In this case, the load of the first cleaner 220 is applied to one side of the bottom surface 111, and the load of the dust collecting motor 191 is applied to the other side of the bottom surface 111, such that the overall weight of the assembly of the first cleaner 200 and the cleaner station 100 is concentrated in the region of the bottom surface 111. Therefore, the cleaner station 100 may maintain the balance in the state in which the first cleaner 200 is mounted on the cleaner station 100.

With this configuration, the overall weight of the first cleaner 200 may be concentrated toward the bottom surface 111, and the cleaner station 100 may maintain the balance in the state in which the first cleaner 200 is mounted on the cleaner station 100.

Meanwhile, in the cleaner station 100 according to the present disclosure, the dust collecting part 170 is disposed at the lower side in the gravitational direction of the coupling part 120 on which the first cleaner is mounted, and the dust suction module 190 is disposed at the lower side in the gravitational direction of the dust collecting part 170. That is, the dust collecting part 170 may be disposed to be closer to the ground surface than is the coupling part 120, and the dust suction module 190 may be disposed to be closer to the ground surface than is the dust collecting part 170.

The most part of the internal space of the cleaner station 100 is occupied by the flow path part 180, which is a space through which the air flows, and by the dust collecting part by which relatively light dust is captured. Further, the fixing unit 130, the door unit 140, the cover opening unit 150, and the lever pulling unit 160 are disposed at the upper side in the cleaner station 100 (the side positioned in the direction away from the ground surface). In addition, the dust collecting motor 191 of the suction module 190 is disposed at the lower side in the cleaner station 100 (the side positioned in the direction close to the ground surface). In this case, in the cleaner station 100, the dust collecting motor 191 may be heaviest in weight.

Therefore, the overall weight of the cleaner station 100 may be concentrated on the lower side at which the dust collecting motor 191 is disposed.

Further, when the first cleaner 200 is mounted on the cleaner station 200, the imaginary plane S1 may pass through the axis of the dust collecting motor 191. In this case, the overall weight may be concentrated on the plane S1 in the state in which the first cleaner 200 is mounted on the cleaner station 200.

Therefore, the cleaner station 100 may maintain the balance in the state in which the first cleaner 200 is mounted on the cleaner station 100.

Meanwhile, the weight at the upper side of the cleaner station 100 (the side positioned in the direction away from the ground surface) may be concentrated on the rear side (the side positioned in the direction close to the second outer wall surface 112*b*). The coupling part 120 disposed at the upper side of the cleaner station 100 is formed to be concave rearward from the first outer wall surface 112*a* disposed at the front side. In this case, the fixing unit 130, the door unit 140, the cover opening unit 150, and the lever pulling unit 160 are disposed to be close to the inside of the coupling surface 121. Therefore, the fixing unit 130, the door unit 140, the cover opening unit 150, and the lever pulling unit 160 are concentratedly disposed in the space between the coupling surface 121 and the second outer wall surface 112*b*. Consequently, the fixing unit 130, the door unit 140, the cover opening unit 150, and the lever pulling unit 160 are disposed concentratedly at the rear side of the cleaner station 100.

Meanwhile, in the present embodiment, an imaginary balance maintaining space R1 may perpendicularly extend from the ground surface and penetrate the dust collecting part 170 and the dust suction module 190. For example, the balance maintaining space R1 may be an imaginary space perpendicularly extending from the ground surface, and the dust collecting motor 191 at least may be accommodated in the balance maintaining space R1. That is, the balance maintaining space R1 may be an imaginary cylindrical shape space that accommodates the dust collecting motor 191 therein.

Therefore, the overall weight of the components disposed in the balance maintaining space R1 may be concentrated on the dust suction module 190. In this case, since the dust suction module 190 is disposed to be close to the ground surface, the cleaner station 100 may stably maintain the balance, like a roly-poly toy.

With this configuration, in the present disclosure, the cleaner station 100 may stably maintain the balance in the state in which the first cleaner 200 is mounted on the cleaner station 100.

That is, when the first cleaner 200 is mounted on the cleaner station 100, the imaginary extension surface of the plane S1 penetrates the balance maintaining space R1. Therefore, the first cleaner 200 according to the present disclosure may maintain the balance in the leftward/rightward direction in the state in which the first cleaner 200 is mounted on the cleaner station 100.

When the first cleaner 200 is mounted on the cleaner station 100, the battery 240 of the first cleaner 200, which is relatively heavy in weight, is accommodated in the coupling part 120 of the cleaner station 100. Further, the suction motor 214 of the first cleaner 200, which is relatively heavy in weight, is disposed to be spaced apart from the battery 240 at a predetermined interval d.

Meanwhile, one or more of the fixing unit 130, the door unit 140, the cover opening unit 150, and the lever pulling unit 160 (hereinafter, referred to as a 'station operating unit') are disposed in the space between the coupling part 120 and the second outer wall surface 112*b*. Further, the dust collecting part 170 and the dust suction module 190 are disposed to be closer to the ground surface than are the battery 240 and the station operating unit.

In order to assist in understanding the present disclosure, the arrangement of a weight m1 of the suction motor 214, a weight m2 of the battery 240, a weight m3 of the station operating unit, and a weight M of the dust collecting motor 191 will be described below (see FIG. 21).

Based on the premise that the battery 240 is fixed to the coupling part 120, a force, which is inclined forward, may be applied to the cleaner station 100 by the weight m1 of the suction motor 214.

In this case, a force, which is inclined rearward, may be applied to the coupling surface 121, to which the battery 240 is fixed, by the weight m3 of the station operating unit.

Consequently, the overall weight may be concentrated on the inside of the housing 110 in the state in which the battery 240, the suction motor 214, and the station operating unit are coupled to one another.

Therefore, based on the battery 240 and the coupling surface 121, the weight m1 of the suction motor 214 and the weight m3 of the station operating unit may be balanced.

Meanwhile, in the present disclosure, a distance from the dust collecting motor 191 to the coupling part 120 may be longer than a distance from the suction motor 214 to the coupling part 120, thereby maintaining the balance of the cleaner station 100.

That is, the suction motor 214 may be disposed to be spaced apart from the coupling part 120 in the horizontal direction at a predetermined distance d, and the coupling part 120 may be disposed vertically above the dust collecting motor 191 so as to be spaced apart from the dust collecting motor 191 at a predetermined distance h. In this case, the distance h from the dust collecting motor 191 to the coupling part 120 may be longer than the distance d from the suction motor 214 to the coupling part 120.

Specifically, a force, which pushes downward the coupling surface 121 to which the battery 240 is fixed, may be applied to the coupling surface 121 by the weight M of the dust collecting motor 191. In this case, the distance h (also referred to as a height) between the dust collecting motor 191 and the battery 240 is longer than the distance d between the battery 240 and the suction motor 214. In addition, the weight M of the dust collecting motor 191 is greater than the weight m1 of the suction motor 214.

Therefore, the weight m1 of the suction motor 214 and the torque generated by the distance d between the battery 240 and the suction motor 214 are significantly smaller than the weight M of the dust collecting motor 191 and the torque generated by the distance h between the dust collecting motor 191 and the battery 240. Therefore, the cleaner station 100 is not inclined by the weight m1 of the suction motor 214.

Therefore, according to the present disclosure, the balance may be stably maintained even though the first cleaner 200 is mounted on the cleaner station 100.

Meanwhile, the arrangement of the first cleaner 200, the first cleaner flow path part 181, the dust collecting part 170, and the dust suction module 190 in the state in which the first cleaner 200 is coupled to the cleaner station 100 will be described below with reference to FIG. 16.

When the first cleaner 200 is mounted on the cleaner station 100, the axis, which penetrates, in the longitudinal direction, the dust bin 220 formed in a cylindrical shape, may be disposed in parallel with the ground surface. Further, the dust bin 220 may be disposed to be perpendicular to the first outer wall surface 112*a* and the coupling surface 121. That is, the dust bin through line a5 may be disposed to be perpendicular to the first outer wall surface 112*a* and the coupling surface 121 and disposed in parallel with the ground surface. In addition, the dust bin through line a5 may be disposed to be perpendicular to the dust collecting motor axis C.

Further, when the first cleaner 200 is mounted on the cleaner station 100, the extension tube 250 may be disposed in the direction perpendicular to the ground surface. Further, the extension tube 250 may be disposed in parallel with the first outer wall surface 112*a*. That is, the suction flow path through line a2 may be disposed in parallel with the first outer wall surface 112*a* and disposed to be perpendicular to the ground surface. In addition, the suction flow path through line a2 may be disposed in parallel with the dust collecting motor axis C.

Meanwhile, when the first cleaner 200 is mounted on the cleaner station 100, at least a part of the outer circumferential surface of the dust bin 220 may be surrounded by the dust bin guide surface 122. The first flow path 181*a* may be disposed at the rear side of the dust bin 220, and the internal space of the dust bin 220 may communicate with the first flow path 181*a* when the dust bin 220 is opened. Further, the second flow path 181*b* may be bent downward from the first flow path 181*a* (toward the ground surface). In addition, the dust collecting part 170 may be disposed to be closer to the ground surface than is the second flow path 181*b*. Further, the dust suction module 190 may be disposed to be closer to the ground surface than is the dust collecting part 170.

Therefore, according to the present disclosure, the first cleaner 200 may be mounted on the cleaner station 100 in the state in which the extension tube 250 and the cleaning module 260 are mounted. Further, it is possible to minimize an occupied space on the horizontal plane even in the state in which the first cleaner 200 is mounted on the cleaner station 100.

In addition, according to the present disclosure, since the first cleaner flow path part 181, which communicates with the dust bin 220, is bent only once, it is possible to minimize a loss of flow force for collecting the dust.

Further, according to the present disclosure, in the state in which the first cleaner 200 is mounted on the cleaner station 100, the outer circumferential surface of the dust bin 220 is surrounded by the dust bin guide surface 122, and the dust bin 220 is accommodated in the coupling part 120. As a result, the dust in the dust bin is invisible from the outside.

Figure 22:
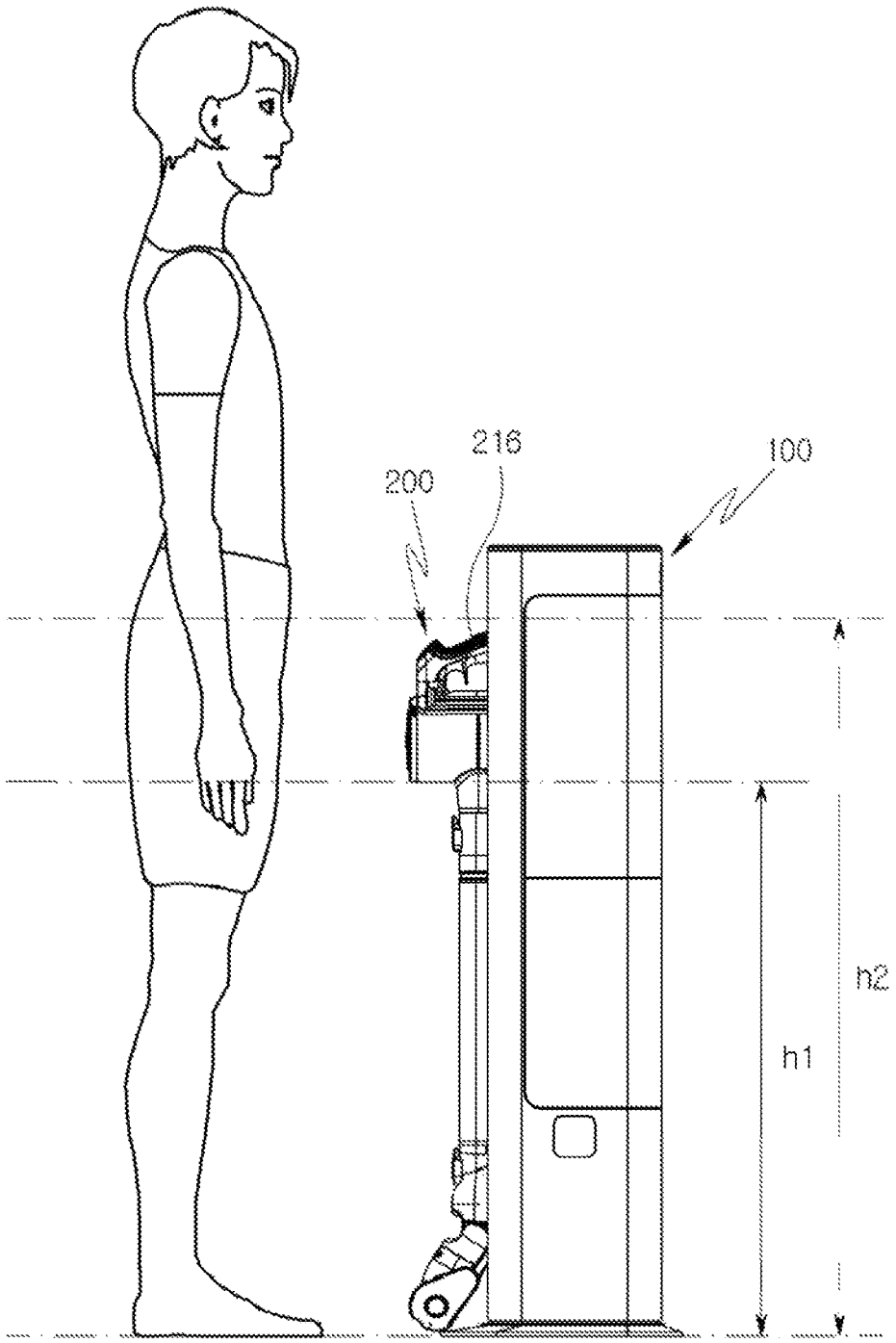
FIGS. 22 and 23 are views for explaining a height at which a user conveniently couples the first cleaner to the cleaner station in the cleaner system according to the embodiment of the present disclosure.
Figure 23:
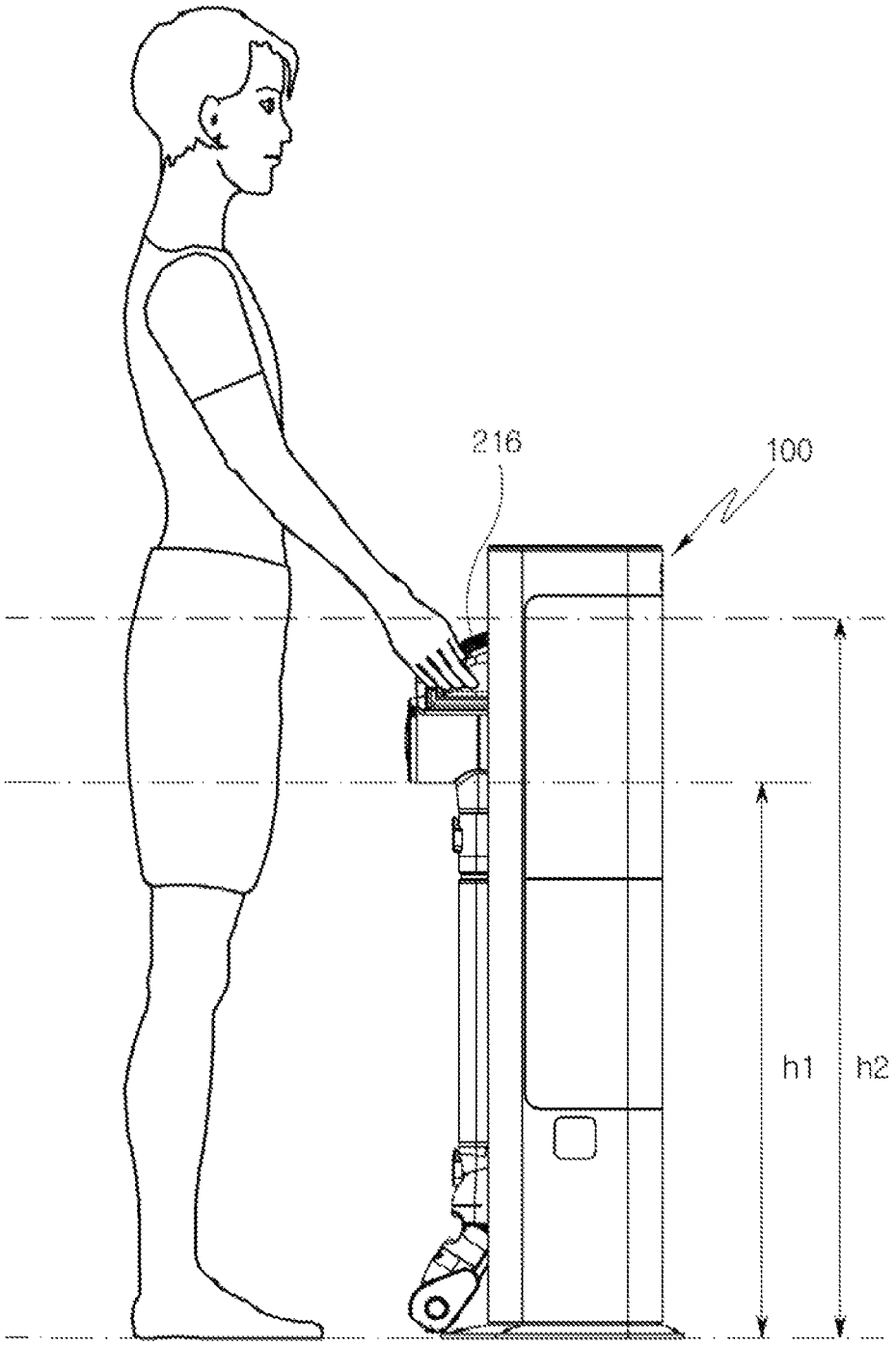

Meanwhile, FIGS. 22 and 23 are views for explaining a height at which the user conveniently couples the first cleaner to the cleaner station in the cleaner system according to the embodiment of the present disclosure.

First, a process of coupling the first cleaner 200 to the cleaner station 100 will be described below.

In general, the user may couple the first cleaner 200 to the cleaner station 100 by grasping the handle 216 and then moving the first cleaner 200. In this case, a direction in which the user's hand grasps the handle 216 may be opposite to a direction in which the user grasps the handle 216 of the first cleaner 200 in order to perform the cleaning operation. Specifically, when the user's palm surrounds the outer circumferential surface of the grip portion 216*a* in order to couple the first cleaner 200 to the cleaner station 100, the user's thumb or index finger may be disposed at the rear side of the grip portion 216*a* (the side positioned in the direction close to the second extension portion 216*c*), and the user's little finger may be disposed at front side of the grip portion 216*a* (the side positioned in the direction close to the first extension portion 216*b*).

As described above, the user grasps the handle 216 and then moves the first cleaner 200 to a position close to the cleaner station 100, and the user finally moves his/her arm or wrist to couple the first cleaner 200 to the coupling part 120 of the cleaner station 100.

In this case, in the embodiment of the present disclosure, the first cleaner 200 may be moved in the direction intersecting the longitudinal direction of the suction part 212 and coupled to the coupling part 120 of the cleaner station 100.

Specifically, in the embodiment of the present disclosure, the first cleaner 200 (or the main body 210) may be moved along the longitudinal axis of the dust bin 220 and coupled to the coupling part 120 of the cleaner station 100. In addition, the first cleaner 200 (or the main body 210) may be moved in the direction perpendicular to the longitudinal direction of the suction part 212 and coupled to the coupling part 120 of the cleaner station 100. In addition, the first cleaner 200 (or the main body 210) may be moved in the direction perpendicular to the longitudinal direction of the suction part 212, moved in the longitudinal direction of the suction part 212, and then coupled to the coupling part 120. In addition, the first cleaner 200 (or the main body 210) may be moved along the longitudinal axis of the cleaner station 100 and coupled to the coupling part 120. In addition, the first cleaner 200 (or the main body 210) may be moved along the longitudinal axis of the cleaner station 100, moved in the direction perpendicular to the longitudinal direction of the suction part 212, and then coupled to the coupling part 120.

For example, in the case in which the cleaner station 100 stands perpendicularly to the ground surface and the coupling part 120 is provided at the lateral side of the cleaner station 100 (the side provided in the direction perpendicular to the ground surface) (i.e., in the case in which the coupling surface 121 is provided in the direction perpendicular to the ground surface), the first cleaner 200 may be moved in the direction parallel to the ground surface and coupled to the coupling part 120.

Meanwhile, the user may also release the first cleaner 200 in the state in which the user pushes the first cleaner 200 into the coupling part 120. In this case, the first cleaner 200 may be moved in the direction parallel to the ground surface and then coupled to the coupling part 120 by being moved vertically downward.

As another example, in the case in which the coupling surface 121 of the coupling part 120 is provided to be inclined at a predetermined angle with respect to the ground surface, the user moves the first cleaner 200 in the direction parallel to the ground surface and then moves the first cleaner 200 to the position vertically above the coupling part 120, and then the user may couple the first cleaner 200 to the coupling part 120 by moving, vertically downward, his/her hand grasping the first cleaner 200. In this case, the first cleaner 200 may be moved in the direction parallel to the ground surface and then coupled to the coupling part 120 by being moved vertically downward.

As still another example, in the case in which the coupling surface 121 of the coupling part 120 is provided in the direction parallel to the ground surface, the user may lift up the first cleaner 200 to the position vertically above the coupling part 120 and then move the first cleaner 200 downward to couple the first cleaner 200 to the coupling part 120. In this case, the first cleaner 200 may be moved vertically downward and coupled to the coupling part 120.

A position of the coupling part 120 at which the user may couple the first cleaner 200 to the cleaner station 100 without bending his/her waist will be described with reference to FIGS.

As illustrated in FIGS. 22 and 23, in order for the user to couple the first cleaner 200 to the cleaner station 100 without bending his/her waist, a height of each of the dust bin 220 and the battery housing 230 may be similar to a height of the coupling part 120 in a state in which the user stands while grasping the handle 216 of the first cleaner 200. In this case, the user may couple the first cleaner 200 to the cleaner station 100 by moving the first cleaner 200 horizontally or further adding a simple operation of moving his/her wrist or forearm.

Therefore, a lowest height at which the user may couple the first cleaner 200 to the cleaner station 100 without bending his/her waist may mean a height from the ground surface to a lower end of the palm based on a state in which the user stands with his/her arm lowered downward.

For example, a height of the cleaner station 100 to which the grip portion 216*a* of the first cleaner 200 is coupled may be 60 cm or more from the ground surface. In addition, a height of the guide protrusion 123 corresponding to the positions of the grip portion 216*a* and the battery housing 230 may be 60 cm or more from the ground surface.

Specifically, the following table shows the data related to average dimensions of human bodies. Referring to the table, a height F from the ground surface to the central portion of the palm may be a value obtained by subtracting a height A of the outer portion of the shoulder by a length B of the upper arm, a length C of the forearm, and a length D of the palm (F=A−(B+C+D)).

TABLE 1

Unit: cm

| Gender | Age | Average A | Average B | Average C | Average D | Calculation F |
|---|---|---|---|---|---|---|
| Female | ~20 | 129.6 | 31.9 | 23.2 | 9.66 | 64.84 |
| | 20~29 | 130.9 | 32.0 | 23.0 | 9.69 | 66.21 |
| | 30~39 | 130.6 | 31.7 | 22.9 | 9.75 | 66.25 |
| | 40~49 | 128.1 | 31.5 | 22.4 | 9.68 | 64.52 |
| | 50~59 | 126.1 | 31.4 | 22.6 | 9.67 | 62.43 |
| | 60~ | 124.2 | 31.3 | 22.3 | 9.71 | 60.89 |
| Gender | Age | Average A | Average B | Average C | Average D | A − B |
| Male | ~20 | 139.9 | 33.9 | 25.1 | 10.34 | 106 |
| | 20~29 | 141.6 | 34.1 | 25.4 | 10.52 | 107.5 |
| | 30~39 | 141.3 | 33.7 | 25.2 | 10.47 | 107.6 |
| | 40~49 | 139.1 | 33.3 | 24.5 | 10.30 | 106.2 |
| | 50~59 | 137.3 | 32.8 | 24.4 | 10.21 | 104.5 |
| | 60~ | 135.0 | 32.4 | 23.9 | 10.17 | 102.6 |

In this case, the lowest height at which the user may couple the first cleaner 200 to the cleaner station 100 without bending his/her waist is about 60.89 cm which is obtained by using the dimensions of the bodies of the women over 60 years old who have the lowest average height among the adults. In this case, in consideration of a diameter of the grip portion 216*a* and the like, a height of the cleaner station 100 to which the grip portion 216*a* is coupled may be at least 60 cm or more from the ground surface.

Therefore, in the state in which the first cleaner 200 is coupled to the cleaner station 100, a shortest distance from the ground surface to the grip portion 216*a* may be 60 cm or more.

Meanwhile, in the case in which the user may couple the first cleaner 200 to the cleaner station 100 only using his/her forearm or wrist without rotating his/her upper arm, the user does not put a relatively large effort. As a result, it is possible to provide convenience for the user.

Therefore, a maximum height at which the user may conveniently couple the first cleaner 200 to the cleaner station 100 may mean a height from the ground surface to the elbow (the lower end of the upper arm) based on the state in which the user stands with his/her arm lowered downward.

For example, a height of the cleaner station 100 to which the grip portion 216*a* of the first cleaner 200 is coupled may be 108 cm or less from the ground surface. In addition, a height of the guide protrusion 123 corresponding to the positions of the grip portion 216*a* and the battery housing 230 may be 108 cm or less from the ground surface.

Specifically, the height from the ground surface to the elbow may be a value (A-B) obtained by subtracting the height A of the outer portion of the shoulder by the length B of the upper arm.

In this case, the height from the ground surface to the elbow is about 107.6 cm which is obtained by using the dimension of the body of the man in his 30s who has the largest height from the ground surface to the elbow among the adults. In this case, in consideration of the diameter of the grip portion 216*a* and the like, a maximum height of the cleaner station 100 to which the grip portion 216*a* is coupled may be 108 cm or less from the ground surface.

Therefore, in the state in which the first cleaner 200 is coupled to the cleaner station 100, a shortest distance from the ground surface to the grip portion 216*a* may be 108 cm or less.

With this configuration, the user may comfortably couple the first cleaner 200 to the cleaner station 100 without bending his/her waist.

Figure 54:
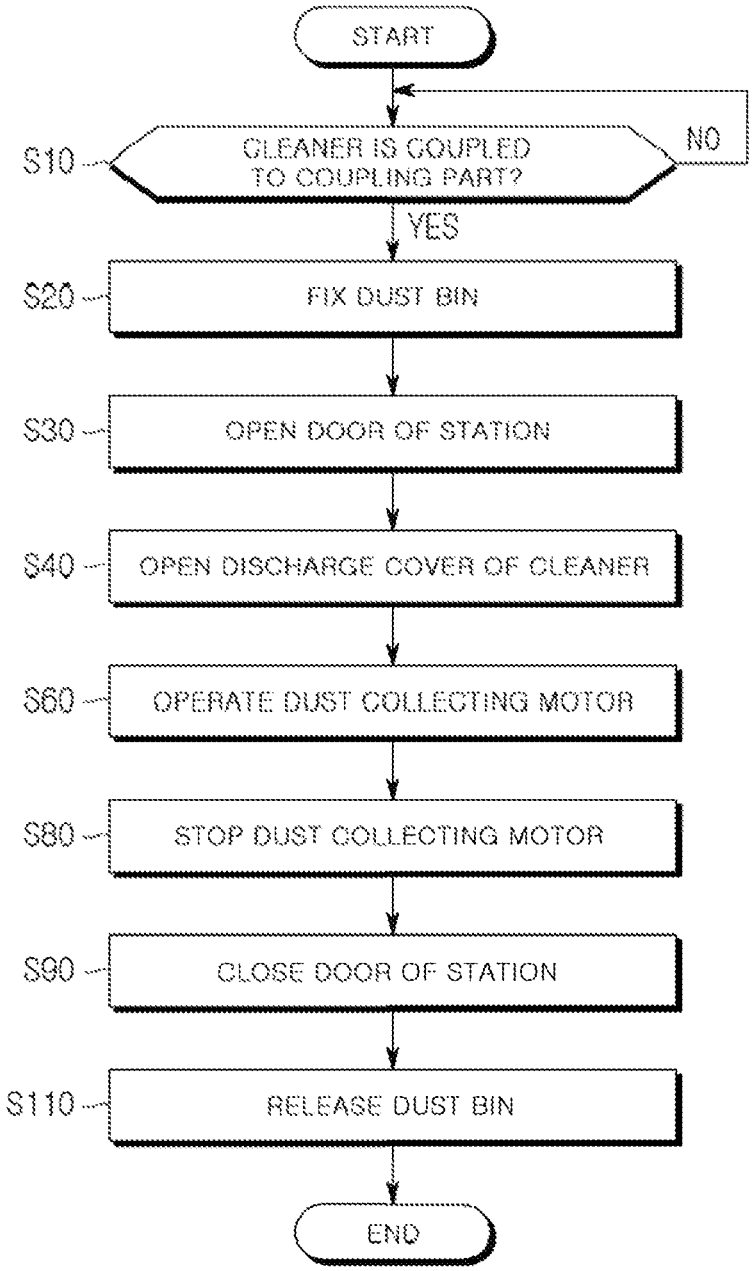
FIG. 54 is a flowchart for explaining a first embodiment of a method of controlling the cleaner station according to the present disclosure.

Meanwhile, FIG. 54 is a flowchart for explaining a first embodiment of a method of controlling the cleaner station according to the present disclosure.

The first embodiment of the method of controlling the cleaner station according to the present disclosure will be described below with reference to FIGS. 4 to 54.

A method of controlling a cleaner station according to the present embodiment includes a coupling checking step S10, a dust bin fixing step S20, a door opening step S30, a cover opening step S40, a dust collecting step S60, a dust collection ending step S80, a door closing step S90, and a release step S110.

In the coupling checking step S10, whether the first cleaner 200 is coupled to the coupling part 120 of the cleaner station 100 may be checked.

Specifically, in the coupling checking step S10, when the first cleaner 200 is coupled to the cleaner station 100, the coupling sensor 125 disposed on the guide protrusion 123 may come into contact with the battery housing 230, and the coupling sensor 125 may transmit a signal indicating that the first cleaner 200 is coupled to the coupling part 120. Alternatively, the coupling sensor 125 of a non-contact sensor type disposed on the sidewall 124 may detect the presence of the dust bin 220, and the coupling sensor 125 may transmit a signal indicating that the first cleaner 200 is coupled to the coupling part 120. Further, in the case in which the coupling sensor 125 is disposed on the dust bin guide surface 122, the dust bin 220 may push the coupling sensor 125 by means of the weight of the dust bin 220, the coupling sensor 125 may detect that the first cleaner 200 is coupled, and the coupling sensor 125 may transmit a signal indicating that the first cleaner 200 is coupled to the coupling part 120.

Therefore, in the coupling checking step S10, the control unit 400 may receive the signal generated by the coupling sensor 125 and determine that the first cleaner 200 is physically coupled to the coupling part 120.

Meanwhile, in the coupling checking step S10 according to the present disclosure, the control unit 400 may determine that the first cleaner 200 is electrically coupled to the cleaner station 100 on the basis of whether the charging part 128 supplies power to the battery 240 of the first cleaner 200, thereby checking whether the first cleaner 200 is coupled at the exact position.

Therefore, in the coupling checking step S10, the control unit 400 may receive the signal, which indicates that the first cleaner 200 is coupled, from the coupling sensor 125, and check whether the charging part 128 supplies power to the battery 240, thereby checking whether the first cleaner 200 is coupled to the coupling part 120 of the cleaner station 100.

In the dust bin fixing step S20, when the first cleaner 200 is coupled to the cleaner station 100, the fixing member 130 may hold and fix the dust bin 220.

Specifically, when the control unit 400 receives the signal, which indicates that the first cleaner 200 is coupled, from the coupling sensor 125, the control unit 400 may operate the fixing drive part 133 in the forward direction so that the fixing member 131 fixes the dust bin 220.

In this case, when the fixing member 131 or the fixing part link 135 is moved to the dust bin fixing position FP1, the first fixing detecting part 137*a* may transmit a signal indicating that the first cleaner 200 is fixed.

Therefore, the control unit 400 may receive the signal, which indicates that the first cleaner 200 is fixed, from the first fixing detecting part 137*a* and determine that the first cleaner 200 is fixed.

When the control unit 400 determines that the first cleaner 200 is fixed, the control unit 400 may stop the operation of the fixing drive part 133.

In the door opening step S30, when the dust bin 220 is fixed, the door 141 may be opened.

Specifically, when the control unit 400 receives the signal, which indicates that the dust bin 220 is fixed, from the first fixing detecting part 137*a*, the control unit 400 may operate the door motor 142 in the forward direction to open the dust passage hole 121*a*.

In this case, when the door arm 143 is moved to the opened position DP1 at which the first door opening/closing detecting part 144*a* is disposed, the first door opening/closing detecting part 144*a* may transmit a signal indicating that the door 141 is opened.

Therefore, the control unit 400 may receive the signal, which indicates that the door 141 is opened, from the first door opening/closing detecting part 144*a* and determine that the door 141 is opened.

When the control unit 400 determines that the door 141 is opened, the control unit 400 may stop the operation of the door motor 142.

In the cover opening step S40, when the door 141 is opened, the discharge cover 222 may be opened.

For example, when the control unit 400 receives the signal, which indicates that the door 141 is opened, from the first door opening/closing detecting part 144*a*, the control unit 400 may operate the cover opening drive part 152 in the forward direction to open the discharge cover 222. That is, the discharge cover 222 may be separated from the dust bin main body 221.

As another example, the control unit 400 may operate the cover opening drive part 152 first with a predetermined time interval before operating the door motor 142 in consideration of the time it takes to move the push protrusion 151 and press the coupling lever 222*c*. Even in this case, the discharge cover 222 is opened after the door 141 begins to be opened. With this configuration, it is possible to minimize the time it takes to open both the door 141 and the discharge cover 222.

When the guide frame 151*e* reaches the predetermined cover opened position CP1 at which the first cover opening detecting part 155*fa* is disposed, the cover opening detecting part 155*f* may transmit a signal indicating that the discharge cover 222 is opened.

In this case, the control unit 400 may receive the signal, which indicates that the discharge cover 222 is opened, from the first cover opening detecting part 155*fa* and determine that the discharge cover 222 is opened.

When the control unit 400 determines that the discharge cover 222 is opened, the control unit 400 may stop the operation of the cover opening drive part 152.

The control unit 400 may perform the dust collecting step S60 after the cover opening step S40.

Specifically, in the dust collecting step S60, when the discharge cover 222 is opened, the dust collecting motor 191 may operate to collect the dust from the dust bin 220.

For example, when the control unit 400 receives the signal, which indicates that the discharge cover 222 is opened, from the first cover opening detecting part 155*fa*, the control unit 400 may operate the dust collecting motor 191.

As another example, the control unit 400 may operate the dust collecting motor 191 when a preset time has elapsed after receiving the signal, which indicates that the first cleaner 200 is coupled to the cleaner station 100, from the coupling sensor 125.

In the dust collecting step S60, the dust in the dust bin 220 may pass through the dust passage hole 121*a* and the first cleaner flow path part 181 and then be collected in the dust collecting part 170. Therefore, the user may remove the dust in the dust bin 220 without a separate manipulation, and as a result, it is possible to provide convenience for the user.

In the dust collection ending step S80, the operation of the dust collecting motor 191 may be ended when the dust collecting motor 191 operates for a predetermined time.

Specifically, the control unit 400 may be embedded with a timer (not illustrated), and the operation of the dust collecting motor 191 may be ended when the control unit 400 determines that a predetermined time has elapsed.

In this case, the operating time of the dust collecting motor 191 may be preset, or the user may input the operating time through an input part (not illustrated). Alternatively, the control unit 400 may automatically set the operating time by detecting the amount of dust in the dust bin 220 using a sensor or the like.

In the door closing step S90, the door 141 may be closed after the dust collection ending step S80.

Specifically, after the control unit 400 stops the operation of the dust collecting motor 191, the control unit 400 may operate the door motor 142 in the reverse direction to close at least a part of the dust passage hole 121*a*.

In this case, the discharge cover 222 supported by the door 141 may be rotated by the door 141 and fastened to the dust bin main body 221, such that the lower side of the dust bin main body 221 may be closed.

In this case, when the door arm 143 is moved to the closed position DP2 at which the second door opening/closing detecting part 144*b* is disposed, the second door opening/closing detecting part 144*b* may transmit a signal indicating that the door 141 is closed.

Therefore, the control unit 400 may receive the signal, which indicates that the door 141 is closed, from the second door opening/closing detecting part 144*b* and determine that the door 141 is closed.

When the control unit 400 determines that the door 141 is closed, the control unit 400 may stop the operation of the door motor 142.

In the release step S110, when the door 141 is closed, the fixing drive part 133 may be operated, such that the fixing member 131 may release the dust bin 220.

Specifically, when the control unit 400 receives the signal, which indicates that the arm gear reaches the initial position LP1, from the arm movement detecting part 165 or 2165, the control unit 400 may operate the fixing drive part 133 in the reverse direction to release the dust bin 220.

In this case, when the fixing member 131 or the fixing part link 135 is moved to the dust bin releasing position FP2, the second fixing detecting part 137*b* may transmit a signal indicating that the first cleaner 200 is released.

Therefore, the control unit 400 may receive the signal, which indicates that the first cleaner 200 is released, from the second fixing detecting part 137*b* and determine that the first cleaner 200 is released.

When the control unit 400 determines that the first cleaner 200 is released, the control unit 400 may stop the operation of the fixing drive part 133.

Figure 55:
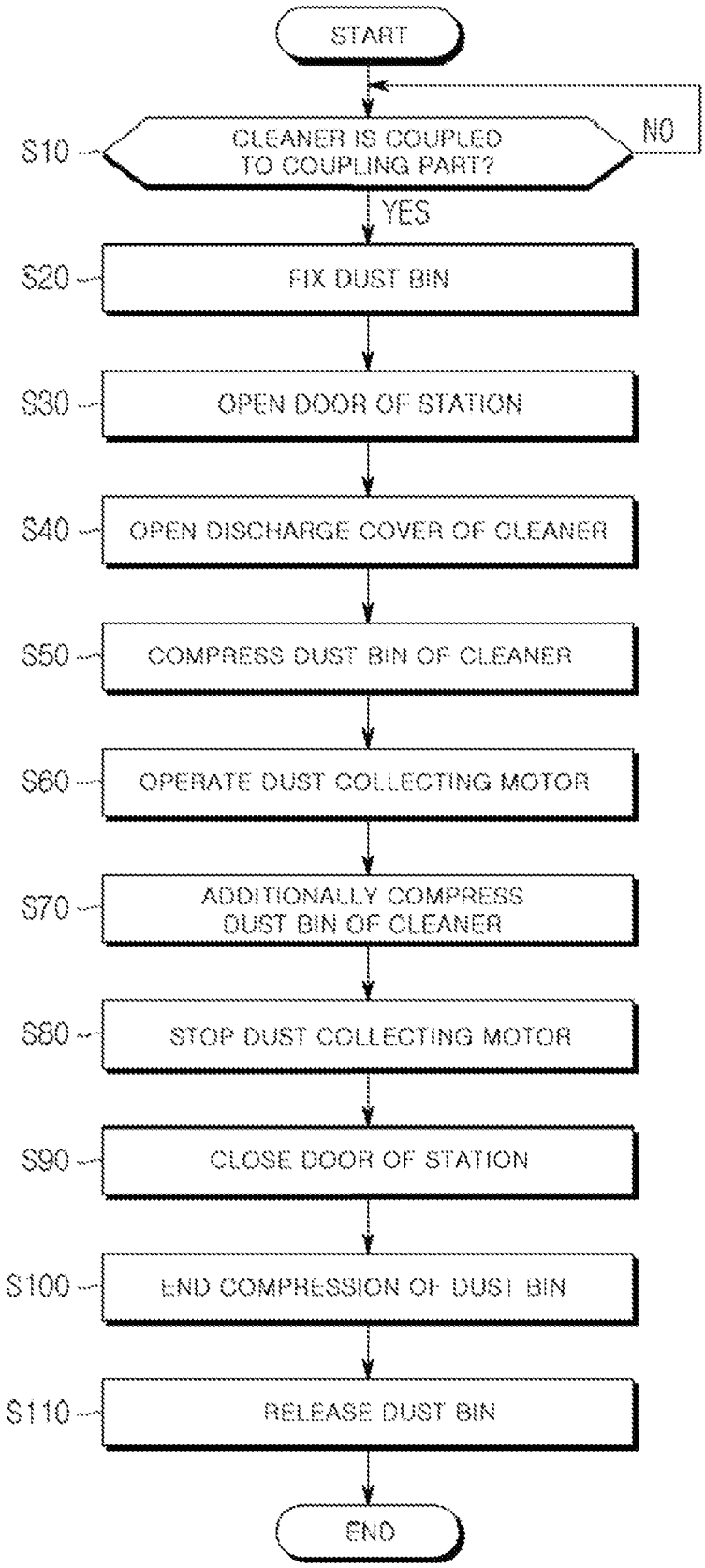
FIG. 55 is a flowchart for explaining a second embodiment of the method of controlling the cleaner station according to the present disclosure.

Meanwhile, FIG. 55 is a flowchart for explaining a second embodiment of the method of controlling the cleaner station according to the present disclosure.

The second embodiment of the method of controlling the cleaner station according to the present disclosure will be described below with reference to FIGS. 4 to 55.

The method of controlling the cleaner station according to the second embodiment of the present disclosure includes the coupling checking step S10, the dust bin fixing step S20, the door opening step S30, the cover opening step S40, a dust bin compressing step S50, the dust collecting step S60, an additional dust bin compressing step S70, the dust collection ending step S80, the door closing step S90, a compression ending step S100, and the release step S110.

In order to avoid a repeated description, the contents related to the method of controlling the cleaner station according to the first embodiment of the present disclosure may be used to describe the coupling checking step S10, the dust bin fixing step S20, the door opening step S30, the cover opening step S40, the dust collection ending step S80, the door closing step S90, and the release step S110 according to the second embodiment.

In the dust bin compressing step S50, when the discharge cover 222 is opened, the inside of the dust bin 220 may be compressed.

The dust bin compressing step S50 may include a first compression preparing step S51, a second compression preparing step S52, and a lever pulling step S53.

In the first compression preparing step S51, the lever pulling arm 161 or 2161 may be stroke-moved to the height at which the lever pulling arm 161 or 2161 may push the dust bin compression lever 223.

Specifically, when the control unit 400 receives the signal, which indicates that the discharge cover 222 is opened, from the first cover opening detecting part 155*fa*, the control unit 400 may operate the stroke drive motor 163 or 2163 to move the lever pulling arm 161 or 2161 to a height equal to or higher than the height of the dust bin compression lever 223.

When the arm movement detecting part 165 or 2165 detects that the lever pulling arm 163 or 2163 is moved to the height equal to or higher than the height of the dust bin compression lever 223, the arm movement detecting part 165 or 2165 may transmit a signal indicating that the lever pulling arm 163 or 2163 is stroke-moved to the target position. That is, the arm movement detecting part 165 or 2165 may transmit the signal when the arm movement detecting part 165 or 2165 detects that the arm gear 162 or the shaft 2166 reaches the maximum stroke movement position LP2. The control unit 400 may receive the signal from the arm movement detecting part 165 or 2165 and stop the operation of the stroke drive motor 163 or 2163.

In the second compression preparing step S52, the lever pulling arm 161 or 2161 may be rotated to the position at which the lever pulling arm 161 or 2161 may push the dust bin compression lever 223.

Specifically, when the control unit 400 receives the signal, which indicates that the lever pulling arm 163 or 2163 is moved to the height equal to or higher than the height of the dust bin compression lever 223, from the arm movement detecting part 165 or 2165, the control unit 400 may operate the rotation drive motor 164 or 2164 to move the lever pulling arm 161 or 2161 to the position at which the lever pulling arm 161 or 2161 may push the dust bin compression lever 223.

When the arm movement detecting part 165 or 2165 detects that the arm gear 162 or the shaft 2166 is rotated to the position at which the arm gear 162 or the shaft 2166 may pull the compression lever 223, the arm movement detecting part 165 or 2165 may transmit a signal indicating that the lever pulling arm 163 or 2163 is rotated to the target position. The control unit 400 may receive the signal from the arm movement detecting part 165 or 2165 and stop the operation of the rotation drive motor 164 or 2164.

In the lever pulling step S53, the lever pulling arm 161 or 2161 may pull the dust bin compression lever 223 at least once.

Specifically, after the second compression preparing step S52, the control unit 400 may operate the stroke drive motor 163 or 2163 in the reverse direction to pull the lever pulling arm 161 or 2161.

In this case, when the arm movement detecting part 165 or 2165 detects that the arm gear 162 or the shaft 2166 reaches the position LP3 when the compression lever 223 is pulled, the arm movement detecting part 165 or 2165 may transmit a signal indicating that the compression lever 223 is pulled. The control unit 400 may receive the signal from the arm movement detecting part 165 or 2165 and stop the operation of the stroke drive motor 163 or 2163.

In the dust bin compressing step S50, the dust in the dust bin 220 is compressed in advance before the dust collecting motor 191 operates, and as a result, there is an effect of preventing residual dust remaining in the dust bin 220 and improving efficiency in collecting the dust in the dust collecting motor 191.

In the dust collecting step S60, when the discharge cover 222 is opened and the inside of the dust bin 220 is compressed, the dust collecting motor 191 may operate to collect the dust from the dust bin 220.

Specifically, when the control unit 400 receives the signal, which indicates that the discharge cover 222 is opened, from the first cover opening detecting part 155*fa* and receives the signal, which indicates that the compression lever 223 is pulled, from the arm movement detecting part 165 or 2165, the control unit 400 may operate the dust collecting motor 191.

In the dust collecting step S60, the dust in the dust bin 220 may pass through the dust passage hole 121*a* and the first cleaner flow path part 181 and then be collected in the dust collecting part 170. Therefore, the user may remove the dust in the dust bin 220 without a separate manipulation, and as a result, it is possible to provide convenience for the user.

In the additional dust bin compressing step S70, the inside of the dust bin 220 may be compressed during the operation of the dust collecting motor 191.

Specifically, after the lever pulling step S53, the control unit 400 may operate the stroke drive motor 163 or 2163 in the forward direction to move the lever pulling arm 161 or 2161 to the height LP2 before the dust bin compression lever 223 is pulled. In this case, the dust bin compression lever 223 is also returned to the original position by an elastic member (not illustrated).

That is, the arm movement detecting part 165 or 2165 may transmit the signal when the arm gear 162 or the shaft 2166 reaches the maximum stroke movement position LP2 again. The control unit 400 may receive the signal from the arm movement detecting part 165 or 2165 and stop the forward operation of the stroke drive motor 163 or 2163.

Thereafter, immediately after the dust collecting motor 191 operates or when a predetermined time has elapsed after the operation of the dust collecting motor 191, the control unit 400 may operate the stroke drive motor 163 or 2163 in the reverse direction to pull the dust bin compression lever 223.

Meanwhile, the additional dust bin compressing step S70 may be performed at least once. In this case, the number of times the additional dust bin compressing step S70 is performed may be preset, or the user may input the number of times through an input part (not illustrated). Alternatively, the control unit 400 may automatically set the number of times by detecting the amount of dust in the dust bin 220 using a sensor or the like.

In the additional dust bin compressing step S70, since the dust in the dust bin 220 is compressed during the operation of the dust collecting motor 191, there is an effect of removing the dust remaining even during the operation of the dust collecting motor 191.

In the compression ending step S100, the lever pulling arm may be returned back to the original position after the door closing step S90.

The compression ending step S100 may include a first returning step S101 and a second returning step S102.

In the first returning step S101, the lever pulling arm 163 or 2163 may be rotated to the original position.

Specifically, when the control unit 400 receives the signal, which indicates that the door 141 is closed, from the second door opening/closing detecting part 144*b*, the control unit 400 may operate the rotation drive motor 164 or 2164 in the reverse direction to move the lever pulling arm 161 or 2161 to the original position.

When the arm movement detecting part 165 or 2165 detects that the arm gear 162 or the shaft 2166 rotates the compression lever 223 to the original position, the arm movement detecting part 165 or 2165 may transmit a signal indicating that the lever pulling arm 163 or 2163 is rotated to the target position. The control unit 400 may receive the signal from the arm movement detecting part 165 or 2165 and stop the operation of the rotation drive motor 164 or In the second returning step S102, the lever pulling arm 163 or 2163 may be stroke-moved to the original position.

Specifically, when the control unit 400 receives the signal indicating that the lever pulling arm 163 or 2163 is rotated to the target position, the control unit 400 may operate the stroke drive motor 163 or 2163 in the reverse direction to move the lever pulling arm 161 or 2161 to the original position (the position LP1 at which the lever pulling arm 161 or 2161 is coupled to the housing 110).

When the arm movement detecting part 165 or 2165 detects that the lever pulling arm 163 or 2163 is moved to the original position, the arm movement detecting part 165 or 2165 may transmit a signal indicating that the lever pulling arm 163 or 2163 is stroke-moved to the target position. That is, the arm movement detecting part 165 or 2165 may transmit the signal when the arm movement detecting part 165 or 2165 detects that the arm gear 162 or the shaft 2166 reaches the initial position LP1. The control unit 400 may receive the signal from the arm movement detecting part 165 or 2165 and stop the operation of the stroke drive motor 163 or 2163.

Figure 56:
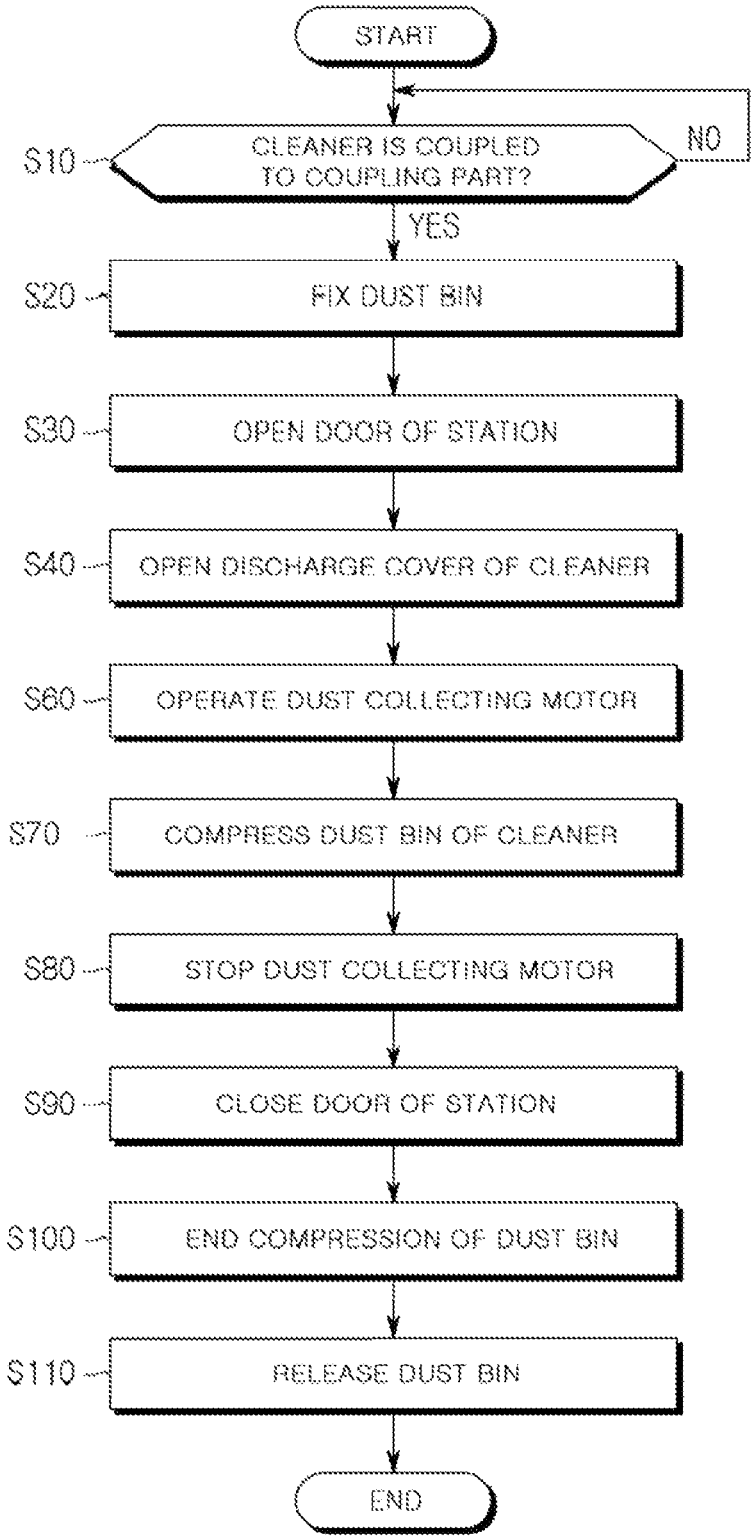
FIG. 56 is a flowchart for explaining a third embodiment of the method of controlling the cleaner station according to the present disclosure.

Meanwhile, FIG. 56 is a flowchart for explaining a third embodiment of the method of controlling the cleaner station according to the present disclosure.

The third embodiment of the method of controlling the cleaner station according to the present disclosure will be described below with reference to FIGS. 5 to 56.

The method of controlling the cleaner station according to the present embodiment includes the coupling checking step S10, the dust bin fixing step S20, the door opening step S30, the cover opening step S40, the dust collecting step S60, a dust bin compressing step S70', the dust collection ending step S80, the door closing step S90, the compression ending step S100, and the release step S110.

In order to avoid a repeated description, the contents related to the method of controlling the cleaner station according to the second embodiment of the present disclosure may be used to describe the coupling checking step S10, the dust bin fixing step S20, the door opening step S30, the cover opening step S40, the dust collection ending step S80, the door closing step S90, the compression ending step S100, and the release step S110 according to the third embodiment.

In the present embodiment, the dust collecting step S60 may be performed after the cover opening step S40.

Specifically, in the dust collecting step S60, when the discharge cover 222 is opened, the dust collecting motor 191 may operate to collect the dust from the dust bin 220.

Specifically, when the control unit 400 receives the signal, which indicates that the discharge cover 222 is opened, from the first cover opening detecting part 155*fa*, the control unit 400 may operate the dust collecting motor 191.

In the dust collecting step S60, the dust in the dust bin 220 may pass through the dust passage hole 121*a* and the first flow path 181 and then be collected in the dust collecting part 170. Therefore, the user may remove the dust in the dust bin 220 without a separate manipulation, and as a result, it is possible to provide convenience for the user.

In addition, in the dust bin compressing step S70' according to the present embodiment, the dust bin 220 may be compressed during the operation of the dust collecting motor 191.

The dust bin compressing step S70' may include a first compression preparing step S71', a second compression preparing step S72', a lever pulling step S73', and an additional pulling step S74'.

In this case, the first compression preparing step S71' and the second compression preparing step S72' may be performed after the operation of the dust collecting motor 191 or performed before the operation of the dust collecting motor 191.

In the first compression preparing step S71', the lever pulling arm 161 or 2161 may be stroke-moved to the height at which the lever pulling arm 161 or 2161 may push the dust bin compression lever 223.

Specifically, the control unit 400 may operate the stroke drive motor 163 or 2163 to move the lever pulling arm 161 or 2161 to a height equal to or higher than the height of the dust bin compression lever 223.

When the arm movement detecting part 165 or 2165 detects that the lever pulling arm 163 or 2163 is moved to the height equal to or higher than the height of the dust bin compression lever 223, the arm movement detecting part 165 or 2165 may transmit a signal indicating that the lever pulling arm 163 or 2163 is stroke-moved to the target position. That is, the arm movement detecting part 165 or 2165 may transmit the signal when the arm movement detecting part 165 or 2165 detects that the arm gear 162 or the shaft 2166 reaches the maximum stroke movement position LP2. The control unit 400 may receive the signal from the arm movement detecting part 165 or 2165 and stop the operation of the stroke drive motor 163 or 2163.

In the second compression preparing step S72', the lever pulling arm 161 or 2161 may be rotated to the position at which the lever pulling arm 161 or 2161 may push the dust bin compression lever 223.

Specifically, when the control unit 400 receives the signal, which indicates that the lever pulling arm 163 or 2163 is moved to the height equal to or higher than the height of the dust bin compression lever 223, from the arm movement detecting part 165 or 2165, the control unit 400 may operate the rotation drive motor 164 or 2164 to move the lever pulling arm 161 or 2161 to the position at which the lever pulling arm 161 or 2161 may push the dust bin compression lever 223.

When the arm movement detecting part 165 or 2165 detects that the arm gear 162 or the shaft 2166 is rotated to the position at which the arm gear 162 or the shaft 2166 may pull the compression lever 223, the arm movement detecting part 165 or 2165 may transmit a signal indicating that the lever pulling arm 163 or 2163 is rotated to the target position. The control unit 400 may receive the signal from the arm movement detecting part 165 or 2165 and stop the operation of the rotation drive motor 164 or 2164.

In the lever pulling step S73', the lever pulling arm 161 or 2161 may pull the dust bin compression lever 223 at least once.

Specifically, after the second compression preparing step S72', the control unit 400 may operate the stroke drive motor 163 or 2163 in the reverse direction to pull the lever pulling arm 161 or 2161.

In this case, when the arm movement detecting part 165 or 2165 detects that the arm gear 162 or the shaft 2166 reaches the position LP3 when the compression lever 223 is pulled, the arm movement detecting part 165 or 2165 may transmit a signal indicating that the compression lever 223 is pulled. The control unit 400 may receive the signal from the arm movement detecting part 165 or 2165 and stop the operation of the stroke drive motor 163 or 2163.

In the additional pulling step S74', the lever pulling arm 161 or 2161 may additionally pull the dust bin compression lever 223.

In this case, whether to perform the additional pulling step S74' and the number of times the additional pulling step S74' is performed may be preset, or the user may input, through an input part (not illustrated), whether to perform the additional pulling step S74' and the number of times the additional pulling step S74' is performed. Alternatively, the control unit 400 may detect the amount of dust in the dust bin 220 using a sensor or the like and automatically set whether to perform the additional pulling step S74' and the number of times the additional pulling step S74' is performed.

After the lever pulling step S73', the control unit 400 may operate the stroke drive motor 163 or 2163 in the forward direction to move the lever pulling arm 161 or 2161 to the height LP2 before the dust bin compression lever 223 is pulled. In this case, the dust bin compression lever 223 is also returned to the original position by the elastic member (not illustrated).

That is, the arm movement detecting part 165 or 2165 may transmit the signal when the arm gear 162 or the shaft 2166 reaches the maximum stroke movement position LP2 again. The control unit 400 may receive the signal from the arm movement detecting part 165 or 2165 and stop the forward operation of the stroke drive motor 163 or 2163.

Thereafter, immediately after the dust collecting motor 191 operates or when a predetermined time has elapsed after the operation of the dust collecting motor 191, the control unit 400 may operate the stroke drive motor 163 or 2163 in the reverse direction to pull the dust bin compression lever 223.

According to the present embodiment, since the dust bin compression lever 223 is pulled an appropriate number of times during the operation of the dust collecting motor 191, there is an effect of reducing the time it takes to empty the dust bin 220.

Figure 57:
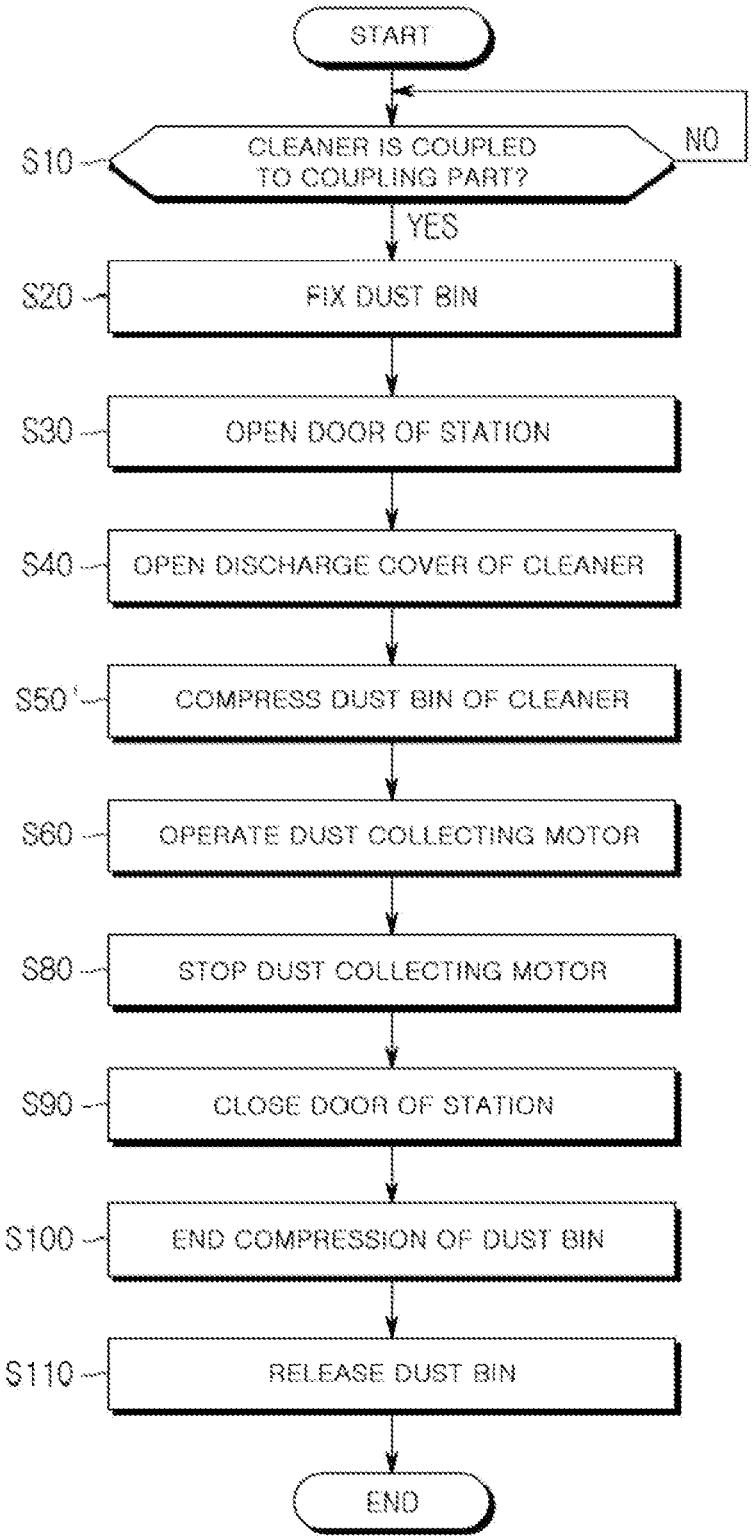
FIG. 57 is a flowchart for explaining a fourth embodiment of the method of controlling the cleaner station according to the present disclosure.

Meanwhile, FIG. 57 is a flowchart for explaining a fourth embodiment of the method of controlling the cleaner station according to the present disclosure.

The fourth embodiment of the method of controlling the cleaner station according to the present disclosure will be described below with reference to FIGS. 5 to 57.

The method of controlling the cleaner station according to the present embodiment includes the coupling checking step S10, the dust bin fixing step S20, the door opening step S30, the cover opening step S40, a dust bin compressing step S50', the dust collecting step S60, the dust collection ending step S80, the door closing step S90, the compression ending step S100, and the release step S110.

In order to avoid a repeated description, the contents related to the method of controlling the cleaner station according to the second embodiment of the present disclosure may be used to describe the coupling checking step S10, the dust bin fixing step S20, the door opening step S30, the cover opening step S40, the dust collection ending step S80, the door closing step S90, the compression ending step S100, and the release step S110 according to the fourth embodiment.

The dust bin compressing step S50' may include a first compression preparing step S51', a second compression preparing step S52', a lever pulling step S53', and an additional pulling step S54'.

In the first compression preparing step S51', when the control unit 400 receives a signal, which indicates that the discharge cover 222 is opened, from the first cover opening detecting part 155*fa*, the control unit 400 may stroke-move the lever pulling arm 161 or 2161 to the height at which the lever pulling arm 161 or 2161 may push the dust bin compression lever 223.

Specifically, the control unit 400 may operate the stroke drive motor 163 or 2163 to move the lever pulling arm 161 or 2161 to a height equal to or higher than the height of the dust bin compression lever 223.

When the arm movement detecting part 165 or 2165 detects that the lever pulling arm 163 or 2163 is moved to the height equal to or higher than the height of the dust bin compression lever 223, the arm movement detecting part 165 or 2165 may transmit a signal indicating that the lever pulling arm 163 or 2163 is stroke-moved to the target position. That is, the arm movement detecting part 165 or 2165 may transmit the signal when the arm movement detecting part 165 or 2165 detects that the arm gear 162 or the shaft 2166 reaches the maximum stroke movement position LP2. The control unit 400 may receive the signal from the arm movement detecting part 165 or 2165 and stop the operation of the stroke drive motor 163 or 2163.

In the second compression preparing step S52', the lever pulling arm 161 or 2161 may be rotated to the position at which the lever pulling arm 161 or 2161 may push the dust bin compression lever 223.

Specifically, when the control unit 400 receives the signal, which indicates that the lever pulling arm 163 or 2163 is moved to the height equal to or higher than the height of the dust bin compression lever 223, from the arm movement detecting part 165 or 2165, the control unit 400 may operate the rotation drive motor 164 or 2164 to move the lever pulling arm 161 or 2161 to the position at which the lever pulling arm 161 or 2161 may push the dust bin compression lever 223.

When the arm movement detecting part 165 or 2165 detects that the arm gear 162 or the shaft 2166 is rotated to the position at which the arm gear 162 or the shaft 2166 may pull the compression lever 223, the arm movement detecting part 165 or 2165 may transmit a signal indicating that the lever pulling arm 163 or 2163 is rotated to the target position. The control unit 400 may receive the signal from the arm movement detecting part 165 or 2165 and stop the operation of the rotation drive motor 164 or 2164.

In the lever pulling step S53', the lever pulling arm 161 or 2161 may pull the dust bin compression lever 223 at least once.

Specifically, after the second compression preparing step S52', the control unit 400 may operate the stroke drive motor 163 or 2163 in the reverse direction to pull the lever pulling arm 161 or 2161.

In this case, when the arm movement detecting part 165 or 2165 detects that the arm gear 162 or the shaft 2166 reaches the position LP3 when the compression lever 223 is pulled, the arm movement detecting part 165 or 2165 may transmit a signal indicating that the compression lever 223 is pulled. The control unit 400 may receive the signal from the arm movement detecting part 165 or 2165 and stop the operation of the stroke drive motor 163 or 2163.

In the additional pulling step S54', the lever pulling arm 161 or 2161 may additionally pull the dust bin compression lever 223.

In this case, whether to perform the additional pulling step S54' and the number of times the additional pulling step S54' is performed may be preset, or the user may input, through an input part (not illustrated), whether to perform the additional pulling step S54' and the number of times the additional pulling step S54' is performed. Alternatively, the control unit 400 may detect the amount of dust in the dust bin 220 using a sensor or the like and automatically set whether to perform the additional pulling step S54' and the number of times the additional pulling step S54' is performed.

After the lever pulling step S53', the control unit 400 may operate the stroke drive motor 163 or 2163 in the forward direction to move the lever pulling arm 161 or 2161 to the height LP2 before the dust bin compression lever 223 is pulled. In this case, the dust bin compression lever 223 is also returned to the original position by the elastic member (not illustrated).

That is, the arm movement detecting part 165 or 2165 may transmit the signal when the arm gear 162 or the shaft 2166 reaches the maximum stroke movement position LP2 again. The control unit 400 may receive the signal from the arm movement detecting part 165 or 2165 and stop the forward operation of the stroke drive motor 163 or 2163.

Thereafter, immediately after the dust collecting motor 191 operates or when a predetermined time has elapsed after the operation of the dust collecting motor 191, the control unit 400 may operate the stroke drive motor 163 or 2163 in the reverse direction to pull the dust bin compression lever 223.

In the present embodiment, the dust collecting step S60 is performed after the dust bin compressing step S50'.

Therefore, in the dust collecting step S60, when the discharge cover 222 is opened and the inside of the dust bin 220 is compressed a preset number of times, the dust collecting motor 191 may operate to collect the dust from the dust bin 220.

According to the present embodiment, since the dust collecting motor 191 operates after the dust bin compression lever 223 is pulled an appropriate number of times, there is an effect of reducing the time it takes to empty the dust bin 220.

While the present disclosure has been described with reference to the specific embodiments, the specific embodiments are only for specifically explaining the present disclosure, and the present disclosure is not limited to the specific embodiments. It is apparent that the present disclosure may be modified or altered by those skilled in the art without departing from the technical spirit of the present disclosure.

All the simple modifications or alterations to the present disclosure fall within the scope of the present disclosure, and the specific protection scope of the present disclosure will be defined by the appended claims.

What is claimed is:

1. A cleaner system comprising:

a cleaner comprising:

a suction part that defines a suction flow path configured to receive air, a suction motor configured to rotate about a rotation axis to thereby generate suction force for suctioning the air through the suction part, a cyclone configured to separate dust from the air introduced through the suction part, and a dust bin configured to store the dust separated by the cyclone; and a cleaner station that is configured to couple to the cleaner and extends in a longitudinal direction intersecting a longitudinal axis of the dust bin, the cleaner station comprising:

a housing that defines a dust collecting space configured to receive the dust from the dust bin of the cleaner, a dust collecting motor configured to generate a suction force for suctioning the dust in the dust bin into the dust collecting space, wherein the dust collecting motor and the dust collecting space are arranged along the longitudinal direction of the cleaner station in the housing, a coupling surface configured to face a bottom surface of the dust bin based on the cleaner being coupled to the cleaner station, a pair of sidewalls that protrude from the coupling surface in a direction perpendicular to the coupling surface, a dust bin guide surface disposed between the pair of sidewalls and configured to couple to an outer circumferential surface of the dust bin based on the cleaner being coupled to the cleaner station, wherein the dust bin guide surface and the pair of sidewalls define an accommodating space configured to receive the dust bin based on the cleaner being coupled to the cleaner station, and a sealer disposed at the dust bin guide surface and configured to be in contact with at least one of the outer circumferential surface or the bottom surface of the dust bin to thereby provide sealing between the dust bin guide surface and a part of the outer circumferential surface of the dust bin based on the cleaner being coupled to the cleaner station, wherein the sealer is configured to provide the sealing between the dust bin guide surface and the part of the outer circumferential surface of the dust bin based on the dust bin being seated on the sealer after the dust bin is moved in a direction intersecting an imaginary dust bin throughline, the imaginary dust bin throughline extending along the longitudinal axis of the dust bin and passing through the bottom surface of the dust bin.

2. The cleaner system of claim 1, wherein the sealer is disposed at a lower portion of the dust bin guide surface, and the cleaner is configured to press the sealer down toward the dust bin guide surface based on being coupled to the cleaner station.

3. The cleaner system of claim 1, wherein the suction flow path extends in a longitudinal axis of the suction part, and wherein the cleaner is configured to move in a coupling direction relative to the cleaner station to thereby couple to the cleaner station, the coupling direction comprising at least one of (i) a first direction intersecting the longitudinal axis of the suction part or (ii) a second direction different from the first direction.

4. The cleaner system of claim 3, wherein the cleaner is configured to move in the first direction and then move in the second direction relative to the cleaner station to thereby couple to the cleaner station.

5. The cleaner system of claim 1, wherein the dust collecting motor is configured to rotate about a dust collecting motor axis to thereby generate the suction force for suctioning the dust in the dust bin into the dust collecting space, wherein the suction flow path extends in a longitudinal axis of the suction part, and wherein, based on the cleaner being coupled to the cleaner station, the sealer is disposed between the dust collecting motor axis and the longitudinal axis of the suction part.

6. The cleaner system of claim 5, wherein the dust collecting motor axis is parallel to the longitudinal axis of the suction part.

7. The cleaner system of claim 5, wherein the dust collecting motor axis intersects the rotation axis of the suction motor.

8. The cleaner system of claim 5, wherein the cleaner station further comprises a charging part disposed at the coupling surface and configured to electrically connect to the cleaner, and wherein, based on the cleaner being coupled to the cleaner station, the charging part is disposed between the dust collecting motor axis and the longitudinal axis of the suction part.

9. The cleaner system of claim 8, wherein the charging part is disposed above the sealer in the longitudinal direction of the cleaner station.

10. The cleaner system of claim 1, wherein the cleaner further comprises a battery configured to supply power to the suction motor, and wherein, based on the cleaner being coupled to the cleaner station, the battery is disposed above the rotation axis of the suction motor in a vertical direction with respect to a ground surface that supports the cleaner station.

11. The cleaner system of claim 10, wherein, based on the cleaner being coupled to the cleaner station, the dust bin is disposed between the sealer and the battery in the vertical direction.

12. The cleaner system of claim 1, wherein the dust collecting motor is configured to rotate about a dust collecting motor axis that intersects the rotation axis of the suction motor, and wherein an intersection point of the dust collecting motor axis and the rotation axis of the suction motor is disposed rearward relative to the sealer.

13. The cleaner system of claim 1, wherein the dust collecting motor is configured to rotate about a dust collecting motor axis that intersects the rotation axis of the suction motor, and wherein an intersection point of the dust collecting motor axis and the rotation axis of the suction motor is disposed below a top surface of the cleaner station.

14. The cleaner system of claim 1, wherein the cleaner further comprises a main body comprising:

a main body housing that accommodates the suction motor; and a handle connected to the main body housing, and wherein, based on the cleaner being coupled to the cleaner station, the handle is disposed above the rotation axis of the suction motor in a vertical direction with respect to a ground surface that supports the cleaner station.

15. The cleaner system of claim 14, wherein, based on the cleaner being coupled to the cleaner station, the handle is disposed at an opposite side of the sealer with respect to the dust bin in the vertical direction.

16. The cleaner system of claim 1, wherein the sealer is configured to support a lower portion of the outer circumferential surface of the dust bin, and wherein at least a portion of the sealer is curved along a circumferential direction of the dust bin.

17. The cleaner system of claim 1, wherein the direction intersecting the imaginary dust bin throughline includes the longitudinal direction of the cleaner housing.

18. The cleaner system of claim 1, wherein the cleaner is configured to be coupled to the cleaner station in a state in which the imaginary dust bin throughline is inclined with respect to the longitudinal direction of the cleaner housing.

* * * * *